US009670924B2

(12) United States Patent
Holtzapple et al.

(10) Patent No.: US 9,670,924 B2
(45) Date of Patent: Jun. 6, 2017

(54) GEROTOR APPARATUS HAVING OUTER GEROTOR WITH STRENGTHENING MEMBERS

(71) Applicant: Texas A&M University System, College Station, TX (US)

(72) Inventors: Mark T. Holtzapple, College Station, TX (US); George A. Rabroker, College Station, TX (US); Michael K. Ross, Bryan, TX (US)

( * ) Notice: Subject to any disclaimer, the term of this patent is extended or adjusted under 35 U.S.C. 154(b) by 0 days.

(21) Appl. No.: 14/305,920

(22) Filed: Jun. 16, 2014

(65) Prior Publication Data

US 2014/0348683 A1 Nov. 27, 2014
US 2016/0138590 A9 May 19, 2016

Related U.S. Application Data

(63) Continuation of application No. 12/978,220, filed on Dec. 23, 2010, now Pat. No. 8,753,099, which is a (Continued)

(51) Int. Cl.

| | |
|---|---|
| ***F03C 2/00*** | (2006.01) |
| ***F03C 4/00*** | (2006.01) |
| ***F04C 2/00*** | (2006.01) |
| ***F04C 11/00*** | (2006.01) |
| ***F01C 1/10*** | (2006.01) |
| ***F01C 11/00*** | (2006.01) |
| ***F01C 17/04*** | (2006.01) |

(Continued)

(52) U.S. Cl.

CPC ..... *F04C 11/003* (2013.01); *F01C 1/104* (2013.01); *F01C 11/004* (2013.01); *F01C 17/04* (2013.01); *F01C 17/06* (2013.01); *F01C 19/085* (2013.01); *F01C 21/008* (2013.01); *F01C 21/04* (2013.01); *F01C 21/06* (2013.01); *F04C 2/10* (2013.01); *F04C 15/0003* (2013.01)

(58) Field of Classification Search

CPC ..... F04C 11/003; F04C 2/10; F04C 15/003; F01C 1/104; F01C 11/004; F01C 17/04; F01C 17/06; F01C 19/085; F01C 21/008; F01C 21/04; F01C 21/06

USPC ..... 418/61.3, 104, 125, 140–141, 143, 166, 418/171; 277/303, 358, 412, 415

See application file for complete search history.

(56) References Cited

U.S. PATENT DOCUMENTS 3,170,409 A * 2/1965 McLeod et al. ..... 418/133
3,214,087 A * 10/1965 Luck ..... 418/171

(Continued)

OTHER PUBLICATIONS

Final Office Action issued for U.S. Appl. No. 14/098,272 dated Feb. 1, 2016, 9 pgs.

*Primary Examiner* — Theresa Trieu

(57) ABSTRACT

According to one embodiment of the invention, a gerotor apparatus includes a first gerotor, a second gerotor, and a synchronizing system operable to synchronize a rotation of the first gerotor with a rotation of the second gerotor. The synchronizing system includes a cam plate coupled to the first gerotor, wherein the cam plate includes a plurality of cams, and an alignment plate coupled to the second gerotor. The alignment plate includes at least one alignment member, wherein the plurality of cams and the at least one alignment member interact to synchronize a rotation of the first gerotor with a rotation of the second gerotor.

20 Claims, 92 Drawing Sheets

Related U.S. Application Data continuation of application No. 11/041,011, filed on Jan. 21, 2005, now abandoned, application No. 14/305,920, which is a continuation-in-part of application No. 14/098,272, filed on Dec. 5, 2013, now Pat. No. 9,382,872, which is a continuation of application No. 12/761,432, filed on Apr. 16, 2010, now Pat. No. 8,821,138, which is a continuation of application No. 11/681,877, filed on Mar. 5, 2007, now Pat. No. 7,726,959, which is a continuation of application No. 10/359,487, filed on Feb. 5, 2003, now Pat. No. 7,186,101.

(60) Provisional application No. 60/538,747, filed on Jan. 23, 2004, provisional application No. 60/355,636, filed on Feb. 5, 2002, provisional application No. 60/358,681, filed on Feb. 21, 2002, provisional application No. 60/397,193, filed on Jul. 18, 2002.

(51) Int. Cl.

| | |
|---|---|
| ***F01C 17/06*** | (2006.01) |
| ***F01C 19/08*** | (2006.01) |
| ***F01C 21/00*** | (2006.01) |
| ***F01C 21/04*** | (2006.01) |
| ***F01C 21/06*** | (2006.01) |
| ***F04C 2/10*** | (2006.01) |
| ***F04C 15/00*** | (2006.01) |

(56) References Cited

U.S. PATENT DOCUMENTS

| | | | | |
|---|---|---|---|---|
| 4,127,364 | A | 11/1978 | Eiermann et al. | |
| 4,793,781 | A * | 12/1988 | Wankel | F01C 1/103 418/168 |
| 5,044,907 | A | 9/1991 | Hirosawa et al. | |
| 6,336,317 | B1 * | 1/2002 | Holtzapple | F01C 1/103 418/166 |
| 2003/0215345 | A1 * | 11/2003 | Holtzapple et al. | 418/171 |
| 2003/0228237 | A1 * | 12/2003 | Holtzapple et al. | 418/171 |

* cited by examiner

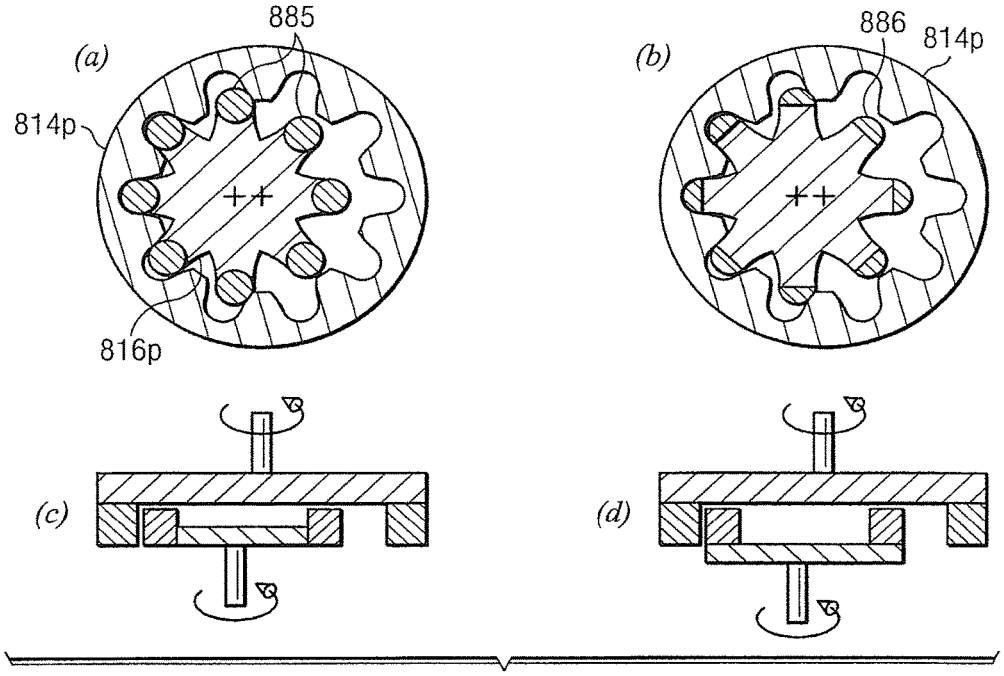
FIG. 97
FIG. 98
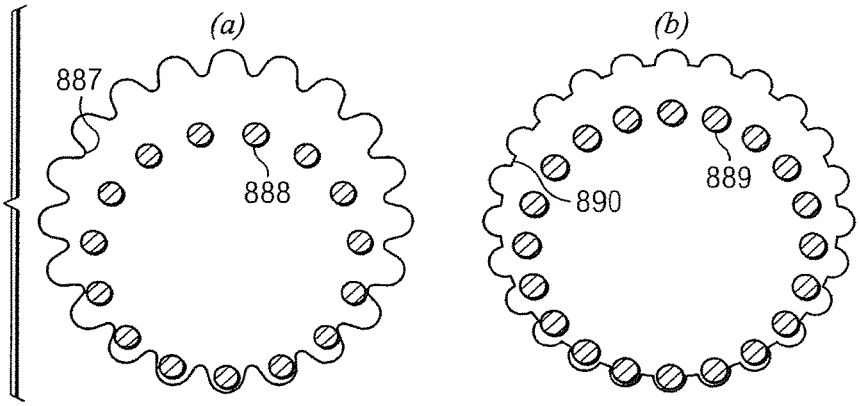
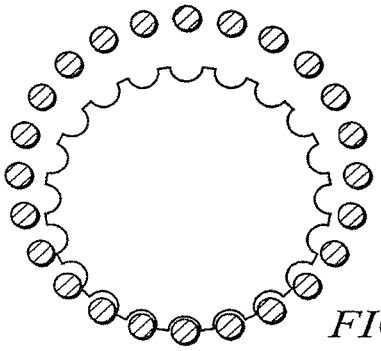
FIG. 99

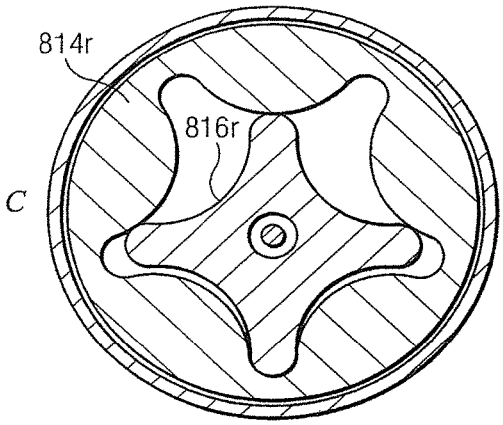
FIG. 102
FIG. 103
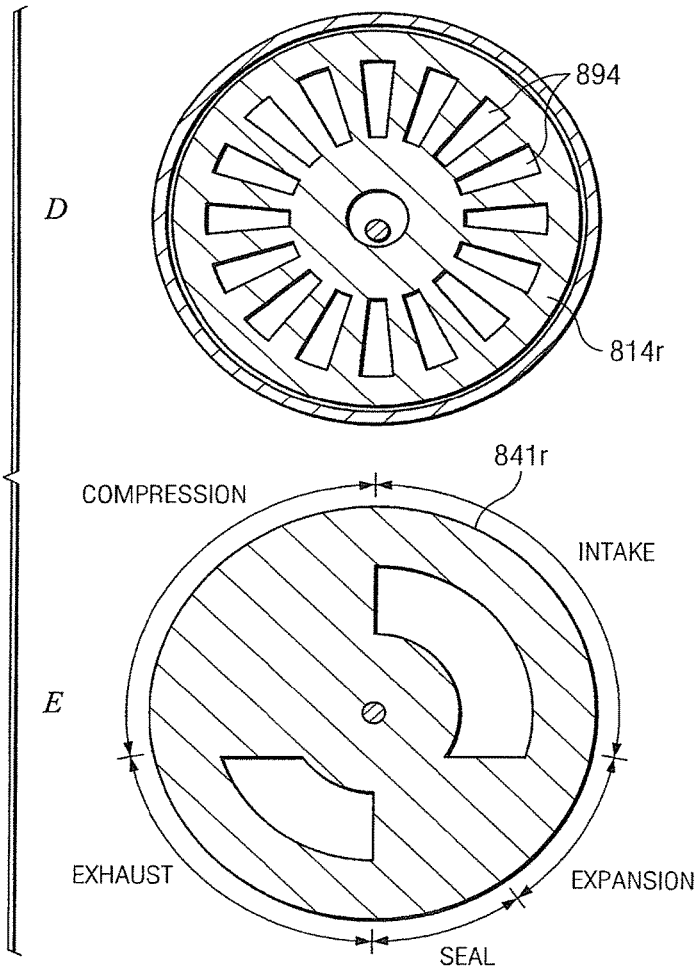

GEROTOR APPARATUS HAVING OUTER GEROTOR WITH STRENGTHENING MEMBERS

CROSS-REFERENCE TO RELATED APPLICATIONS AND PRIORITY CLAIM

This application is a continuation of U.S. patent application Ser. No. 12/978,220 filed Dec. 23, 2010, entitled "SEALING SYSTEM FOR GEROTOR APPARATUS", which claims priority to U.S. patent application Ser. No. 11/041,011, filed Jan. 21, 2005, entitled "GEROTOR APPARATUS FOR A QUASI-ISOTHERMAL BRAYTON CYCLE ENGINE," which claims priority from U.S. Provisional Application Ser. No. 60/538,747, entitled "QUASI-ISOTHERMAL BRAYTON CYCLE ENGINE," filed Jan. 23, 2004.

This application is also a continuation-in-part of U.S. patent application Ser. No. 14/098,272 filed on Dec. 5, 2013, which claims priority to U.S. patent application Ser. No. 12/761,432 filed on Apr. 16, 2010 (now U.S. Pat. No. 8,821,138), which claims priority to U.S. patent application Ser. No. 11/681,877 filed on Mar. 5, 2007 (now U.S. Pat. No. 7,726,959), which claims priority to U.S. patent application Ser. No. 10/359,487 filed on Feb. 5, 2003 (now U.S. Pat. No. 7,186,101), which claims benefit and/or priority under 35 U.S.C. 119(e) to (i) U.S. Provisional Application No. 60/355,636 filed on Feb. 5, 2002, (ii) U.S. Provisional Application No. 60/358,681 filed on Feb. 21, 2002, and (iii) U.S. Provisional Application No. 60/397,193 filed on Jul. 18, 2002.

TECHNICAL FIELD OF THE INVENTION

The present invention relates to a gerotor apparatus that functions as a compressor or expander. The gerotor apparatus may be applied generally to Brayton cycle engines and, more particularly, to a quasi-isothermal Brayton cycle engine.

BACKGROUND OF THE INVENTION

For mobile applications, such as an automobile or truck, it is generally desirable to use a heat engine that has the following characteristics: internal combustion to reduce the need for heat exchangers; complete expansion for improved efficiency; isothermal compression and expansion; high power density; high-temperature expansion for high efficiency; ability to efficiently "throttle" the engine for part-load conditions; high turn-down ratio (i.e., the ability to operate at widely ranging speeds and torques); low pollution; uses standard components with which the automotive industry is familiar; multifuel capability; and regenerative braking.

There are currently several types of heat engines, each with their own characteristics and cycles. These heat engines include the Otto Cycle engine, the Diesel Cycle engine, the Rankine Cycle engine, the Stirling Cycle engine, the Erickson Cycle engine, the Carnot Cycle engine, and the Brayton Cycle engine. A brief description of each engine is provided below.

The Otto Cycle engine is an inexpensive, internal combustion, low-compression engine with a fairly low efficiency. This engine is widely used to power automobiles.

The Diesel Cycle engine is a moderately expensive, internal combustion, high-compression engine with a high efficiency that is widely used to power trucks and trains.

The Rankine Cycle engine is an external combustion engine that is generally used in electric power plants. Water is the most common working fluid.

The Erickson Cycle engine uses isothermal compression and expansion with constant-pressure heat transfer. It may be implemented as either an external or internal combustion cycle. In practice, a perfect Erickson cycle is difficult to achieve because isothermal expansion and compression are not readily attained in large, industrial equipment.

The Carnot Cycle engine uses isothermal compression and expansion and adiabatic compression and expansion. The Carnot Cycle may be implemented as either an external or internal combustion cycle. It features low power density, mechanical complexity, and difficult-to-achieve constant-temperature compressor and expander.

The Stirling Cycle engine uses isothermal compression and expansion with constant-volume heat transfer. It is almost always implemented as an external combustion cycle. It has a higher power density than the Carnot cycle, but it is difficult to perform the heat exchange, and it is difficult to achieve constant-temperature compression and expansion.

The Stirling, Erickson, and Carnot cycles are as efficient as nature allows because heat is delivered at a uniformly high temperature, $T_{hot}$ during the isothermal expansion, and rejected at a uniformly low temperature, $T_{cold}$, during the isothermal compression. The maximum efficiency, $\eta_{max}$, of these three cycles is:

$$\eta_{max} = 1 - \frac{T_{cold}}{T_{hot}}$$

This efficiency is attainable only if the engine is "reversible," meaning that the engine is frictionless, and that there are no temperature or pressure gradients. In practice, real engines have "irreversibilities," or losses, associated with friction and temperature/pressure gradients.

The Brayton Cycle engine is an internal combustion engine that is generally implemented with turbines and is generally used to power aircraft and some electric power plants. The Brayton cycle features very high power density, normally does not use a heat exchanger, and has a lower efficiency than the other cycles. When a regenerator is added to the Brayton cycle, however, the cycle efficiency increases. Traditionally, the Brayton cycle is implemented using axial-flow, multi-stage compressors and expanders. These devices are generally suitable for aviation in which aircraft operate at fairly constant speeds; they are generally not suitable for most transportation applications, such as automobiles, buses, trucks, and trains, which must operate over widely varying speeds.

The Otto cycle, the Diesel cycle, the Brayton cycle, and the Rankine cycle all have efficiencies less than the maximum because they do not use isothermal compression and expansion steps. Further, the Otto and Diesel cycle engines lose efficiency because they do not completely expand high-pressure gases, and simply throttle the waste gases to the atmosphere.

Reducing the size and complexity, as well as the cost, of Brayton cycle engines is important. In addition, improving the efficiency of Brayton cycle engines and/or their components is important. Manufacturers of Brayton cycle engines are continually searching for better and more economical ways of producing Brayton cycle engines.

SUMMARY OF THE INVENTION

According to one embodiment of the invention, a gerotor apparatus includes a first gerotor, a second gerotor, and a synchronizing system operable to synchronize a rotation of the first gerotor with a rotation of the second gerotor. The synchronizing system includes a cam plate coupled to the first gerotor, wherein the cam plate includes a plurality of cams, and an alignment plate coupled to the second gerotor. The alignment plate includes at least one alignment member, wherein the plurality of cams and the at least one alignment member interact to synchronize a rotation of the first gerotor with a rotation of the second gerotor.

Embodiments of the invention provide a number of technical advantages. Embodiments of the invention may include all, some, or none of these advantages. One technical advantage is a more compact and lightweight Brayton cycle engine having simpler gas flow paths, less loads on bearings, and lower power consumption. Some embodiments have fewer parts then previous Brayton cycle engines. Another advantage is that the present invention introduces a simpler method for regulating leakage from gaps. An additional advantage is that the oil path is completely separated from the high-pressure gas preventing heat transfer from the gas to the oil, or entrainment of oil into the gas. A further advantage is that precision alignment between the inner and outer gerotors may be achieved through a single part (e.g., a rigid shaft). A still further advantage is that drive mechanisms disclosed herein have small backlash and low wear.

Other technical advantages are readily apparent to one skilled in the art from the following figures, descriptions, and claims.

BRIEF DESCRIPTION OF THE DRAWINGS

For a more complete understanding of example embodiments of the present invention and its advantages, reference is now made to the following description, taken in conjunction with the accompanying drawings, in which:

FIG. 97 shows that a plurality of tips of an inner synchronization gerotor may be comprised of full cylinders, according to an embodiment of the invention;

FIG. 98 shows even more phase-shifted sets of tips may be added to both the outer gerotor and inner gerotor, respectively, according to an embodiment of the invention;

FIG. 99 shows that this may be reversed; the male tips may be on the outer gerotor and the female tips on the inner gerotor, according to an embodiment of the invention;

FIG. 102 illustrates a face-breathing gerotor apparatus according to another embodiment of the invention;

FIG. 103 illustrates a face-breathing gerotor apparatus according to another embodiment of the invention;

DETAILED DESCRIPTION OF EXAMPLE EMBODIMENTS OF THE INVENTION

Figure 1:
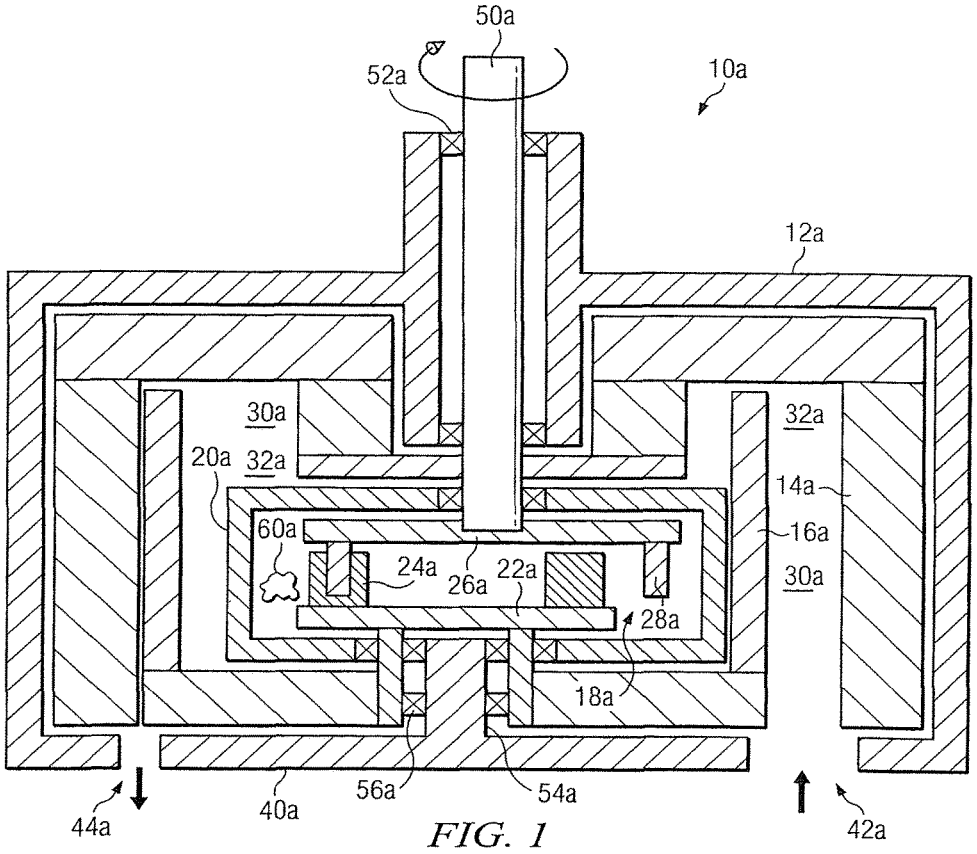
FIG. 1 illustrates a cross-section of an example gerotor apparatus having an integrated synchronizing system in accordance with one embodiment of the invention.
Figure 104:
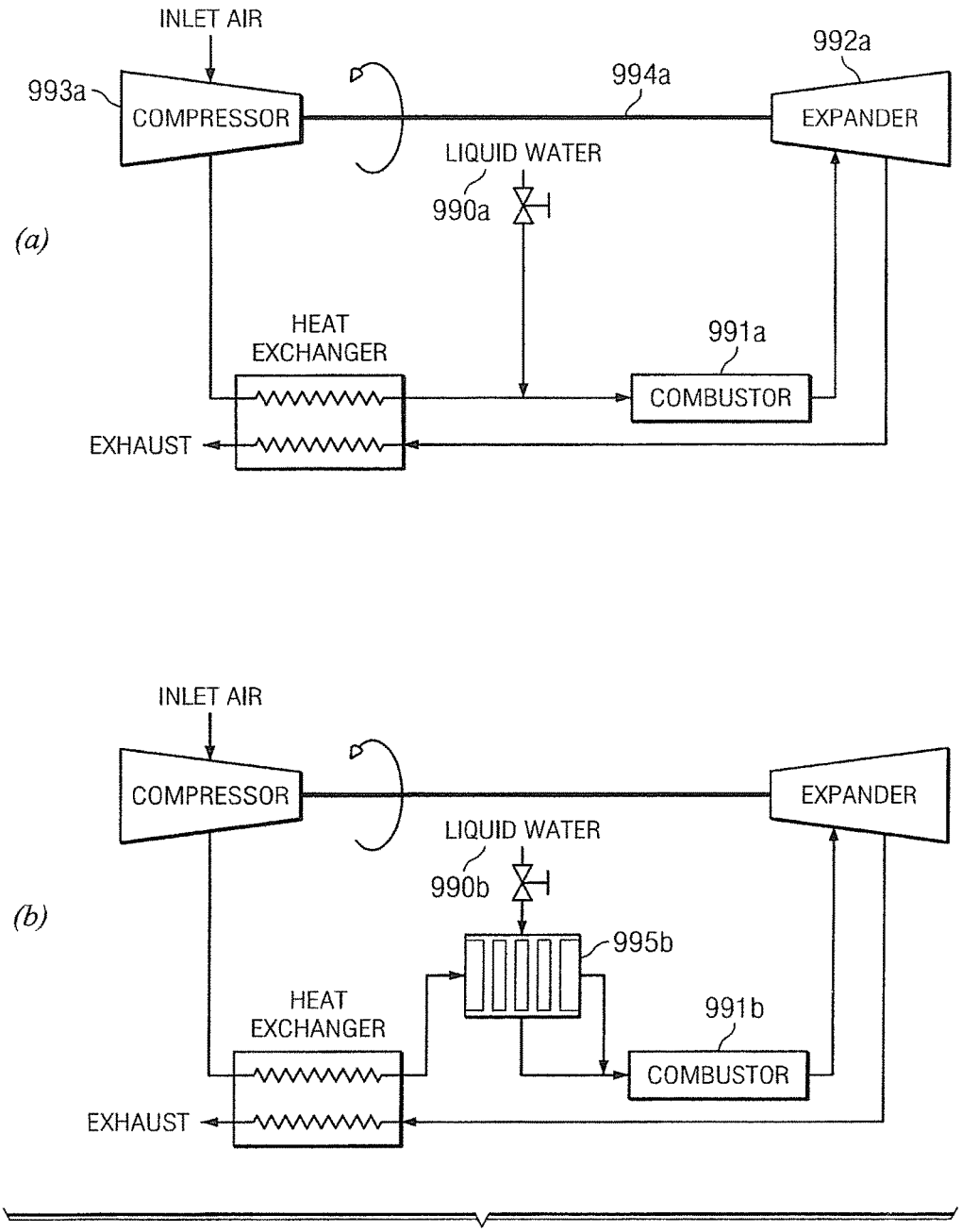
FIG. 104 shows that liquid water may be added to a combustor when a power boost is desire.

FIGS. 1 through 104 below illustrate example embodiments of a gerotor apparatus within the teachings of the present invention. Generally, the following detailed description describes gerotor apparatuses as being used in the context of a gerotor compressor; however, some of the following gerotor apparatuses may function equally as well as gerotor expanders or other suitable gerotor apparatuses. In addition, the present invention contemplates that the gerotor apparatuses described below may be utilized in any suitable application; however, the gerotor apparatuses described below are particularly suitable for a quasi-isothermal Brayton cycle engine, such as the one described in U.S. Pat. No. 6,336,317 B1 ("the '317 patent") issued Jan. 8, 2002. The '317 patent, which is herein incorporated by reference, describes the general operation of a gerotor compressor and/or a gerotor expander. Hence, the operation of some of the gerotor apparatuses described below may not be described in detail.

Embodiments of the invention may provide a number of technical advantages, such as a more compact and lightweight design of a gerotor compressor or expander having simpler gas flow paths, less loads on bearings, and lower power consumption. In addition, some embodiments of the invention introduce a simpler method for regulating leakage from gaps, provide for precision alignment between the inner and outer gerotors, and introduce drive mechanisms that have small backlash and low wear. These technical advantages may be facilitated by all, some, or none of the embodiments described below. In addition, in some embodiments, the technology described herein may be utilized in conjunction with the technology described in U.S. patent application Ser. No. 10/359,487, which is herein incorporated by reference.

FIG. 1 illustrates a cross-section of an example gerotor apparatus 10*a* having an integrated synchronizing system 18*a* in accordance with one embodiment of the invention. Gerotor apparatus 10*a* includes a housing 12*a*, an outer gerotor 14*a* disposed within housing 12*a*, an inner gerotor 16*a* at least partially disposed within outer gerotor 14*a*, and a synchronizing system 18*a* at least partially housed within a synchronizing system housing 20*a*. More particularly, outer gerotor 14*a* at least partially defines an outer gerotor chamber 30*a*, and inner gerotor 16*a* is at least partially disposed within outer gerotor chamber 30*a*. Gerotor apparatus 10*a* may be designed as either a compressor or an expander, depending on the embodiment or intended application.

Housing 12*a* includes a valve plate 40*a* that includes one or more fluid inlets 42*a* and one or more fluid outlets 44*a*. Fluid inlets 42*a* generally allow fluids, such as gasses, liquids, or liquid-gas mixtures, to enter outer gerotor chamber 30*a*. Likewise, fluid outlets 44*a* generally allow fluids within outer gerotor chamber 30*a* to exit from outer gerotor chamber 30*a*. Fluid inlets 42*a* and fluid outlets 44*a* may have any suitable shape and size. In some embodiments, such as embodiments in which apparatus 10*a* is used for communicating compressible fluids, such as gasses or liquid-gas mixtures, the total area of the one or more fluid inlets 42*a* is different than the total area of the one or more fluid outlets 44*a*. In embodiments in which apparatus 10*a* is a compressor, the total area of fluid inlets 42*a* may be greater than the total area of fluid outlets 44*a*. Conversely, in embodiments in which apparatus 10*a* is an expander, the total area of fluid inlets 42*a* may be less than the total area of fluid outlets 44*a*.

As shown in FIG. 1, outer gerotor 14*a* may be rigidly coupled to a first shaft 50*a* having a first axis, which shaft 50*a* may be rotatably coupled to a hollow cylindrical portion of housing 12*a*, such by one or more ring-shaped bearings 52*a*. Thus, first shaft 50*a* and outer gerotor 14*a* may rotate together about the first axis relative to housing 12*a* and inner gerotor 16*a*. In some embodiments, first shaft 50*a* is a drive shaft operable to drive the operation of gerotor apparatus 10*a*. Inner gerotor 16*a* may be rotatably coupled to a second shaft 54*a* having a second axis offset from (i.e., not aligned with) the first axis. Second shaft 54*a* may be rigidly coupled to, or integral with, housing 12*a*, such as by one or more ring-shaped bearings 56*a*. Thus, inner gerotor 16*a* may rotate together about the second axis relative to housing 12*a* and outer gerotor 14*a*.

In this embodiment, synchronizing system 18*a* includes a cam plate 22*a* including one or more cams 24*a* interacting with an alignment plate 26*a* including one or more alignment members 28*a*. Cam plate 22*a* is rigidly coupled to inner gerotor 16*a*, and alignment plate 26*a* is rigidly coupled to outer gerotor 14*a* via first shaft 50*a*. In alternative embodiments, cam plate 22*a* may be coupled to outer gerotor 14*a* and alignment plate 26*a* may be coupled to inner gerotor 16*a*. Cam plate 22*a* and alignment plate 26*a* cooperate to synchronize the relative motion of outer gerotor 14*a* and inner gerotor 16*a*. During operation of gerotor apparatus 10*a*, alignment members 28*a* ride against the surfaces of cams 24*a*, which synchronizes the relative motion of outer gerotor 14*a* and inner gerotor 16*a*. Alignment members 28*a* may include pegs or any other suitable members that may interact with cams 24*a*. Synchronizing system 18*a* may include a lubricant 60*a* operable to reduce friction between cams 24*a* and alignment members 28*a*. Synchronizing system 18*a* is discussed in greater detail below with reference to FIGS. 2 and 3.

As discussed above, synchronizing system 18*a* may be partially or substantially housed within synchronizing system housing 20*a*. In this embodiment, synchronizing system housing 20*a* is coupled to first axis 50*a* and second axis 54*a* and, because first axis 50*a* and second axis 54*a* are offset from each other, synchronizing system housing 20*a* is restricted from rotating relative to housing 12*a*. Synchronizing system housing 20*a* may be operable to restrict lubricant 60*a* from flowing into the portions of outer gerotor chamber 30*a* though which fluids are communicated during the operation of gerotor apparatus 10*a*. Such portions of outer gerotor chamber 30*a* are indicated in FIG. 1 as fluid-flow passageways 32*a*. Thus, synchronizing system housing 20*a* may substantially prevent lubricant 60*a* from mixing with fluids flowing though fluid-flow passageways 32*a*, and vice versa.

Figure 2:
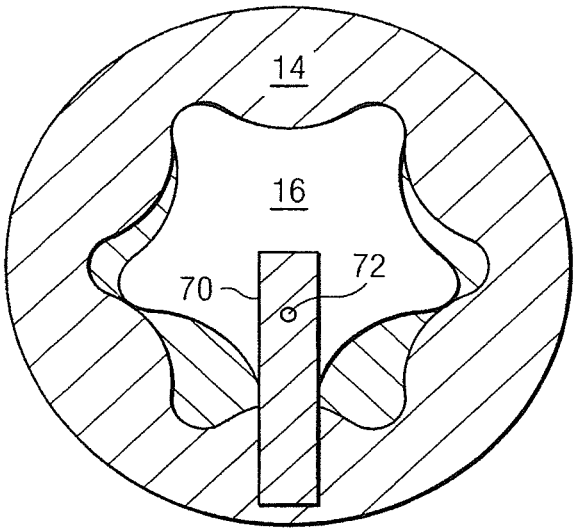
FIG. 2 illustrates an example method for determining the shape of cam plates according to one embodiment of the present invention.

FIG. 2 illustrates an example method for determining the shape of cams 24*a* of cam plate 22*a* according to one embodiment of the present invention. As shown in FIG. 2, a rigid bar 70 is attached to an outer gerotor 14. As inner gerotor 16 and outer gerotor 14 rotate, a point 72 located on bar 70 traces a path 74 (or scribes a line) on inner gerotor 16, the shape of which path 74 is shown in FIG. 3 as a dashed line.

Figure 3:
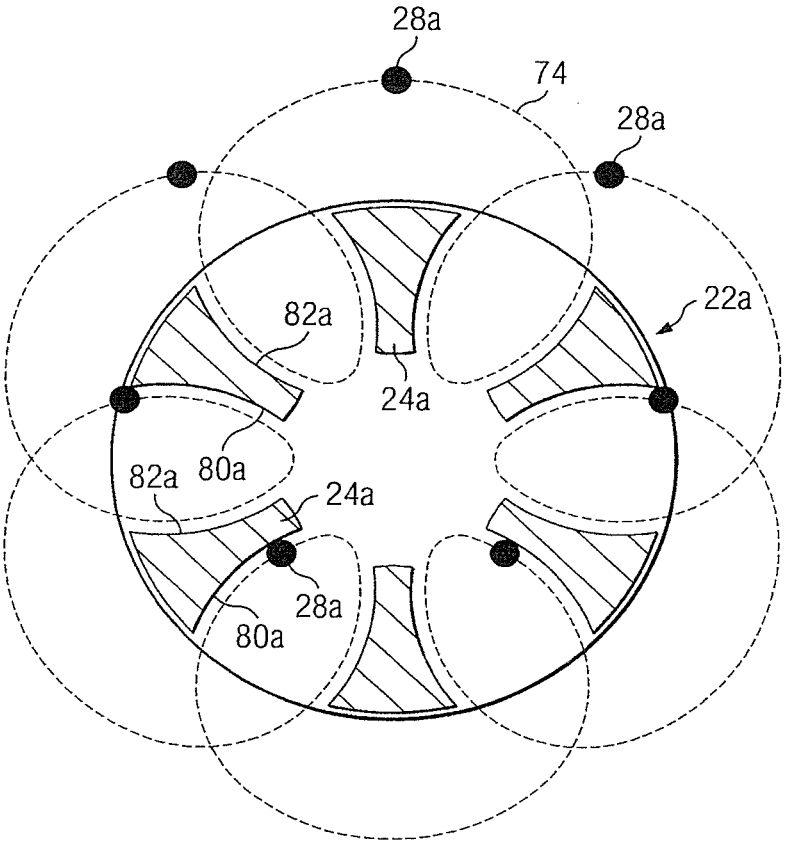
FIG. 3 is a cross-sectional view of a synchronizing system taken though cams and alignment members.

FIG. 3 is a cross-sectional view of synchronizing system 18*a* taken though cams 24*a* and alignment members (here, pegs) 28*a*. In some embodiments, the number of cams 24*a* on cam plate 22*a* is different than the number of alignment members 28*a* on alignment plate 26*a*. For example, in a particular embodiment, cam plate 22*a* includes seven cams 24*a*, while alignment plate 26*a* includes six alignment members 28*a*. The shape of cams 24*a* corresponds with the path 74 determined as described above. In this embodiment, each cam 24*a* has a "dog bone" shape including a first surface 80*a* and a second surface 82*a* that guide alignment members 28*a* along portions of path 74 as outer gerotor 14*a* and inner gerotor 16*a* rotate relative to each other, thus keeping outer gerotor 14*a* and inner gerotor 16*a* in alignment. The "dog bone" shape may have a narrower width across an inner portion than the width at either end of the shape.

In the embodiment shown in FIG. 3, at any instant during the rotation of outer gerotor 14*a* and inner gerotor 16*a*, at least two alignment members 28*a* are touching the first surface 80*a* or second surface 82*a* of one of the cams 24*a*. If cam plate 22*a* is held rigid, one alignment member 28*a* prevents alignment plate 26*a* from rotating clockwise, and another alignment member 28*a* prevents alignment plate 26*a* from rotating counter-clockwise. When cam plate 22*a* rotates about its center, cams 24*a* and alignment members 28*a* cooperate to synchronize the motion of outer gerotor 14*a* and inner gerotor 16*a*.

Figure 4:
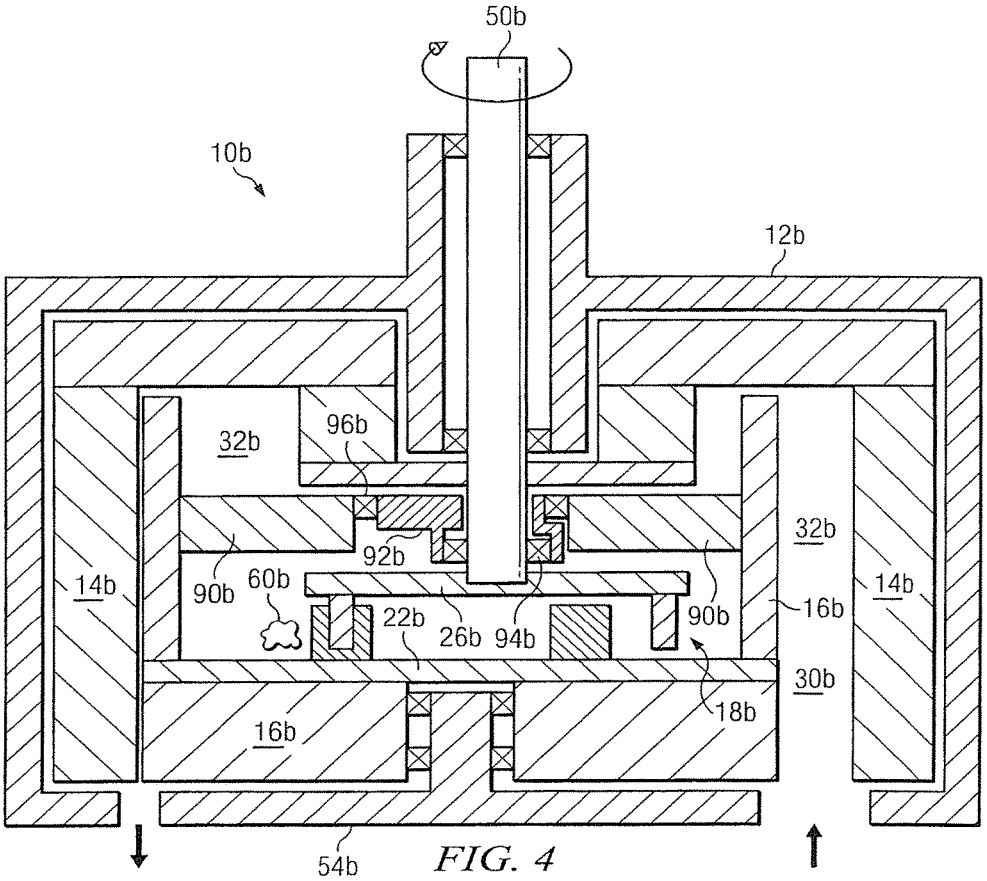
FIG. 4 illustrates a cross-section of an example gerotor apparatus having an integrated synchronizing system in accordance with another embodiment of the invention.

FIG. 4 illustrates a cross-section of an example gerotor apparatus 10*b* having an integrated synchronizing system 18*b* in accordance with another embodiment of the invention. Like gerotor apparatus 10*a* shown in FIG. 1, gerotor apparatus 10*b* includes a housing 12*b*, an outer gerotor 14*b* disposed within housing 12*b*, an inner gerotor 16*b* at least partially disposed within outer gerotor 14*b*, and a synchronizing system 18*b* including a cam plate 22*b* and an alignment plate 26*b*. Outer gerotor 14*b* at least partially defines an outer gerotor chamber 30*b*, and inner gerotor 16*b* is at least partially disposed within outer gerotor chamber 30*b*. Outer gerotor 14*b* is rigidly coupled to a first shaft 50*b*, which is rotatably coupled to housing 12*b*, and inner gerotor 16*b* is rotatably coupled to a second shaft 54*b* rigidly coupled to, or integral with, housing 12*b*. Gerotor apparatus 10*b* may be designed as either a compressor or an expander, depending on the embodiment or intended application.

However, unlike gerotor apparatus 10*a*, synchronizing system 18*b* of gerotor apparatus 10*b* is partially or substantially enclosed by a dam 90*b* and a plug 92*b*. Dam 90*b* may comprise a cylindrical member rigidly coupled to, or integral with, inner gerotor 16*b*, and plug 92*b* may also comprise a cylindrical member. Plug 92*b* may be coupled to dam 90*b* and shaft 50*b*, such as by one or more bearings, such that plug 92*b* forms a seal between inner gerotor 16*b* and shaft 50*b*. In the embodiment shown in FIG. 4, plug 92*b* is coupled to shaft 50*b* by a first, smaller bearing 94*b* and to dam 90*b* by a second, larger bearing 96*b*. Dam 90*b* and plug 92*b* may be operable to restrict a lubricant 60*b* from flowing into fluid-flow passageways 32*b* of outer gerotor chamber 30*b*. Thus, dam 90*b* and plug 92*b* may substantially prevent lubricant 60*b* from mixing with fluids flowing though fluid-flow passageways 32*b*, and vice versa.

Figure 5:
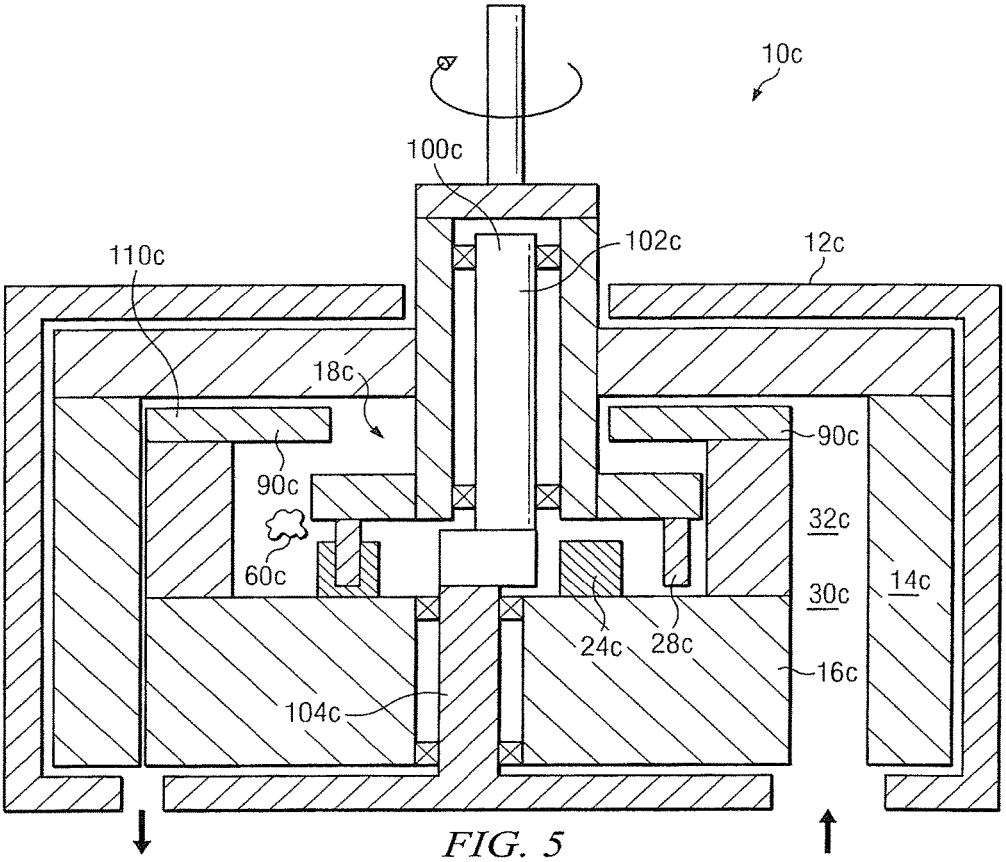
FIG. 5 illustrates a cross-section of an example gerotor apparatus having an integrated synchronizing system in accordance with another embodiment of the invention.

FIG. 5 illustrates a cross-section of an example gerotor apparatus 10*c* having an integrated synchronizing system 18*c* in accordance with another embodiment of the invention. Like gerotor apparatus 10*a* shown in FIG. 1, gerotor apparatus 10*c* includes a housing 12*c*, an outer gerotor 14*c* disposed within housing 12*c*, an inner gerotor 16*c* at least partially disposed within outer gerotor 14*c*, and a synchronizing system 18*c* including a number of cams 24*c* interacting with a number of alignment members 28*c*. Outer gerotor 14*c* at least partially defines an outer gerotor chamber 30*c*, and inner gerotor 16*c* is at least partially disposed within outer gerotor chamber 30*c*. Outer gerotor 14*c* and inner gerotor 16*c* are rotatably coupled to a single shaft 100*c* rigidly coupled to housing 12*c*. In particular, outer gerotor 14*c* is rotatably coupled to a first portion 102*c* of shaft 100*c* having a first axis about which outer gerotor 14*c* rotates, and inner gerotor 16*c* is rotatably coupled to a second portion 104*c* of shaft 100*c* having a second axis about which inner gerotor 16*c* rotates, the second axis being offset from the first axis. Gerotor apparatus 10*c* may be designed as either a compressor or an expander, depending on the embodiment or intended application.

Synchronizing system 18*c* is partially enclosed by a dam 90*c*. Dam 90*c* may comprise a cylindrical member rigidly coupled to, or integral with, inner gerotor 16*c* proximate a first end 110*c* of inner gerotor 16*c*. In this embodiment, dam 90*c* does not completely seal synchronizing system 18*c* from portions of outer gerotor chamber 30*c* though which fluids are communicated during the operation of gerotor apparatus 10*c*, indicated in FIG. 5 as fluid-flow passageways 32*c*. A lubricant 60*c* may be used to lubricate synchronizing system 18*c*. In this embodiment, lubricant 60*c* may be grease or a similar lubricant. Dam 90*c* may help keep lubricant 60*c* from escaping into fluid-flow passageways 32*c*, thus preventing or reducing the amount of lubricant 60*c* mixing with fluids flowing though fluid-flow passageways 32*b*, and vice versa.

Figure 6:
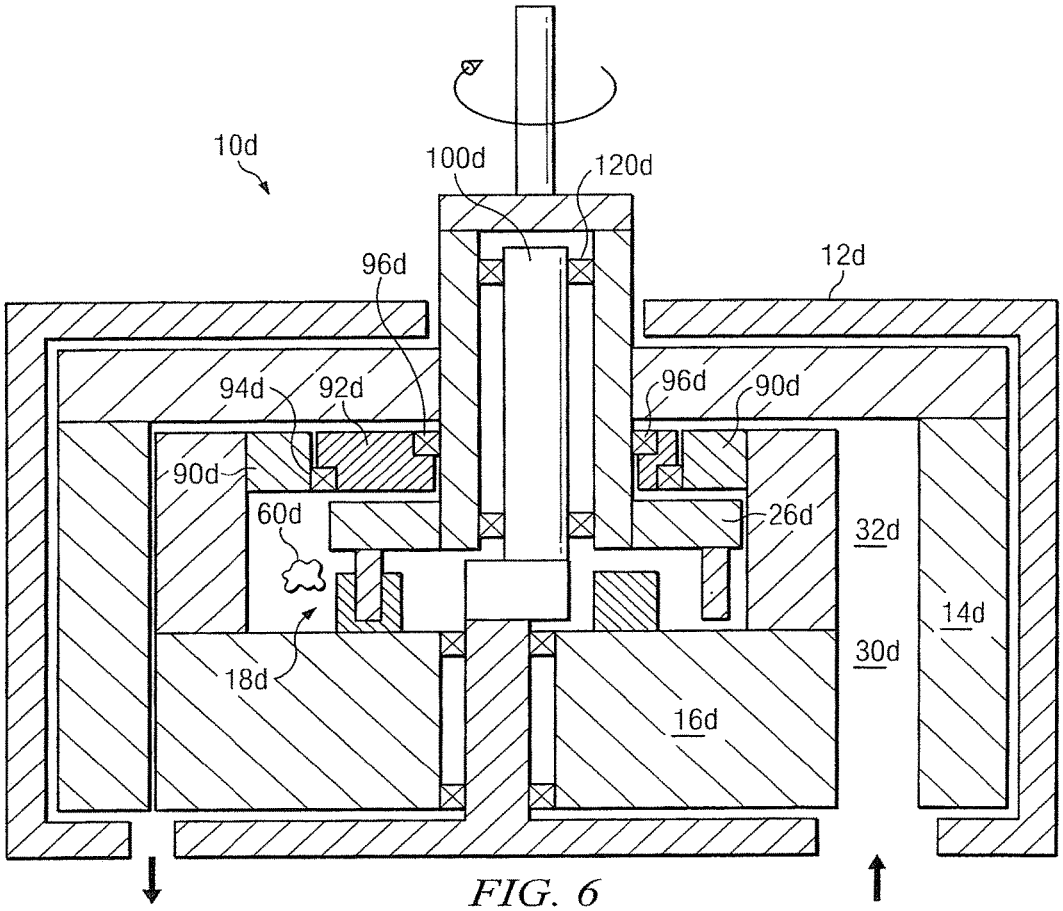
FIG. 6 illustrates a cross-section of an example gerotor apparatus having an integrated synchronizing system in accordance with another embodiment of the invention.

FIG. 6 illustrates a cross-section of an example gerotor apparatus 10*d* having an integrated synchronizing system 18*d* in accordance with another embodiment of the invention. Gerotor apparatus 10*d* is similar to gerotor apparatus 10*c* shown in FIG. 5, including a housing 12*d*, an outer gerotor 14*d*, an inner gerotor 16*d*, and a synchronizing system 18*d*. Synchronizing system 18*d* includes an alignment plate 26*d* rigidly coupled to outer gerotor 14*d* by a cylindrical member 120*d*. Gerotor apparatus 10*d* further includes a dam 90*d* coupled to, or integral with, inner gerotor 16*d*, and a plug 92*d* that cooperates with dam 90*d* to substantially enclose synchronizing system 18*d*. Plug 92*d* may comprise a cylindrical member, and may be coupled to dam 90*d* and shaft 100*d*, such as by one or more bearings, such that plug 92*d* forms a substantial seal between inner gerotor 16*d* and shaft 100*d*. In the embodiment shown in FIG. 6, plug 92*d* is coupled to cylindrical member 120*d* (and thus to outer gerotor 14*d*) by a first, smaller bearing 94*d*, and to dam 90*d* by a second, larger bearing 96*d*. Dam 90*d* and plug 92*d* may restrict a lubricant 60*d* from flowing into fluid-flow passageways 32*d* of outer gerotor chamber 30*b*. Thus, dam 90*d* and plug 92*d* may substantially prevent lubricant 60*d* from mixing with fluids flowing though fluid-flow passageways 32*d*, and vice versa.

Figure 7:
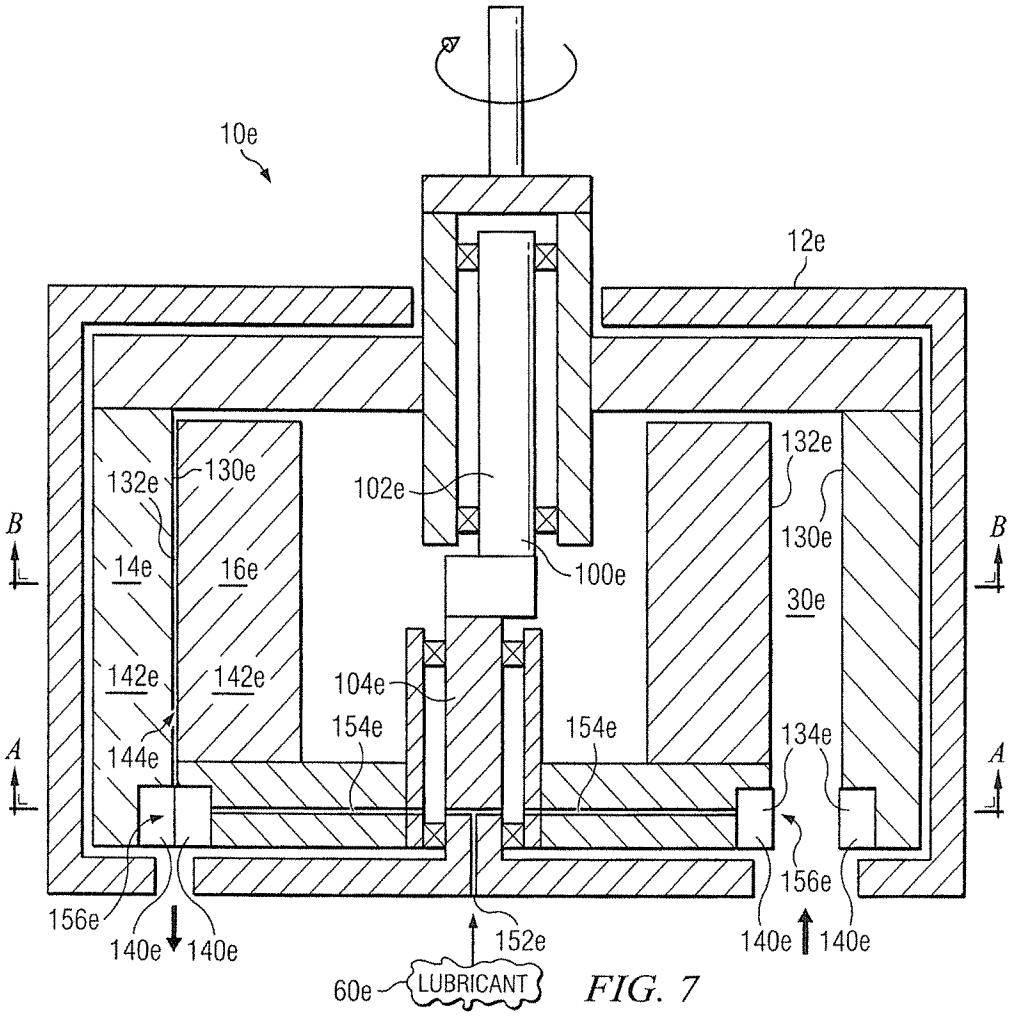
FIG. 7 illustrates a cross-section of an example self-synchronizing gerotor apparatus in accordance with another embodiment of the invention.

FIG. 7 illustrates a cross-section of an example self-synchronizing gerotor apparatus 10*e* in accordance with another embodiment of the invention. Like gerotor apparatus 10*a* shown in FIG. 1, gerotor apparatus 10*e* includes a housing 12*e*, an outer gerotor 14*e* disposed within housing 12*e*, an outer gerotor chamber 30*e* at least partially defined by outer gerotor 14*e*, and an inner gerotor 16*e* at least partially disposed within outer gerotor chamber 30*e*. Outer gerotor 14*e* and inner gerotor 16*e* are rotatably coupled to a single shaft 100*e* rigidly coupled to housing 12*e*. In particular, outer gerotor 14*e* is rotatably coupled to a first portion 102*e* of shaft 100*e* having a first axis about which outer gerotor 14*e* rotates, and inner gerotor 16*e* is rotatably coupled to a second portion 104*e* of shaft 100*e* having a second axis about which inner gerotor 16*e* rotates, the second axis being offset from the first axis. Gerotor apparatus 10*e* may be designed as either a compressor or an expander, depending on the embodiment or intended application.

Outer gerotor 14*e* includes an inner surface 130*e* extending around the inner perimeter of outer gerotor 14*e* and at least partially defining outer gerotor chamber 30*e*. Inner gerotor 16*e* includes an outer surface 132*e* extending around the outer perimeter of inner gerotor 16*e*. As inner gerotor 16*e* and outer gerotor 14*e* rotate relative to each other, at least portions of outer surface 132*e* of inner gerotor 16*e* contacts at least portions of inner surface 130*e* of outer gerotor 14*e*, which synchronizes the rotation of inner gerotor 16*e* and outer gerotor 14*e*. Thus, as shown in FIG. 7, outer surface 132*e* of inner gerotor 16*e* and inner surface 130*e* of outer gerotor 14*e* may provide the synchronization function that is provided by separate synchronization mechanisms 18 discussed herein with regard to other embodiments.

In order to reduce friction and wear between inner gerotor 16*e* and outer gerotor 14*e*, at least a portion of (a) outer surface 132*e* of inner gerotor 16*e* and/or (b) inner surface 130*e* of outer gerotor 14*e* is formed from one or more relatively low-friction materials 134*e*, which portions may be referred to as low-friction regions 140*e*. Such low-friction materials 134*e* may include, for example, a polymer (phenolics, nylon, polytetrafluoroethylene, acetyl, polyimide, polysulfone, polyphenylene sulfide, ultrahigh-molecular-weight polyethylene), graphite, or oil-impregnated sintered bronze. In some embodiments, such as embodiments in which water is provided as a lubricant between outer surface 132*e* of inner gerotor 16*e* and inner surface 130*e* of outer gerotor 14*e*, low-friction materials 134*e* may comprise VESCONITE.

Low-friction regions 140*e* may include portions (or all) of inner gerotor 16*e* and/or outer gerotor 14*e*, or low-friction implants coupled to, or integral with, inner gerotor 16*e* and/or outer gerotor 14*e*. Depending on the particular embodiment, such low-friction regions 140*e* may extend around the inner perimeter of outer gerotor 14*e* and/or the outer perimeter of inner gerotor 16*e*, or may be located only at particular locations around the inner perimeter of outer gerotor 14*e* and/or the outer perimeter of inner gerotor 16*e*, such as proximate the tips of inner gerotor 16*e* and/or outer gerotor 14*e* as discussed below with respect to FIG. 8B. As shown in FIG. 7, low-friction regions 140*e* may extend a slight distance beyond the outer surface 132*e* of inner gerotor 16*e* and/or inner surface 130*e* of outer gerotor 14*e* such that only the low-friction regions 140*e* of inner gerotor 16*e* and/or outer gerotor 14*e* contact each other. Thus, there may be a narrow gap between the remaining, higher-friction regions 142*e* of inner gerotor 16*e* and outer gerotor 14*e*, as indicated by arrow 144*e* in FIG. 7. Higher-friction regions 142*e* may have a higher coefficient of friction than corresponding low-friction regions 134*e*.

In some embodiments, low-friction regions 140*e* of inner gerotor 16*e* and/or outer gerotor 14*e* may sufficiently reduce friction and wear such that gerotor apparatus 10*e* may be run dry, or without lubrication. However, in some embodiments, a lubricant 60*e* is provided to further reduce friction and wear between inner gerotor 16*e* and outer gerotor 14*e*. As shown in FIG. 7, shaft 100*e* may include a shaft lubricant channel 152*e* and inner gerotor 16*e* may include one or more inner gerotor lubricant channels 154*e* terminating at one or more lubricant channel openings 156*e* in the outer surface 132*e* of inner gerotor 16*e*. Lubricant channels 152*e* and 154*e* may provide a path for communicating a lubricant 60*e* through lubricant channel openings 156*e* such that lubricant 60*e* may provide lubrication between outer surface 132*e* of inner gerotor 16*e* and inner surface 130*e* of outer gerotor 14*e*.

Lubricant 60*e*, as well as any other lubricant discussed here, may include any one or more suitable substances suitable to provide lubrication between multiple surfaces, such as oils, graphite, grease, water, or any other suitable lubricants.

FIGS. 8A-8D illustrate cross-sectional views A and B of outer gerotor 14*e* and inner gerotor 16*e* taken along line A and line B, respectively, shown in FIG. 7, according to various embodiments of the invention. In the embodiment shown in FIG. 8A, view A, inner gerotor 16*e* includes low-friction regions 140*e* at each tip 160*e* of inner gerotor 16*e*. Lubricant channels 154*e* provide passageways for communicating lubricant 60*e* through lubricant channel openings 156*e* such that lubricant 60*e* may provide lubrication between outer surface 132*e* of inner gerotor 16*e* and inner surface 130*e* of outer gerotor 14*e*. Outer gerotor 14*e* includes a low-friction region 140*e* extending around the inner perimeter of outer gerotor 14*e* and defining inner surface 130*e* of outer gerotor 14*e*. As discussed above, as inner gerotor 16*e* and outer gerotor 14*e* rotate relative to each other, at least portions of outer surface 132*e* of inner gerotor 16*e* contact inner surface 130*e* of outer gerotor 14*e*, which synchronizes the rotation of inner gerotor 16*e* and outer gerotor 14*e*.

Figure 8A:
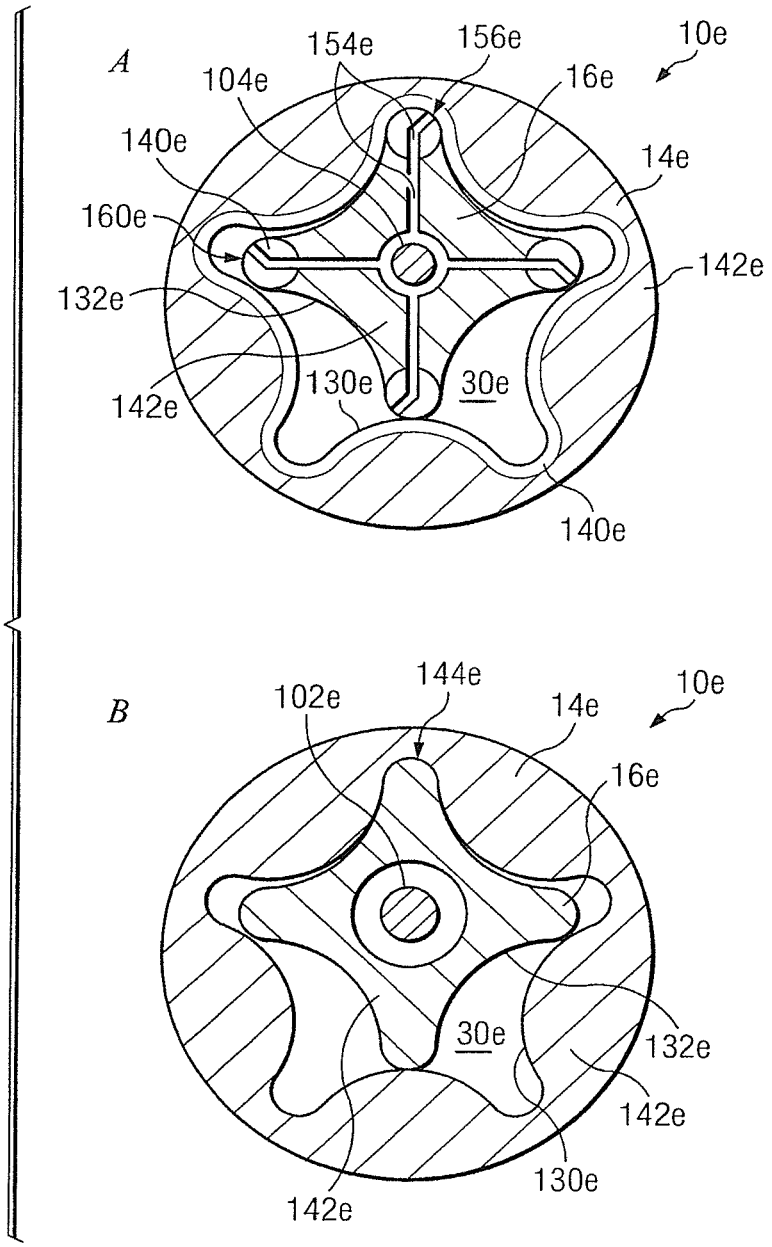
FIGS. 8A-8D illustrate cross-sectional views A and B of an outer gerotor and an inner gerotor taken along line A and line B, respectively, shown in FIG. 7, according to various embodiments of the invention.

View B of FIG. 8A is a cross-section taken through the portion of inner gerotor 16*e* and outer gerotor 14*e* not including low-friction region 140*e*. As discussed above regarding FIG. 7, a narrow gap 144*e* may be maintained between outer surface 132*e* of inner gerotor 16*e* and inner surface 130*e* of outer gerotor 14*e*. Thus, contact (and thus friction and wear) between higher-friction regions 142*e* of inner gerotor 16*e* and outer gerotor 14*e* may be substantially reduced or eliminated.

Figure 8B:
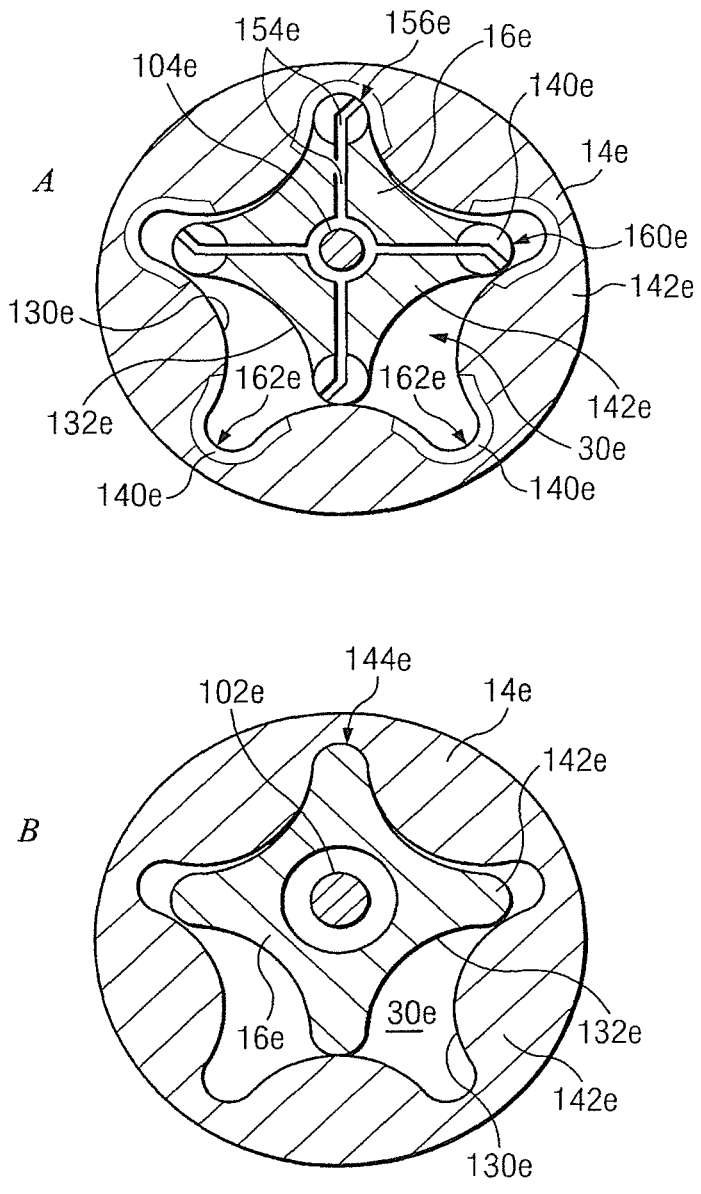

In the embodiment shown in FIG. 8B, view A, inner gerotor 16*e* includes low-friction regions 140*e* at each tip 160*e* of inner gerotor 16*e*. Lubricant channels 154*e* provide passageways for communicating lubricant 60*e* through lubricant channel openings 156*e* such that lubricant 60*e* may provide lubrication between outer surface 132*e* of inner gerotor 16*e* and inner surface 130*e* of outer gerotor 14*e*. Outer gerotor 14*e* includes a low-friction region 140*e* proximate each tip 162*e* of inner surface 130*e* of outer gerotor 14*e*. Because a large portion of friction and wear between inner gerotor 16*e* and outer gerotor 14*e* occurs at tips 160*e* and 162*e* of inner gerotor 16*e* and outer gerotor 14*e*, respectively, limiting low-friction regions 140*e* to areas near tips 160*e* and 162*e* may reduce costs where low-friction materials 134*e* are relatively expensive and/or provide additional structural integrity where low-friction regions 140*e* are less durable than higher-friction regions 142*e*. View B of FIG. 8B is similar or identical to View B of FIG. 8A, wherein the complete cross-sections of both inner gerotor 16*e* and outer gerotor 14*e* at section B are higher-friction regions 142*e*.

Figure 8C:
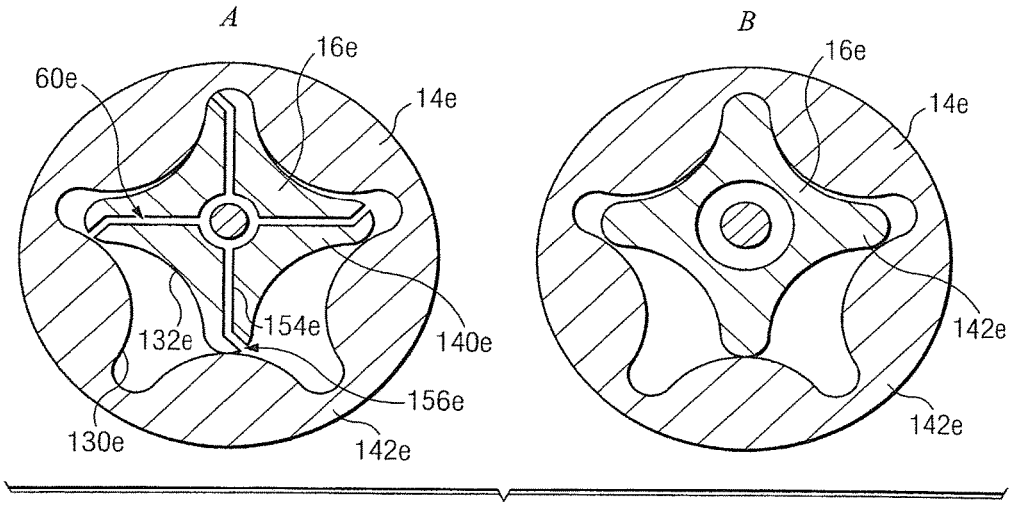

In the embodiment shown in FIG. 8C, view A, the complete cross-section of inner gerotor 16*e* at section A is a low-friction region 140*e* formed from a low-DALOI friction material 134*e*. Again, lubricant channels 154*e* provide passageways for communicating lubricant 60*e* through lubricant channel openings 156*e* such that lubricant 60*e* may provide lubrication between outer surface 132*e* of inner gerotor 16*e* and inner surface 130*e* of outer gerotor 14*e*. Outer gerotor 14*e* is a higher-friction region 140*e* formed from a higher-friction material. Providing inner gerotor 16*e* having a complete cross-section formed from a low-friction material 134*e* may provide manufacturing advantages over other embodiments that include both low-friction regions 140*e* and higher-friction regions 142*e* at a particular cross-section. View B of FIG. 8C is similar or identical to View B of FIG. 8A, wherein the complete cross-sections of both inner gerotor 16*e* and outer gerotor 14*e* at section B are higher-friction regions 142*e*.

Figure 8D:
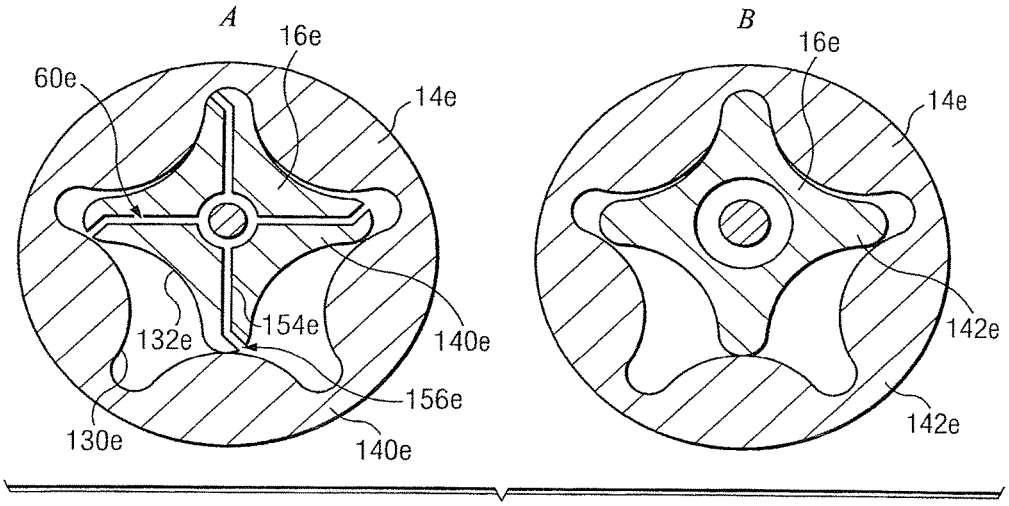

In the embodiment shown in FIG. 8D, view A, the complete cross-sections of both inner gerotor 16*e* and outer gerotor 14*e* at section A are low-friction regions 140*e* formed from one or more low-friction materials 134*e*. Again, lubricant channels 154*e* provide passageways for communicating lubricant 60*e* through lubricant channel openings 156*e* such that lubricant 60*e* may provide lubrication between outer surface 132*e* of inner gerotor 16*e* and inner surface 130*e* of outer gerotor 14*e*. View B of FIG. 8D is similar or identical to View B of FIG. 8A, wherein the complete cross-sections of both inner gerotor 16*e* and outer gerotor 14*e* at section B are higher-friction regions 142*e*.

Figure 9:
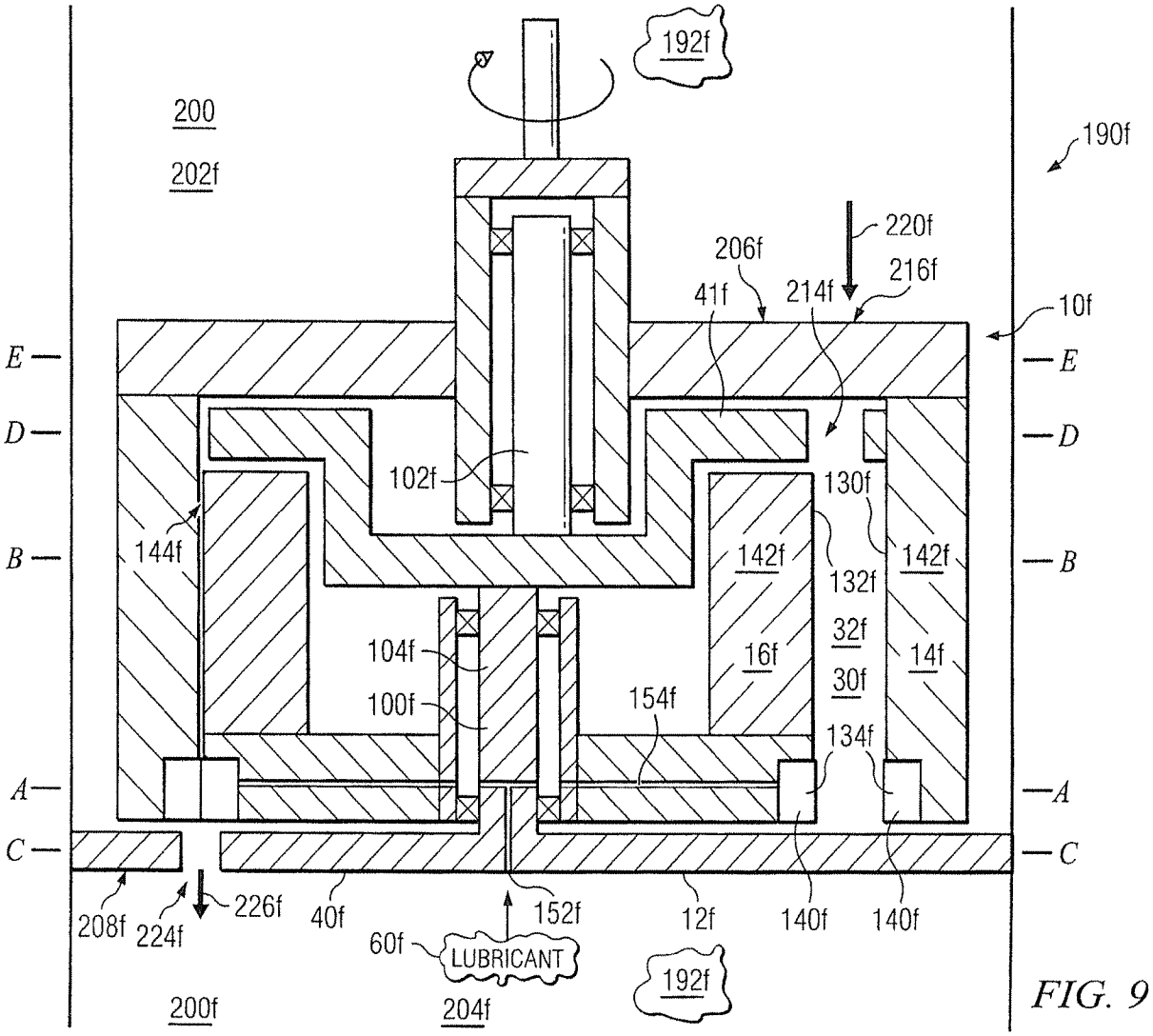
FIG. 9 illustrates a cross-section of a system including a gerotor apparatus located within a chamber such that a portion of chamber on one side of gerotor apparatus is at a higher pressure than a portion of chamber on the other side of gerotor apparatus, in accordance with one embodiment of the invention.

FIG. 9 illustrates a cross-section of a system 190*f* including a gerotor apparatus 10*f* located within a chamber 200*f* such that a portion of chamber 200*f* on one side of gerotor apparatus 10*f* is at a higher pressure than a portion of chamber 200*f* on the other side of gerotor apparatus 10*f*, in accordance with one embodiment of the invention. Gerotor apparatus 10*f* is generally located between a first chamber portion 202*f* and a second chamber portion 204*f* of chamber 200*f*, such that gas or other fluids may pass from first chamber portion 202*f*, through a first face 206*f* of gerotor apparatus 10*f*, though one or more fluid flow passageways 32*f* defined by gerotor apparatus 10*f*, and through a second face 208*f* of gerotor apparatus 10*f* and into second chamber portion 204*f*.

Gerotor apparatus 10*f* may be designed as either a compressor or an expander, depending on the embodiment or intended application. A compressible fluid 192*f*, such as a gas or gas-liquid mixture, may be run through system 190*f*, including through first chamber portion 202*f*, gerotor apparatus 10*f*, and second chamber portion 204*f*. In embodiments in which gerotor apparatus 10*f* is a compressor, compressible fluid 192*f* may flow through first chamber portion 202*f* at a first pressure, become compressed within gerotor apparatus 10*f*, and flow through second chamber portion 204*f* at a second pressure higher than the first pressure. Conversely, in embodiments in which gerotor apparatus 10*f* is an expander, the compressible fluid 192*f* may flow through first chamber portion 202*f* at a first pressure, expand within gerotor apparatus 10*f*, and flow through second chamber portion 204*f* at a second pressure lower than the first pressure. In some embodiments, chamber 200*f* is a vacuum chamber. In some embodiments, system 190*f* may be a portion of an air conditioning system. In a particular embodiment, system 190*f* is part of a water-based air conditioning system.

Like gerotor apparatus 10*e* shown in FIG. 7, gerotor apparatus 10*f* includes a housing 12*f*, an outer gerotor 14*f* disposed within housing 12*f*, an outer gerotor chamber 30*f* at least partially defined by outer gerotor 14*f*, and an inner gerotor 16*f* at least partially disposed within outer gerotor chamber 30*f*. Outer gerotor 14*f* and inner gerotor 16*f* are rotatably coupled to a single shaft 100*f* rigidly coupled to housing 12*f*. In particular, outer gerotor 14*f* is rotatably coupled to a first portion 102*f* of shaft 100*f* having a first axis about which outer gerotor 14*f* rotates, and inner gerotor 16*f* is rotatably coupled to a second portion 104*f* of shaft 100*f* having a second axis about which inner gerotor 16*f* rotates, the second axis being offset from the first axis.

Housing 12*f* includes a fluid outlet plate 40*f* and a fluid inlet plate 41*f*. Fluid inlet plate 41*f* includes at least one inlet opening 214*f* (see FIG. 11, discussed below) allowing fluids to pass through. Outer gerotor 14*f* also includes at least one inlet opening 216*f* (see FIG. 11, discussed below) allowing fluids to pass through during the rotation of outer gerotor 14*f*. Together, openings 214*f* and 216*f* comprise a fluid inlet port 218*f* allowing fluids (such as gas or water, for example) to flow from first chamber portion 202*f* into fluid flow passageways 32*f* of gerotor apparatus 10*f*, as indicated by arrow 220*f*. Fluid outlet plate 40*f* includes at least one outlet opening 224*f* and/or check valve 230*f* (see FIG. 10, discussed below) allowing fluids to flow from fluid flow passageways 32*f* of gerotor apparatus 10*f* into second chamber portion 204*f*, as indicated by arrow 226*f*.

In this particular embodiment, gerotor apparatus 10*f* is a self-synchronizing gerotor apparatus 10*f* similar to gerotor apparatus 10*e* shown in FIG. 7 as discussed above. For example, at least a portion of (a) outer surface 132*f* of inner gerotor 16*f* and/or (b) inner surface 130*f* of outer gerotor 14*f* of gerotor apparatus 10*f* may include one or more low-friction regions 140*f* formed from low-friction materials 134*f* in order to reduce friction and wear between inner gerotor 16*f* and outer gerotor 14*f*, thus allowing outer surface 132*f* of inner gerotor 16*f* and inner surface 130*f* of outer gerotor 14*f* to synchronization the rotation of inner gerotor 16*f* and outer gerotor 14*f*. Low-friction regions 140*f* may extend a slight distance beyond the outer surface 132*f* of inner gerotor 16*f* and/or inner surface 130*f* of outer gerotor 14*f* to provide a narrow gap 144*f* between remaining, higher-friction regions 142*f* of inner gerotor 16*f* and outer gerotor 14*f* such that only the low-friction regions 140*f* of inner gerotor 16*f* and/or outer gerotor 14*f* contact each other. In other embodiments, gerotor apparatus 10*f* may include a synchronizing system 18*f*, such as shown in FIGS. 1-6, for example. In addition, in some embodiments, as shown in FIG. 9, a lubricant 60*f* may be communicated through lubricant channels 152*f* and 154*f* to provide lubrication between outer surface 132*f* of inner gerotor 16*f* and inner surface 130*f* of outer gerotor 14*f*.

Figure 10:
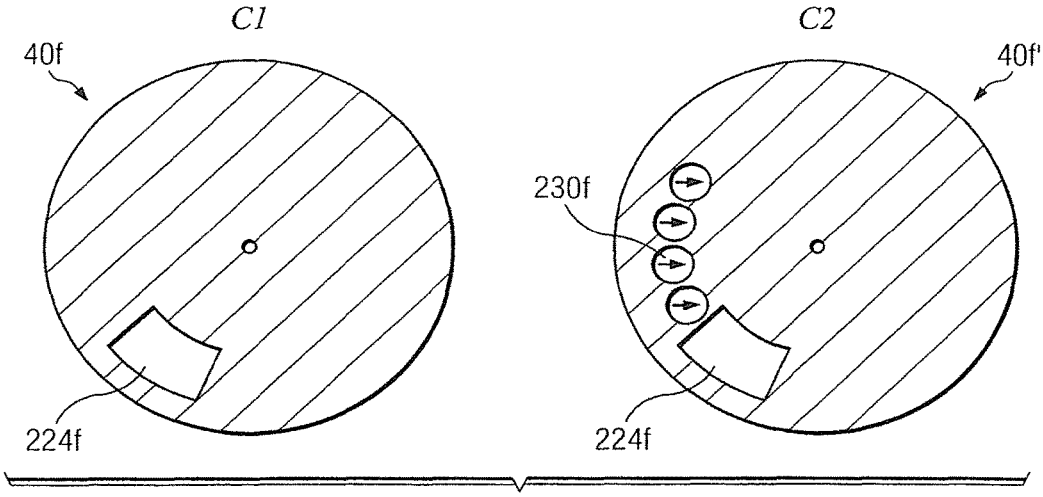
FIG. 10 illustrates example cross-sections of outlet valve plate taken along line C of FIG. 9 according to two embodiments of the invention.

FIG. 10 illustrates example cross-sections of outlet valve plate 40*f* taken along line C of FIG. 9 according to two embodiments of the invention. In the first embodiment, C1, outlet valve plate 40*f* includes an outlet opening 224*f* allowing fluids to exit fluid flow passageways 32*f* into second chamber portion 204*f*. In some embodiments in which gerotor apparatus 10*f* is a compressor, the area of outlet opening 224*f* is smaller than the total area of inlet opening(s) 214*f* formed in inlet valve plate 41*f* (see FIG. 11, discussed below).

In the second embodiment, C2, outlet valve plate 40*f* includes an outlet opening 224*f*, as well as one or more check valves 230*f*, allowing fluids to exit fluid flow passageways 32*f* into second chamber portion 204*f*. Providing one or more check valves 230*f* allows various types of fluids 192*f* to be run through gerotor apparatus 10*f*, such as gasses, liquids (e.g., water), and gas-liquid mixtures. The area of outlet opening 224*f* may be smaller than the total area of inlet opening(s) 214*f* formed in inlet valve plate 41*f* (see FIG. 11, discussed below). The total area of outlet opening 224*f* and check valves 230*f* may be approximately equal to the total area of inlet opening(s) 214*f* formed in inlet valve plate 41*f*. The appropriate check valves 230*f* may open to discharge the particular fluid 192*f* running through gerotor apparatus 10*f*. For example, if a low compression ratio is required for the application, all of the check valves 230*f* may open. If a high compression ratio is required, none of the check valves 230*f* may open. If an intermediate compression ratio is required, then some of the check valves 230*f* may open. Check valves 230*f* may open or close slowly, which is particularly useful for applications that operate at low pressures, such as water-based air conditioning. At low pressures, there may be insufficient force available to rapidly move the mass of the check valve 230*f*. Check valves 230*f* may be particularly valuable for protecting compressor apparatus 10*f* from damage from liquids. For instance, if there is relatively large amount of liquid in the compressor, it may have difficulty exiting outlet opening 224*f*. In this case, the pressure would rise allowing check valves 230*f* to pop open and release the liquid, which is non-compressible, which may protect compressor apparatus 10*f* from damage.

Figure 11:
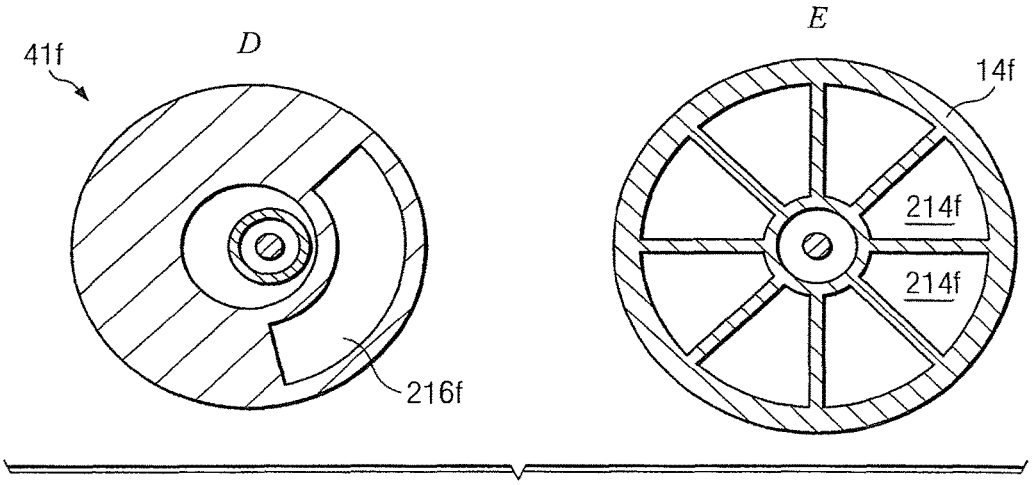
FIG. 11 illustrates example cross-sections of inlet valve plate and outer gerotor taken along lines D and E, respectively, shown in FIG. 9 according to one embodiment of the invention.

FIG. 11 illustrates example cross-sections of inlet valve plate 41*f* and outer gerotor 14*e* taken along lines D and E, respectively, shown in FIG. 9 according to one embodiment of the invention. Inlet valve plate 41*f* includes one or more inlet opening 214*f* allowing fluids to enter fluid flow passageways 32*f* from first chamber portion 202*f*. In some embodiments in which gerotor apparatus 10*f* is a compressor, the area of inlet opening 214*f* is larger than the total area of outlet opening(s) 224*f* formed in outlet valve plate 40*f* (see FIG. 10, discussed above). As discussed above, at cross-section E, outer gerotor 14*f* includes at least one inlet opening 214*f* (see FIG. 11, discussed below) allowing fluids to pass through during the rotation of outer gerotor 14*f*. In this embodiment, outer gerotor 14*f* has a spoked hub shape at cross-section E, forming a plurality of inlet openings 214*f*. However, the portion of outer gerotor 14*f* interfacing first chamber portion 202*f* may be otherwise configured to provide one or more inlet openings 214*f* allowing fluids to enter fluid flow passageways 32*f* from first chamber portion 202*f*.

Figure 12:
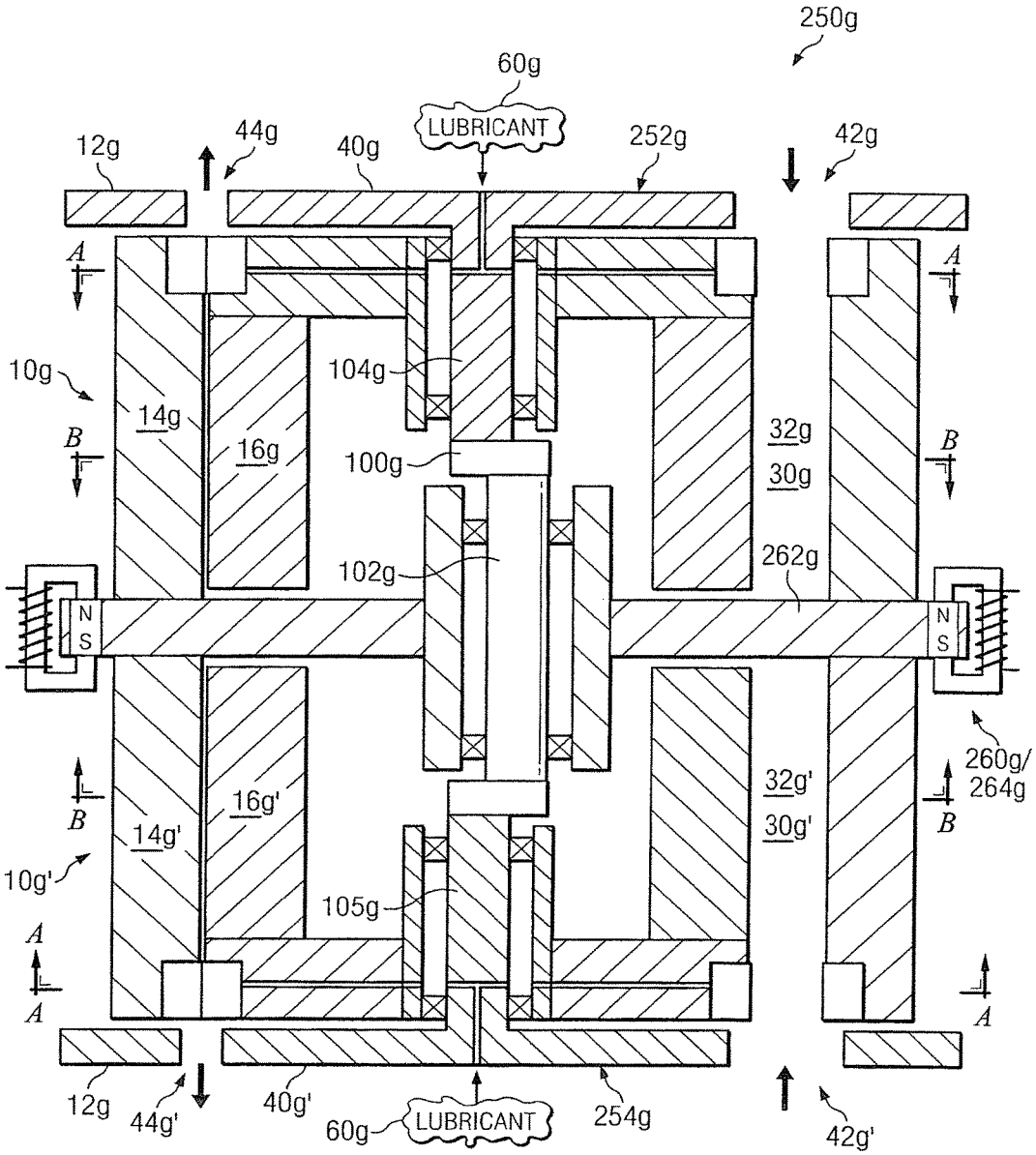
FIG. 12 illustrates an example cross-section of a dual gerotor apparatus according to one embodiment of the invention.

FIG. 12 illustrates an example cross-section of a dual gerotor apparatus 250*g* according to one embodiment of the invention. Dual gerotor apparatus 250*g* includes a housing 12*g* and an integrated pair of gerotor apparatuses, including a first gerotor apparatus 10*g* proximate a first face 252*g* of apparatus 250*g* and a second gerotor apparatus 10*g*' proximate a second face 254*g* of apparatus 250*g* generally opposite first face 252*g*. First gerotor apparatus 10*g* and second gerotor apparatus 10*g*' may both be compressors, may both be expanders, or may include one expander and one compressor, depending on the particular embodiment or application. Each gerotor apparatus 10*g* and 10*g*' may be partially or substantially similar to those otherwise described herein, such as gerotor apparatus 10*e* shown in FIG. 7 and discussed above, for example.

Like gerotor apparatus 10*e* shown in FIG. 7, gerotor apparatus 10*g* includes an outer gerotor 14*g* disposed within housing 12*g*, an outer gerotor chamber 30*g* at least partially defined by outer gerotor 14*g*, and an inner gerotor 16*g* at least partially disposed within outer gerotor chamber 30*g*. Outer gerotor 14*g* and inner gerotor 16*g* are rotatably coupled to a single shaft 100*g* rigidly coupled to housing 12*g*. In particular, outer gerotor 14*g* is rotatably coupled to a first portion 102*g* of shaft 100*g* having a first axis about which outer gerotor 14*g* rotates, and inner gerotor 16*g* is rotatably coupled to a second portion 104*g* of shaft 100*g* having a second axis about which inner gerotor 16*g* rotates, the second axis being offset from the first axis.

Similarly, gerotor apparatus 10*g*' includes an outer gerotor 14*g*' disposed within housing 12*g*, an outer gerotor chamber 30*g*' at least partially defined by outer gerotor 14*g*', and an inner gerotor 16*g*' at least partially disposed within outer gerotor chamber 30*g*'. Outer gerotor 14*g*' may be rigidly coupled to, or integral with, outer gerotor 14*g* of gerotor apparatus 10*g*. In alternative embodiments, inner gerotor 16*g*' may be rigidly coupled to, or integral with, inner gerotor 16*g* of gerotor apparatus 10*g*. Outer gerotor 14*g*' and inner gerotor 16*g*' are rotatably coupled to shaft 100*g* rigidly coupled to housing 12*g*. In particular, outer gerotor 14*g*' is rotatably coupled to first portion 102*g* of shaft 100*g*, and inner gerotor 16*g*' is rotatably coupled to a third portion 105*g* of shaft 100*g* having a third axis about which inner gerotor 16*g*' rotates, the third axis being offset from the first axis. The third axis about which inner gerotor 16*g*' rotates may be co-axial with the second axis about which inner gerotor 16*g* rotates.

Housing 12*g* includes a first valve plate 40*g* proximate first face 252*g* of apparatus 250*g* and operable to control the flow of fluids through first gerotor apparatus 10*g*, and a second valve plate 40*g*' proximate second face 254*g* of apparatus 250*g* and operable to control the flow of fluids through second gerotor apparatus 10*g*'. First valve plate 40*g* includes at least one fluid inlet 42*g* allowing fluids to enter fluid flow passageways 32*g* of gerotor apparatus 10*g*, and at least one fluid outlet 44*g* allowing fluids to exit fluid flow passageways 32*g* of gerotor apparatus 10*g*. Similarly, second valve plate 40*g*' includes at least one fluid inlet 42*g*' allowing fluids to enter fluid flow passageways 32*g*' of gerotor apparatus 10*g*', and at least one fluid outlet 44*g*' allowing fluids to exit fluid flow passageways 32*g*' of gerotor apparatus 10*g*'. Having fluid inlets 42*g* and 42*g*' and fluid outlets 44*g* and 44*g*' at each face 252*g* and 254*g* of apparatus 250*g* doubles the porting area into and out of dual gerotor apparatus 250*g*, which may provide more efficient fluid flow and/or reduce or minimize porting losses as compared to an apparatus with a single gerotor apparatus 10.

In the embodiment shown in FIG. 12, each of gerotor apparatus 10*g* and 10*g*' is a self-synchronizing gerotor apparatus similar to gerotor apparatus 10*e* shown in FIG. 7 as discussed above. In other embodiments, gerotor apparatus 10*g* may include a synchronizing system 18*g*, such as shown in FIGS. 1-6, for example. In addition, in some embodiments, as shown in FIG. 12, a lubricant 60*g* may be communicated through appropriate lubricant channels to provide lubrication between inner gerotor 16*g* and outer gerotor 14*g*, such as described above with reference to FIG. 7.

As shown in FIG. 12, an imbedded motor 260*g* may drive dual gerotor apparatus 250*g* by driving rigidly coupled, or integrated, outer gerotors 14*g* and 14*g*', which may in turn drive inner gerotors 16*g* and 16*g*'. For example, motor 260*g* may drive one or more magnetic elements 262*g* coupled to, or integrated with, outer gerotors 14*g* and 14*g*'. Motor 260*g* may comprise any suitable type of motor, such as a permanent magnet motor, a switched reluctance motor (SRM), or an inductance motor, for example. In alternative embodiments, dual gerotor apparatus 250*g* may include an electric generator 264*g* (instead of a motor), which may be powered by the rotation of outer gerotors 14*g* and 14*g*'.

Figure 13:
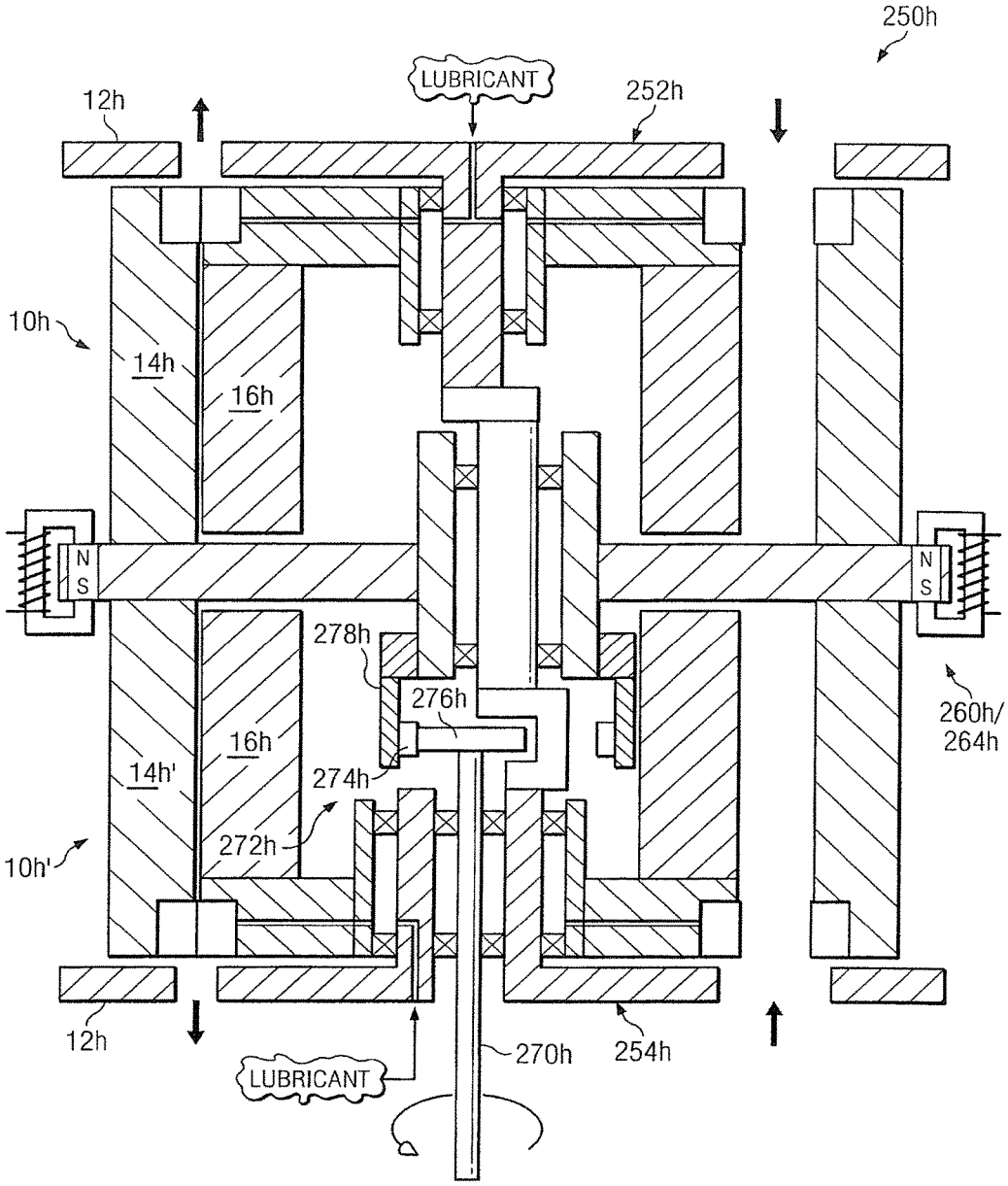
FIG. 13 illustrates an example cross-section of a dual gerotor apparatus having a motor (or generator) according to another embodiment of the invention.

FIG. 13 illustrates an example cross-section of a dual gerotor apparatus 250*h* having a motor 260*h* (or generator 264*h*) according to another embodiment of the invention. Like dual gerotor apparatus 250*g* shown in FIG. 12, dual gerotor apparatus 250*h* includes a housing 12*h* and an integrated pair of gerotor apparatuses, including a first gerotor apparatus 10*h* proximate a first face 252*h* of apparatus 250*h* and a second gerotor apparatus 10*h*' proximate a second face 254*h* of apparatus 250*h* generally opposite first face 252*h*. First gerotor apparatus 10*h* and second gerotor apparatus 10*h*' may both be compressors, may both be expanders, or may include one expander and one compressor, depending on the particular embodiment or application. Gerotor apparatuses 10*h* and 10*h*' may be partially or substantially similar to gerotor apparatuses 10*g* and 10*g*' shown in FIG. 12 and described above.

However, unlike dual gerotor apparatus 250*g* shown in FIG. 12, dual gerotor apparatus 250*h* includes a rotatable shaft 270*h* coupled to the rigidly coupled outer gerotors 14*h* and 14*h*' by a coupling system 272*h* such that rotation of rigidly coupled outer gerotors 14*h* and 14*h*' causes rotation of shaft 270*h* and/or vice-versa. In the embodiment shown in FIG. 13, coupling system 272*h* includes a first gear 274*h* interacting with a second gear 276*h*. First gear 274*h* is rigidly coupled to a cylindrical member 278*h* rigidly coupled to outer gerotors 14*h* and 14*h*'. Second gear 276*h* is rigidly coupled to rotatable shaft 270*h*. In other embodiments, coupling system 272*h* may include a flexible coupling device, such as a chain or belt.

Thus, embodiments in which dual gerotor apparatus 250*h* includes a motor 260*h* and gerotor apparatuses 10*h* and 10*h*' are compressors, motor 260*h* may not only power the compressors, but also power rotating shaft 270*h*, which power may be used for other purposes, such as to power auxiliary devices. For example, where dual gerotor apparatus 250*h* is used in a water-based air conditioner, rotating shaft 270*h* may be used to power one or more pumps.

Figure 14:
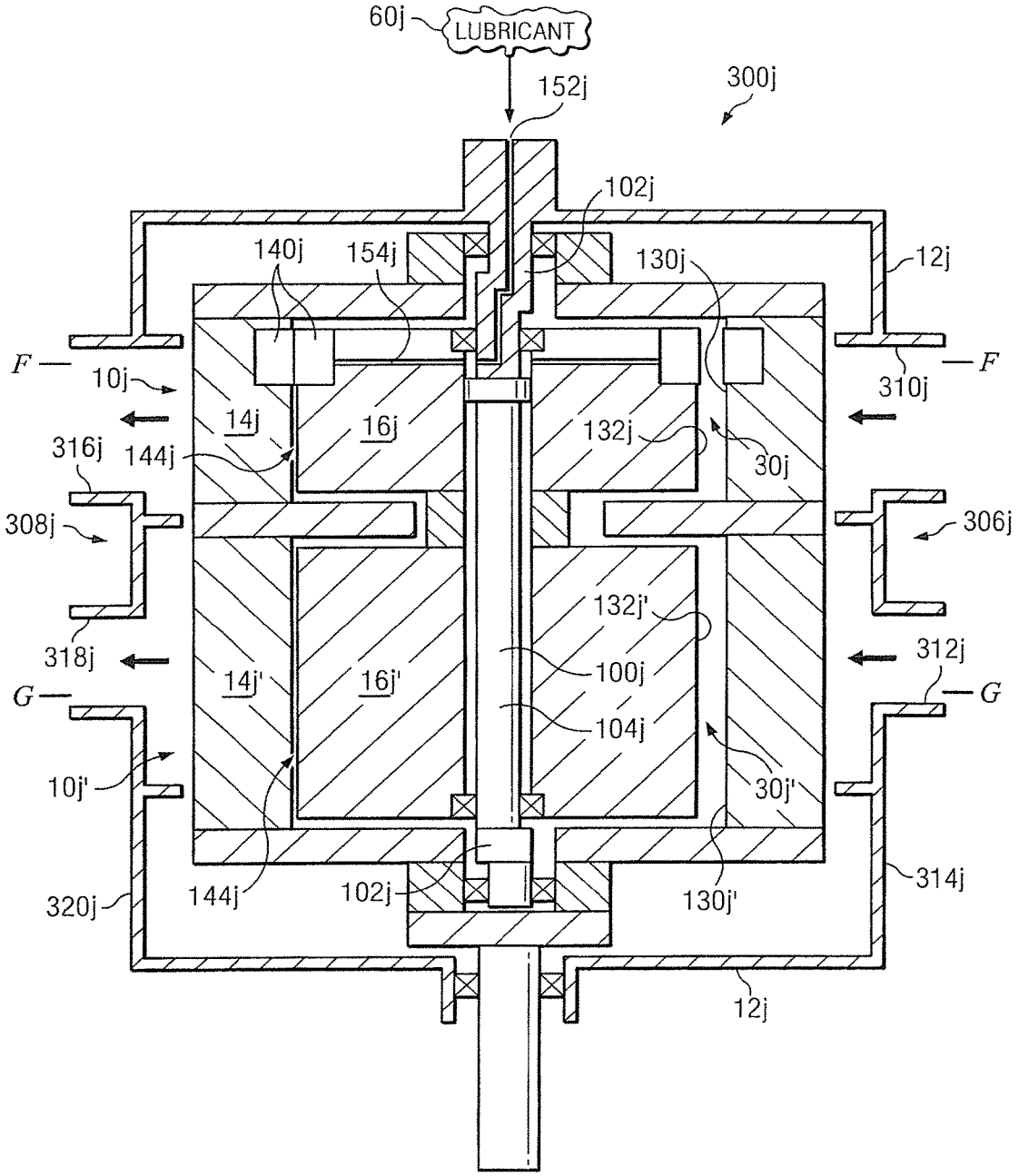
FIG. 14 illustrates an example cross-section of a side-breathing engine system **300*j*** in accordance with one embodiment of the invention.

FIG. 14 illustrates an example cross-section of a side-breathing engine system 300*j* in accordance with one embodiment of the invention. Side-breathing engine system 300*j* includes a housing 12*j*, a compressor gerotor apparatus 10*j*, and an expander gerotor apparatus 10*j*'. Compressor gerotor apparatus 10*j* includes a compressor outer gerotor 14*j* disposed within housing 12*j*, a compressor outer gerotor chamber 30*j* at least partially defined by compressor outer gerotor 14*j*, and a compressor inner gerotor 16*j* at least partially disposed within compressor outer gerotor chamber 30*j*. Similarly, expander gerotor apparatus 10*j*' includes an expander outer gerotor 14*j*' disposed within housing 12*j*, an expander outer gerotor chamber 30*j*' at least partially defined by expander outer gerotor 14*j*', and an expander inner gerotor 16*j*' at least partially disposed within expander outer gerotor chamber 30*j*'.

Compressor outer gerotor 14*j* may be rigidly coupled to, or integral with, expander outer gerotor 14*j*'. Similarly, compressor inner gerotor 16*j* may be rigidly coupled to, or integral with, expander inner gerotor 16*j*'. Compressor and expander outer gerotors 14*j* and 14*j*' and compressor and expander inner gerotors 16*j* and 16*j*' may be rotatably coupled to a single shaft 100*j* rigidly coupled to housing 12*j*. In the embodiment shown in FIG. 14, compressor and expander outer gerotors 14*j* and 14*j*' are rotatably coupled to first portions 102*j* of shaft 100*j* having a first axis about which outer gerotors 14*j* and 14*j*' rotate, and compressor and expander inner gerotors 16*j* and 16*j*' are rotatably coupled to a second portion 104*j* of shaft 100*j* having a second axis about which inner gerotors 16*j* and 16*j*' rotate, the second axis being offset from the first axis.

Compressor gerotor apparatus 10*j* and/or expander gerotor apparatus 10*j*' may be self-synchronizing, such as described above regarding the various gerotor apparatuses shown in FIGS. 7-13. In the embodiment shown in FIG. 14, compressor gerotor apparatus 10*j* performs the synchronization function for both compressor gerotor apparatus 10*j* and expander gerotor apparatus 10*j*'. In particular, at least a portion of (a) an outer surface 132*j* of compressor inner gerotor 16*j* and/or (b) an inner surface 130*j* of compressor outer gerotor 14*j* may include one or more low-friction regions 140*j* formed from low-friction materials 134*j* in order to reduce friction and wear between compressor inner gerotor 16*j* and compressor outer gerotor 14*j*, thus allowing outer surface 132*j* of compressor inner gerotor 16*j* and inner surface 130*j* of compressor outer gerotor 14*j* to synchronize the rotation of compressor inner gerotor 16*j* and compressor outer gerotor 14*j*. Further, because expander inner gerotor 16*j*' and expander outer gerotor 14*j*' are rigidly coupled to compressor inner gerotor 16*j* and compressor outer gerotor 14*j*, respectively, the rotation of expander inner gerotor 16*j*' and expander outer gerotor 14*j*' is also synchronized.

Low-friction regions 140*j* of compressor inner gerotor 16*j* and/or compressor outer gerotor 14*j* may extend a slight distance beyond the outer surface 132*j* of compressor inner gerotor 16*j* and/or inner surface 130*j* of compressor outer gerotor 14*j* to provide a narrow gap 144*j* between remaining, higher-friction regions 142*j* of compressor inner gerotor 16*j* and compressor outer gerotor 14*j* such that only the low-friction regions 140*j* contact each other. The narrow gap 144*j* may similarly exist between expander inner gerotor 16*j*' and expander outer gerotor 14*j*' (which may include only higher-friction regions 142*j*) such that expander inner gerotor 16*j*' and expander outer gerotor 14*j*' do not touch each other (or touch each other only slightly or occasionally), thus reducing or eliminating friction and wear between expander inner gerotor 16*j*' and expander outer gerotor 14*j*'. In addition, as shown in FIG. 14, a lubricant 60*j* may be communicated through lubricant channels 152*j* and 154*j* to provide lubrication between outer surface 132*j* of compressor inner gerotor 16*j* and inner surface 130*j* of compressor outer gerotor 14*j*.

In alternative embodiments, expander inner gerotor 16j' and expander outer gerotor 14j' may also include low-friction regions 140j to provide further synchronization or mechanical support. In general, none, portions, or all of each of compressor inner gerotor 16j, compressor outer gerotor 14j, expander inner gerotor 16j' and/or expander outer gerotor 14j' may include low-friction regions 140j. In addition, in some alternative embodiments, compressor gerotor apparatus 10j and/or expander gerotor apparatus 10j' may include a synchronizing system 18j, such as shown in FIGS. 1-6, for example.

Figure 15:
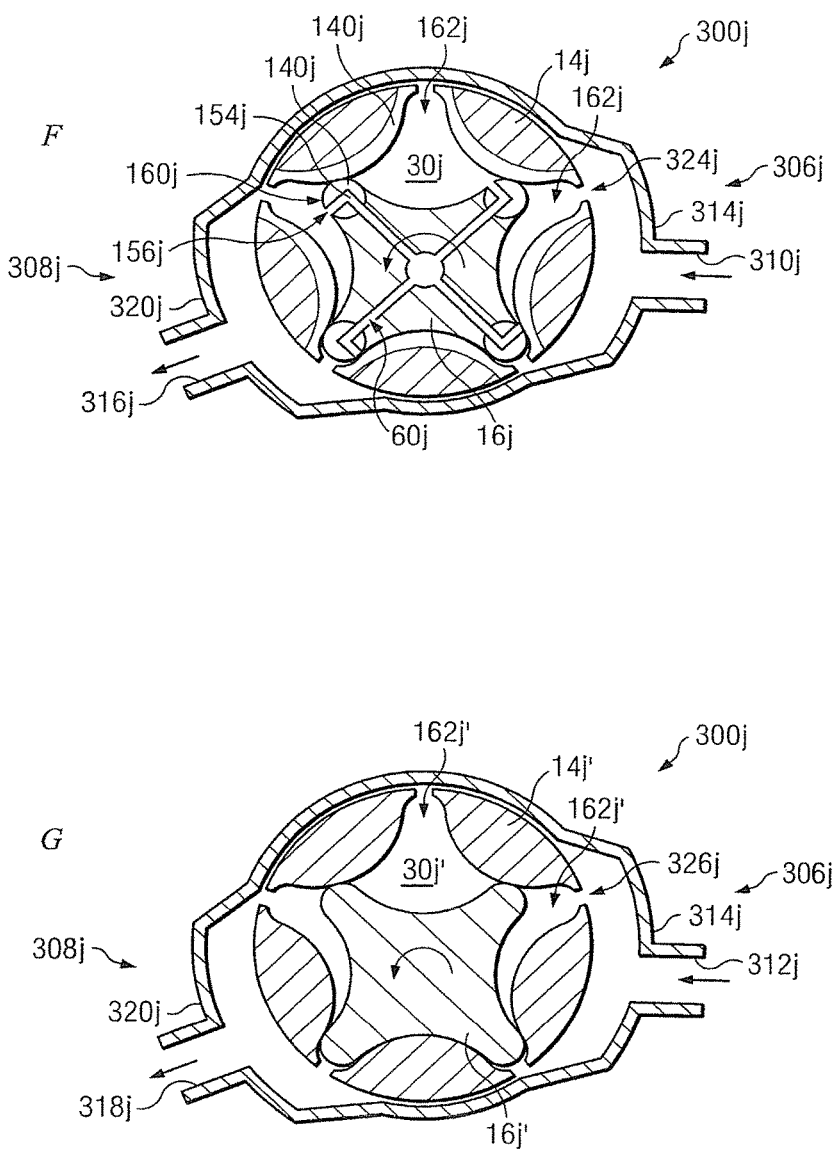
FIG. 15 illustrates example cross-sections of engine system taken along lines F and G, respectively, shown in FIG. 14 according to one embodiment of the invention.

As shown in FIGS. 14 and 15, fluid flows through the sides 306j and 308j (rather than the faces) of compressor gerotor apparatus 10j and expander gerotor apparatus 10j'. Thus, a first fluid inlet 310j and a second fluid inlet 312j are formed in a first side 314j of housing 12j, and a first fluid outlet 316j and a second fluid outlet 318j are formed in a second side 320j of housing 12j. One or more compressor gerotor openings 324j are formed in the outer perimeter of compressor outer gerotor 14j, and one or more expander gerotor openings 326j are formed in the outer perimeter of expander outer gerotor 14j'. First fluid inlet 310j is operable to communicate fluid into compressor outer gerotor chamber 30j through compressor gerotor openings 324j, and first fluid outlet 316j is operable to communicate the fluid out of compressor outer gerotor chamber 30j through compressor gerotor openings 324j. Similarly, second fluid inlet 312j is operable to communicate fluid into expander outer gerotor chamber 30j' through expander gerotor openings 324j', and second fluid outlet 318j is operable to communicate the fluid out of expander outer gerotor chamber 30j' through expander gerotor openings 326j.

FIG. 15 illustrates example cross-sections of engine system 300j taken along lines F and G, respectively, shown in FIG. 14 according to one embodiment of the invention. As shown in FIG. 15, section F, compressor gerotor openings 324j may be formed in the perimeter of compressor outer gerotor 14j at each tip 162j of compressor outer gerotor chamber 30j. Low-friction regions 140j are formed at each tip 160j of compressor inner gerotor 16j, and around the inner perimeter of compressor outer gerotor 14j defining inner surface 130j of compressor outer gerotor 14j. Lubricant channels 154j provide passageways for communicating lubricant 60j through lubricant channel openings 156j at each tip 160j such that lubricant 60j may provide lubrication between compressor inner gerotor 16j and compressor outer gerotor 14j. As shown in FIG. 15, section G, expander gerotor openings 326j may be formed in the perimeter of expander outer gerotor 14j' at each tip 162j' of expander outer gerotor chamber 30j'.

Figure 16:
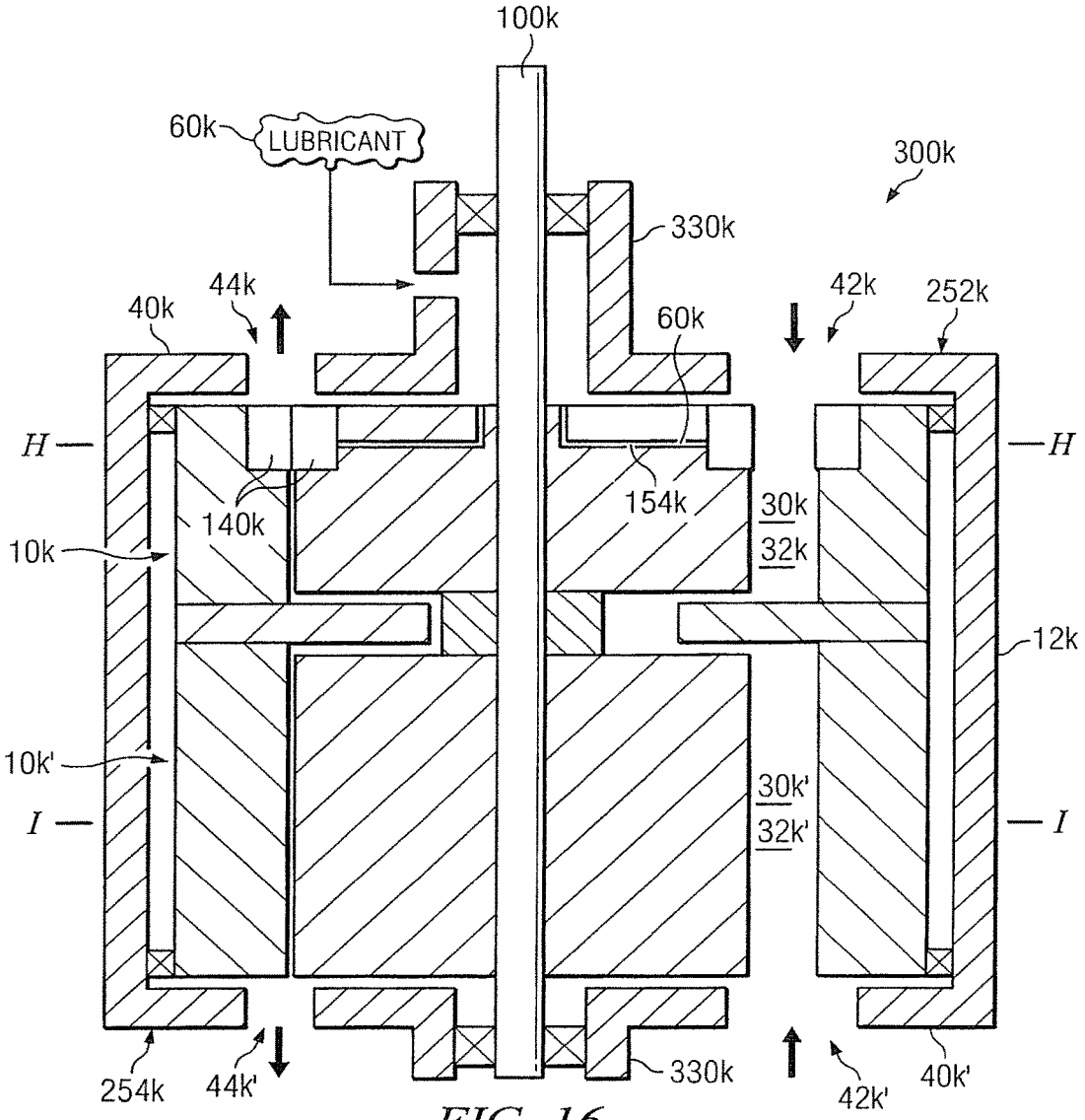
FIG. 16 illustrates an example cross-section of a face-breathing engine system in accordance with one embodiment of the invention.

FIG. 16 illustrates an example cross-section of a face-breathing engine system 300k in accordance with one embodiment of the invention. Engine system 300k includes a housing 12k, a compressor gerotor apparatus 10k and an expander gerotor apparatus 10k'. Compressor gerotor apparatus 10k includes a compressor outer gerotor 14k disposed within housing 12k, a compressor outer gerotor chamber 30k at least partially defined by compressor outer gerotor 14k, and a compressor inner gerotor 16k at least partially disposed within compressor outer gerotor chamber 30k. Similarly, expander gerotor apparatus 10k' includes an expander outer gerotor 14k' disposed within housing 12k, an expander outer gerotor chamber 30k' at least partially defined by expander outer gerotor 14k', and an expander inner gerotor 16k' at least partially disposed within expander outer gerotor chamber 30k'.

Compressor outer gerotor 14k may be rigidly coupled to, or integral with, expander outer gerotor 14k'. Similarly, compressor inner gerotor 16k may be rigidly coupled to, or integral with, expander inner gerotor 16k'. Compressor and expander inner gerotors 16k and 16k' may be rigidly coupled to a shaft 100k that is rotatably coupled to the inside of a cylindrical portion 330k of housing 12k by one or more bearings. Compressor and expander outer gerotors 14k and 14k' may be rotatably coupled to an inner perimeter of housing 12k by one or more bearings.

Unlike side-breathing engine system 300j shown in FIGS. 14-15, face-breathing engine system 300k shown in FIG. 16 breathes through a first face 252k and second face 254k of system 300k. Housing 12k includes a compressor valve plate 40k proximate first face 252k of system 300k and operable to control the flow of fluids through compressor gerotor apparatus 10k, and an expander valve plate 40k' proximate second face 254k of system 300k and operable to control the flow of fluids through expander gerotor apparatus 10k'. Compressor valve plate 40k includes at least one compressor fluid inlet 42k allowing fluids to enter fluid flow passageways 32k of compressor gerotor apparatus 10k, and at least one compressor fluid outlet 44k allowing fluids to exit fluid flow passageways 32k of compressor gerotor apparatus 10k. Similarly, expander valve plate 40k' includes at least one expander fluid inlet 42k' allowing fluids to enter fluid flow passageways 32k' of expander gerotor apparatus 10k', and at least one expander fluid outlet 44k' allowing fluids to exit fluid flow passageways 32k' of expander gerotor apparatus 10k'.

Compressor gerotor apparatus 10k and/or expander gerotor apparatus 10k' of engine system 300k shown in FIG. 16 may be self-synchronizing, such as described above regarding the various gerotor apparatuses shown in FIGS. 7-13. Instead or in addition, compressor gerotor apparatus 10k and/or expander gerotor apparatus 10k' may include a synchronizing system 18, such as discussed above regarding FIGS. 1-6, for example. As discussed above regarding engine system 300j, compressor gerotor apparatus 10k of engine system 300k may include one or more low-friction regions 140k operable to perform the synchronization function for both compressor gerotor apparatus 10k and expander gerotor apparatus 10k'. In addition, as shown in FIG. 16, a lubricant 60k may be communicated through lubricant channels 154k to provide lubrication between compressor inner gerotor 16k and compressor outer gerotor 14k.

Figure 17A:
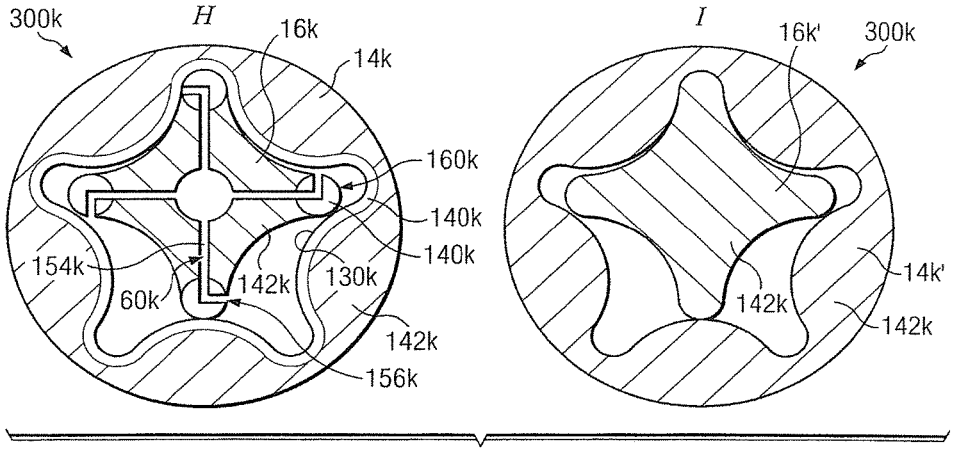
FIGS. 17 A-17D illustrate example cross-sections of an engine system taken along lines H and I, respectively, shown in FIG. 16, according to various embodiments of the invention.

FIGS. 17A-17D illustrate example cross-sections of engine system 300k taken along lines H and I, respectively, shown in FIG. 16, according to various embodiments of the invention. As shown in FIG. 17A, section H, low-friction regions 140k are formed at each tip 160k of compressor inner gerotor 16k, and around the inner perimeter of compressor outer gerotor 14k defining inner surface 130k of compressor outer gerotor 14k. Remaining portions of compressor inner gerotor 16k and compressor outer gerotor 14k may include higher-friction regions 142k. Lubricant channels 154k provide passageways for communicating lubricant 60k through lubricant channel openings 156k at each tip 160k of compressor inner gerotor 16k such that lubricant 60k may provide lubrication between compressor inner gerotor 16k and compressor outer gerotor 14k. As shown in FIG. 17A, section I, all of expander inner gerotor 16k' and expander outer gerotor 14k' may be a higher-friction region 142k.

Figure 17B:
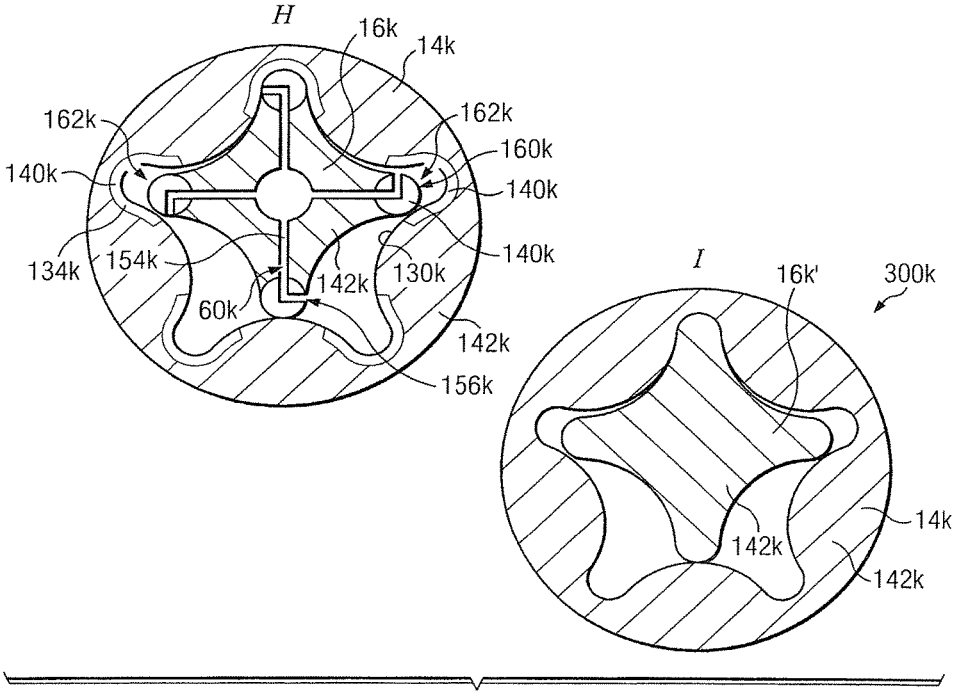

As shown in FIG. 17B, section H, low-friction regions 140k are formed at each tip 160k of compressor inner gerotor 16k. Lubricant channels 154k provide passageways for communicating lubricant 60*k* through lubricant channel openings 156*k* at each tip 160*k* of compressor inner gerotor 16*k*, such that lubricant 60*k* may provide lubrication between compressor inner gerotor 16*k* and compressor outer gerotor 14*k*. Compressor outer gerotor 14*k* includes a low-friction region 140*k* proximate each tip 162*k* of inner surface 130*k* of compressor outer gerotor 14*k*. Because a large portion of friction and wear between compressor inner gerotor 16*k* and compressor outer gerotor 14*k* occurs at the tips 160*k* and 162*k* of compressor inner gerotor 16*k* and compressor outer gerotor 14*k*, respectively, limiting low-friction regions 140*k* to areas near such tips 160*k* and 162*k* may reduce costs associated where low-friction materials 134*k* are relatively expensive and/or provide additional structural integrity where low-friction regions 140*k* are less durable than higher-friction regions 142*k*. As shown in FIG. 17B, section I, all of expander inner gerotor 16*k*' and expander outer gerotor 14*k*' may be a higher-friction region 142*k*.

Figure 17C:
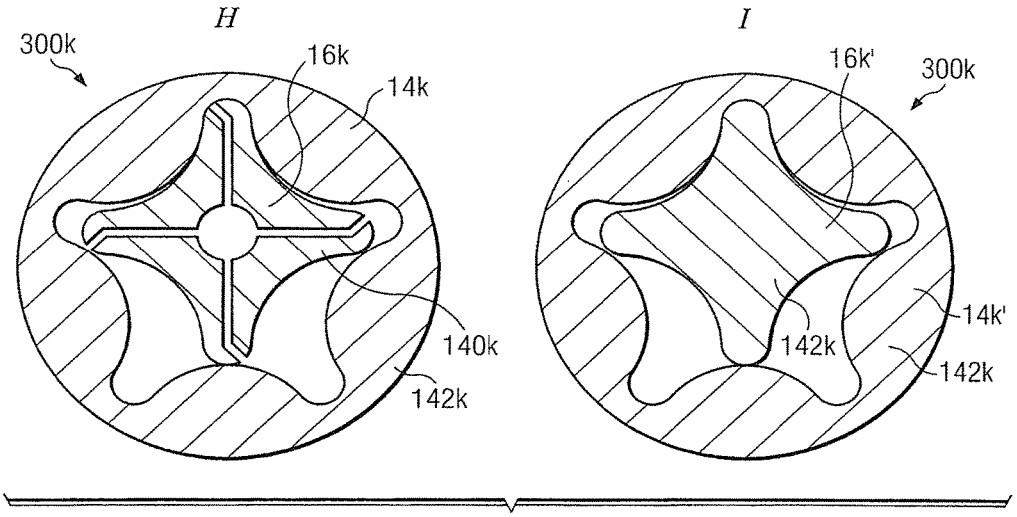

As shown in FIG. 17C, section H, the complete cross-section of compressor inner gerotor 16*k* is a low-friction region 140*k*, while the complete cross-section of compressor outer gerotor 14*k* is a higher-friction region 142*k*. As shown in FIG. 17C, section I, all of expander inner gerotor 16*k*' and expander outer gerotor 14*k*' may be a higher-friction region 142*k*.

Figure 17D:
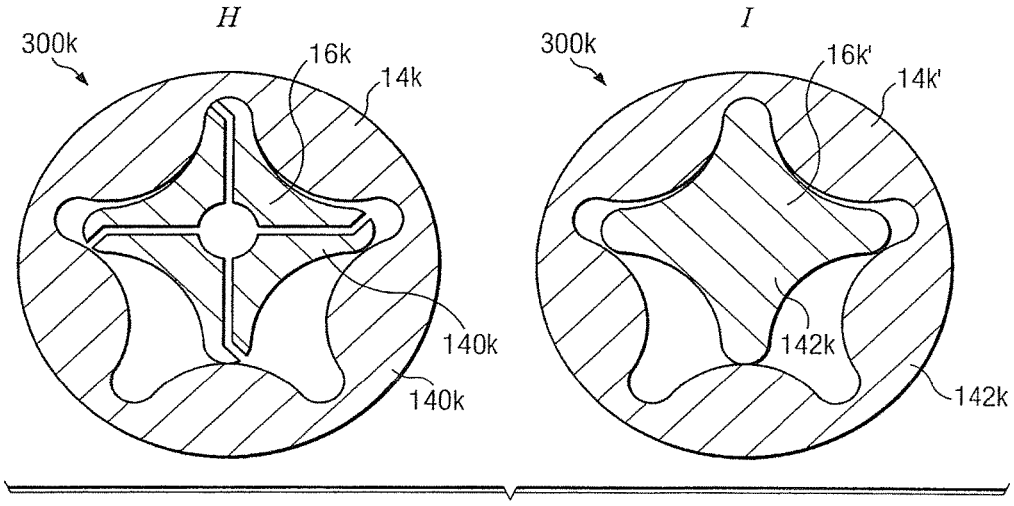

As shown in FIG. 17D, section H, the complete cross-section of both compressor inner gerotor 16*k* and compressor outer gerotor 14*k* is a low-friction region 140*k*. As shown in FIG. 17D, section I, all of expander inner gerotor 16*k*' and expander outer gerotor 14*k*' may be a higher-friction region 142*k*.

Figure 18:
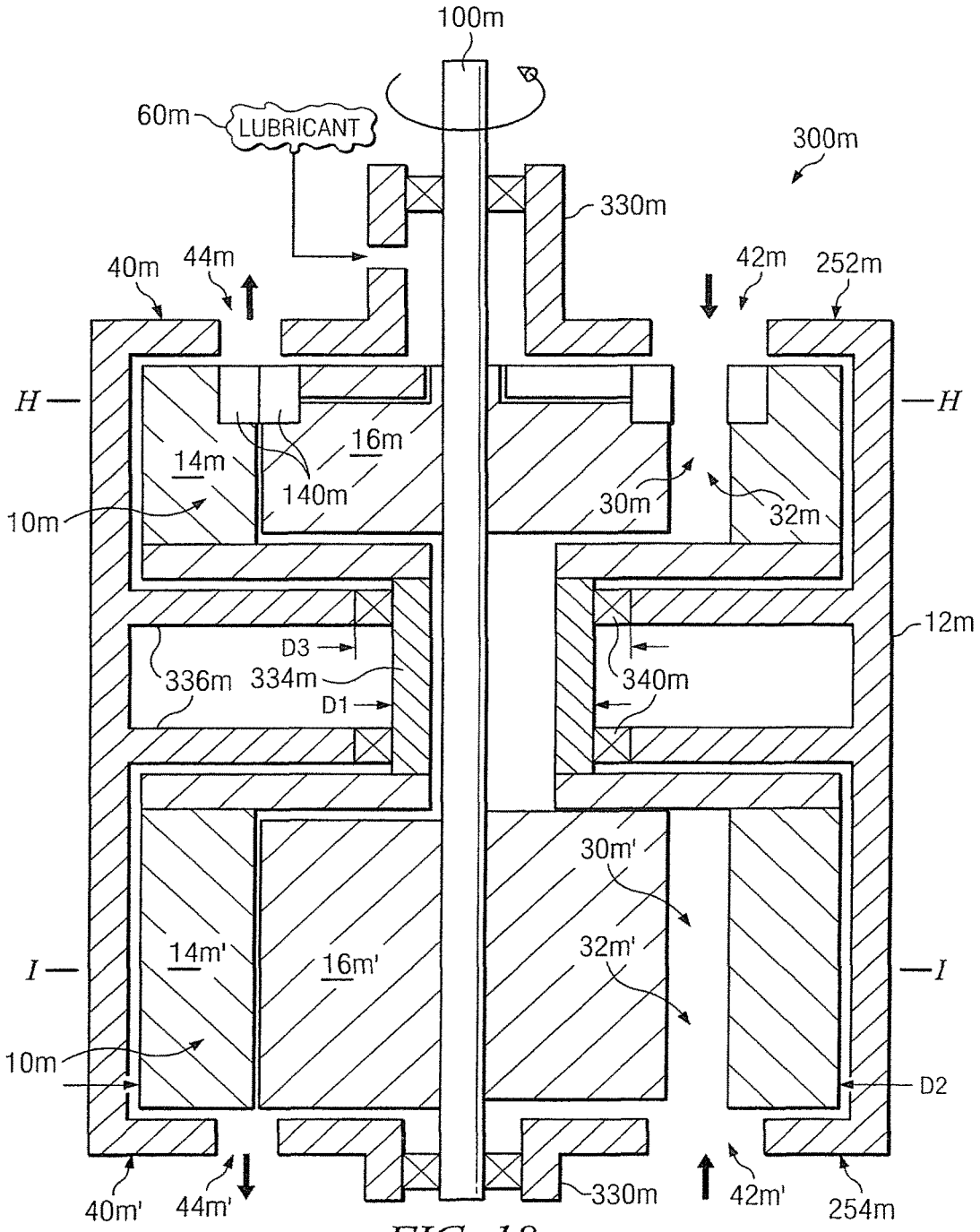
FIG. 18 illustrates an example cross-section of a face-breathing engine system in accordance with another embodiment of the invention.

FIG. 18 illustrates an example cross-section of a face-breathing engine system 300*m* in accordance with another embodiment of the invention. Like engine system 300*k* shown in FIG. 16, engine system 300*m* includes a housing 12*m*, a compressor gerotor apparatus 10*m* and an expander gerotor apparatus 10*m*'. Compressor gerotor apparatus 10*m* includes a compressor outer gerotor 14*m* disposed within housing 12*m*, a compressor outer gerotor chamber 30*m* at least partially defined by compressor outer gerotor 14*m*, and a compressor inner gerotor 16*m* at least partially disposed within compressor outer gerotor chamber 30*m*. Similarly, expander gerotor apparatus 10*m*' includes an expander outer gerotor 14*m*' disposed within housing 12*m*, an expander outer gerotor chamber 30*m*' at least partially defined by expander outer gerotor 14*m*', and an expander inner gerotor 16*m*' at least partially disposed within expander outer gerotor chamber 30*m*'.

In this embodiment, compressor inner gerotor 16*m* is rigidly coupled to, or integral with, expander inner gerotor 16*m*'. In particular, compressor and expander inner gerotors 16*m* and 16*m*' are rigidly coupled to a shaft 100*m* that is rotatably coupled to the inside of a cylindrical portion 330*m* of housing 12*m* by one or more bearings. In addition, compressor outer gerotor 14*m* is rigidly coupled to, or integral with, expander outer gerotor 14*m*'. In particular, compressor and expander outer gerotors 14*m* and 14*m*' are rigidly coupled to, or integral with, a cylindrical outer gerotor support member 334*m* having an outer diameter, indicated as D1, that is smaller than the outer diameter of the compressor and expander outer gerotors 14*m* and 14*m*', indicated as D2. In some embodiments, D1 is less than ½ of D2. In particular embodiments, D1 is less than ⅓ of D2. Outer gerotor support member 334*m* is rotatably coupled to one or more extension members 336*m* of housing 12*m* by one or more ring-shaped bearings 340*m*. As shown in FIG. 18, ring-shaped bearings 340*m* have an outer diameter, indicated as D3, that is smaller than the outer diameter, D2, of outer gerotors 14*m* and 14*m*'. In some embodiments, D3 is less than ½ of D2. Using bearings 340*m* having smaller diameters than that of outer gerotors 14*m* and 14*m*' reduces the amount of power lost by bearings 340*m* during operation of system 300*m*, and thus the amount of heat generated by bearings 340*m*. The smaller the diameter of bearings 340*m*, the less power lost and heat generated by bearings 340*m*.

Like face-breathing engine system 300*k* shown in FIG. 16, face-breathing engine system 300*m* shown in FIG. 18 breathes through a first face 252*m* and second face 254*m* of system 300*m*. Housing 12*m* includes a compressor valve plate 40*m* proximate first face 252*m* of system 300*m* operable to control the flow of fluids through compressor gerotor apparatus 10*m*, and an expander valve plate 40*m*' proximate second face 254*m* of system 300*m* operable to control the flow of fluids through expander gerotor apparatus 10*m*'. Compressor valve plate 40*m* includes at least one compressor fluid inlet 42*m* allowing fluids to enter fluid flow passageways 32*m* of compressor gerotor apparatus 10*m*, and at least one compressor fluid outlet 44*m* allowing fluids to exit fluid flow passageways 32*m* of gerotor apparatus 10*m*. Similarly, expander valve plate 40*m*' includes at least one expander fluid inlet 42*m*' allowing fluids to enter fluid flow passageways 32*m*' of expander gerotor apparatus 10*m*', and at least one expander fluid outlet 44*m*' allowing fluids to exit fluid flow passageways 32*m*' of expander gerotor apparatus 10*m*'.

Compressor gerotor apparatus 10*m* and/or expander gerotor apparatus 10*m*' of engine system 300*m* shown in FIG. 18 may be self-synchronizing, such as described above regarding the various gerotor apparatuses shown in FIGS. 7-16. Instead or in addition, compressor gerotor apparatus 10*m* and/or expander gerotor apparatus 10*m*' may include a synchronizing system 18, such as discussed above regarding FIGS. 1-6, for example. As discussed above regarding engine system 300*j*, compressor gerotor apparatus 10*m* of engine system 300*m* may include one or more low-friction regions 140*m* operable to perform the synchronization function for both compressor gerotor apparatus 10*m* and expander gerotor apparatus 10*m*'. In addition, as shown in FIG. 16, a lubricant 60*m* may be communicated through lubricant channels to provide lubrication between compressor inner gerotor 16*m* and compressor outer gerotor 14*m*.

In operation, torque generated by system 300*m* is transmitted from outer gerotors 14*m* and 14*m*' to inner gerotors 16*m* and 16*m*', and then to the rotating output shaft 100*m*, which shaft power may be used to power any suitable device or devices. As with various other engine systems 300 shown and described herein, in some embodiments, the same mechanical arrangement of engine system 300*m* could be used in a reverse-Brayton cycle heat pump in which power is input to shaft 100*m*.

Figure 19:
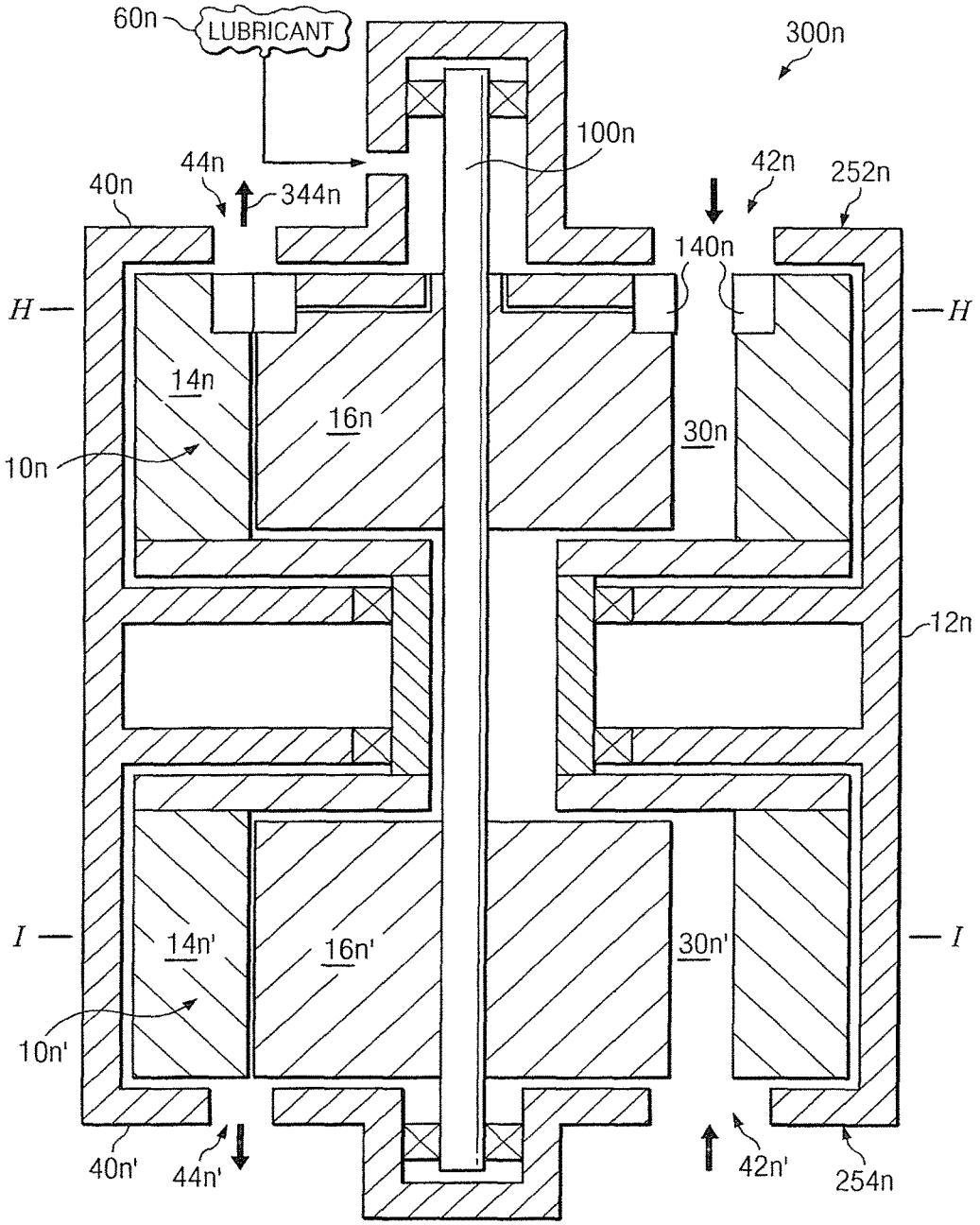
FIG. 19 illustrates an example cross-section of a face-breathing engine system in accordance with another embodiment of the invention.

FIG. 19 illustrates an example cross-section of a face-breathing engine system 300*n* in accordance with another embodiment of the invention. Like engine system 300*m* shown in FIG. 18, engine system 300*n* includes a housing 12*n*, a compressor gerotor apparatus 10*n* and an expander gerotor apparatus 10*n*'. Compressor gerotor apparatus 10*n* includes a compressor outer gerotor 14*n* disposed within housing 12*n*, a compressor outer gerotor chamber 30*n* at least partially defined by compressor outer gerotor 14*n*, and a compressor inner gerotor 16*n* at least partially disposed within compressor outer gerotor chamber 30*n*. Similarly, expander gerotor apparatus 10*n*' includes an expander outer gerotor 14*n*' disposed within housing 12*n*, an expander outer gerotor chamber 30*n*' at least partially defined by expander outer gerotor 14*n*', and an expander inner gerotor 16*n*' at least partially disposed within expander outer gerotor chamber 30*n*'.

Like engine system 300*m* shown in FIG. 18, compressor and expander inner gerotors 16*n* and 16*n*' are rigidly coupled to a shaft 100*n* that is rotatably coupled to housing 12*n* by one or more bearings, and compressor and expander outer gerotors 14*n* and 14*n*' are rigidly coupled to, or integral with, a cylindrical outer gerotor support member 334*n* that is rotatably coupled to housing 12*n* by one or more ring-shaped bearings 340*n*.

Like face-breathing engine system 300*m* shown in FIG. 18, face-breathing engine system 300*n* shown in FIG. 19 breathes through at least one compressor fluid inlet 42*n* and at least one compressor fluid outlet 44*n* at a first face 252*n* of system 300*n*, and through at least one expander fluid inlet 42*n*' and at least one expander fluid outlet 44*n*' at a second face 254*n* of system 300*n*. Compressor gerotor apparatus 10*n* and/or expander gerotor apparatus 10*n*' of engine system 300*n* shown in FIG. 19 may be self-synchronizing, such as described above regarding the various gerotor apparatuses shown in FIGS. 7-18. Instead or in addition, compressor gerotor apparatus 10*n* and/or expander gerotor apparatus 10*n*' may include a synchronizing system 18, such as discussed above regarding FIGS. 1-6, for example. In addition, as shown in FIG. 19, a lubricant 60*n* may be communicated through lubricant channels to provide lubrication between compressor inner gerotor 16*n* and compressor outer gerotor 14*n*.

Unlike engine system 300*m* shown in FIG. 18, engine system 300*n* does not provide shaft output power (to shaft 100*m* or otherwise). Instead, compressor gerotor apparatus 10*n* of engine system 300*n* is oversized such that power generated by system 300*n* is output in the form of compressed fluid (such as compressed air, for example) exiting compressor outer gerotor chamber 30*n* through compressor fluid outlet 44*n*, as indicated by arrow 344*n*. Thus, this embodiment may be useful for applications in which compressed air or other gas is the desired product, such as a fuel-powered compressor or jet engine, for example. In some embodiments, a similar mechanical arrangement of engine system 300*n* could be used in a reverse-Brayton cycle heat pump in which power is input to shaft 100*n*.

Figure 20:
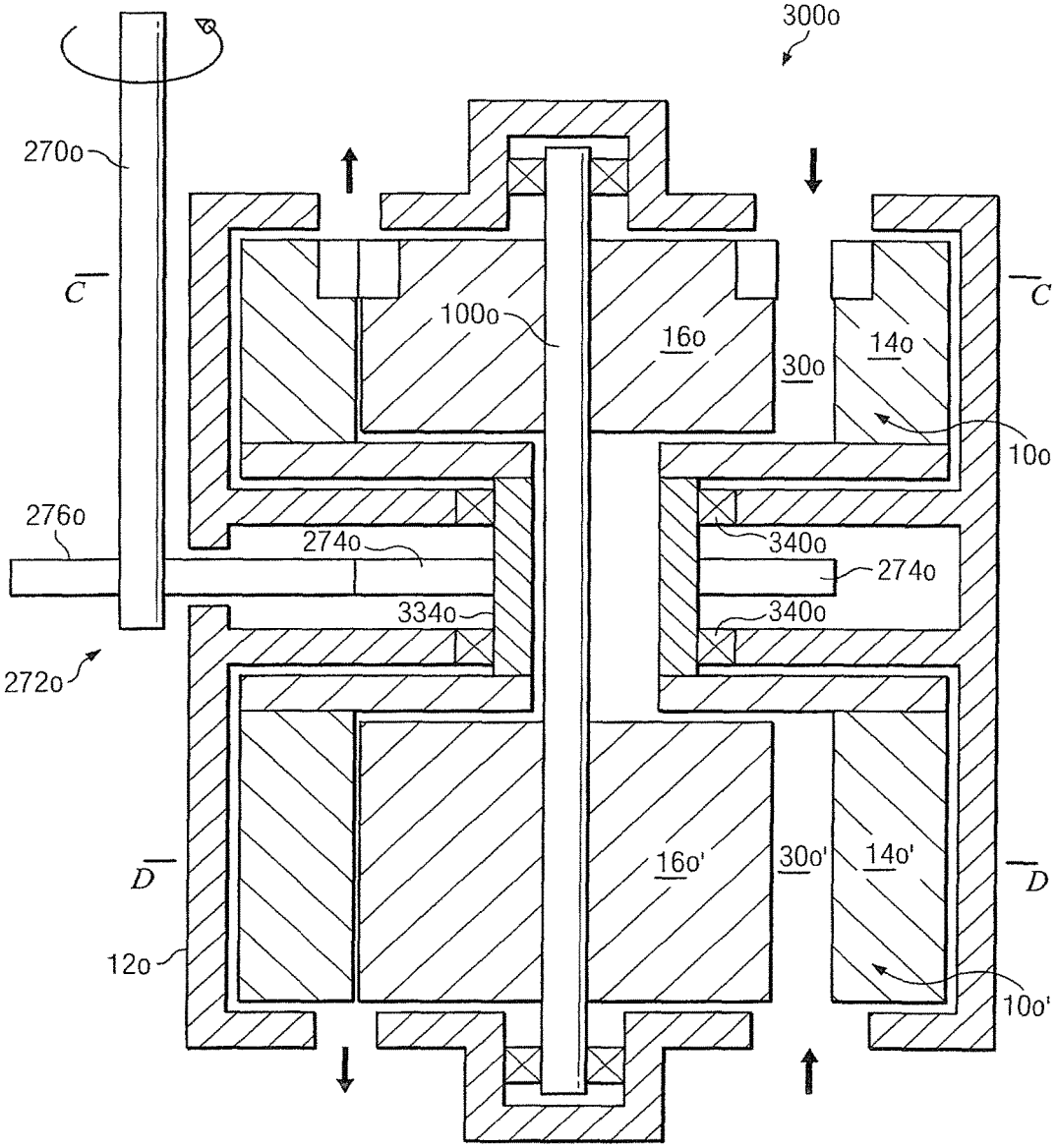
FIGS. 20-22 illustrates example cross-sections of face-breathing engine systems in accordance with three other embodiments of the invention.
Figure 21:
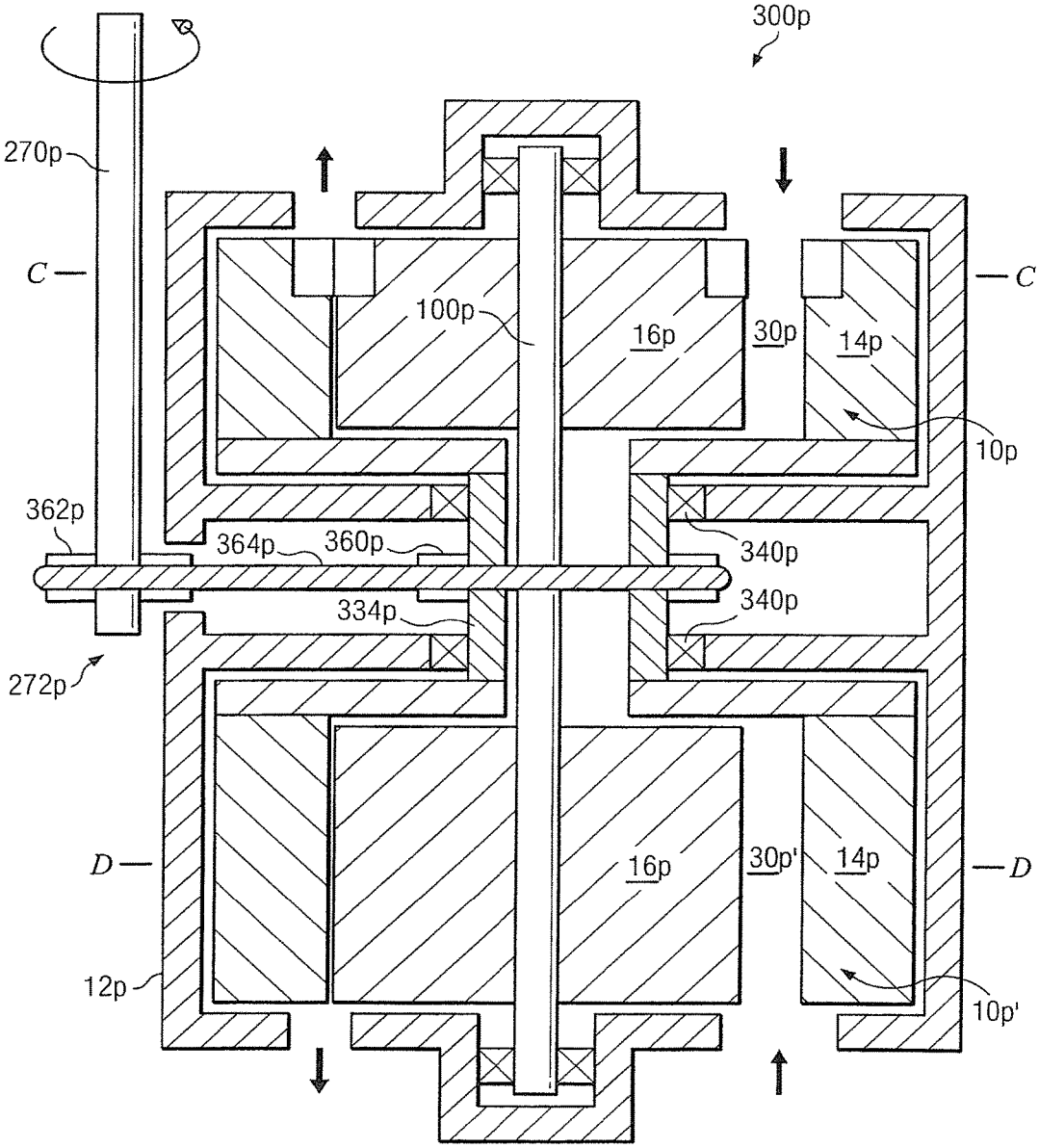
Figure 22:
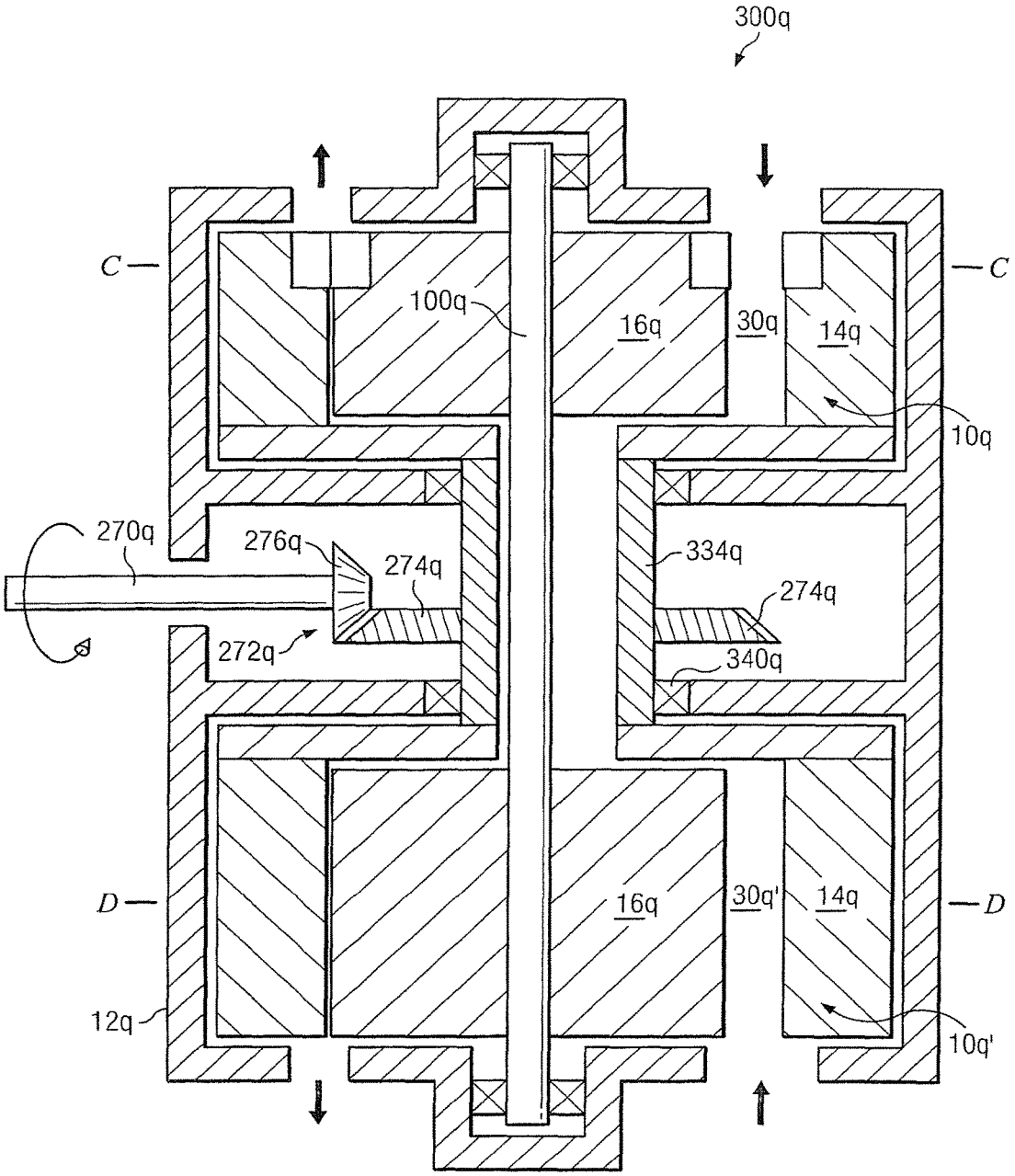

FIGS. 20-22 illustrates example cross-sections of face-breathing engine systems 300*o*, 300*p*, and 300*q* in accordance with three other embodiments of the invention. Engine systems 300*o*/300*p*/300*q* are similar to engine system 300*m* shown in FIG. 18, except that power is transmitted to an external shaft 270 rather than to internal shaft 100, as discussed in greater detail below.

Like engine system 300 shown in FIG. 18, each of engine systems 300*o*/300*p*/300*q* shown in FIGS. 20-22 include a housing 12*o*/12*p*/12*q*, a compressor gerotor apparatus 10*o*/10*p*/10*q* and an expander gerotor apparatus 10*o*/10*p*'/10*q*'. Compressor gerotor apparatus 10*o*/10*p*/10*q* includes a compressor outer gerotor 14*o*/14*p*/14*q* disposed within housing 12*o*/12*p*/12*q*, a compressor outer gerotor chamber 30*o*/30*p*/30*q* at least partially defined by compressor outer gerotor 14*o*/14*p*/14*q*, and a compressor inner gerotor 16*o*/16*p*/16*q* at least partially disposed within compressor outer gerotor chamber 30*o*/30*p*/30*q*. Similarly, expander gerotor apparatus 10*o*'/10*p*'/10*q*' includes an expander outer gerotor 14*o*'/14*p*'/14*q*' disposed within housing 12*o*/12*p*/12*q*, an expander outer gerotor chamber 30*o*'/30*p*'/30*q*' at least partially defined by expander outer gerotor 14*o*'/14*p*'/14*q*', and an expander inner gerotor 16*o*'/16*p*'/16*q*' at least partially disposed within expander outer gerotor chamber 30*o*'/30*p*'/30*q*'. Compressor and expander inner gerotors 16*o*/16*p*/16*q* and 16*o*'/16*p*'/16*q*' are rigidly coupled to a shaft 100*o*/100*p*/100*q* that is rotatably coupled to housing 12*o*/12*p*/12*q* by one or more bearings, and compressor and expander outer gerotors 14*o*/14*p*/14*q* and 14*o*'/14*p*'/14*q*' are rigidly coupled to, or integral with, a cylindrical outer gerotor support member 334*o*/334*p*/334*q* that is rotatably coupled to housing 12*o*/12*p*/12*q* by one or more ring-shaped bearings 340*o*/340*p*/340*q*.

As discussed above, unlike engine system 300*m* shown in FIG. 18, engine systems 300*o*/300*p*/300*q* shown in FIGS. 20-22 output power to an external drive shaft 270*o*/270*p*/270*q* rather than to internal shaft 100*o*/100*p*/100*q*. In general, each engine system 300*o*/300*p*/300*q* includes a rotatable shaft 270*o*/270*p*/270*q* coupled to the rigidly coupled outer gerotors 14*o*/14*p*/14*q* and 14*o*'/14*p*'/14*q*' by a coupling system 272*o*/272*p*/272*q* such that rotation of outer gerotors 14*o*/14*p*/14*q* and 14*o*'/14*p*'/14*q*' causes rotation of shaft 270*o*/270*p*/270*q* and/or vice-versa, as described below.

First, in the embodiment shown in FIG. 20, coupling system 272*o* includes a first gear 274*o* interacting with a second gear 276*o*. First gear 274*o* is rigidly coupled to cylindrical outer gerotor support member 334*o* rigidly coupled to outer gerotors 14*o* and 14*o*'. Second gear 276*o* is rigidly coupled to rotatable drive shaft 270*o*.

Thus, power generated by engine system 300*o* is withdrawn from first gear 274*o* mounted to outer gerotors 14*o* and 14*o*' and transferred to drive shaft 270*o*. One advantage of this embodiment is that torque is transmitted directly from outer gerotors 14*o* and 14*o*' to drive shaft 270*o* without involving inner gerotors 16*o* or 16*o*', thereby reducing friction and wear at the low-friction regions 140*o* of compressor outer gerotor 14*o* and/or inner gerotor 16*o*, such as low-friction regions 140*o* at each tip 160*o* of compressor inner gerotor 16*o* and proximate the inner perimeter of compressor outer gerotor 14*o*. At a steady rotational speed, there is negligible torque transmitted through the low-friction regions 140*o* at tips 160*o* of compressor inner gerotor 16*o* and proximate the inner perimeter of compressor outer gerotor 14*o* because there is little net torque acting on inner gerotors 16*o* or 16*o*'. The pressure forces acting on inner gerotors 16*o* or 16*o*' that would cause inner gerotors 16*o* and 16*o*' to rotate clockwise are substantially counterbalanced by the pressure forces acting to rotate inner gerotors 16*o* and 16*o*' counterclockwise. In essence, inner gerotors 16*o* and 16*o*' act as an idler.

It should be noted that lubrication channels are omitted to simplify FIG. 20. In practice, lubricant could be supplied to the low-friction regions 140*o*, such as described herein regarding other embodiments. In addition, as with various other engine systems 300 shown and described herein, in some embodiments, the same mechanical arrangement of engine system 300*o* could be used in a reverse-Brayton cycle heat pump in which power is input to shaft 270*o*.

Second, in the embodiment shown in FIG. 21, coupling system 272*p* includes a first coupler 360*p* interacting with a second coupler 362*p*. First coupler 360*p* is rigidly coupled to cylindrical outer gerotor support member 334*p* rigidly coupled to outer gerotors 14*p* and 14*p*'. Second coupler 362*p* is rigidly coupled to rotatable drive shaft 270*p*. A flexible coupling device 364*p*, such as a chain or belt, couples first coupler 360*p* and second coupler 362*p* such that rotation of outer gerotor support member 334*p* causes rotation of drive shaft 270*p*, and vice versa.

Thus, power generated by engine system 300*p* is withdrawn from first coupler 360*p* mounted to outer gerotors 14*p* and 14*p*' and transferred to drive shaft 270*p*. As discussed above, one advantage of such embodiment is that torque is transmitted directly from outer gerotors 14*p* and 14*p*' to drive shaft 270*p* without involving inner gerotors 16*p* or 16*p*', thereby reducing friction and wear at the low-friction regions 140*p* of compressor outer gerotor 14*p* and/or inner gerotor 16*p*. Also, at a steady rotational speed, there is negligible torque transmitted through the low-friction regions 140*p* at tips 160*p*, as inner gerotors 16*p* and 16*p*' essentially act as an idler.

Again, it should be noted that lubrication channels are omitted to simplify FIG. 21. In practice, lubricant could be supplied to the low-friction regions 140*p*, such as described herein regarding other embodiments. In addition, as with various other engine systems 300 shown and described herein, in some embodiments, the same mechanical arrangement of engine system 300*p* could be used in a reverse-Brayton cycle heat pump in which power is input to shaft 270*p*.

Third, in the embodiment shown in FIG. 22, coupling system 272*q* includes a first gear 274*q* interacting with a second gear 276*q*. First gear 274*q* is a bevel gear rigidly coupled to cylindrical outer gerotor support member 334*q* rigidly coupled to outer gerotors 14*q* and 14*q*'. Second gear 276*q* is a bevel gear rigidly coupled to rotatable drive shaft 270*q*, which is oriented generally perpendicular to shaft 100*q*. Thus, power generated by engine system 300*q* is withdrawn from first bevel gear 274*q* mounted to outer gerotors 14*q* and 14*q*' and transferred to drive shaft 270*o*. As discussed above, one advantage of such embodiment is that torque is transmitted directly from outer gerotors 14*q* and 14*q*' to drive shaft 270*q* without involving inner gerotors 16*q* or 16*q*', thereby reducing friction and wear at the low-friction regions 140*q* of compressor outer gerotor 14*q* and/or inner gerotor 16*q*. Also, at a steady rotational speed, there is negligible torque transmitted through the low-friction regions 140*q* at tips 160*q*, as inner gerotors 16*q* and 16*q*' essentially act as an idler.

Again, it should be noted that lubrication channels are omitted to simplify FIG. 22. In practice, lubricant could be supplied to the low-friction regions 140*q*, such as described herein regarding other embodiments. In addition, as with various other engine systems 300 shown and described herein, in some embodiments, the same mechanical arrangement of engine system 300*q* could be used in a reverse-Brayton cycle heat pump in which power is input to shaft 270*q*.

Figure 23:
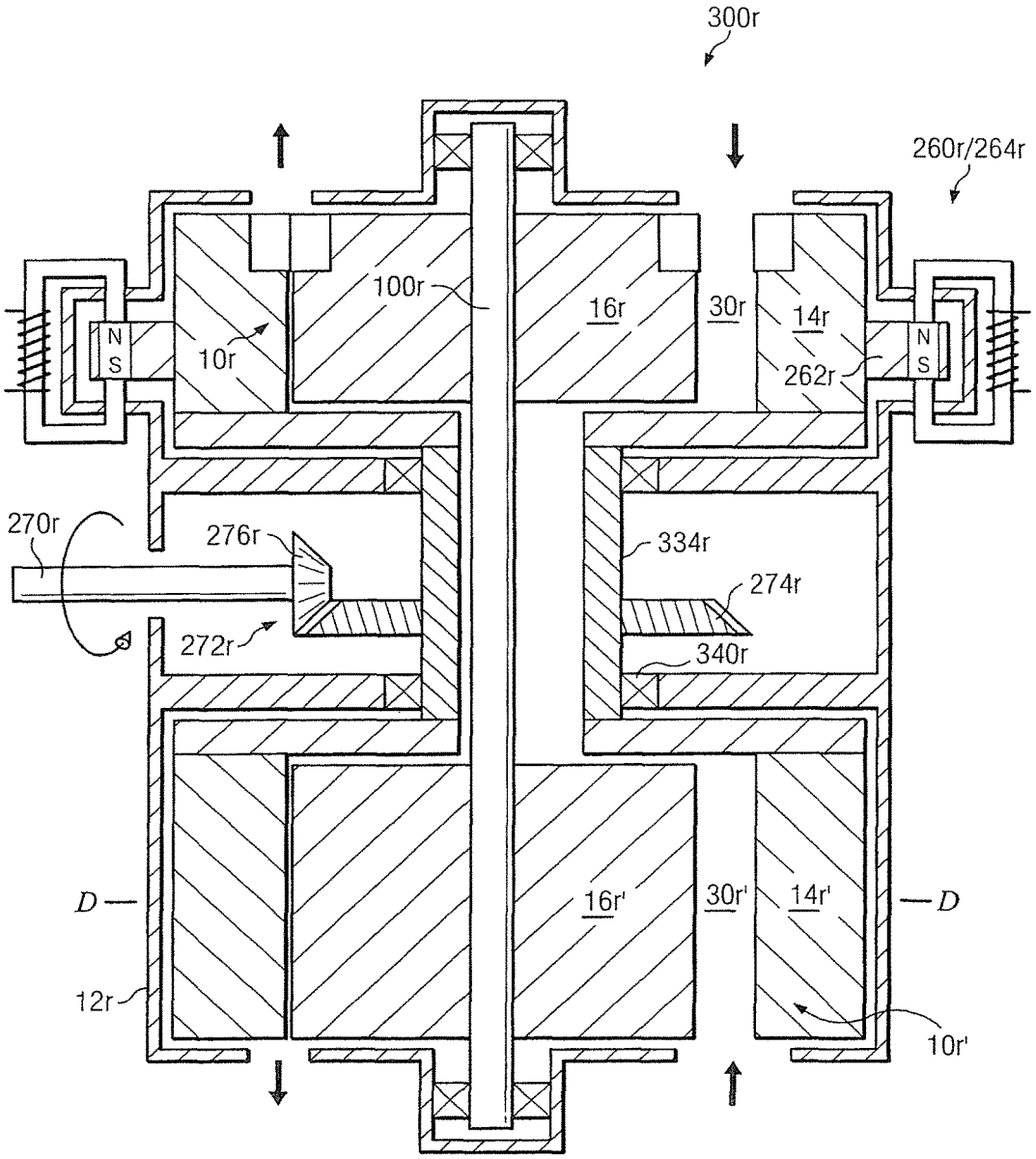
FIG. 23 illustrates an example cross-section of an engine system in accordance with another embodiment of the invention.

FIG. 23 illustrates an example cross-section of an engine system 300*r* in accordance with another embodiment of the invention. Engine system 300*r* is substantially similar to engine system 300*q* shown in FIG. 22, except that engine system 300*r* includes a motor 260*r* or a generator 264*r* integrated with the engine, as discussed in greater detail below.

Like engine system 300*q* shown in FIG. 22, engine system 300*r* includes a housing 12*r*, a compressor gerotor apparatus 10*r* and an expander gerotor apparatus 10*r*'. Compressor gerotor apparatus 10*r* includes a compressor outer gerotor 14*r* disposed within housing 12*r*, a compressor outer gerotor chamber 30*r* at least partially defined by compressor outer gerotor 14*r*, and a compressor inner gerotor 16*r* at least partially disposed within compressor outer gerotor chamber 30*r*. Similarly, expander gerotor apparatus 10*r*' includes an expander outer gerotor 14*r*' disposed within housing 12*r*, an expander outer gerotor chamber 30*r*' at least partially defined by expander outer gerotor 14*r*', and an expander inner gerotor 16*r*' at least partially disposed within expander outer gerotor chamber 30*r*'. Compressor and expander inner gerotors 16*r* and 16*r*' are rigidly coupled to a shaft 100*r* that is rotatably coupled to housing 12*r* by one or more bearings, and compressor and expander outer gerotors 14*r* and 14*r*' are rigidly coupled to, or integral with, a cylindrical outer gerotor support member 334*r* that is rotatably coupled to housing 12*r* by one or more ring-shaped bearings 340*r*.

In addition, like face-breathing engine system 300*q* shown in FIG. 22, face-breathing engine system 300*r* shown in FIG. 23 breathes through a first face 252*r* and a second face 254*r* of system 300*r*. In addition, compressor gerotor apparatus 10*r* and/or expander gerotor apparatus 10*r*' of engine system 300*r* shown in FIG. 23 may be self-synchronizing, such as described above regarding the various gerotor apparatuses shown in FIGS. 7-22. Instead or in addition, compressor gerotor apparatus 10*r* and/or expander gerotor apparatus 10*r*' may include a synchronizing system 18, such as discussed above regarding FIGS. 1-6, for example. Also, although not shown in order to simplify FIG. 23, engine system 300*q* may include a lubricant communicated through lubricant channels to provide lubrication between compressor inner gerotor 16*r* and compressor outer gerotor 14*r*. Further, like engine system 300*q* shown in FIG. 22, engine system 300*r* shown in FIG. 23 outputs power to an external rotatable drive shaft 270*r* oriented generally perpendicular to shaft 100*r* and coupled to outer gerotors 14*r* and 14*r*' by a coupling system 272*r* including a first gear 274*r* interacting with a second gear 276*r*.

As discussed above, engine system 300*r* includes a motor 260*r* or a generator 264*r* integrated with the engine. As shown in FIG. 23, motor 260*r* or generator 264*r* may be coupled to, or integrated with, housing 12*r*. In embodiments including a motor 260*r*, motor 260*r* may drive engine system 300*r* by driving rigidly coupled, or integrated, outer gerotors 14*r* and 14*r*', which may in turn drive inner gerotors 16*r* and 16*r*'. For example, motor 260*r* may drive one or more magnetic elements 262*r* coupled to, or integrated with, an outer perimeter surface 370*r* of outer gerotor 14*r* (or, in an alternative embodiment, an outer perimeter surface of outer gerotor 14*r*'). A portion of the power generated by motor 260*r* may be transferred to drive shaft 270*r*. In some applications, motor 260*r* may be used as a starter, or it may be used to provide supplemental torque in applications such as hybrid electric vehicles.

In embodiments including a generator 264*r*, generator 264*r* may be powered by the rotation of outer gerotors 14*r* and 14*r*'. Thus, rotation of outer gerotors 14*r* and 14*r*' may supply output power to both generator 264*r* and drive shaft 270*r*, which output power may be used for any suitable purpose. Motor 260*r*/generator 264*r* may comprise any suitable type of motor or generator, such as a permanent magnet motor or generator, a switched reluctance motor (SRM) or generator, or an inductance motor or generator, for example.

Figure 24:
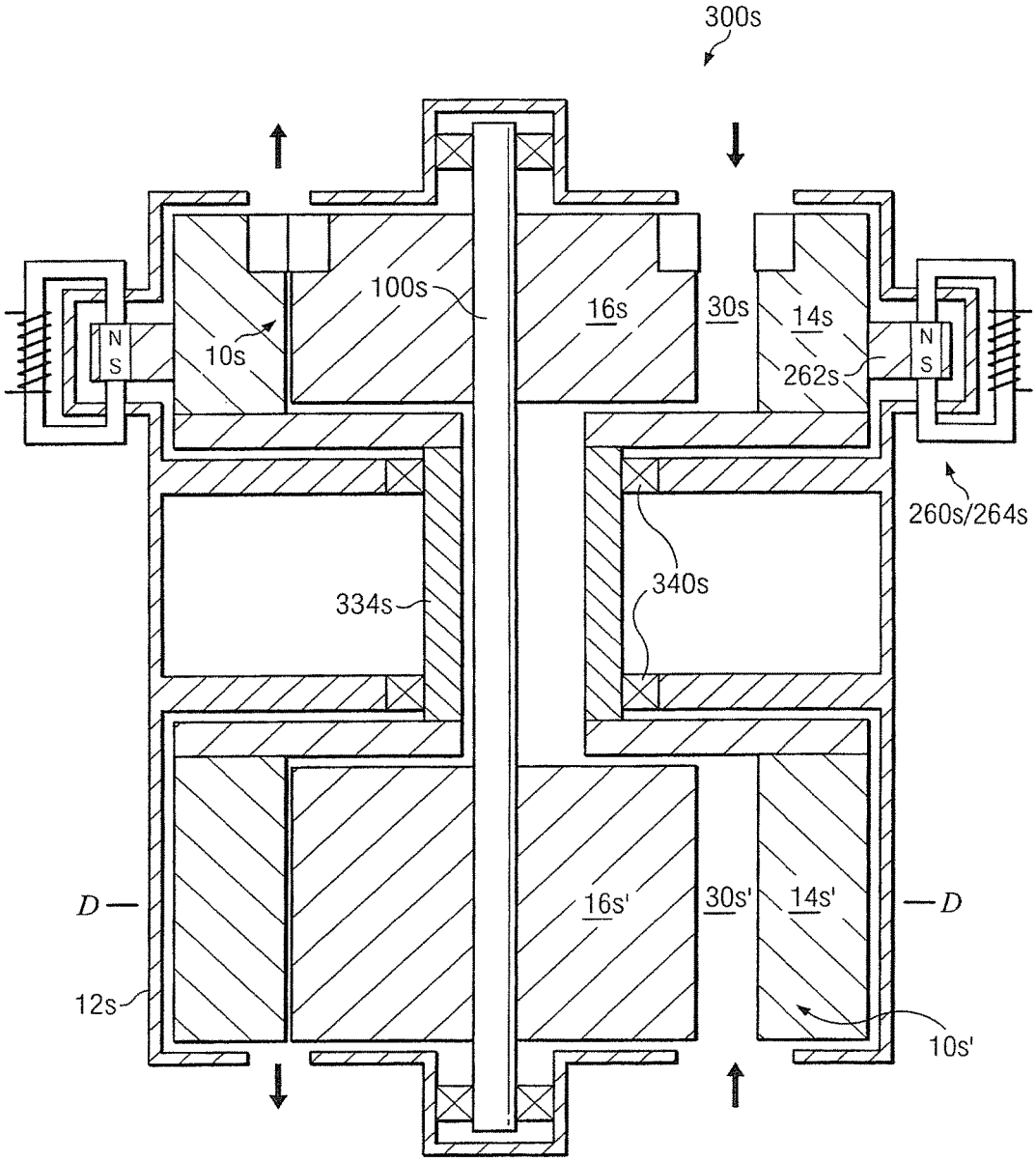
FIG. 24 illustrates an example cross-section of an engine system in accordance with another embodiment of the invention.

FIG. 24 illustrates an example cross-section of an engine system 300*s* in accordance with another embodiment of the invention. Engine system 300*s* is substantially similar to engine system 300*r* shown in FIG. 23, except that engine system 300*s* does not include an external drive shaft 270, and thus all the engine power output may be transferred to a generator 264*s* (or where engine system 300*s* includes a motor 260*s*, all the power generated by motor 260*s* may be used by engine system 300*s*), as discussed in greater detail below. Because there is no shaft output or input, the system is best viewed as a reverse Brayton cycle heat pump rather than an engine.

Like engine system 300*r* shown in FIG. 23, engine system 300*s* includes a housing 12*s*, a compressor gerotor apparatus 10*s* and an expander gerotor apparatus 10*s*'. Compressor gerotor apparatus 10*s* includes a compressor outer gerotor 14*s* disposed within housing 12*s*, a compressor outer gerotor chamber 30*s* at least partially defined by compressor outer gerotor 14*s*, and a compressor inner gerotor 16*s* at least partially disposed within compressor outer gerotor chamber 30*s*. Similarly, expander gerotor apparatus 10*s*' includes an expander outer gerotor 14*s*' disposed within housing 12*s*, an expander outer gerotor chamber 30*s*' at least partially defined by expander outer gerotor 14*s*', and an expander inner gerotor 16*s*' at least partially disposed within expander outer gerotor chamber 30*s*'. Compressor and expander inner gerotors 16*s* and 16*s*' are rigidly coupled to a shaft 100*s* that is rotatably coupled to housing 12*s* by one or more bearings, and compressor and expander outer gerotors 14*s* and 14*s*' are rigidly coupled to, or integral with, a cylindrical outer gerotor support member 334*s* that is rotatably coupled to housing 12*s* by one or more ring-shaped bearings 340*s*. In addition, like engine system 300*r* shown in FIG. 22, engine system 300*s* shown in FIG. 23 is a face-breathing system, may be self-synchronizing, and may use lubricant (not shown) to provide lubrication between compressor inner gerotor 16*s* and compressor outer gerotor 14*s*.

As discussed above, engine system 300*s* includes an integrated motor 260*s* or generator 264*s*, which may be coupled to, or integrated with, housing 12*s*. In embodiments including a motor 260*s*, motor 260*s* may drive engine system 300*s* by driving rigidly coupled, or integrated, outer gerotors 14*s* and 14*s*', which may in turn drive inner gerotors 16*s* and 16*s*'. For example, motor 260*s* may drive one or more magnetic elements 262*s* coupled to, or integrated with, an outer perimeter surface 370*s* of outer gerotor 14*s* (or, in an alternative embodiment, an outer perimeter surface of outer gerotor 14*s*'). For example, during starting, all of the power generated by motor 260*s* may be used by engine system 300*s*. Once the engine has started, there is no way to take energy out of the system. Again, in the case of an electric motor, the compressor/expander system is best viewed as a reverse Brayton cycle heat pump. In embodiments including a generator 264*s*, all of the engine power output generated by the rotation of outer gerotors 14*s* and 14*s*' may be used by generator 264*s* to make electricity. Motor 260*s*/generator 264*s* may comprise any suitable type of motor or generator, such as a permanent magnet motor or generator, a switched reluctance motor (SRM) or generator, or an inductance motor or generator, for example.

Figure 25:
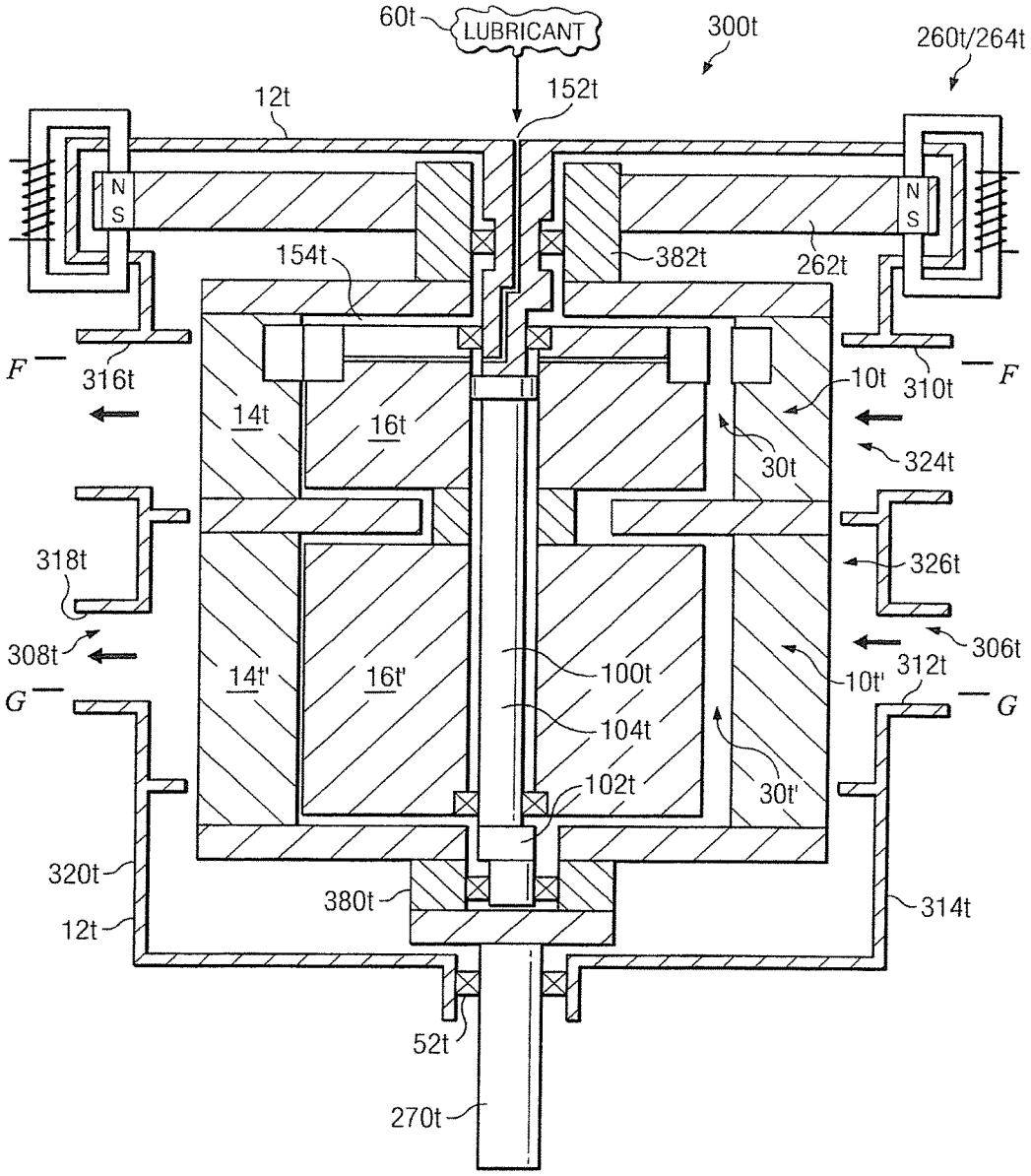
FIG. 25 illustrates an example cross-section of an engine system in accordance with another embodiment of the invention.

FIG. 25 illustrates an example cross-section of an engine system 300*t* in accordance with another embodiment of the invention. Engine system 300*t* is substantially similar to side-breathing engine system 300*j* shown in FIGS. 14-15, except that engine system 300*t* includes a motor 260*t* or a generator 264*t* integrated with the engine, as discussed in greater detail below.

Like engine system 300*j*, engine system 300*t* includes a housing 12*t*, a compressor gerotor apparatus 10*t* and an expander gerotor apparatus 10*t*'. Compressor gerotor apparatus 10*t* includes a compressor outer gerotor 14*t* disposed within housing 12*t*, a compressor outer gerotor chamber 30*t* at least partially defined by compressor outer gerotor 14*t*, and a compressor inner gerotor 16*t* at least partially disposed within compressor outer gerotor chamber 30*t*. Similarly, expander gerotor apparatus 10*t*' includes an expander outer gerotor 14*t*' disposed within housing 12*t*, an expander outer gerotor chamber 30*t*' at least partially defined by expander outer gerotor 14*t*', and an expander inner gerotor 16*t*' at least partially disposed within expander outer gerotor chamber 30*t*'.

Compressor outer gerotor 14*t* may be rigidly coupled to, or integral with, expander outer gerotor 14*t*'. Similarly, compressor inner gerotor 16*t* may be rigidly coupled to, or integral with, expander inner gerotor 16*t*'. Compressor and expander outer gerotors 14*t* and 14*t*' and compressor and expander inner gerotors 16*t* and 16*t*' may be rotatably coupled to a single shaft 100*t* rigidly coupled to housing 12*t*. In the embodiment shown in FIG. 25, compressor and expander outer gerotors 14*t* and 14*t*' are rotatably coupled to first portions 102*t* of shaft 100*t* having a first axis about which outer gerotors 14*t* and 14*t*' rotate, and compressor and expander inner gerotors 16*t* and 16*t*' are rotatably coupled to a second portion 104*t* of shaft 100*t* having a second axis about which inner gerotors 16*t* and 16*t*' rotate, the second axis being offset from the first axis. In addition, a drive shaft 270*t* is rigidly coupled to outer gerotors 14*t* and 14*t*' by a first cylindrical extension 380*t*, and rotatably coupled to housing 12*t* by one or more bearings 52*t*.

Compressor gerotor apparatus 10*t* and/or expander gerotor apparatus 10*t*' may be self-synchronizing, such as described above regarding the various gerotor apparatuses shown in FIGS. 7-24. Instead or in addition, compressor gerotor apparatus 10*t* and/or expander gerotor apparatus 10' may include a synchronizing system 18, such as discussed above regarding FIGS. 1-6, for example. In the embodiment shown in FIG. 25, compressor gerotor apparatus 10*t* performs the synchronization function for both compressor gerotor apparatus 10*t* and expander gerotor apparatus 10*t*', such as discussed above regarding FIGS. 14-24. In addition, a lubricant 60*t* may be communicated through lubricant channels 152*t* and 154*t* to provide lubrication between compressor inner gerotor 16*t* and compressor outer gerotor 14*t*.

Engine system 300*t* shown in FIG. 25 is a side-breathing system in which fluid flows through sides 306*t* and 308*t* (rather than the faces) of compressor gerotor apparatus 10*t* and expander gerotor apparatus 10*t*', such as described above regarding engine system 300*j* shown in FIGS. 14-15. Thus, regarding compressor gerotor apparatus 10*t*, fluid may flow from a first fluid inlet 310*t*, formed in a first side 314*t* of housing 12*t*, into compressor outer gerotor chamber 30*t* through compressor gerotor openings 324*t* formed in the outer perimeter of compressor outer gerotor 14*t*, through compressor outer gerotor chamber 30*t*, and into first fluid outlet 316*t* formed in a second side 320*t* of housing 12*t* through compressor gerotor openings 324*t*. Similarly, regarding expander gerotor apparatus 10*t*', fluid may flow from a second fluid inlet 312*t*, formed in first side 314*t* of housing 12*t*, into expander outer gerotor chamber 30*t*' through expander gerotor openings 326*t* formed in the outer perimeter of expander outer gerotor 14*t*', through expander outer gerotor chamber 30*t*', and into second fluid outlet 318*t* formed in second side 320*t* of housing 12*t* through expander gerotor openings 326*t*.

As discussed above, engine system 300*t* includes a motor 260*t* or a generator 264*t* integrated with the engine. As shown in FIG. 25, motor 260*t* or generator 264*t* may be coupled to, or integrated with, housing 12*t*. In embodiments including a motor 260*t*, motor 260*t* may drive engine system 300*t* by driving rigidly coupled, or integrated, outer gerotors 14*t* and 14*t*', which may in turn drive inner gerotors 16*t* and 16*t*'. For example, motor 260*t* may drive one or more magnetic elements 262*t* rigidly coupled to, or integrated with, outer gerotors 14*t* and 14*t* by a second cylindrical extension 382*t*. For example, magnetic elements 262*t* may include a series of bar magnets arranged in a circular pattern along the periphery of a disc. A portion of the power generated by motor 260*t* may be transferred to drive shaft 270*t*. In some applications, motor 260*t* may be used as a starter, or it may be used to provide supplemental torque in applications such as hybrid electric vehicles.

In embodiments including a generator 264*t*, generator 264*t* may be powered by the rotation of outer gerotors 14*t* and 14*t*'. Thus, rotation of outer gerotors 14*t* and 14*t*' may supply output power to both generator 264*t* and drive shaft 270*t*, which output power may be used for any suitable purpose. Motor 260*t*/generator 264*t* may comprise any suitable type of motor or generator, such as a permanent magnet motor or generator, a switched reluctance motor (SRM) or generator, or an inductance motor or generator, for example.

Figure 26:
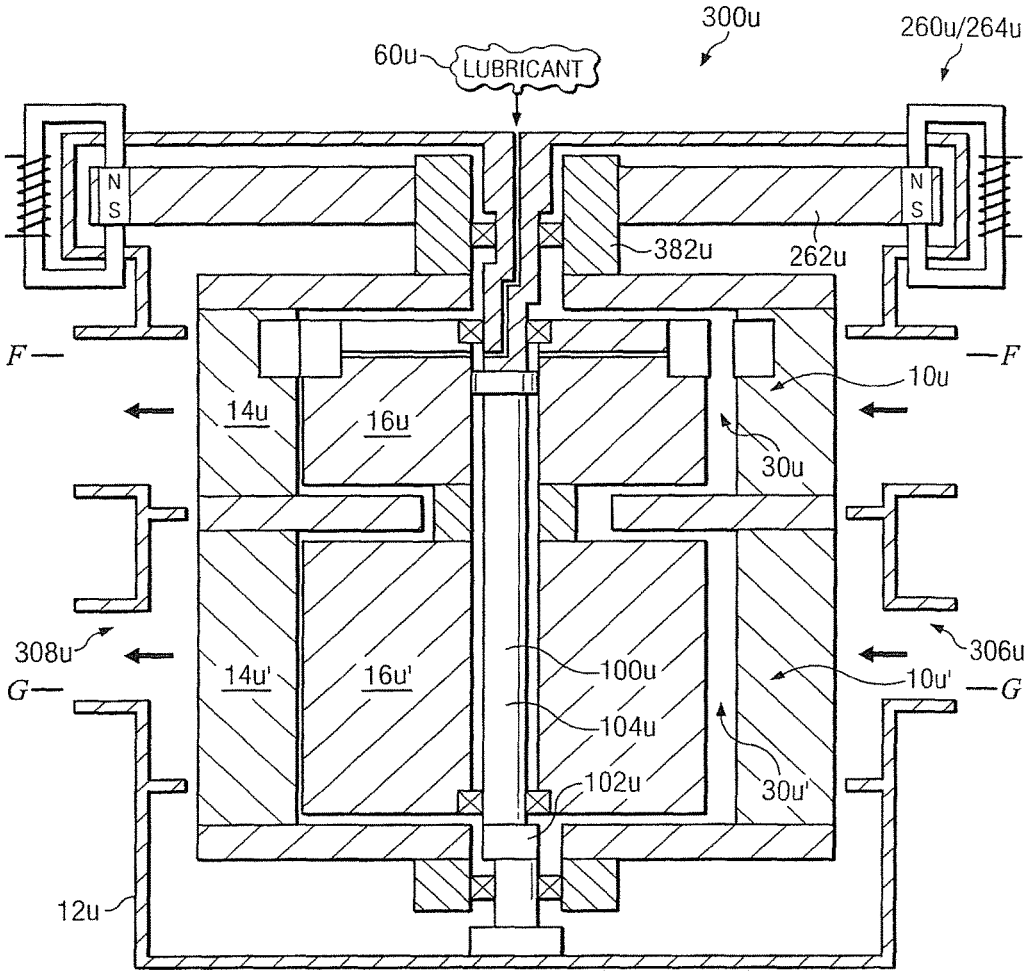
FIG. 26 illustrates an example cross-section of an compressor-expander system in accordance with another embodiment of the invention.

FIG. 26 illustrates an example cross-section of an compressor-expander system 300*u* in accordance with another embodiment of the invention. Compressor-expander system 300*u* is substantially similar to engine system 300*t* shown in FIG. 25, except that compressor-expander system 300*u* does not include an external drive shaft 270, and thus all the power output may be transferred to a generator 264*u* (or where compressor-expander system 300*u* includes an electric motor 260*u*, all the power generated by motor 260*u* may be used by compressor-expander system 300*u*), as discussed in greater detail below.

Like engine system 300*t*, compressor-expander system 300*u* includes a housing 12*u*, a compressor gerotor apparatus 10*u* and an expander gerotor apparatus 10*u*'. Compressor gerotor apparatus 10*u* includes a compressor outer gerotor 14*u* disposed within housing 12*u*, a compressor outer gerotor chamber 30*u* at least partially defined by compressor outer gerotor 14*u*, and a compressor inner gerotor 16*u* at least partially disposed within compressor outer gerotor chamber 30*u*. Similarly, expander gerotor apparatus 10*u*' includes an expander outer gerotor 14*u*' disposed within housing 12*u*, an expander outer gerotor chamber 30*u*' at least partially defined by expander outer gerotor 14*u*', and an expander inner gerotor 16*u*' at least partially disposed within expander outer gerotor chamber 30*u*'.

Compressor and expander outer gerotors 14*u* and 14*u*' are rotatably coupled to first portions 102*u* of shaft 100*u* having a first axis about which outer gerotors 14*u* and 14*u*' rotate, and compressor and expander inner gerotors 16*u* and 16*u*' are rotatably coupled to a second portion 104*u* of shaft 100*u* having a second axis about which inner gerotors 16*u* and 16*u*' rotate, the second axis being offset from the first axis. Compressor gerotor apparatus 10*u* and/or expander gerotor apparatus 10*u*' may be self-synchronizing, such as described above regarding the various gerotor apparatuses shown in FIGS. 7-25, and a lubricant 60*u* may be communicated through lubricant channels to provide lubrication between compressor inner gerotor 16*u* and compressor outer gerotor 14*u*. Instead or in addition, compressor gerotor apparatus 10*u* and/or expander gerotor apparatus 10*u*' may include a synchronizing system 18, such as discussed above regarding FIGS. 1-6, for example. In addition, compressor-expander system 300*u* shown in FIG. 26 is a side-breathing system in which fluid flows through sides 306*u* and 308*u* (rather than the faces) of compressor gerotor apparatus 10*u* and expander gerotor apparatus 10*u*', such as described above regarding engine system 300*t* shown in FIG. 25.

As discussed above, compressor-expander system 300*u* includes a motor 260*u* or a generator 264*u* integrated with the engine. As shown in FIG. 26, motor 260*u* or generator 264*u* may be coupled to, or integrated with, housing 12*u*. In embodiments or situations in which electricity is supplied to compressor-expander system 300*u*, motor 260*u*/generator 264*u* functions as a motor 260*u*, which may drive rigidly coupled, or integrated, outer gerotors 14*u* and 14*u*', which may in turn drive inner gerotors 16*u* and 16*u*'. For example, motor 260*u* may drive one or more magnetic elements 262*u* rigidly coupled to, or integrated with, outer gerotors 14*u* and 14*u*' by a cylindrical extension 382*u*. In such situations, compressor-expander system 300*u* may function as a reverse Brayton-cycle cooling system, such as for use in an air conditioner, for example.

In embodiments or situations in which fuel is supplied to compressor-expander system 300*u* to rotate outer gerotors 14*u* and 14*u*', motor 260*u*/generator 264*u* functions as an electric generator 264*u* to produce electricity. In such situations, compressor-expander system 300*u* may function as an engine. Motor 260*u*/generator 264*u* may comprise any suitable type of motor or generator, such as a permanent magnet motor or generator, a switched reluctance motor (SRM) or generator, or an inductance motor or generator, for example.

Figure 27:
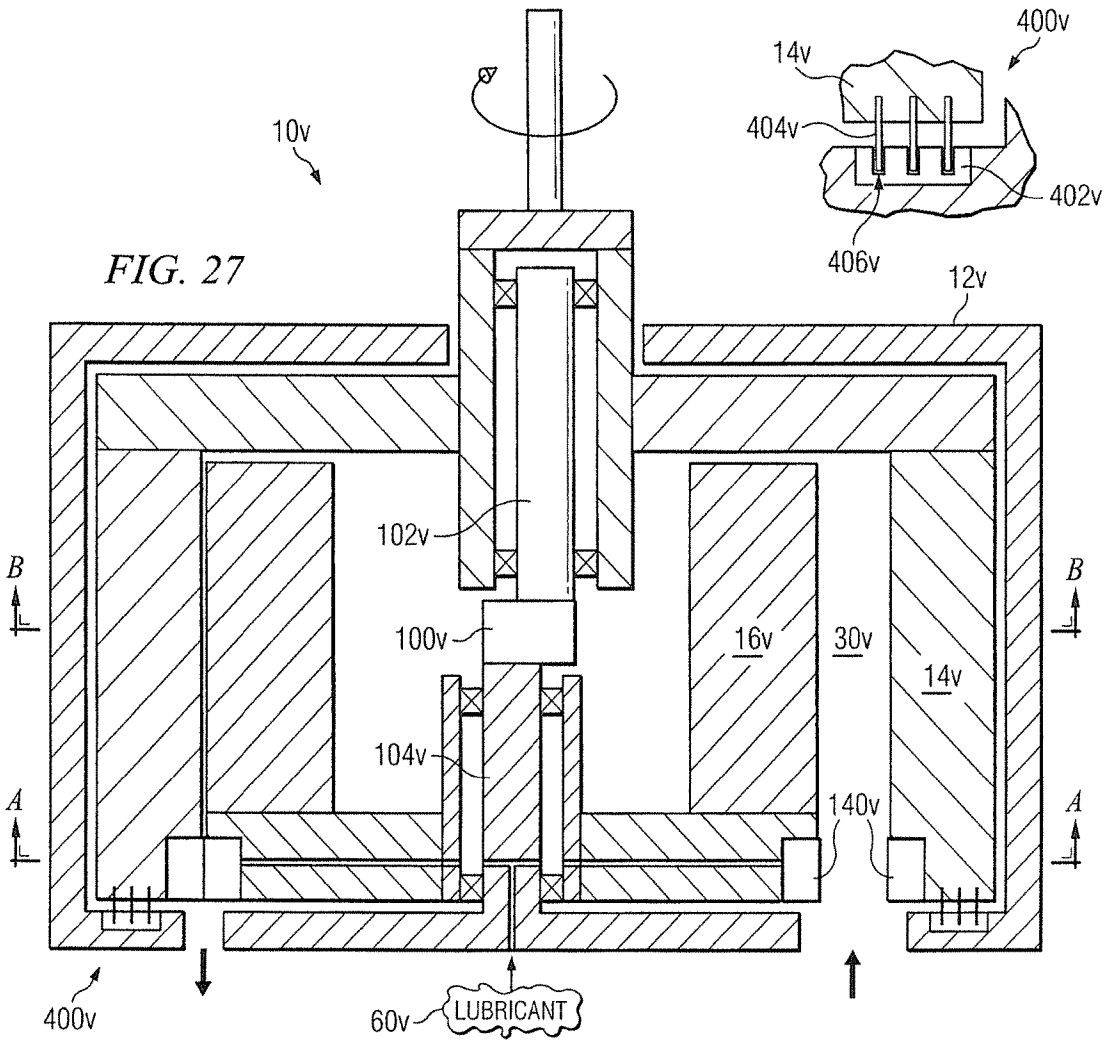
FIG. 27 illustrates an example cross-section of a gerotor apparatus having a sealing system to reduce fluid (e.g., gas) leakage in accordance with one embodiment of the invention.

FIG. 27 illustrates an example cross-section of a gerotor apparatus 10*v* having a sealing system 400*v* to reduce fluid (e.g., gas) leakage in accordance with one embodiment of the invention. Gerotor apparatus 10*v* is substantially similar to gerotor apparatus 10*e* shown in FIG. 7, except that gerotor apparatus 10*v* includes a sealing system 400*v* to reduce fluid (e.g., gas) leakage from outer gerotor chamber 30*v*, as discussed in greater detail below.

Like gerotor apparatus 10*e* shown in FIG. 7, gerotor apparatus 10*v* shown in FIG. 27 includes a housing 12*v*, an outer gerotor 14*v* disposed within housing 12*v*, an outer gerotor chamber 30*v* at least partially defined by outer gerotor 14*v*, and an inner gerotor 16*v* at least partially disposed within outer gerotor chamber 30*v*. Outer gerotor 14*v* and inner gerotor 16*v* are rotatably coupled to a single shaft 100*v* rigidly coupled to housing 12*v*. In particular, outer gerotor 14*v* is rotatably coupled to a first portion 102*v* of shaft 100*v* having a first axis about which outer gerotor 14*v* rotates, and inner gerotor 16*v* is rotatably coupled to a second portion 104*v* of shaft 100*v* having a second axis about which inner gerotor 16*v* rotates, the second axis being offset from the first axis.

Housing 12*v* includes a valve plate 40*v* including one or more fluid inlets 42*v* and one or more fluid outlets 44*v*. Fluid inlets 42*v* generally allow fluids, such as gasses, liquids, or liquid-gas mixtures, to enter outer gerotor chamber 30*v*. Likewise, fluid outlets 44*v* generally allow fluids within outer gerotor chamber 30*v* to exit from outer gerotor chamber 30*v*. Gerotor apparatus 10*v* may be self-synchronized by one or more low-friction regions 140*v*, such as described above regarding the various gerotor apparatuses shown in FIGS. 7-26. Instead or in addition, compressor gerotor apparatus 10*v* and/or expander gerotor apparatus 10*v*' may include a synchronizing system 18, such as discussed above regarding FIGS. 1-6, for example. In addition, a lubricant 60*v* may be communicated through lubricant channels to provide lubrication between compressor inner gerotor 16*v* and compressor outer gerotor 14*v*.

As discussed above, gerotor apparatus 10*v* includes a sealing system 400*v* to reduce leakage of fluid traveling through outer gerotor chamber 30*v*. For example, sealing system 400*v* may reduce leakage of gas between rotating gerotors 14*v* and 16*v* and housing 12*v*. As shown in the enlarged view of sealing system 400*v* in FIG. 27, sealing system 400*v* may include soft material 402*v* (such as a polymer, for example) and one or more seal protrusions 404*v* that form seal tracks 406*v* in the soft material 402*v*. A substantial seal may be provided between the seal protrusions 404*v* and seal tracks 406*v*. Seal protrusions 404*v* may be formed from a relatively hard material, such as metal, for example. In the embodiment shown in FIG. 27, seal protrusions 404*v* comprise hard "blades" that cut into the soft material 402*v*. The blades may be circular and may be coupled to, and extend around the circumference of, outer gerotor 14*v*. As gerotors 14*v* and 16*v* deform due to thermal expansion and centrifugal force, the blades 404*v* may cut into soft material 402*v* to form seal tracks 406*v*, thus providing a customized fit. In some embodiments, the surface of blades 404*v* may be roughened (e.g., by sand blasting) to help cut soft material 402*v*.

Figure 28:
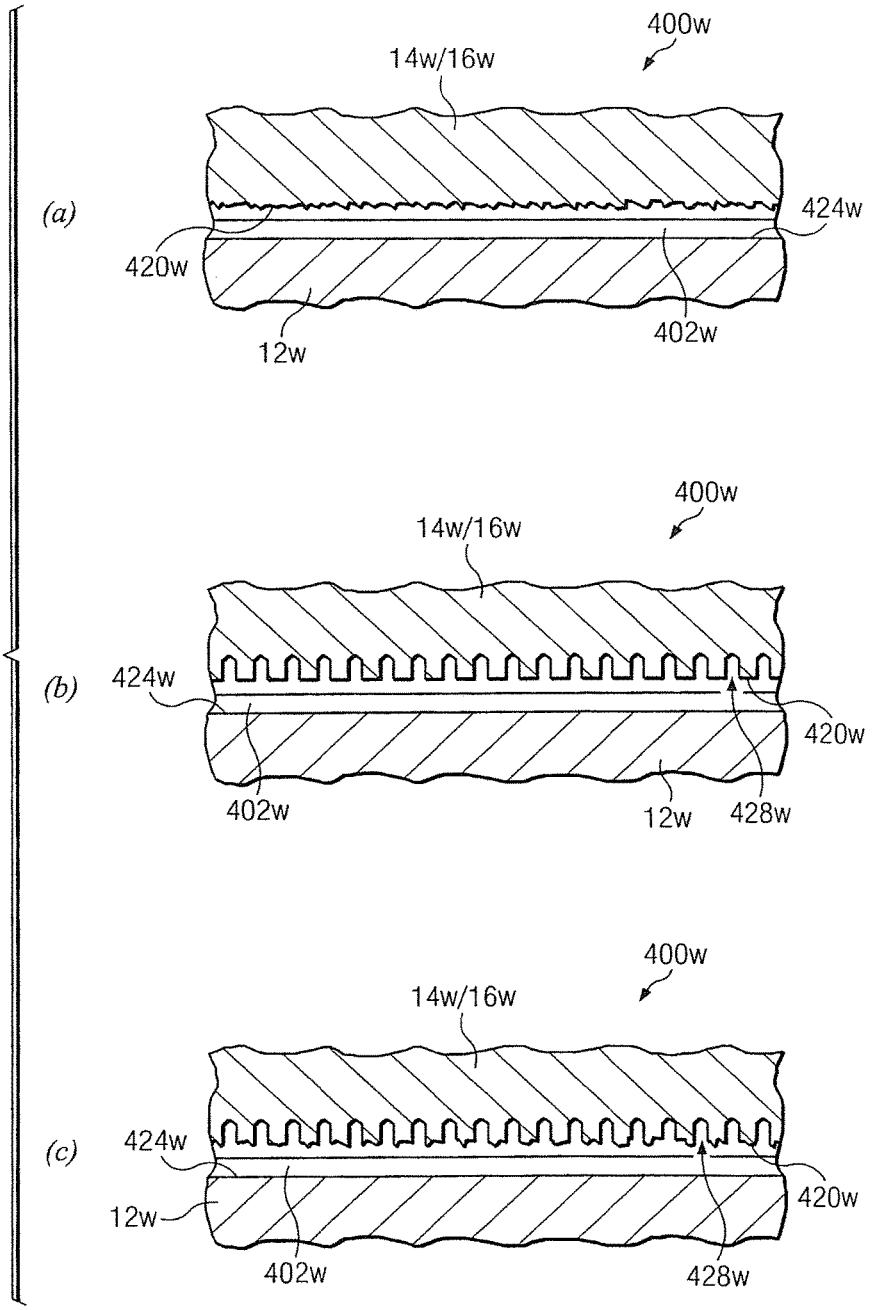
FIG. 28 illustrates example cross-sections of three alternative embodiments of a sealing system similar to sealing system shown in FIG. 27.

FIG. 28 illustrates example cross-sections of three alternative embodiments of a sealing system 400*w* similar to sealing system 400*v* shown in FIG. 27. In particular, FIG. 28 illustrates three embodiments for forming abraded seals between an outer gerotor 14*w* (or an inner gerotor 16*w*) and a housing 12*w*. As shown in FIG. 28, embodiment (a), a surface 420*w* of outer gerotor 14*w* is roughened by sandblasting or other suitable means. A layer or surface coating of soft material 402*w* is formed on a surface 424*w* of housing 12*w*. The soft material 402*w* may be an abradable material, such as Teflon. When roughened surface 420*w* and the abradable material 402*w* contact each other, roughened surface 420*w* removes a portion of the abradable material 402*w*, thus forming a very tight clearance with very low leakage. Although the illustration of embodiment (a) shows flat surfaces being sealed in this manner, these materials and techniques could also be used on curved surfaces.

FIG. 28, embodiment (b) shows a similar sealing system 400*w* as embodiment (a), except surface 420*w* of outer gerotor 14*w* has numerous indentations or holes 428*w*, such as formed by a drill, rather than being roughened. Alternatively, surface 420*w* may have non-circular holes shaped in a honeycomb or other suitable pattern. The purpose of the indentation or hole 428*w* is to accommodate fine dust that is produced when surface 420*w* and abradable material 402*w* contact each other, as well as to add cutting edges to aid the abrasion process. FIG. 28, embodiment (c) shows a sealing system 400*w* that is a combination of embodiments (a) and (b). Surface 420*w* of outer gerotor 14*w* is both roughened and includes indentations or holes 428*w*.

Figure 29:
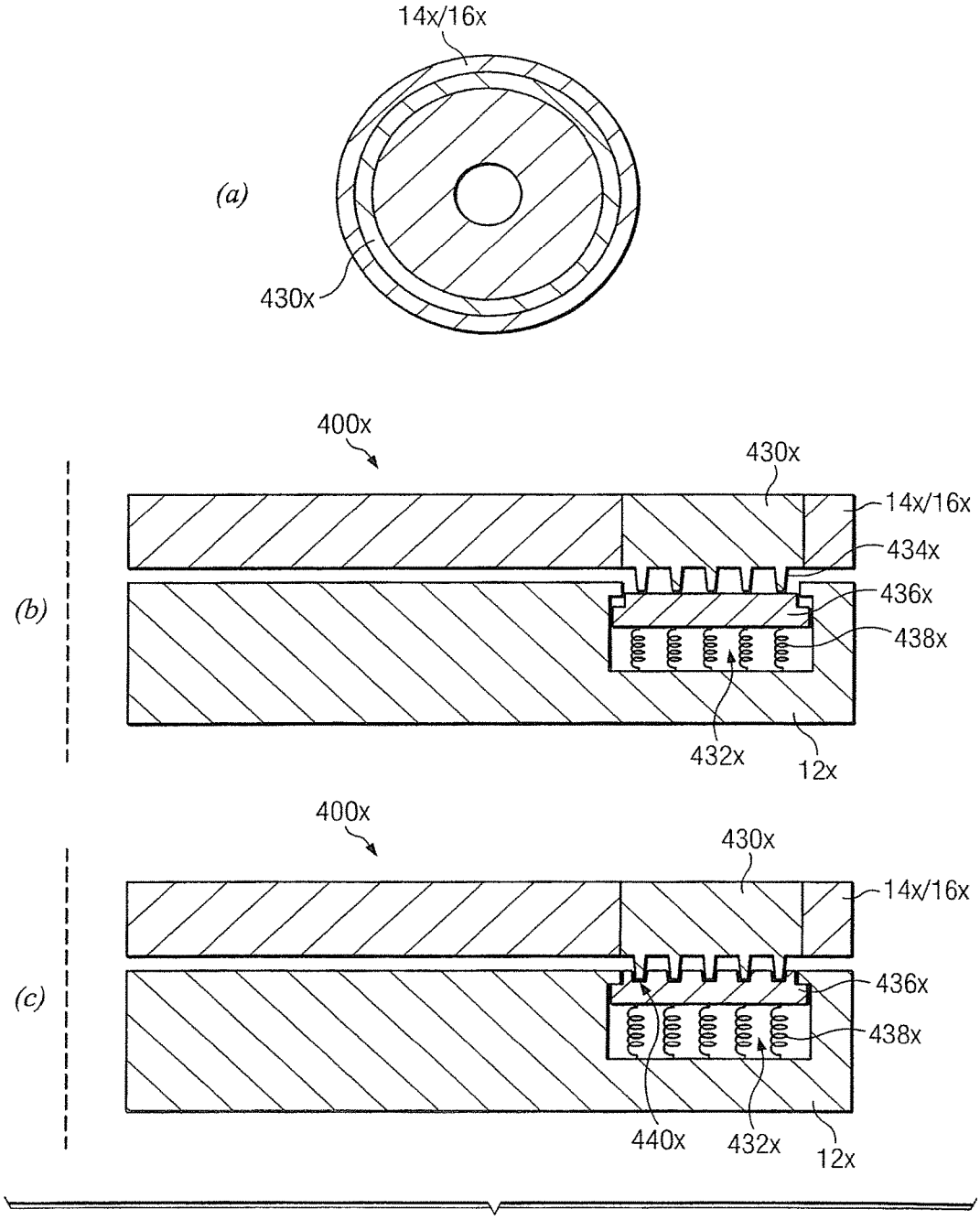
FIG. 29 illustrates a method of forming a sealing system in accordance with one embodiment of the invention.

FIG. 29 illustrates a method of forming a sealing system 400*x* in accordance with one embodiment of the invention. The method may be used to form a labyrinthian seal between two flat surfaces of a gerotor apparatus, one stationary and the other rotating about a fixed center. For example, as discussed below, the method may be used to form a labyrinthian seal between a surface 420*x* of an outer gerotor 14*x* (or an inner gerotor 16*x*) rotating about a fixed center and a surface 424*x* of a stationary housing 12*x*.

FIG. 29, view (a) shows a top view of a ring-shaped portion of a housing 12*x*, including a ring-shaped sealing portion 430*x*. FIG. 29, view (b) shows a partial side view of the ring-shaped portion of housing 12*x* as well as a portion of an outer gerotor 14*x*. Ring-shaped sealing portion 430*x* may interface with a ring-shaped sealing portion 432*x* of outer gerotor 14*x*. Sealing portion 432*x* of outer gerotor 14*x* may be formed from a relatively hard material, such as metal, and may include one or more seal protrusions, or cutters, 434*x* extending from a surface 420*x* of outer gerotor 14*x*. Sealing portion 430*x* of housing 12*x* may include a ring-shaped sealing member 436*x* that is spring loaded by one or more springs 438*x*. Springs 438*x* may push sealing member 436*x* upward such that during assembly and/or operation of the relevant gerotor apparatus, sealing member 436*x* is spring-biased against seal cutters 434*x* of sealing portion 432*x*. Sealing member 436*x* may be formed from a soft, or abradable, material 402*x* such as Teflon, for example.

As outer gerotor 14*x* begins to rotate relative to the stationary housing 12*x*, seal cutters 434*x* abrade one or more ring-shaped seal tracks, or grooves, 440*x* into the abradable, spring-loaded sealing member 436*x*, thus forming a labyrinthian seal extending around the circumference of outer gerotor 14*x* and housing 12*x*, such as shown in view (c). Although FIG. 29 shows the abradable sealing portion 432*x* loaded using springs 438*x*, other suitable loading mechanisms may be used, such as gas or hydraulic pressure, for example.

Figure 30:
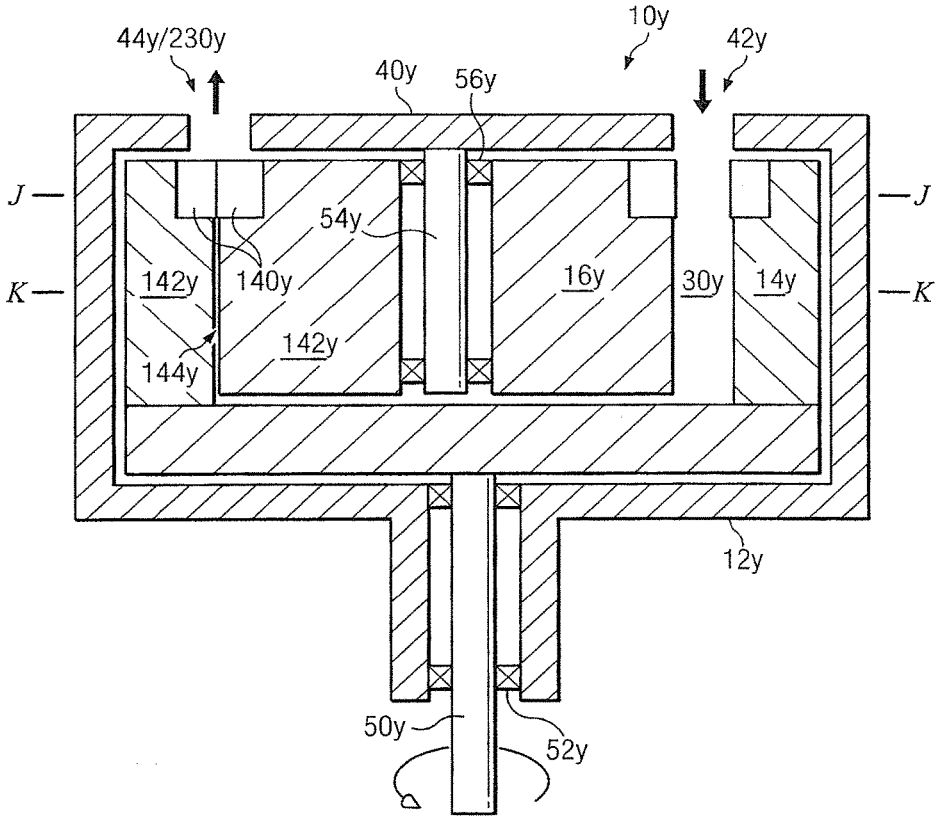
FIG. 30 illustrates an example cross-section of a liquid-processing gerotor apparatus in accordance with one embodiment of the invention.

FIG. 30 illustrates an example cross-section of a liquid-processing gerotor apparatus 10*y* in accordance with one embodiment of the invention. Liquid-processing gerotor apparatus 10*y* may process liquids, liquid/gas mixtures and/or gasses. Gerotor apparatus 10*y* may function as a pump, a compressor, or an expander, depending on the embodiment or application.

Gerotor apparatus 10*y* includes a housing 12*y*, an outer gerotor 14*y* disposed within housing 12*y*, an outer gerotor chamber 30*y* at least partially defined by outer gerotor 14*y*, and an inner gerotor 16*y* at least partially disposed within outer gerotor chamber 30*y*. Outer gerotor 14*y* is rigidly coupled to a first shaft 50*y*, which is rotatably coupled to housing 12*y* by one or more ring-shaped bearings 52*y*, and inner gerotor 16*y* is rotatably coupled to a second shaft 54*y* by one or more ring-shaped bearings 56*y*, which shaft 54*y* is rigidly coupled to, or integral with, housing 12*y*. Outer gerotor 14*y* rotates about a first axis and inner gerotor 16*y* rotates about a second axis offset from the first axis. In situations in which gerotor apparatus 10*y* functions as a pump, power is delivered to gerotor apparatus 10*y* through first shaft 50*y*. In situations in which gerotor apparatus 10*y* functions as an expander, power is output to first shaft 50*y*.

Housing 12*y* includes a valve plate 40*y* that includes one or more fluid inlets 42*y* and one or more fluid outlets 44*y*. Fluid inlets 42*y* generally allow fluids to enter outer gerotor chamber 30*y*. Likewise, fluid outlets 44*y* and check valves 230*y* (if present) generally allow fluids to exit outer gerotor chamber 30*y*. Fluid inlets 42*y* and fluid outlets 44*y* may have any suitable shape and size. Where apparatus 10*y* is used as a liquid pump, such as a water pump for example, the total area of fluid inlets 42*y* may be approximately equal to the total area of fluid outlets 44*y*. Where apparatus 10*y* functions as an expander, the total area of fluid inlets 42*y* may be smaller than the total area of fluid outlets 44*y*. Where apparatus 10*y* functions as a compressor, the total area of fluid inlets 42*y* may be greater than the total area of fluid outlets 44*y*. In some embodiments, valve plate 40*y* may also include one or more check valves 230*y* generally operable to allow fluids to exit from outer gerotor chamber 30*y*, as discussed below regarding FIG. 32, embodiment (b).

Gerotor apparatus 10*y* may be self-synchronizing, such as described above regarding the various gerotor apparatuses shown in FIGS. 7-27. In particular, outer gerotor 14*y* and/or inner gerotor 16*y* may include one or more low-friction regions 140*y* operable to reduce friction between outer gerotor 14*y* and/or inner gerotor 16*y*, thus synchronizing the relative rotation of outer gerotor 14*y* and inner gerotor 16*y*. As discussed above, low-friction regions 140*y* may extend a slight distance beyond the outer surface 132*y* of inner gerotor 16*y* and/or inner surface 130*y* of outer gerotor 14*y* such that only the low-friction regions 140*y* of inner gerotor 16*y* and/or outer gerotor 14*y* contact each other. Thus, there may be a narrow gap 144*y* between the remaining, higher-friction regions 142*y* of inner gerotor 16*y* and outer gerotor

14*y*. In addition, in some embodiments, a lubricant (not shown) may be communicated through various lubricant channels to provide lubrication between inner gerotor 16*y* and outer gerotor 14*y*.

As discussed above, low-friction regions 140*y* may be formed from a polymer (phenolics, nylon, polytetrafluoroethylene, acetyl, polyimide, polysulfone, polyphenylene sulfide, ultrahigh-molecular-weight polyethylene), graphite, or oil-impregnated sintered bronze, for example. In embodiments in which the fluid flowing through outer gerotor chamber 30*y* is water (e.g., where gerotor apparatus functions as a water pump), low-friction regions 140*y* may be formed from VESCONITE.

Figure 31A:
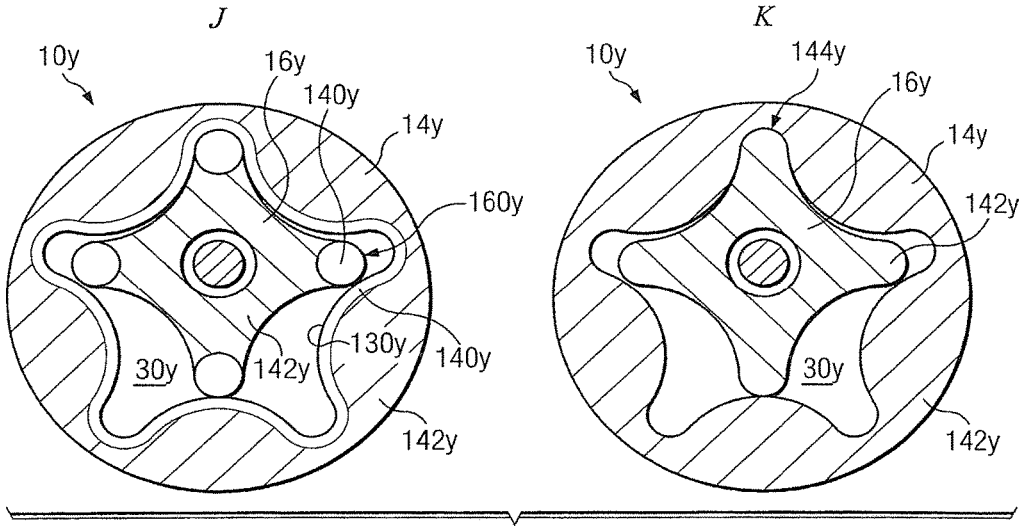
FIGS. 31A-31D illustrate example cross-sections of a liquid-processing gerotor apparatus taken along lines J and K, respectively, shown in FIG. 30, according to various embodiments of the invention.

FIGS. 31A-31D illustrate example cross-sections of liquid-processing gerotor apparatus 10*y* taken along lines J and K, respectively, shown in FIG. 30, according to various embodiments of the invention. As shown in FIG. 31A, at section J, low-friction regions 140*y* are formed at each tip 160*y* of inner gerotor 16*y*, and around the inner perimeter of outer gerotor 14*y* defining inner surface 130*y* of outer gerotor 14*y*. Remaining portions of inner gerotor 16*y* and outer gerotor 14*y* may include higher-friction regions 142*y*. As shown in FIG. 31A, at section K, all of inner gerotor 16*y* and outer gerotor 14*y* may be a higher-friction region 142*y*. However, as discussed above regarding FIG. 30, a narrow gap 144*y* may be maintained between higher-friction regions 142*y* of inner gerotor 16*y* and outer gerotor 14*y*.

Figure 31B:
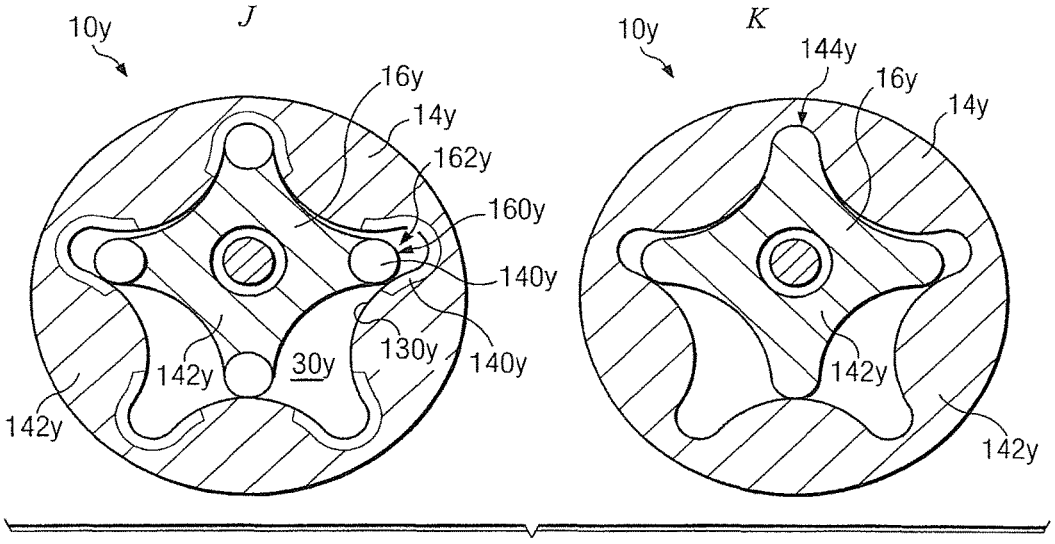

As shown in FIG. 31B, at section J, low-friction regions 140*y* are formed at each tip 160*y* of inner gerotor 16*y*. Outer gerotor 14*y* includes a low-friction region 140*y* proximate each tip 162*y* of inner surface 130*y* of outer gerotor 14*y*. Because a large portion of friction and wear between inner gerotor 16*y* and outer gerotor 14*y* occurs at the tips 160*y* and 162*y* of inner gerotor 16*y* and outer gerotor 14*y*, respectively, limiting low-friction regions 140*y* to areas near such tips 160*y* and 162*y* may reduce costs associated where low-friction materials 134*y* are relatively expensive and/or provide additional structural integrity where low-friction regions 140*y* are less durable than higher-friction regions 142*y*. As shown in FIG. 31B, at section K, all of inner gerotor 16*y* and outer gerotor 14*y* may be a higher-friction region 142*y*. Again, as discussed above, a narrow gap 144*y* may be maintained between higher-friction region 142*y* of inner gerotor 16*y* and outer gerotor 14*y*.

Figure 31C:
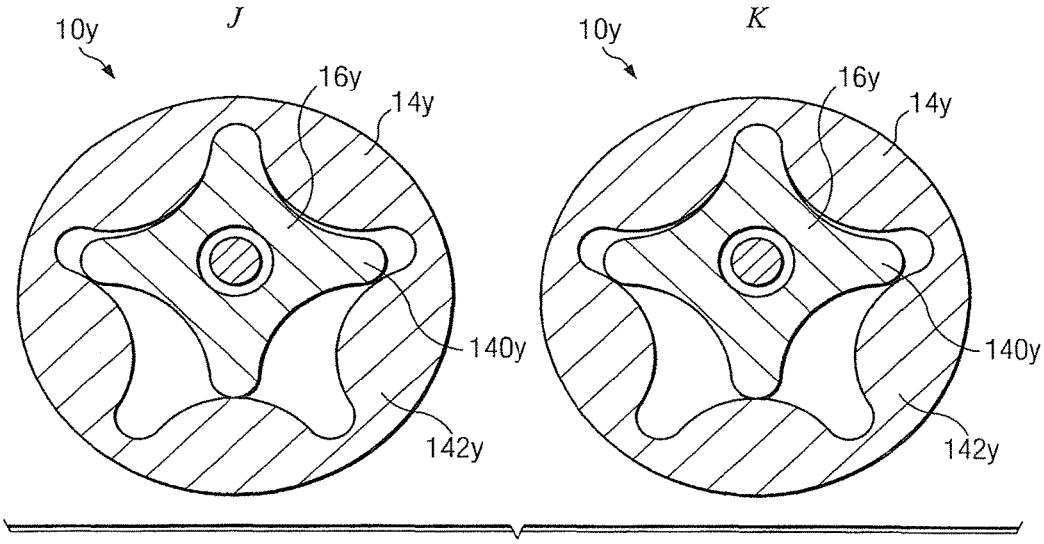

As shown in FIG. 31C, at section J, the complete cross-section of inner gerotor 16*y* is a low-friction region 140*y*, while the complete cross-section of outer gerotor 14*y* is a higher-friction region 142*y*. As shown in FIG. 31C, at section K, all of inner gerotor 16*y* and outer gerotor 14*y* may be a higher-friction region 142*y*.

Figure 31D:
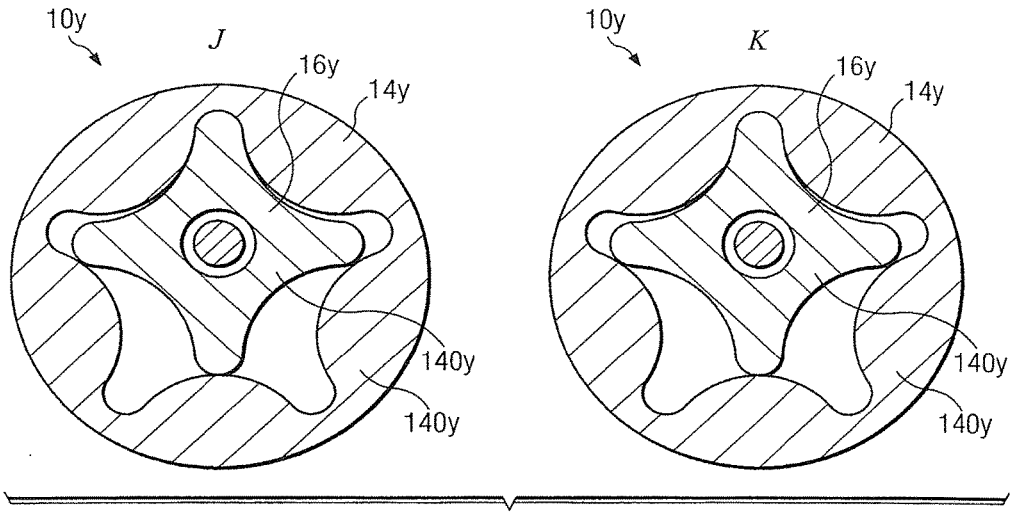

As shown in FIG. 31D, at section J, the complete cross-section of both inner gerotor 16*y* and outer gerotor 14*y* is a low-friction region 140*y*. As shown in FIG. 31D, at section K, all of inner gerotor 16*y* and outer gerotor 14*y* may be a higher-friction region 142*y*.

Figure 32:
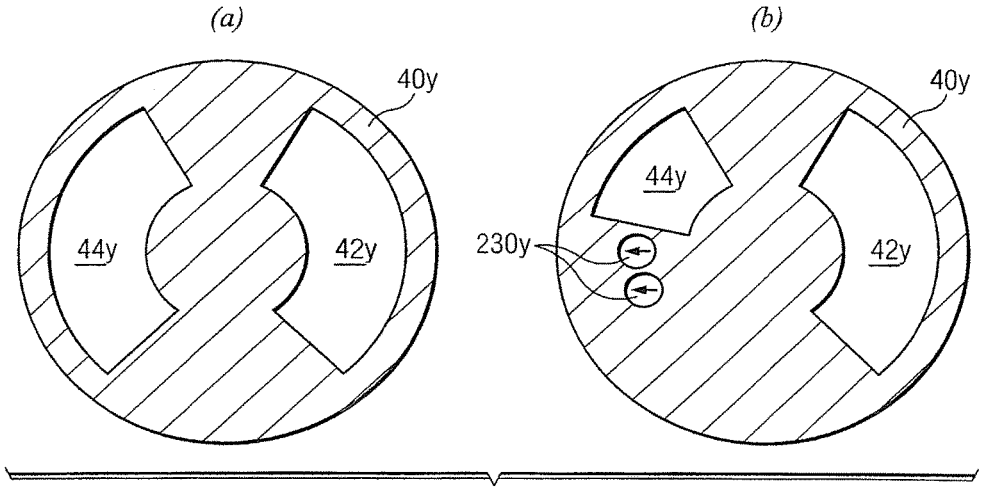
FIG. 32 illustrates example cross-sections of valve plate of liquid-processing gerotor apparatus shown in FIG. 30 according to two different embodiments of the invention.

FIG. 32 illustrates example cross-sections of valve plate 40*y* of liquid-processing gerotor apparatus 10*y* shown in FIG. 30 according to two different embodiments of the invention. In embodiment (a), outlet valve plate 40*y* includes a fluid inlet 42*y* allowing fluids to enter outer gerotor chamber 30*y* and a fluid outlet 44*y* allowing fluids to exit outer gerotor chamber 30*y*. In this embodiment, which is suitable for non-compressible fluids, such as liquids, the area of fluid inlet 42*y* is substantially identical to the area of fluid outlet 44*y*.

In embodiment (b), outlet valve plate 40*y* includes a fluid inlet 42*y* allowing fluids to enter outer gerotor chamber 30*y*, a fluid outlet 44*y* allowing fluids to exit outer gerotor chamber 30*y*, and one or more check valves 230*y* also allowing fluids to exit outer gerotor chamber 30*y*. In this embodiment, the area of fluid inlet 42*y* may be substantially identical to the total area of fluid outlet 44*y* and check valves 230*y*. This embodiment is suitable for a pump that is pressurizing a mixture of liquid and gas. As the liquid/gas mixture is compressed within outer gerotor chamber 30*y*, the appropriate check valves open to discharge the liquid/gas mixture. For example, if the fluid flowing through and exiting outer gerotor chamber 30*y* consists only of liquid, all check valves 230*y* open. If the fluid flowing through and exiting outer gerotor chamber 30*y* contains an intermediate content of gas, a portion of check valves 230*y* may open. Check valves 230*y* may open and/or close slowly. This is particularly useful for applications that operate at relatively low pressures, such as water-based air conditioning. At low pressure, there is insufficient force available to rapidly move the mass of check valves 230*y*.

Figure 33:
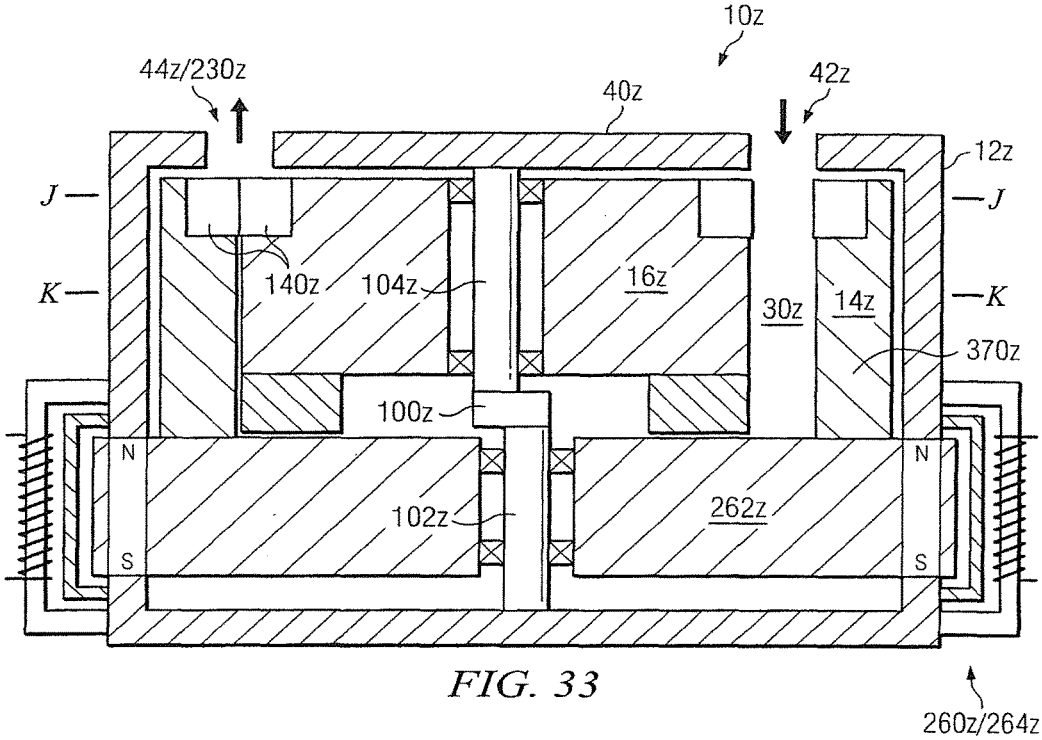
FIG. 33 illustrates an example cross-section of a liquid-processing gerotor apparatus in accordance with another embodiment of the invention.

FIG. 33 illustrates an example cross-section of a liquid-processing gerotor apparatus 10*z* in accordance with another embodiment of the invention. Gerotor apparatus 10*z* is similar to gerotor apparatus 10*y* shown in FIG. 30-32, except that gerotor apparatus 10*z* includes an integrated motor 260*z* or generator 264*z*, as discussed in greater detail below. Liquid-processing gerotor apparatus 10*z* may process liquids, liquid/gas mixtures and/or gasses. Gerotor apparatus 10*z* may function as a pump, a compressor, or an expander, depending on the embodiment or application.

Gerotor apparatus 10*z* includes a housing 12*z*, an outer gerotor 14*z* disposed within housing 12*z*, an outer gerotor chamber 30*z* at least partially defined by outer gerotor 14*z*, and an inner gerotor 16*z* at least partially disposed within outer gerotor chamber 30*z*. Outer gerotor 14*z* and inner gerotor 16*z* are rotatably coupled to a single shaft 100*z* rigidly coupled to housing 12*z*. In particular, outer gerotor 14*z* is rotatably coupled to a first portion 102*z* of shaft 100*z* having a first axis about which outer gerotor 14*z* rotates, and inner gerotor 16*z* is rotatably coupled to a second portion 104*z* of shaft 100*z* having a second axis about which inner gerotor 16*z* rotates, the second axis being offset from the first axis.

Housing 12*z* includes a valve plate 40*z* that includes one or more fluid inlets 42*z*, one or more fluid outlets 44*z* and/or one or more check valves 230*z*. Fluid inlets 42*z* generally allow fluids to enter outer gerotor chamber 30*z*, and fluid outlets 44*z* and/or check valves 230*z* generally allow fluids within outer gerotor chamber 30*z* to exit from outer gerotor chamber 30*z*, such as described above regarding valve plate 40*y* shown in FIGS. 30 and 30.

Gerotor apparatus 10*z* may be self-synchronizing, such as described above regarding gerotor apparatus 10*y* shown in FIGS. 30-32. In particular, outer gerotor 14*z* and/or inner gerotor 16*z* may include one or more low-friction regions 140*z* operable to reduce friction between outer gerotor 14*z* and/or inner gerotor 16*z*, thus synchronizing the relative rotation of outer gerotor 14*z* and inner gerotor 16*z*. In addition, in some embodiments, a lubricant (not shown) may be communicated through various lubricant channels to provide lubrication between inner gerotor 16*z* and outer gerotor 14*z*.

As discussed above, gerotor apparatus 10*z* includes an integrated motor 260*z* or generator 264*z*. As shown in FIG. 33, motor 260*z* or generator 264*z* may be coupled to, or integrated with, housing 12*z*. In embodiments including a motor 260*z*, motor 260*z* may drive gerotor apparatus 10*z* by driving outer gerotor 14*z*, which may in turn drive inner gerotor 16*z*. For example, motor 260*z* may drive one or more magnetic elements 262*z* coupled to, or integrated with, an outer perimeter surface 370*z* of outer gerotor 14*z*. In embodiments including a generator 260*y*, rotation of outer gerotor 14*z* may provide power to generator 260*y* to produce electricity. Motor 260*y* or generator 264*y* may comprise any suitable type of motor or generator, such as a permanent magnet motor or generator, a switched reluctance motor (SRM) or generator, or an inductance motor or generator, for example.

Figure 34:
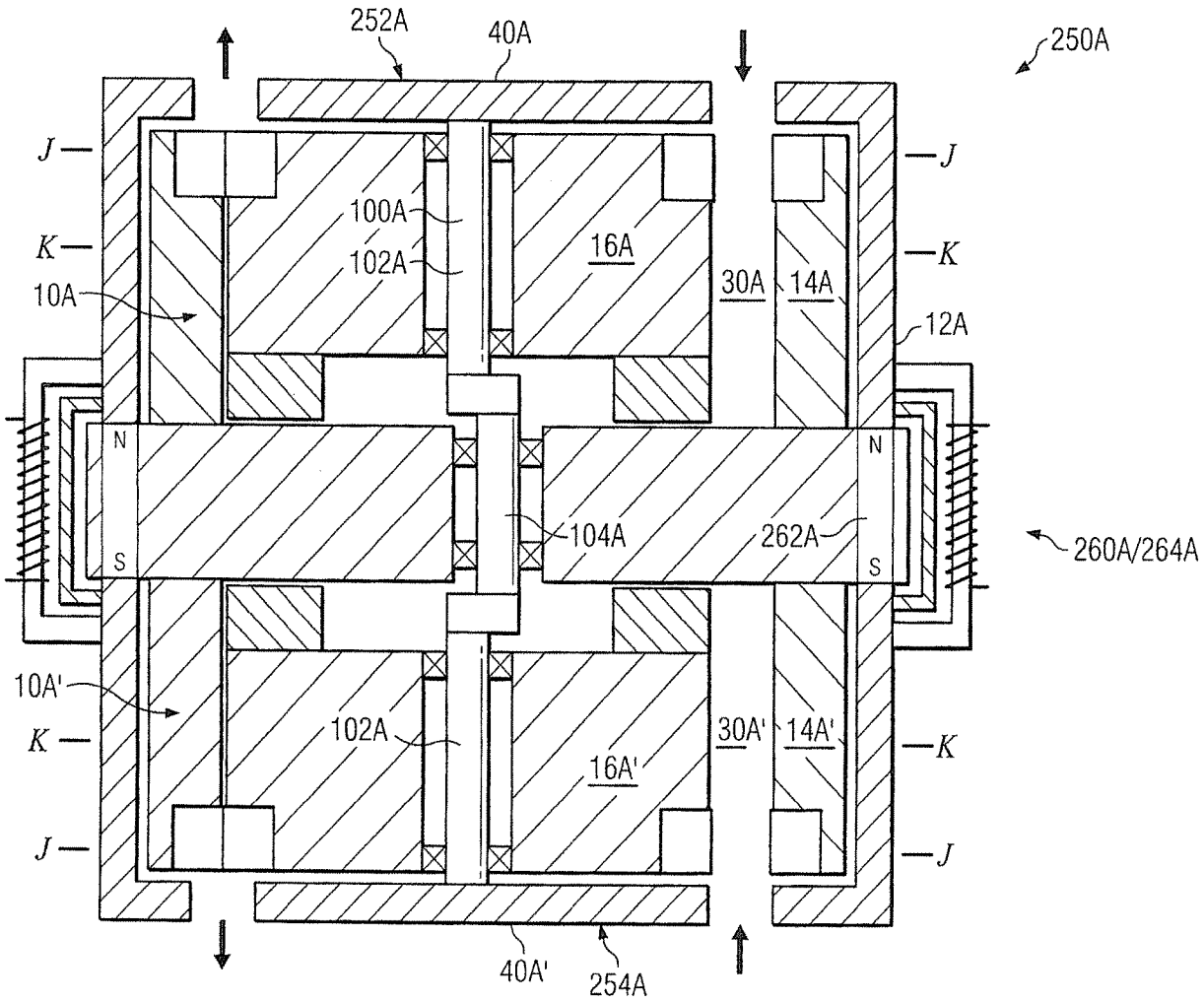
FIG. 34 illustrates an example cross-section of a dual gerotor apparatus having an integrated motor or generator, according to another embodiment of the invention.

FIG. 34 illustrates an example cross-section of a dual gerotor apparatus 250A having an integrated motor 260A or generator 264A according to another embodiment of the invention. Dual gerotor apparatus 250A is similar to gerotor apparatus 250*z* shown in FIG. 33, but dual gerotor apparatus 250A includes a pair of face-breathing gerotor apparatuses, rather than a single gerotor apparatus, as discussed below.

As shown in FIG. 34, dual gerotor apparatus 250A includes a housing 12A and an integrated pair of gerotor apparatuses, including a first gerotor apparatus 10A proximate a first face 252A of apparatus 250A and a second gerotor apparatus 10A' proximate a second face 254A of apparatus 250A generally opposite first face 252A. First gerotor apparatus 10A and second gerotor apparatus 10A' may both be compressors, may both be expanders, or may include one expander and one compressor, depending on the particular embodiment or application.

Each of gerotor apparatuses 10A and 10A' may be substantially similar to gerotor apparatus 10*z* shown in FIG. 33 and described above. Gerotor apparatus 10A includes an outer gerotor 14A disposed within housing 12A, an outer gerotor chamber 30A at least partially defined by outer gerotor 14A, and an inner gerotor 16A at least partially disposed within outer gerotor chamber 30A. Similarly, gerotor apparatus 10A' includes an outer gerotor 14A' disposed within housing 12A, an outer gerotor chamber 30A' at least partially defined by outer gerotor 14A', and an inner gerotor 16A' at least partially disposed within outer gerotor chamber 30A'.

Outer gerotor 14A' may be rigidly coupled to, or integral with, outer gerotor 14A of gerotor apparatus 10A. Outer gerotors 14A and 14A' and inner gerotors 16A and 16A' are rotatably coupled to a single shaft 100A rigidly coupled to housing 12A. In particular, outer gerotors 14A and 14A' are rotatably coupled to first portions 102A of shaft 100A having a first axis, and inner gerotors 16A and 16A' are rotatably coupled to a second portion 104A of shaft 100A having a second axis offset from the first axis. Housing 12A includes a first valve plate 40A proximate first face 252A of apparatus 250A operable to control the flow of fluids through first gerotor apparatus 10A, and a second valve plate 40A' proximate second face 254A of apparatus 250A operable to control the flow of fluids through second gerotor apparatus 10A', such as described above with reference to FIGS. 12-13, for example. In addition, each of gerotor apparatuses 10A and 10A' may be a self-synchronizing gerotor apparatus similar to gerotor apparatus 10*z* shown in FIG. 33 as discussed above.

As discussed above, gerotor apparatus 10A includes an integrated motor 260A or generator 264A. Motor 260A or generator 264A may or may not be coupled to, or integrated with, housing 12A. In embodiments including a motor 260A, motor 260A may drive gerotor apparatus 10A by driving outer gerotors 14A and 14A', which may in turn drive inner gerotors 16A and 16A'. For example, motor 260A may drive one or more magnetic elements 262A coupled to, or integrated with, outer gerotors 14A and 14A'. In embodiments including a generator 260A, rotation of outer gerotors 14A and 14A' may provide power to generator 260A to produce electricity. Motor 260A or generator 264A may comprise any suitable type of motor or generator, such as a permanent magnet motor or generator, a switched reluctance motor (SRM) or generator, or an inductance motor or generator, for example.

Figure 35A:
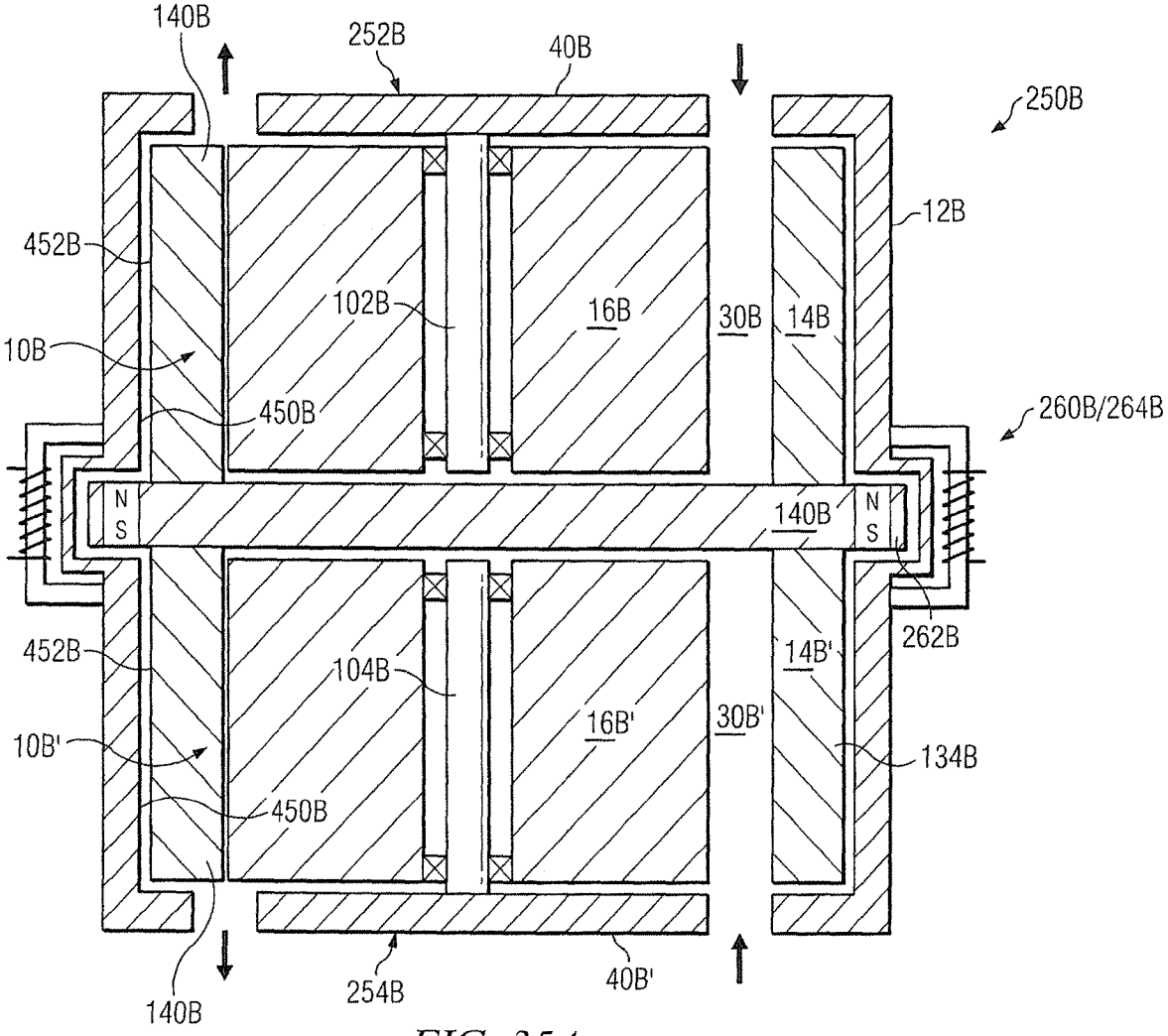
FIG. 35A illustrates an example cross-section of a dual gerotor apparatus having an integrated motor or generator, according to another embodiment of the invention.

FIG. 35A illustrates an example cross-section of a dual gerotor apparatus 250B having an integrated motor 260B or generator 264B according to another embodiment of the invention. Dual gerotor apparatus 250B is similar to gerotor apparatus 250A shown in FIG. 34, except that outer gerotors 14B and 14B' of dual gerotor apparatus 250B are rotatably coupled to an interior surface of housing 12B, rather than being rotatably coupled to a shaft 100, as discussed below in greater detail.

As shown in FIG. 35A, dual gerotor apparatus 250B includes a housing 12B and an integrated pair of gerotor apparatuses, including a first gerotor apparatus 10B proximate a first face 252B of apparatus 250B and a second gerotor apparatus 10B' proximate a second face 254B of apparatus 250B generally opposite first face 252B. First gerotor apparatus 10B and second gerotor apparatus 10B' may both be compressors, may both be expanders, or may include one expander and one compressor, depending on the particular embodiment or application.

Each of gerotor apparatuses 10B and 10B' may be substantially similar to gerotor apparatus 10*z* shown in FIG. 33 and described above. Gerotor apparatus 10B includes an outer gerotor 14B disposed within housing 12B, an outer gerotor chamber 30B at least partially defined by outer gerotor 14B, and an inner gerotor 16B at least partially disposed within outer gerotor chamber 30B. Similarly, gerotor apparatus 10B' includes an outer gerotor 14B' disposed within housing 12B, an outer gerotor chamber 30B' at least partially defined by outer gerotor 14B', and an inner gerotor 16B' at least partially disposed within outer gerotor chamber 30B'.

Inner gerotors 16B and 16B' are rotatably coupled to a pair of shaft portions 102B and 104B sharing a first axis such that inner gerotors 16B and 16B' rotate around the first axis. Outer gerotor 14B' may be rigidly coupled to, or integral with, outer gerotor 14B of gerotor apparatus 10B. Outer gerotors 14B and 14B' are rotatably coupled to an interior perimeter surface 450B of housing 12B and rotate around a second axis offset from the first axis. In particular, outer perimeter surfaces 452B of outer gerotors 14B and 14B' rotate within, and at least partially in contact with, interior perimeter surface 450B of housing 12B. Thus, at least portions of outer perimeter surfaces 452B of outer gerotors 14B and 14B' may be low-friction regions 140B in order to reduce friction and wear between outer perimeter surfaces 452B of outer gerotors 14B and 14B' and interior perimeter surface 450B of housing 12B. In addition, outer gerotors 14B and 14B' may be self-synchronized with inner gerotors 16B and 16B', such as described above regarding gerotor apparatus 10*z* shown in FIG. 33. Thus, in some embodiments, such as shown in FIG. 35A, outer gerotors 14B and 14B' may be completely formed from a low-friction material 134B.

Housing 12B includes a first valve plate 40B proximate first face 252B of apparatus 250B operable to control the flow of fluids through first gerotor apparatus 10B, and a second valve plate 40B' proximate second face 254B of apparatus 250B operable to control the flow of fluids through second gerotor apparatus 10B, such as described above with reference to FIGS. 12-13, for example.

As discussed above, gerotor apparatus 10B includes an integrated motor 260B or generator 264B. Motor 260B or generator 264B may or may not be coupled to, or integrated with, housing 12B. In embodiments including a motor 260B, motor 260B may drive gerotor apparatus 10B by driving outer gerotors 14B and 14B', which may in turn drive inner gerotors 16B and 16B'. For example, motor 260B may drive one or more magnetic elements 262B coupled to, or integrated with, outer gerotors 14B and 14B'. In this embodiment, one or more magnetic elements 262B are coupled to, or integrated with, outer gerotors 14B and 14B'. Magnetic elements 262B may be formed from a low-friction material 134B in order to reduce friction and wear between surfaces of magnetic elements 262B and inner gerotors 16B and 16B'.

In embodiments including a generator 260B, rotation of outer gerotors 14B and 14B' may provide power to generator 260B to produce electricity. Motor 260B or generator 264B may comprise any suitable type of motor or generator, such as a permanent magnet motor or generator, a switched reluctance motor (SRM) or generator, or an inductance motor or generator, for example.

Figure 35B:
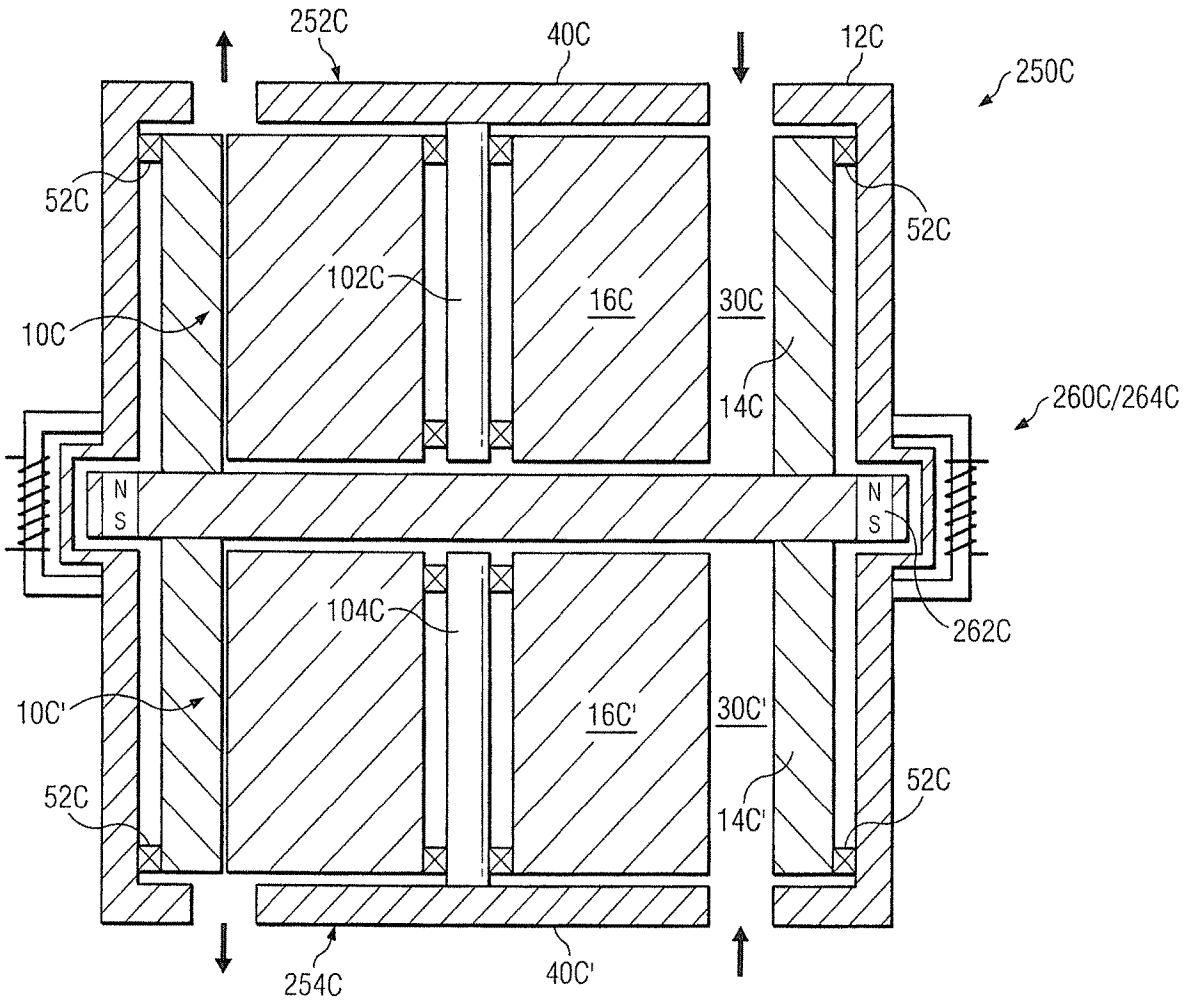
FIG. 35B illustrates an example cross-section of a dual gerotor apparatus having an integrated motor or generator, according to another embodiment of the invention.

FIG. 35B illustrates an example cross-section of a dual gerotor apparatus 250C having an integrated motor 260C or generator 264C according to another embodiment of the invention. Dual gerotor apparatus 250C is similar to gerotor apparatus 250B shown in FIG. 35A, except that outer gerotors 14C and 14C' of dual gerotor apparatus 250C are rotatably coupled to an interior surface of housing 12C by bearings, rather than direct contact between low-friction regions 140 of outer gerotors 14C and 14C' and the interior surface of housing 12C, as discussed below in greater detail.

As shown in FIG. 35B, dual gerotor apparatus 250C includes a housing 12C and an integrated pair of gerotor apparatuses, including a first gerotor apparatus 10C proximate a first face 252C of apparatus 250C and a second gerotor apparatus 10C' proximate a second face 254C of apparatus 250C generally opposite first face 252C. First gerotor apparatus 10C and second gerotor apparatus 10C' may both be compressors, may both be expanders, or may include one expander and one compressor, depending on the particular embodiment or application.

Gerotor apparatuses 10C and 100' may be substantially similar to gerotor apparatuses 10B and 10B' shown in FIG. 35A. Gerotor apparatus 10C includes an outer gerotor 14C disposed within housing 12C, an outer gerotor chamber 30C at least partially defined by outer gerotor 14C, and an inner gerotor 16C at least partially disposed within outer gerotor chamber 30C. Similarly, gerotor apparatus 10C' includes an outer gerotor 14C' disposed within housing 12C, an outer gerotor chamber 30C' at least partially defined by outer gerotor 14C', and an inner gerotor 16C' at least partially disposed within outer gerotor chamber 30C'.

Inner gerotors 16C and 16C' are rotatably coupled to a pair of shaft portions 102C and 104C sharing a first axis such that inner gerotors 16C and 16C' rotate around the first axis. Outer gerotor 14C' may be rigidly coupled to, or integral with, outer gerotor 14C of gerotor apparatus 100. Outer gerotors 14C and 14C' are rotatably coupled to housing 12C by one or more ring-shaped bearings 52C and rotate around a second axis offset from the first axis.

In some embodiments, outer gerotors 14C and 14C' may be self-synchronized with inner gerotors 16C and 16C', such as described above regarding gerotor apparatus 10*z* shown in FIG. 33. Thus, in some embodiments, although not shown in order to simplify FIG. 35A, outer gerotors 14C and 14C' and/or inner gerotors 16C and 16C' may include low-friction regions 140C to facilitate the synchronization.

As discussed above, gerotor apparatus 10C includes an integrated motor 260C or generator 264C. Motor 260C or generator 264C may or may not be coupled to, or integrated with, housing 12C. In embodiments including a motor 260C, motor 260C may drive gerotor apparatus 10C by driving outer gerotors 14C and 14C', which may in turn drive inner gerotors 16C and 16C'. For example, motor 260C may drive one or more magnetic elements 262C coupled to, or integrated with, outer gerotors 14C and 14C'. In this embodiment, one or more magnetic elements 262C are coupled to, or integrated with, outer gerotors 14C and 14C'. In embodiments including a generator 260C, rotation of outer gerotors 14C and 14C' may provide power to generator 260C to produce electricity. Motor 260C or generator 264C may comprise any suitable type of motor or generator, such as a permanent magnet motor or generator, a switched reluctance motor (SRM) or generator, or an inductance motor or generator, for example.

Figure 36:
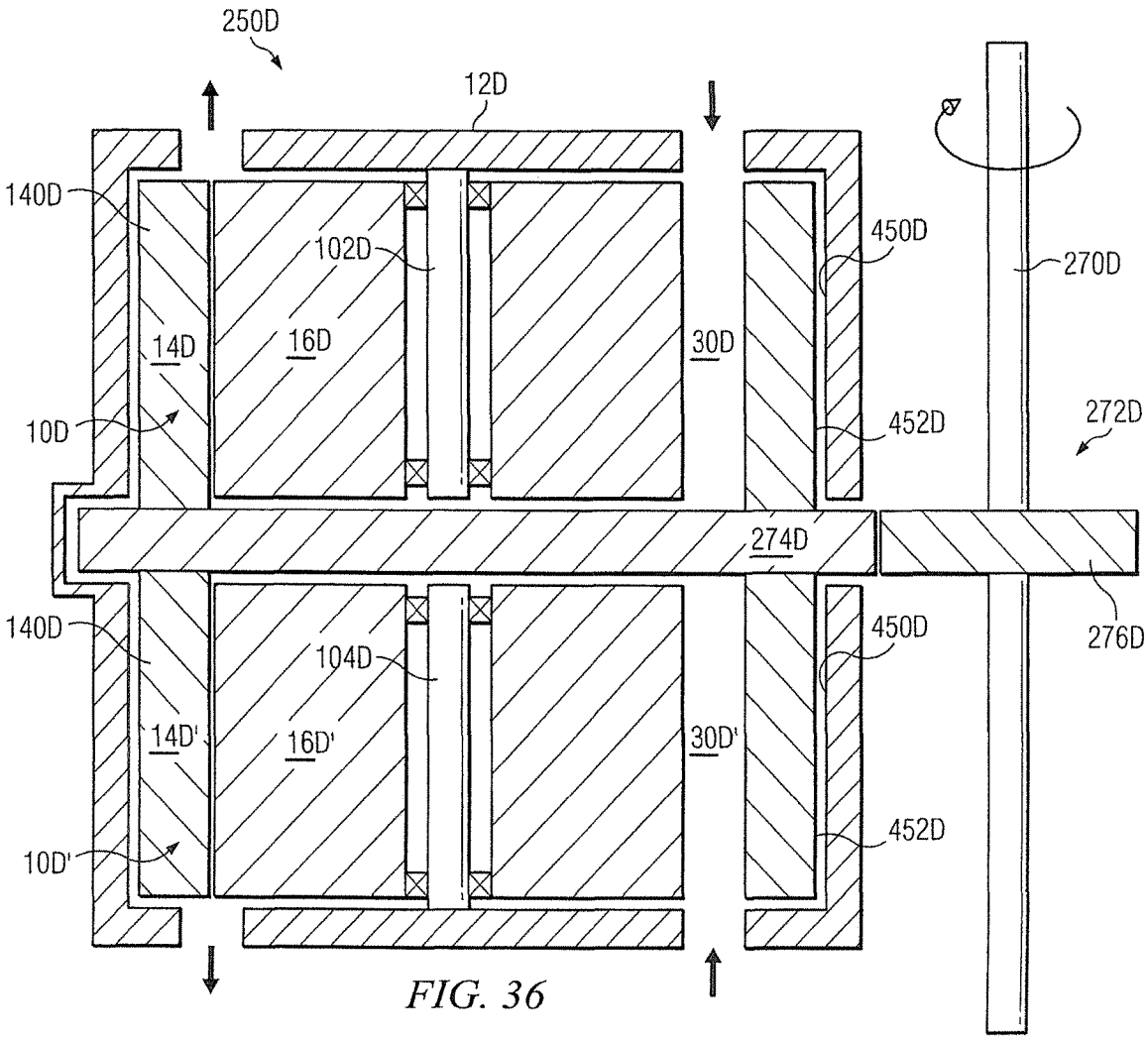
FIG. 36 illustrates example cross-sections of dual gerotor apparatuses, according to other embodiments of the invention.
Figure 37:
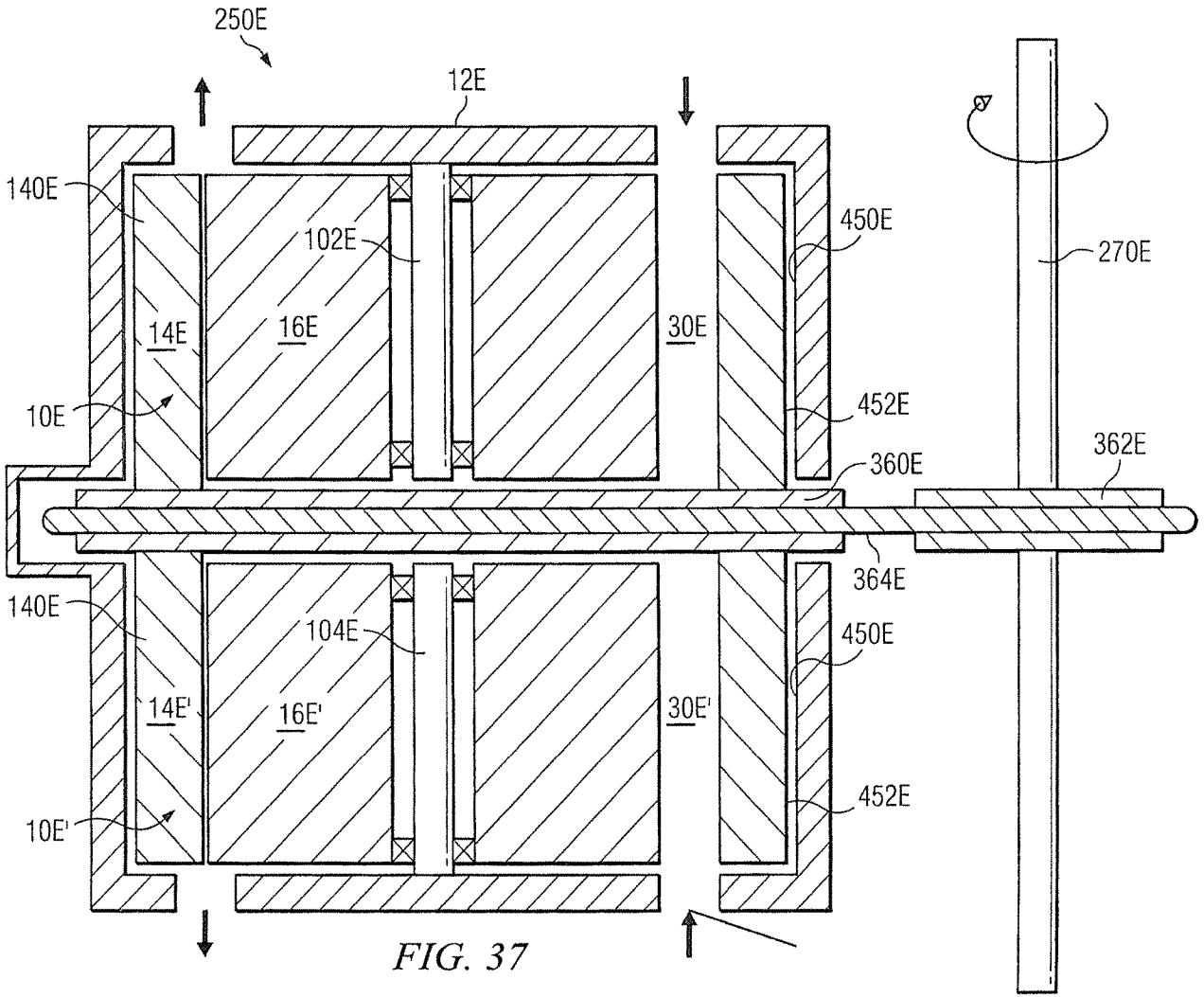
FIG. 37 illustrates example cross-sections of dual gerotor apparatuses, according to other embodiments of the invention.

FIGS. 36-37 illustrate example cross-sections of dual gerotor apparatuses 250D and 250E according to other embodiments of the invention. Dual gerotor apparatuses 250D/250E are similar to dual gerotor apparatus 250B shown in FIG. 35A, except that dual gerotor apparatuses 250D/250E are powered by a rotatable shaft 270D/270E coupled to outer gerotors 14D/14E and 14D'/14E' of dual gerotor apparatus 250D/250E by a coupling device 272D/272E, rather than by a motor, as discussed below in greater detail.

As shown in FIGS. 36-37, dual gerotor apparatuses 250D/250E include a housing 12D/12E and an integrated pair of gerotor apparatuses, including a first gerotor apparatus 10D/10E and a second gerotor apparatus 10D'/10E'. First gerotor apparatus 10D/10E and second gerotor apparatus 10D'/10E' may both be compressors, may both be expanders, or may include one expander and one compressor, depending on the particular embodiment or application.

Gerotor apparatuses 10D/10E and 10D'/10E' may be substantially similar to gerotor apparatuses 10B and 10B' shown in FIG. 35A. Gerotor apparatus 10D/10E includes an outer gerotor 14D/14E and an inner gerotor 16D/16E, and gerotor apparatus 10D'/10E' includes an outer gerotor 14D'/14E' and an inner gerotor 16D'/16E'. Inner gerotors 16D/16E and 16D'/16E' are rotatably coupled to a pair of shaft portions 102D/102E and 104D/104E sharing a first axis. Outer gerotor 14D'/14E' may be rigidly coupled to, or integral with, outer gerotor 14D of gerotor apparatus 10D/10E. Like outer gerotors 14B and 14B' shown in FIG. 35A, outer gerotors 14D/14E and 14D'/14E' shown in FIGS. 36-37 are rotatably coupled to an interior perimeter surface 450D/450E of housing 12D/12E. Thus, all or portions of outer gerotors 14D/14E and 14D'/14E' may be low-friction regions 140D/140E in order to reduce friction and wear between outer perimeter surfaces 452D/452E of outer gerotors 14D/14E and 14D'/14E' and interior perimeter surface 450D/450E of housing 12D/12E. In addition, outer gerotors 14D/14E and 14D'/14E' may be self-synchronized with inner gerotors 16D/16E and 16D'/16E', such as described above regarding gerotor apparatus 10*z* shown in FIG. 33. Thus, in some embodiments, such as shown in FIGS. 36-37, outer gerotors 14D/14E and 14D'/14E' may be completely formed from a low-friction material 134D/134E.

Dual gerotor apparatuses 250D/250E are powered by a rotatable shaft 270D/270E coupled to outer gerotors 14D/14E and 14D'/14E' of dual gerotor apparatuses 250D/250E, such as described above with reference to FIGS. 20-21, for example. As shown in FIG. 36, rotatable shaft 270D is coupled to the rigidly coupled, or integrated, outer gerotors 14D and 14D' by a coupling system 272D such that rotation of outer gerotors 14D and 14D' causes rotation of shaft 270D and/or vice-versa. Coupling system 272D includes a first gear 274D rigidly coupled to outer gerotors 14D and 14D' and interacting with a second gear 276D rigidly coupled to rotatable drive shaft 270D. As shown in FIG. 37, coupling system 272E includes a first coupler 360E rigidly coupled to outer gerotors 14E and 14E' and interacting with a second coupler 362E rigidly coupled to rotatable drive shaft 270E. A flexible coupling device 364E, such as a chain or belt, couples first coupler 360E and second coupler 362E such that rotation of outer gerotors 14E and 14E' causes rotation of drive shaft 270E, and vice versa.

Figure 38:
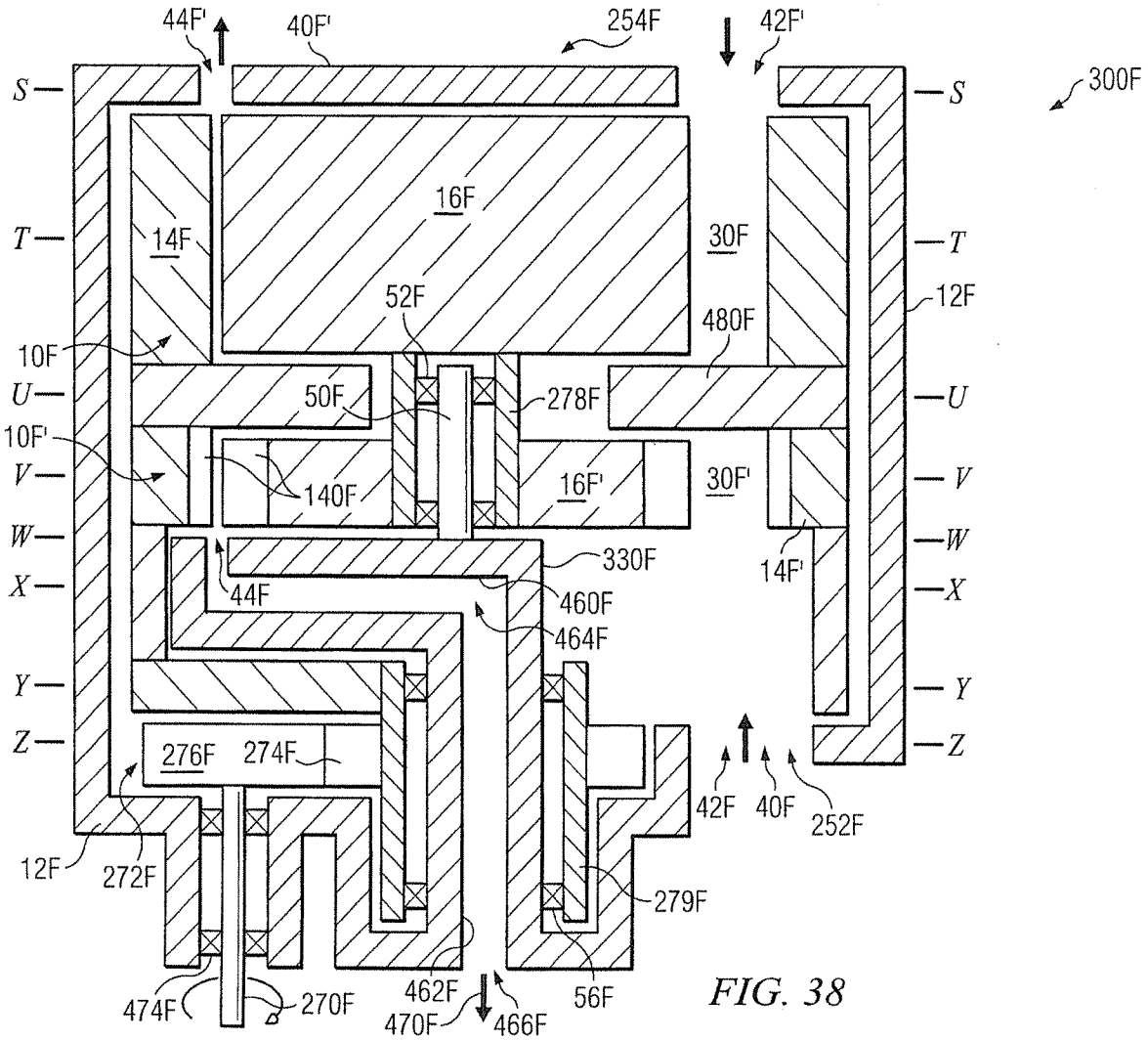
FIG. 38 illustrates an example cross-section of a face-breathing engine system in accordance with one embodiment of the invention.

FIG. 38 illustrates an example cross-section of a face-breathing engine system 300F in accordance with one embodiment of the invention. Engine system 300F includes a housing 12F, a compressor gerotor apparatus 10F, and an expander gerotor apparatus 10F'. Compressor gerotor apparatus 10F includes a compressor outer gerotor 14F disposed within housing 12F, a compressor outer gerotor chamber 30F at least partially defined by compressor outer gerotor 14F, and a compressor inner gerotor 16F at least partially disposed within compressor outer gerotor chamber 30F. Similarly, expander gerotor apparatus 10F' includes an expander outer gerotor 14F' disposed within housing 12F, an expander outer gerotor chamber 30F' at least partially defined by expander outer gerotor 14F', and an expander inner gerotor 16F' at least partially disposed within expander outer gerotor chamber 30F'.

Compressor outer gerotor 14F may be rigidly coupled to, or integral with, expander outer gerotor 14F'. Similarly, compressor inner gerotor 16F may be rigidly coupled to, or integral with, expander inner gerotor 16F'. Compressor and expander inner gerotors 16F and 16F' may be rigidly coupled to a cylindrical member 278F, which may be rotatably coupled by one or more ring-shaped bearings 52F to a shaft 50F rigidly coupled to housing 12F. Compressor and expander outer gerotors 14F and 14F' may be rigidly coupled to a cylindrical member 279F, which may be rotatably coupled to cylindrical portion 330F of housing 12F by one or more ring-shaped bearings 56F.

Engine system 300F breathes through a first face 252F and second face 254F of system 300F. Housing 12F includes compressor valve portions 40F proximate first face 252F of system 300F and operable to control the flow of fluids through compressor gerotor apparatus 10F, and an expander valve plate 40F' proximate second face 254F of system 300F operable to control the flow of fluids through expander gerotor apparatus 10F'. Compressor valve portions 40F define at least one compressor fluid inlet 42F allowing fluids to enter compressor outer gerotor chamber 30F, and at least one compressor fluid outlet 44F allowing fluids to exit compressor outer gerotor chamber 30F. Housing 12F may include compressor outlet channeling portions 460F and 462F that define fluid passageways 464F and 466F to carry fluids (e.g., compressed gasses) away from compressor outer gerotor chamber 30F, as indicated by arrow 470F. Expander valve plate 40F' defines at least one expander fluid inlet 42F' allowing fluids to enter expander outer gerotor chamber 30F', and at least one expander fluid outlet 44F' allowing fluids to exit expander outer gerotor chamber 30F'.

Compressor gerotor apparatus 10F and/or expander gerotor apparatus 10F' of engine system 300F shown in FIG. 16 may be self-synchronizing, such as described above regarding the various gerotor apparatuses discussed herein. Compressor gerotor apparatus 10F of engine system 300F may include one or more low-friction regions 140F operable to perform the synchronization function for both compressor gerotor apparatus 10F and expander gerotor apparatus 10F', such as described above with reference to FIGS. 14-26, for example. In other embodiments, engine system 300F may include a synchronizing system 18F, such as shown in FIGS. 1-6, for example. In addition, although not shown in order to simplify FIG. 38, a lubricant may be communicated through lubricant channels to provide lubrication between compressor inner gerotor 16F and compressor outer gerotor 14F.

Engine system 300F may power a rotatable shaft 270F coupled to outer gerotors 14F and 14F', such as described above with reference to FIGS. 20-21, for example. As shown in FIG. 38, rotatable shaft 270F is coupled outer gerotors 14F and 14F' by a coupling system 272F such that rotation of outer gerotors 14F and 14F' causes rotation of shaft 270F and/or vice-versa. Coupling system 272F includes a first gear 274F rigidly coupled to cylindrical member 279F interacting with a second gear 276F rigidly coupled to rotatable drive shaft 270F, which may be rotatably coupled to housing 12F by one or more ring-shaped bearings 474F. In alternative embodiments, coupling system 272F may include a flexible coupling device, such as a belt or chain.

In this embodiment, all of the bearings included in engine system 300F, including bearings 52F, 56F, and 474F, are located near compressor gerotor apparatus 10F or distanced away from expander gerotor apparatus 10F'. This may be advantageous because compressor gerotor apparatus 10F is generally cooler than expander gerotor apparatus 10F', thus protecting bearings 52F, 56F, and 474F from thermal effects.

Figure 39:
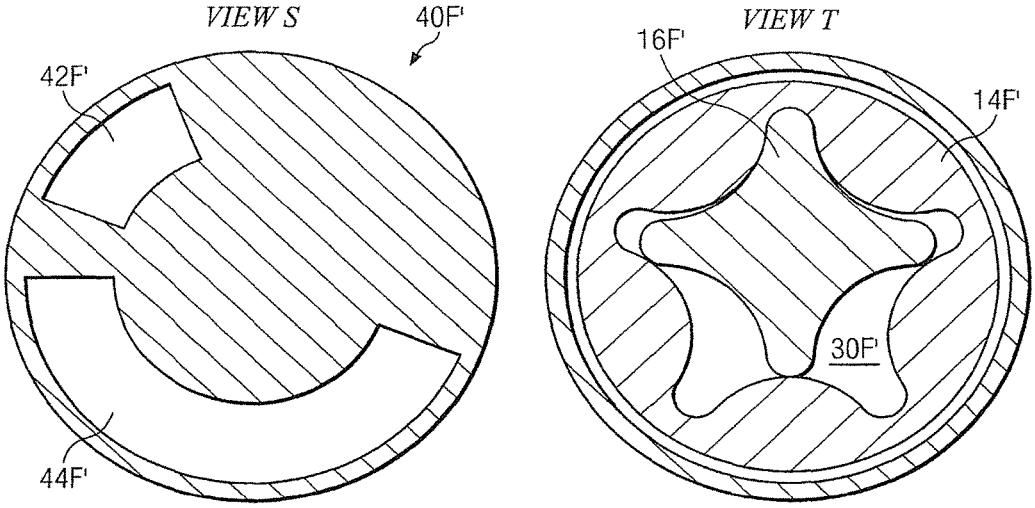
FIG. 39 illustrates example cross-sectional views S, T and D of engine system taken along lines S, T and D, respectively, shown in FIG. 38 according to one embodiment of the invention.
Figure 39:
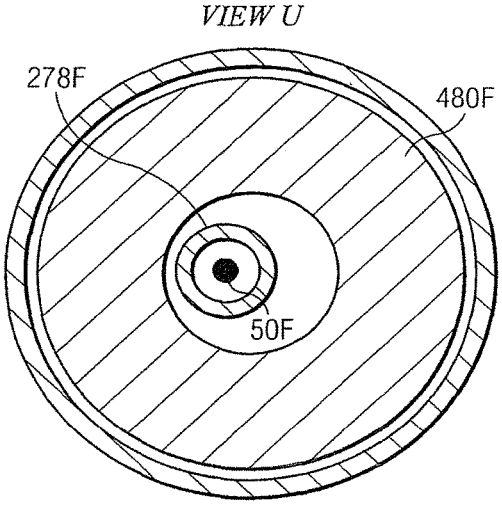

FIG. 39 illustrates example cross-sectional views S, T and U of engine system 300F taken along lines S, T and U, respectively, shown in FIG. 38 according to one embodiment of the invention.

View S is a cross-sectional view of expander valve plate 40F', which includes an expander fluid inlet 42F' allowing fluids to enter expander outer gerotor chamber 30F', and an expander fluid outlet 44F' allowing fluids to exit expander outer gerotor chamber 30F'.

View T is a cross-sectional view of expander gerotor apparatus 10F', showing expander outer gerotor 14F', expander inner gerotor 16F', and expander outer gerotor chamber 30F'.

View U is a cross-sectional view taken through a portion 480F of housing 12F, and showing shaft 50F and cylindrical member 278F rigidly coupled to inner gerotors 16F and 16F'.

Figure 40:
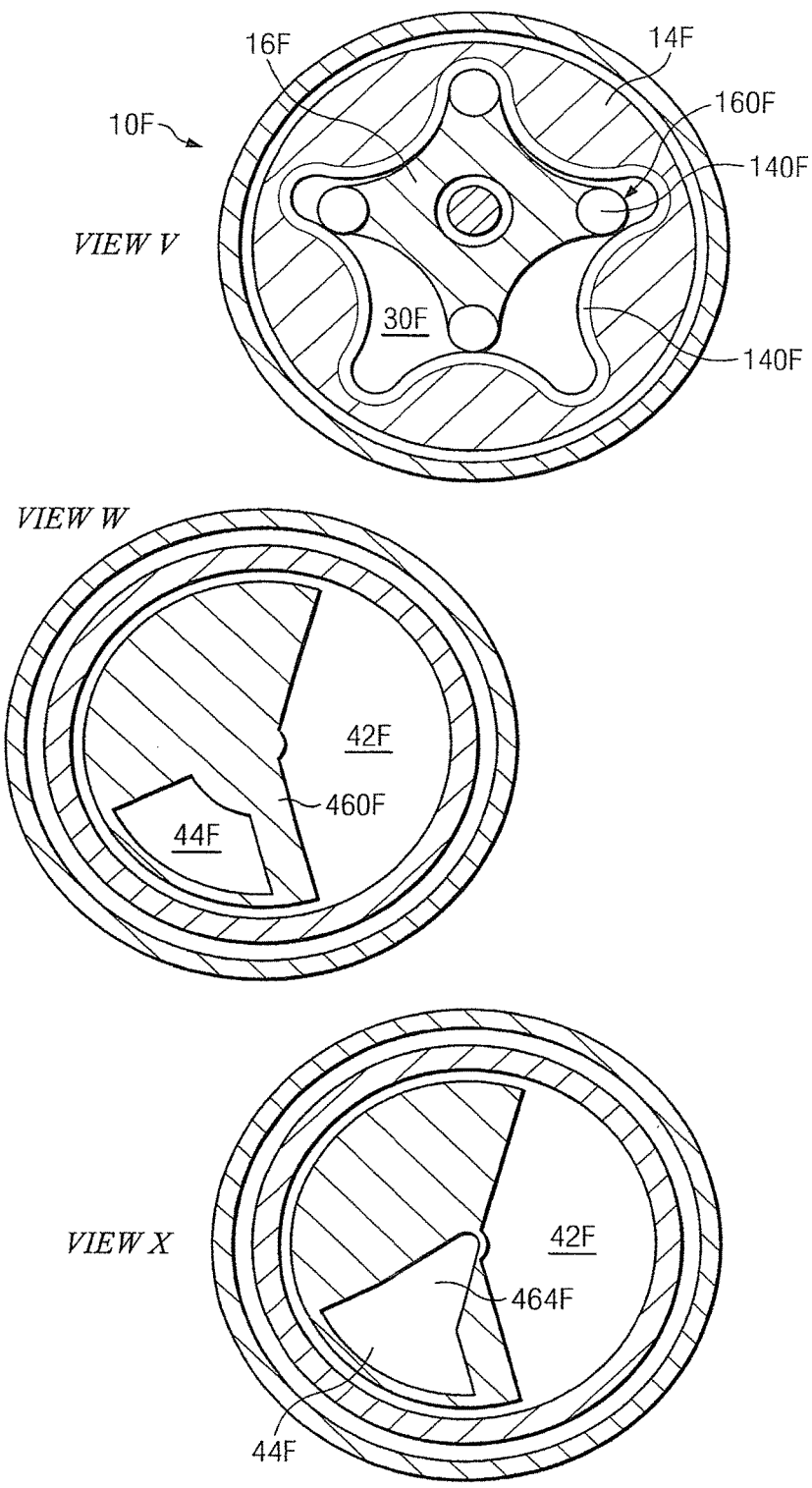
FIG. 40 illustrates example cross-sectional views V, Wand X of engine system taken along lines V, Wand X, respectively, shown in FIG. 38 according to one embodiment of the invention.

FIG. 40 illustrates example cross-sectional views V, W and X of engine system 300F taken along lines V, W and X, respectively, shown in FIG. 38 according to one embodiment of the invention.

View V is a cross-sectional view of compressor gerotor apparatus 10F, showing compressor outer gerotor 14F, compressor inner gerotor 16F, and compressor outer gerotor chamber 30F. Compressor inner gerotor 16F includes low-friction regions 140F at each tip 160F, and compressor outer gerotor 14F includes low-friction regions 140F proximate compressor outer gerotor chamber 30F.

View W is a cross-sectional view taken through outer channeling portion 460F of housing 12F, which view indicates compressor fluid inlet 42F and compressor fluid outlet 44F. As shown in view W, the cross-sectional area of compressor fluid inlet 42F is greater than the cross-sectional area and compressor fluid outlet 44F.

View X is a cross-sectional view taken through outer channeling portion 460F of housing 12F, as well as through passageway 464F formed by outer channeling portion 460F.

View X indicates compressor fluid inlet 42F, compressor fluid outlet 44F, and passageway 464F. As discussed above, compressor fluid outlet 44F and passageway 464F are operable to carry compressed fluids (e.g., high-pressurized gasses) away from compressor apparatus 10F.

Figure 41:
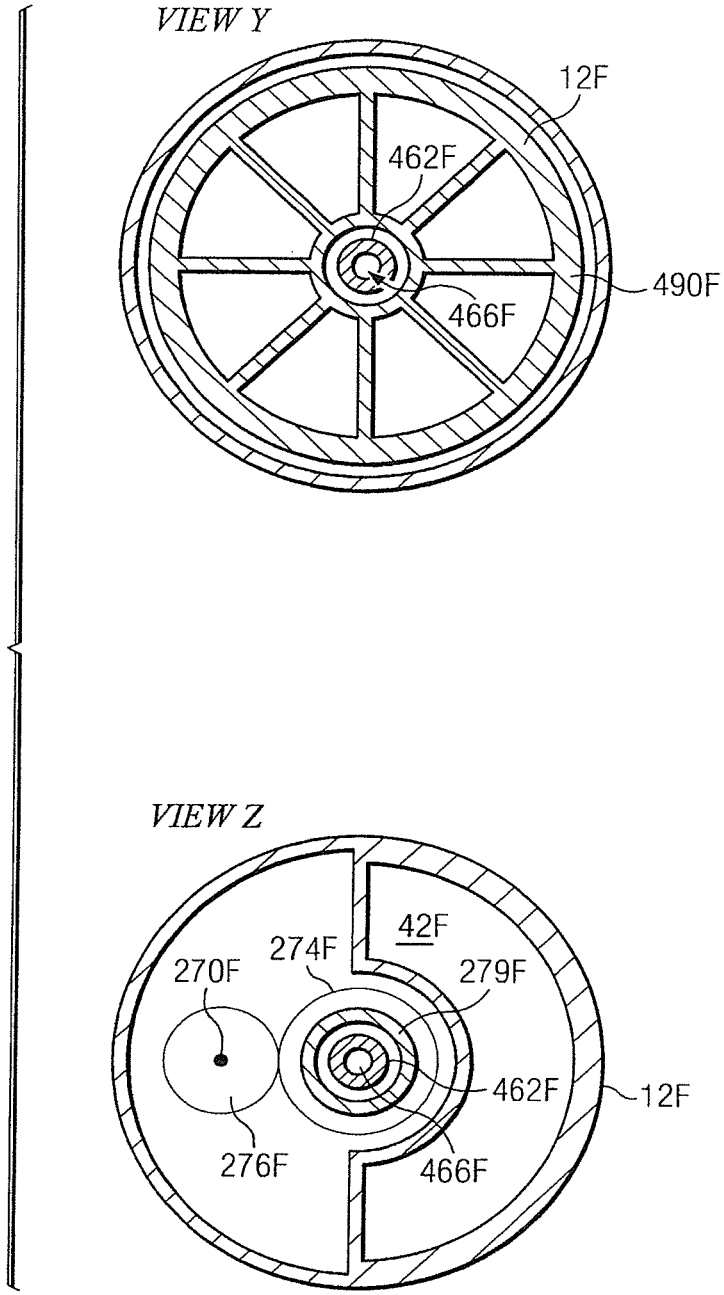
FIG. 41 illustrates example cross-sectional views Y and Z of engine system taken along lines Y and Z, respectively, shown in FIG. 38 according to one embodiment of the invention.

FIG. 41 illustrates example cross-sectional views Y and Z of engine system 300F taken along lines Y and Z, respectively, shown in FIG. 38 according to one embodiment of the invention.

View Y is a cross-sectional view of a spoked-hub member 490F coupling outer gerotors 14F and 14F' to cylindrical member 279F (see also FIG. 38). As discussed above, cylindrical member 279F rotates around channeling portion 462F of housing 12F, which defines fluid passageway 466F. The spoked-hub cross-section of spoked-hub member 490F allows fluids to enter compressor apparatus 10F through compressor fluid inlet 42F.

View Z is a cross-sectional view taken through housing 12F, indicating compressor fluid inlet 42F, cylindrical member 279F, channeling portion 462F of housing 12F, fluid passageway 466F, first gear 274F and second gear 276F of coupling system 272F, and rotatable drive shaft 270F.

Figure 42:
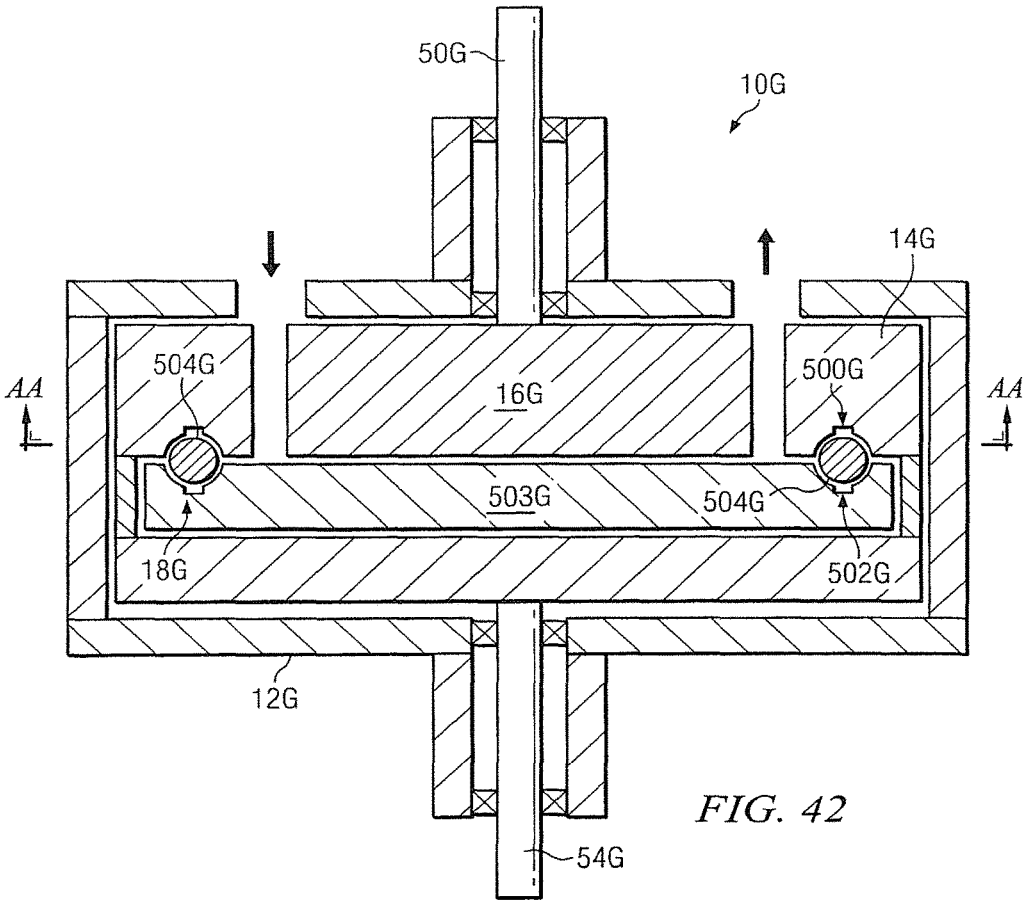
FIG. 42 illustrates an example cross-section of a gerotor apparatus including a synchronizing system in accordance with one embodiment of the invention.

FIG. 42 illustrates an example cross-section of a gerotor apparatus 10G including a synchronizing system 18G in accordance with one embodiment of the invention. Gerotor apparatus 10G includes an outer gerotor 14G, an outer gerotor chamber 30G at least partially defined by outer gerotor 14G, and an inner gerotor 16G at least partially disposed within outer gerotor chamber 30G. Inner gerotor 16G is rigidly coupled to a first shaft 50G, which is rotatably coupled to housing 12G, such that inner gerotor 16G rotates around a first axis. Outer gerotor 14G is rigidly coupled to a second shaft 54G, which is rotatably coupled to housing 12G, such that inner gerotor 16G rotates around a second axis offset from first axis (here, in a direction into or out of the page).

Synchronizing system 18G is coupled to, or integrated with, inner gerotor 16G and outer gerotor 14G. Synchronizing system 18G includes an alignment guide, or track, 500G formed in outer gerotor 14G, and one or more sockets 502G formed in a synchronization disc 503G rigidly coupled to, or integrated with, inner gerotor 16G. Sockets 502G may be located outside the outer perimeter of inner gerotor 16G. One or more spherical balls 504G are socket-mounted within sockets 502G such that they may travel (e.g., roll) along alignment track 5000, which synchronizes the relative rotation of inner gerotor 16G and outer gerotor 14G. If balls 504G are well lubricated, they may rotate, rather than slide, within sockets 502G and alignment track 500G, thus reducing friction and wear. Because balls 504G are constantly being accelerated and decelerated as they move along alignment track 500G, sliding may be reduced and rotation encouraged by making balls 504G as light as reasonably possible. Thus, in some embodiments, balls 504G are ceramic or hollow-metal spheres.

In other embodiments, instead of balls 504G, synchronizing system 18G may include a number of alignment members (such as knobs, rollers or pegs, for example) rigidly coupled to inner gerotor 16G. Like balls 504G, such alignment members may travel within alignment track 500G formed in outer gerotor 14G in order to synchronize the relative rotation of inner gerotor 16G and outer gerotor 14G. In addition, in other embodiments, sockets 502G may be formed in outer gerotor 14G and alignment track 500G may be formed in synchronization disc 503G rigidly coupled to, or integrated with, inner gerotor 16G.

Figure 43:
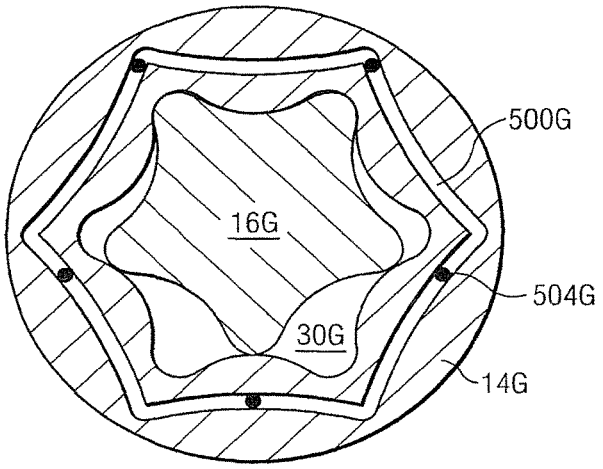
FIG. 43 illustrates a cross-section view of gerotor apparatus taken through line AA shown in FIG. 42.

FIG. 43 illustrates a cross-section view of gerotor apparatus 10G taken through line AA shown in FIG. 42. In particular, FIG. 43 shows outer gerotor 14G, inner gerotor 16G, outer gerotor chamber 30G, alignment track 500G formed in outer gerotor 14G, and a number of balls 504G mounted within sockets 502G (see FIG. 42) and traveling along alignment track 500G.

In some embodiments, the shape of alignment track 500G may be defined as described with respect to one or more of FIGS. 88-91 of U.S. patent application Ser. No. 10/359,487, which is herein incorporated by reference, as discussed above. Alignment track 500G may include a number of tips 506G corresponding to the number of tips 162G defined by outer gerotor chamber 30G. Thus, in this embodiment, alignment track 500G includes six tips 506G corresponding with the six tips 162G of outer gerotor chamber 30G. Synchronizing system 18G may include a number of balls 504G corresponding to the number of tips 160G defined by inner gerotor 16G. Thus, in this embodiment, synchronizing system 18G includes five balls 504G corresponding with the five tips 160G of inner gerotor 16G.

Figure 44:
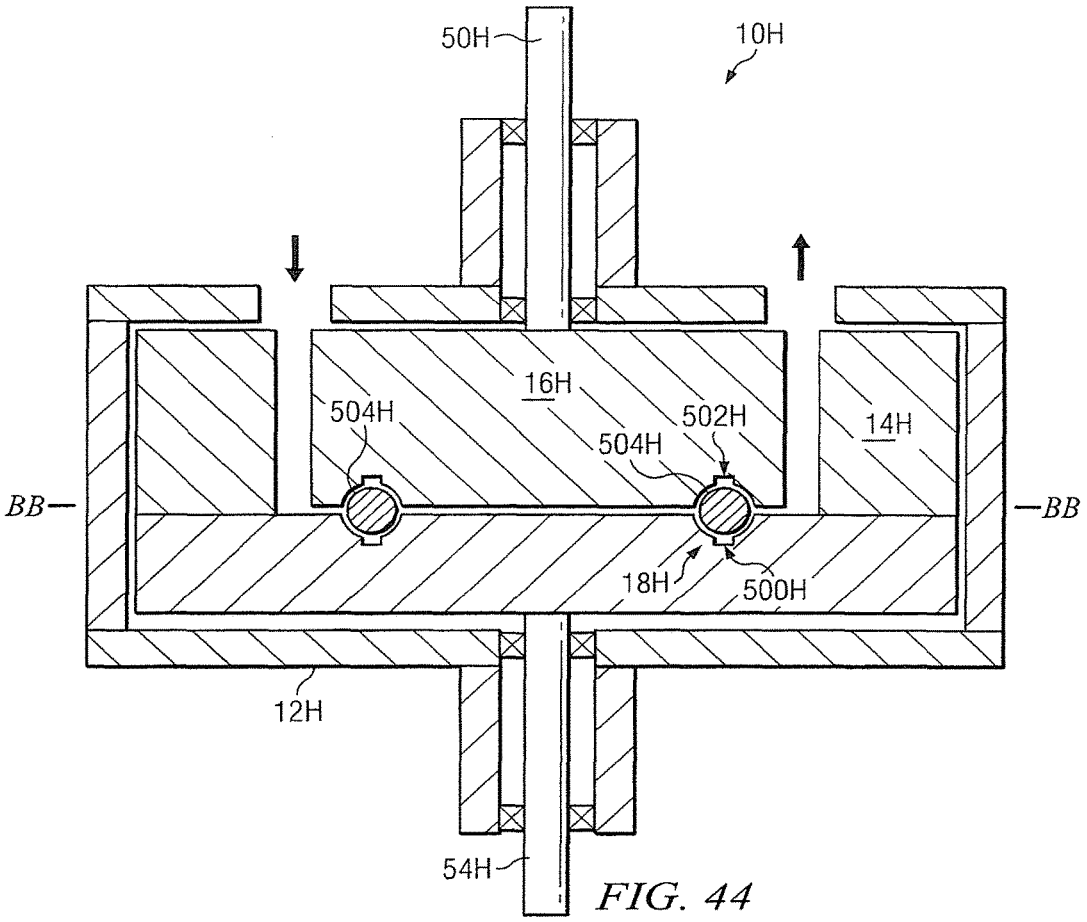
FIG. 44 illustrates an example cross-section of a gerotor apparatus including a synchronizing system in accordance with one embodiment of the invention.

FIG. 44 illustrates an example cross-section of a gerotor apparatus 10H including a synchronizing system 18H in accordance with one embodiment of the invention. Gerotor apparatus 10H includes an outer gerotor 14H, an outer gerotor chamber 30H at least partially defined by outer gerotor 14H, and an inner gerotor 16H at least partially disposed within outer gerotor chamber 30H. Inner gerotor 16H is rigidly coupled to a first shaft 50H, which is rotatably coupled to housing 12H, such that inner gerotor 16H rotates around a first axis. Outer gerotor 14H is rigidly coupled to a second shaft 54H, which is rotatably coupled to housing 12H, such that inner gerotor 16H rotates around a second axis offset from first axis (here, in a direction into or out of the page).

Synchronizing system 18H is coupled to, or integrated with, inner gerotor 16H and outer gerotor 14H. Synchronizing system 18H includes an outer gerotor alignment guide, or track, 500H formed in outer gerotor 14F, and one or more sockets 502H formed within inner gerotor 16F itself. One or more spherical balls 504H are socket-mounted within sockets 502H such that they may travel (e.g., roll) along alignment track 500H, which synchronizes the relative rotation of inner gerotor 16H and outer gerotor 14H. If balls 504H are well lubricated, they may rotate, rather than slide, within sockets 502H and alignment track 500H, thus reducing friction and wear. Because balls 504H are constantly being accelerated and decelerated as they move along alignment track 500H, sliding may be reduced and rotation encouraged by making balls 504H as light as reasonably possible. Thus, in some embodiments, balls 504H are ceramic or hollow-metal spheres.

In other embodiments, synchronizing system 18H may include a number of alignment members (such as knobs, rollers or pegs, for example) rigidly coupled to inner gerotor 16H instead of balls 504H. Like balls 504H, such alignment members may travel within alignment track 500H formed in outer gerotor 14H in order to synchronize the relative rotation of inner gerotor 16H and outer gerotor 14H. In addition, in other embodiments, sockets 502H may be formed in outer gerotor 14H and alignment track 500H may be formed in inner gerotor 16H.

Figure 45:
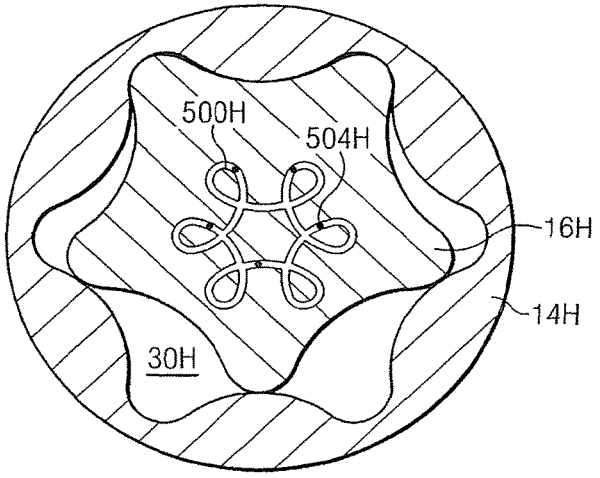
FIG. 45 illustrates a cross-section view of gerotor apparatus taken through line BB shown in FIG. 44.

FIG. 45 illustrates a cross-section view of gerotor apparatus 10H taken through line BB shown in FIG. 44. In particular, FIG. 45 shows outer gerotor 14H, inner gerotor 16H, outer gerotor chamber 30H, alignment track 500H formed in outer gerotor 16H, and a number of balls 504H mounted within sockets 502H (see FIG. 44) and traveling along alignment track 500H.

In some embodiments, the shape of alignment track 500H may be defined as described at least with respect to one or more of FIGS. 88-91 of U.S. patent application Ser. No. 10/359,487, which is herein incorporated by reference, as discussed above. Alignment track 500H may include a number of tips 506H corresponding to the number of tips 162H defined by outer gerotor chamber 30H. Thus, in this embodiment, alignment track 500H includes six tips 506H corresponding with the six tips 162H of outer gerotor chamber 30H. Synchronizing system 18H may include a number of balls 504H corresponding to the number of tips 160H defined by inner gerotor 16H. Thus, in this embodiment, synchronizing system 18H includes five balls 504H corresponding with the five tips 160H of inner gerotor 16H.

Generally, the inner and outer gerotors described above have been based upon a hypocycloid or an epicycloid. These geometric shapes are determined by rolling a small circle inside or outside a large circle. The diameter of the larger circle is an integer number times the diameter of the small circle.

$$D_L=\alpha D_s \ (\alpha=\text{integer})$$

For the hypocycloid and epicycloid, the reference point is located on the outside diameter of the smaller circle $$r=D_s$$

Figure 105:
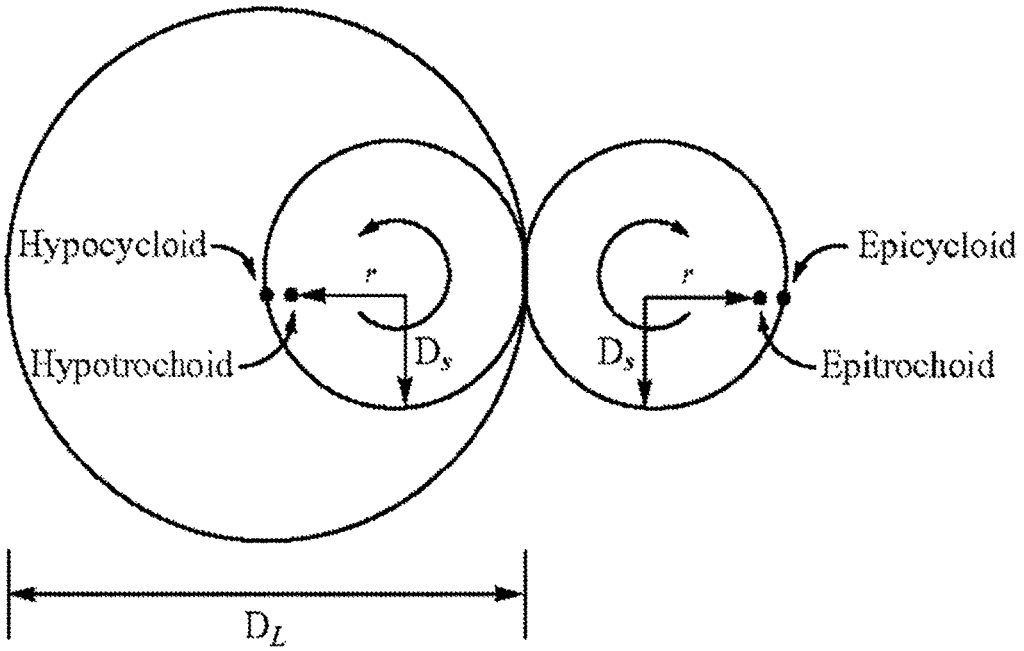
FIG. 105 illustrates the reference point traces of a hypocycloid, hypotrochoid, epicycloid, and epitrochoids.

With reference to FIG. 105, the reference point traces the hypocycloid shape when the small circle is rotated inside the larger circle and it traces the epicycloid shape when the small circle is rotated outside the larger circle.

The hypocycloid and epicycloid are special cases of the general cases of hypotrochoids and epitrochoids, respectively. In the general cases, the reference point is located at an arbitrary radius. In one embodiment, for processing fluid, the reference point is at a radius within the smaller circle:

$$r\leq D_s$$

Figure 106:
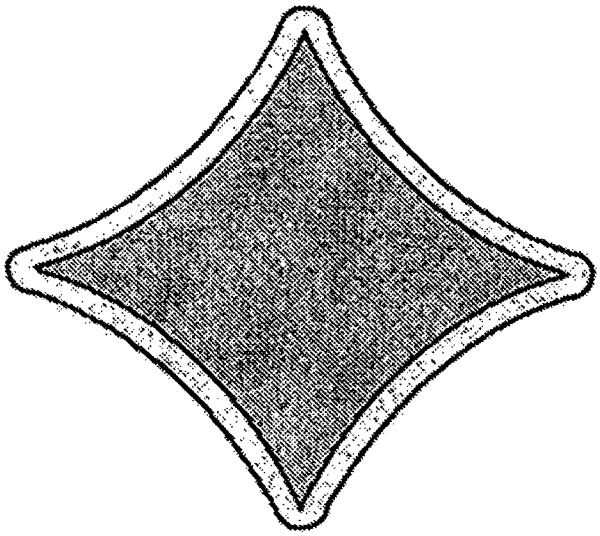
FIG. 106 illustrates an example of adding an offset to hypocycloid, hypotrochoid, epicycloid, and epitrochoids to strengthen tips.

The hypotrochoids and epitrochoids (and the special cases of hypocycloids and epicycloids) have relatively sharp tips, which may be mechanically fragile. To strengthen the tips, an offset may be added, as shown in FIG. 106.

For an inner gerotor of defined geometry (e.g., hypocycloid, epicycloid, hypotrochoid, epitrochoid) the outer conjugate is the geometry of the outer gerotor. Conceptually, the outer conjugate may be determined by imagining the inner gerotor is mated with a tray of sand. The inner gerotor and tray of sand each spin about their respective centers. The relative spinning rate is determined by the relative number of inner and outer teeth. The outer conjugate is the shape of the remaining sand that is not pushed away. In some cases, the outer conjugate is a well-defined shape with a name (e.g., hypocycloid, epicycloid, hypotrochoid, epitrochoid); in other cases, the outer conjugate does not have a name.

For an outer gerotor of defined geometry (e.g., hypocycloid, epicycloid, hypotrochoid, epitrochoid) the inner conjugate is the geometry of the inner gerotor. Conceptually, the inner conjugate may be determined by imagining the outer gerotor is mated with a tray of sand. The outer gerotor and tray of sand each spin about their respective centers. The relative spinning rate is determined by the relative number of inner and outer teeth. The inner conjugate is the shape of the remaining sand that is not pushed away. In some cases, the inner conjugate is a well-defined shape with a name (e.g., hypocycloid, epicycloid, hypotrochoid, epitrochoid); in other cases, the inner conjugate does not have a name.

The following table shows the combinations of geometries of inner and outer gerotors:

| Combination | Inner gerotor | Outer gerotor | Possible? |
|---|---|---|---|
| A | hypocycloid | hypocycloid | yes |
| B | epicycloid | epicycloid | yes |
| C | hypocycloid | epicycloid | yes |
| D | epicycloid | hypocycloid | no |
| E | hypotrochoid | conjugate | yes |
| F | conjugate | hypotrochoid | yes |
| G | epitrochoid | conjugate | yes |
| H | conjugate | epitrochoid | yes |

The following articles, which are herein incorporated by reference, provide detailed methods for defining the geometry of hypocycloids, epicycloids, hypotrochoids, epitrochoids, and conjugates with and without offsets:

Jaroslaw Stryczek, *Hydraulic Machines with Cycloidal Gearing*, Archiwum Budowy Maszyn (Archive of Mechanical Engineering), Vol. 43, No. 1, pp. 29-72 (1996).

J. B. Shung and G. R. Pennock, *Geometry for Trochoidal-Type Machines with Conjugate Envelopes, Mechanisms and Machine Theory*, Vol. 29, No. 1, pp. 25-42 (1994).

FIGS. 46-49 illustrate a gerotor apparatus 810*a* according to one embodiment of the invention that is based upon Combination E in the above table, a hypotrochoid inner gerotor 816*a* and a conjugate outer gerotor 814*a*. Gerotor apparatus 810*a* may function both as a compressor or an expander; in the illustrated embodiment, it is assumed to be a compressor. An advantage of Combination E gerotors is that they have very large volumetric capacities, compared to many of the other alternatives. In the example shown in FIGS. 46-49, outer gerotor 814*a* is disposed within a housing 812*a* and is rotatable with respect to housing 812*a* via any suitable manner, such as a shaft 801 and suitable bearings 802. As illustrated best in FIG. 47, outer gerotor 814*a* includes one tip (sometimes referred to as a "lobe"); however, outer gerotor 814*a* may include any suitable number of tips. Outer gerotor 814*a* includes an inlet port 820*a* that leads to an inner chamber 830*a* defined by the inside surface of outer gerotor 814*a*.

Figure 48:
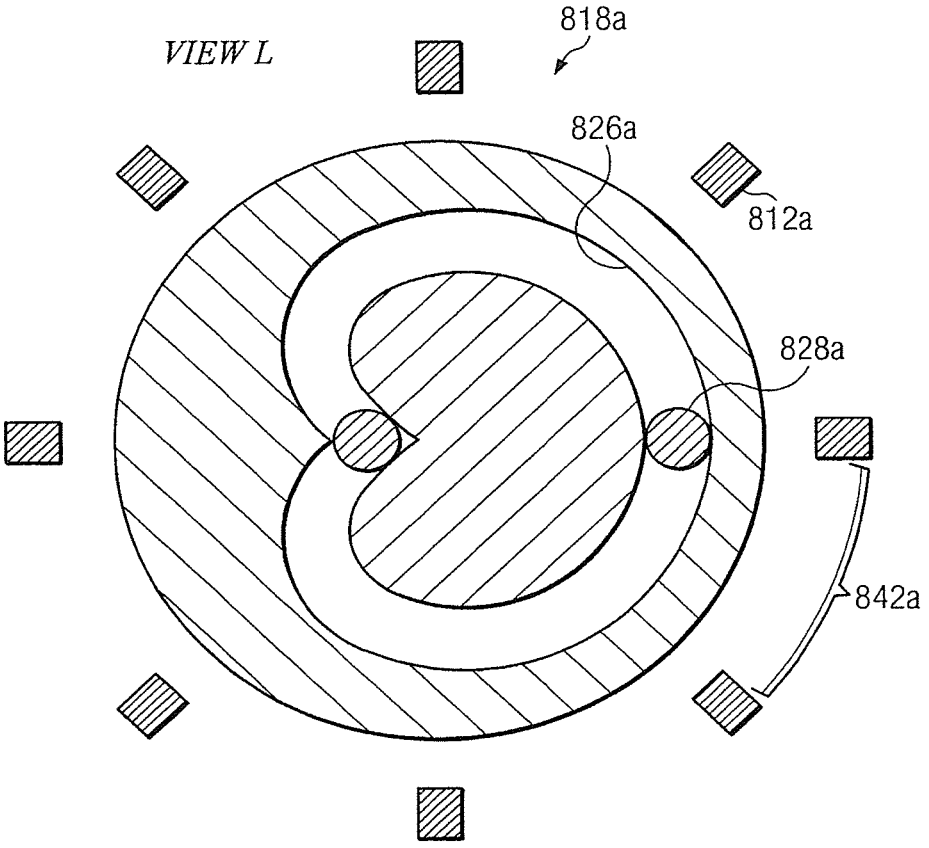

As illustrated best in FIG. 48, housing 812*a* includes a plurality of openings 842*a*, which may have any suitable size, shape, and orientation. In the illustrated embodiment, openings 842*a* are vertical slots. Openings 842*a* allow gas or vapor to enter inner chamber 830*a* of outer gerotor 814*a*, as described in further detail below.

Inner gerotor 816*a* is disposed within inner chamber 830*a* and is rotatably coupled to a first end 815*a* of housing 812*a* via any suitable manner. In the illustrated embodiment, inner gerotor 816*a* is rotatably coupled to an exit pipe 817*a* via bearings 803. As illustrated best in FIG. 47, inner gerotor 816*a* includes two tips 819*a* (i.e., "lobes"); however, inner gerotor 816*a* may include any suitable number of tips. In addition, inner gerotor 816*a* may have any suitable configuration. In the illustrated embodiment, the outside surface of inner gerotor 816*a* is defined by a hypotrochoid. Inner gerotor 816*a* also includes a pair of passageways 821*a* that are each in fluid communication with exit pipe 817*a* at various times during the rotation of inner gerotor 816*a*. Passageways 821*a* may have any suitable size and shape.

Figure 47:
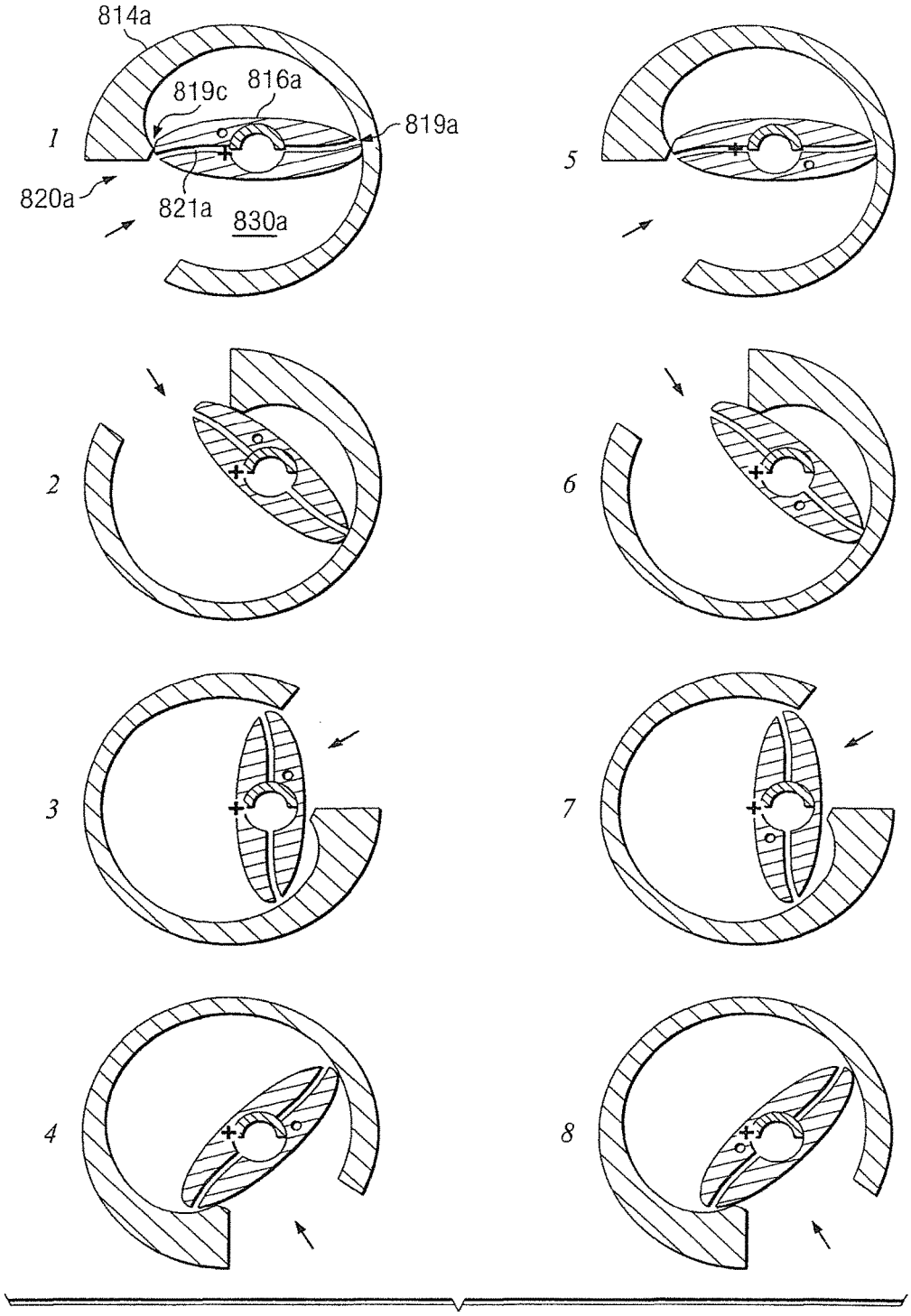

Referring mainly to FIG. 47, in operation of one embodiment, both inner gerotor 816*a* and outer gerotor 814*a* are spinning clockwise, but outer gerotor 814*a* is spinning more rapidly (twice as fast in this embodiment). The white dot on inner gerotor 816*a* is simply a reference point to illustrate the orientation of inner gerotor 816*a* during rotation and serves no other function. Gas or vapor enters through inlet port 820*a* located in outer gerotor 814*a*. At particular points in the rotation (positions 3 and 7), the captured volume is a maximum. As the rotation continues, the captured volume compresses. Ultimately, the compressed gas travels down through one of the passageways 821*a* on inner gerotor 816*a* and into and out of exit pipe 817*a*. While part of inner chamber 830*a* is growing and gathering more air, one of the passageways 821*a* on inner gerotor 816*a* is blocked so the gas cannot enter it. When part of inner chamber 830*a* is shrinking and the gas is compressing, one of the passageways 821*a* on inner gerotor 816*a* is open allowing the gas to exit.

Figure 46:
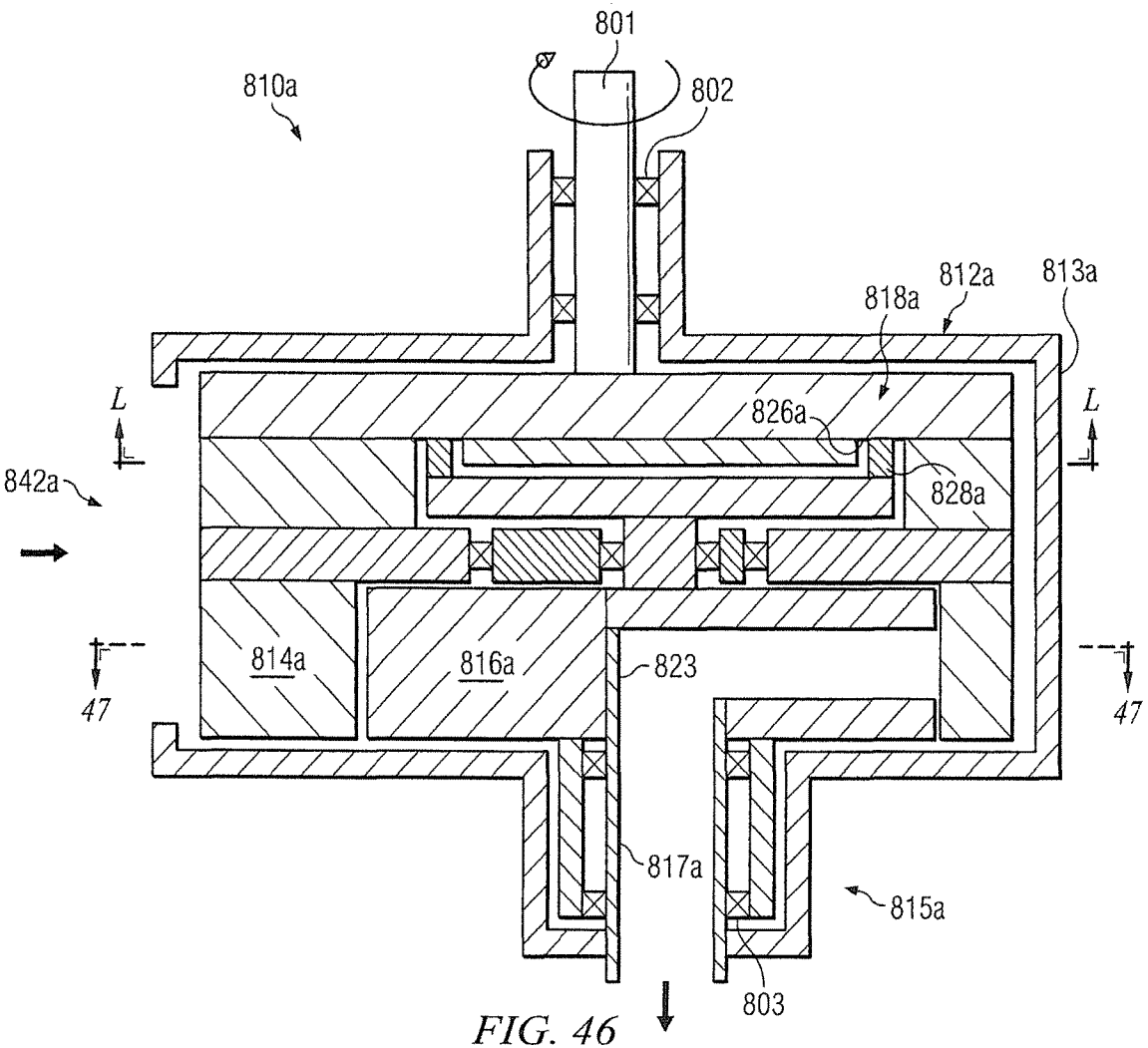
FIGS. 46-49 illustrate a gerotor apparatus according to one embodiment of the invention that is based upon.

As best illustrated by FIG. 46, exit pipe 817*a* includes a projecting portion 823*a* that projects upward into inner gerotor 816*a*, thereby blocking one of the passageways 821*a* at certain times during the rotation of inner gerotor 816*a*. Projecting portion 823*a* may have any suitable configuration; however, in the illustrated embodiment, projecting portion 823*a* is substantially semicircular.

Figure 49:
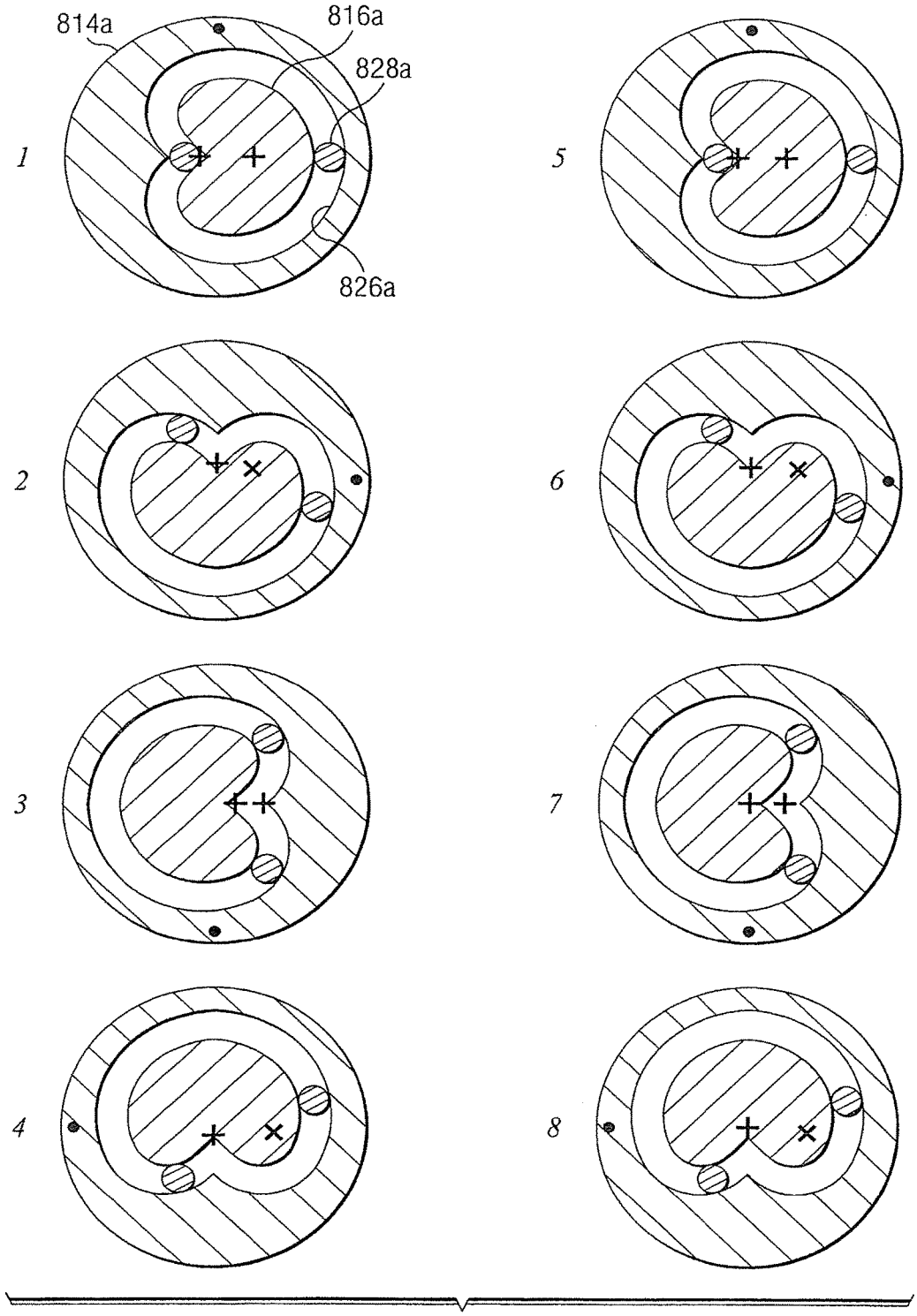

Gerotor apparatus 810*a* also includes a synchronization system 818*a* that synchronizes the motion of inner gerotor 816*a* and outer gerotor 814*a*. In the illustrated embodiment, as best shown in FIGS. 48 and 49, synchronization system 818*a* includes an alignment member 828*a* and an alignment guide 826*a*. Alignment member 828*a* may be any suitable alignment member, such as a peg, and alignment guide 826*a* may be any suitable alignment guide, such as a suitably shaped track. For example, as shown in FIGS. 48 and 49, the track may have a heart shape. Or the track may have a shape configured according to the method outlined in FIG. 2 above. Other suitable synchronization systems are contemplated by the present invention, such as those described in previous disclosures for other embodiments. For example, a gear set may be utilized as well. FIG. 49 illustrates synchronization system 818*a* in operation of one embodiment of the invention. The black dot on outer gerotor 814*a* is simply a reference point to illustrate the orientation of outer gerotor 814*a* during rotation and serves no other function.

Figure 50:
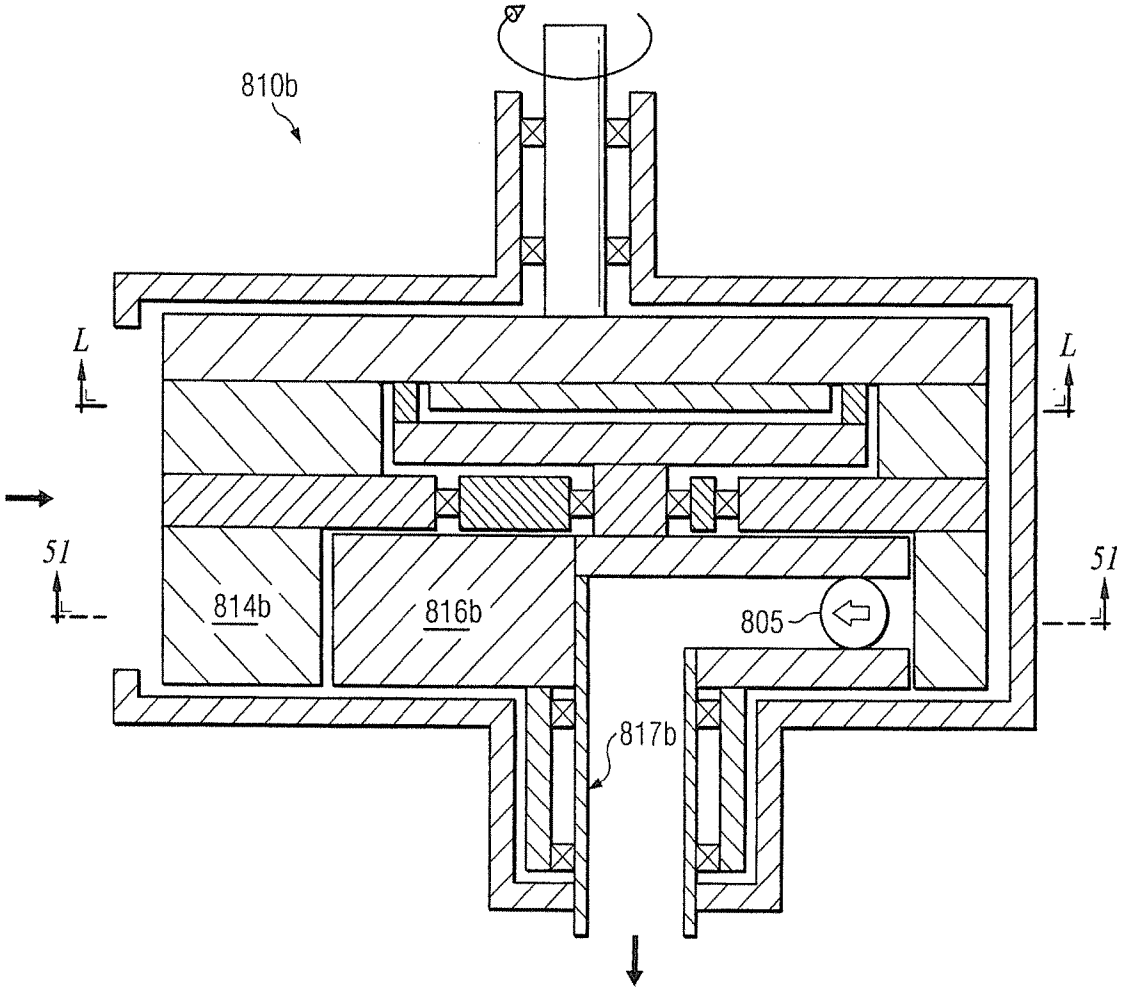
FIG. 50 illustrates a gerotor apparatus according to another embodiment of the invention, which may only function as a compressor.
Figure 51:
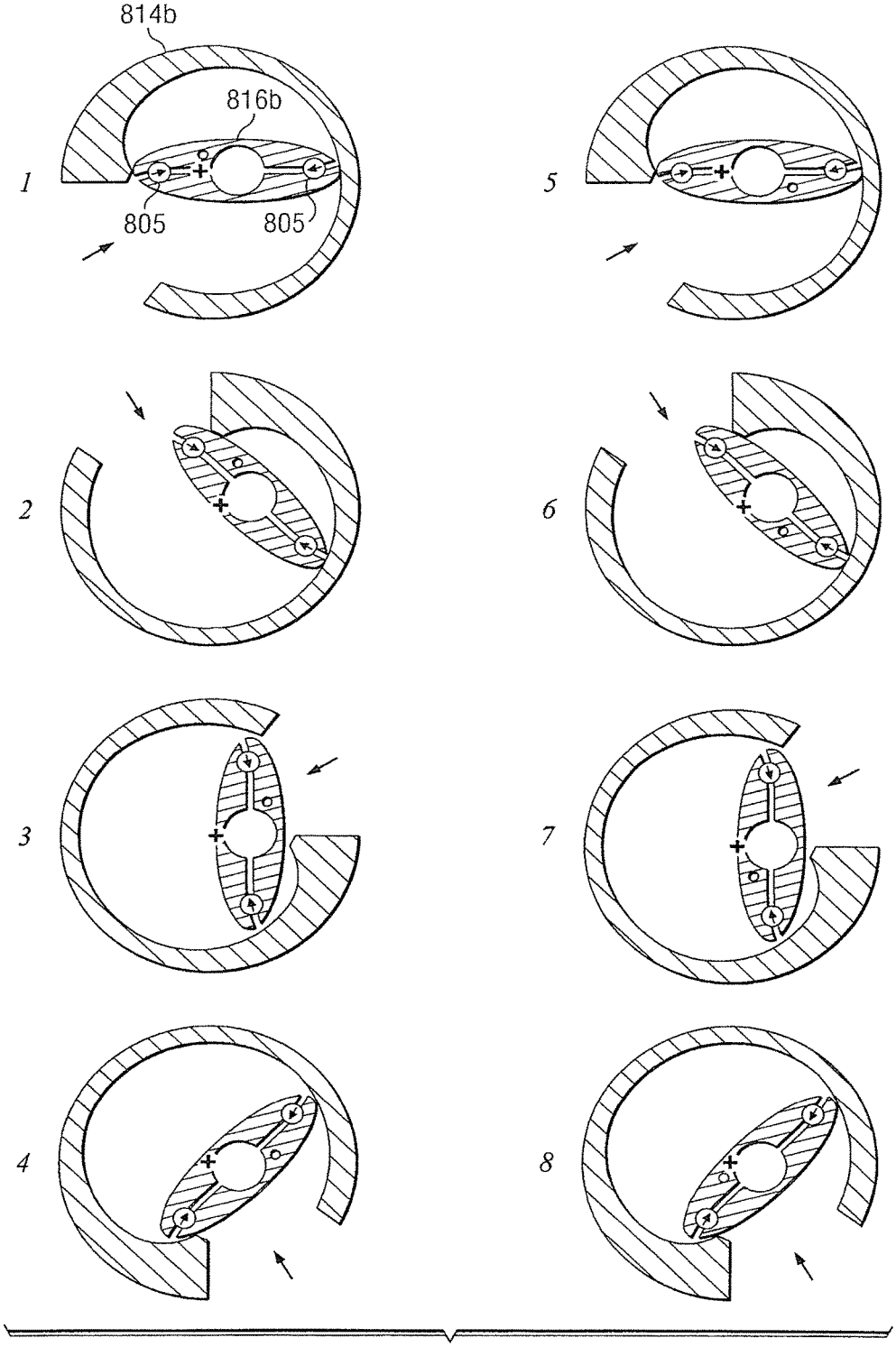
FIG. 51 illustrates a gerotor apparatus according to another embodiment of the invention, which may only function as a compressor.

FIGS. 50 and 51 illustrate a gerotor apparatus 810*b* according to another embodiment of the invention, which may only function as a compressor. Gerotor apparatus 810*b* is substantially similar to gerotor apparatus 810*a*; however, gerotor apparatus 810*b* includes an inner gerotor 816*b* having a plurality of check valves 805 associated with respective ones of passageways 821*b* to regulate the discharge of gas through passageways 821*b* of inner gerotor 816*b*. Check valves 805 may be any suitable check valves and may coupled to passageways 821*b* in any suitable manner. Because of the existence of check valves 805, exit pipe 817*b* does not include a projecting portion.

Figure 52:
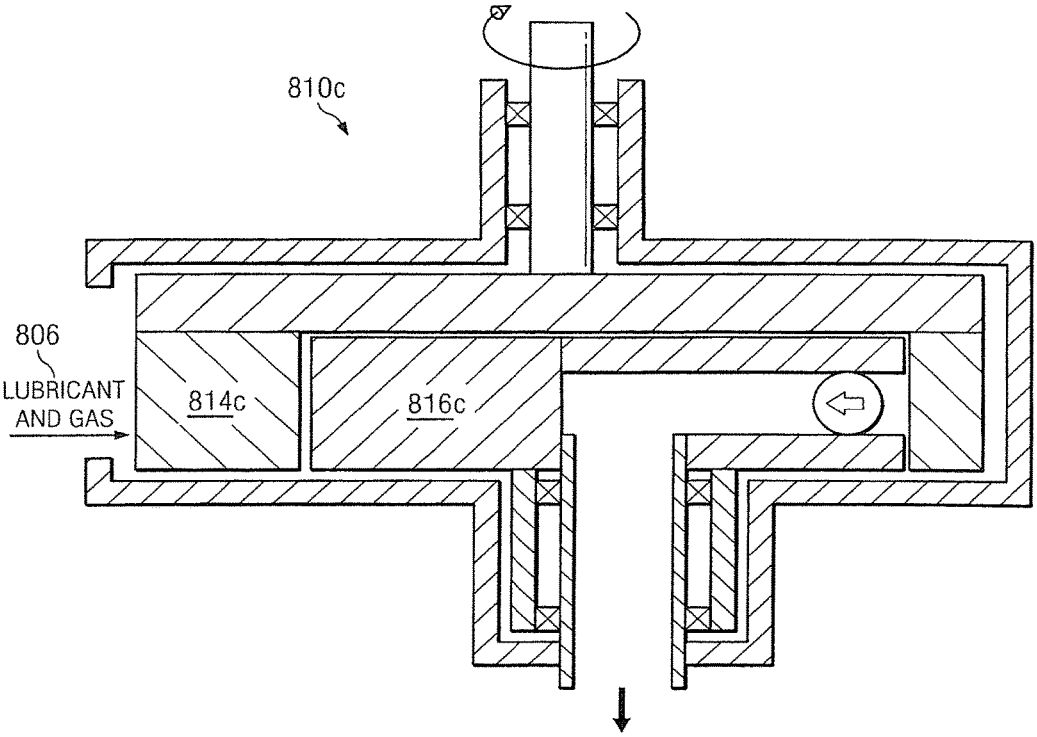
FIG. 52 illustrates a gerotor apparatus according to another embodiment of the invention.

FIG. 52 illustrates a gerotor apparatus 810*c* according to another embodiment of the invention. Gerotor apparatus 810*c* is substantially similar to gerotor apparatus 810*b*; however, rather than employing a synchronizing system, inner gerotor 816*c* and outer gerotor 814*c* contact each other. Wear may be minimized by including a lubricant in the gas, as referenced by reference numeral 806, such as is done with vapor-compression air conditioners. Alternatively, the points of contact between inner gerotor 816*c* and outer gerotor 814*c* may be made from low-friction materials, such as those described above. In one embodiment, if water is used as a lubricant, a suitable low-friction material may be VESCONITE.

Figure 53:
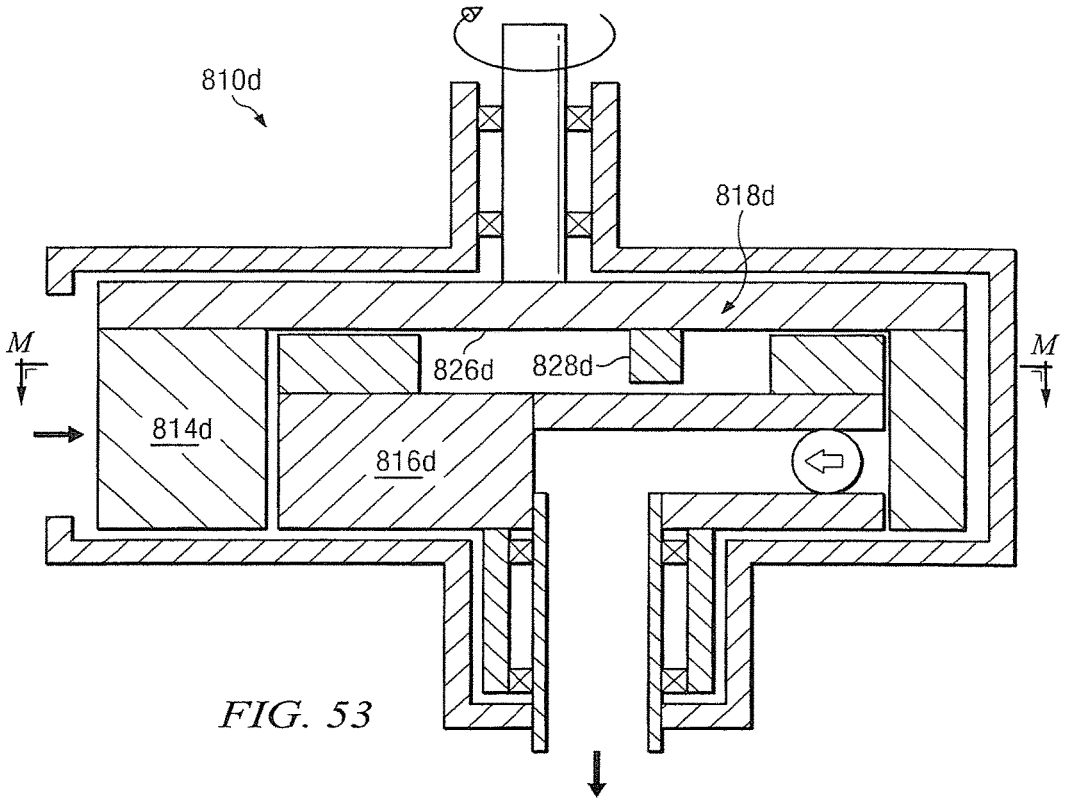
FIGS. 53-55 illustrate a gerotor apparatus according to another embodiment of the invention.
Figure 54:
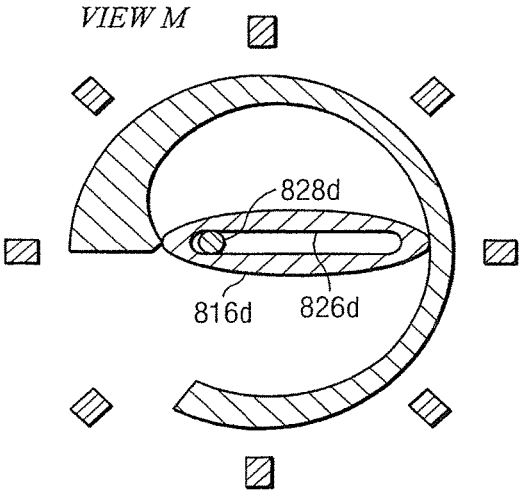
Figure 55:
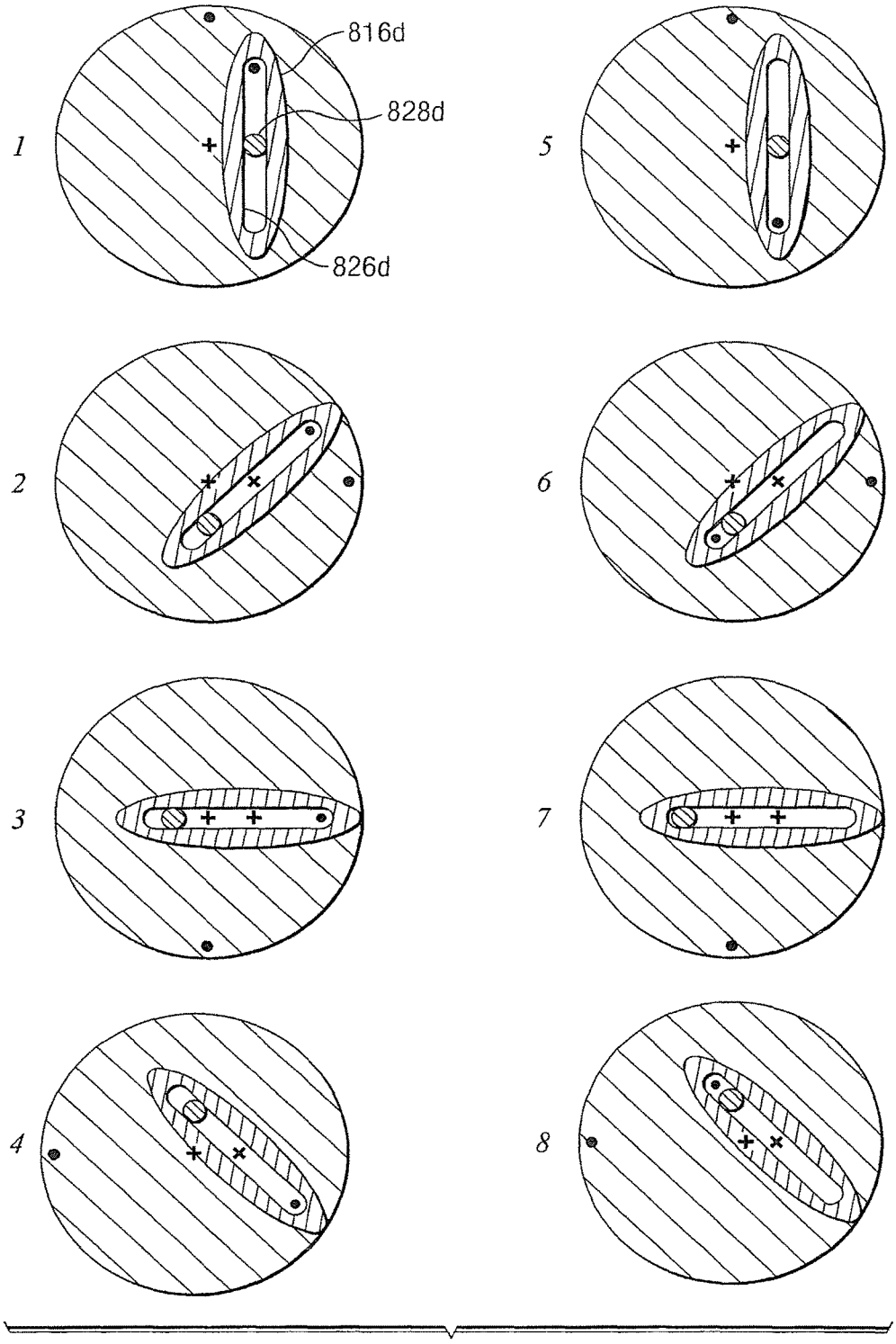
Figure 56:
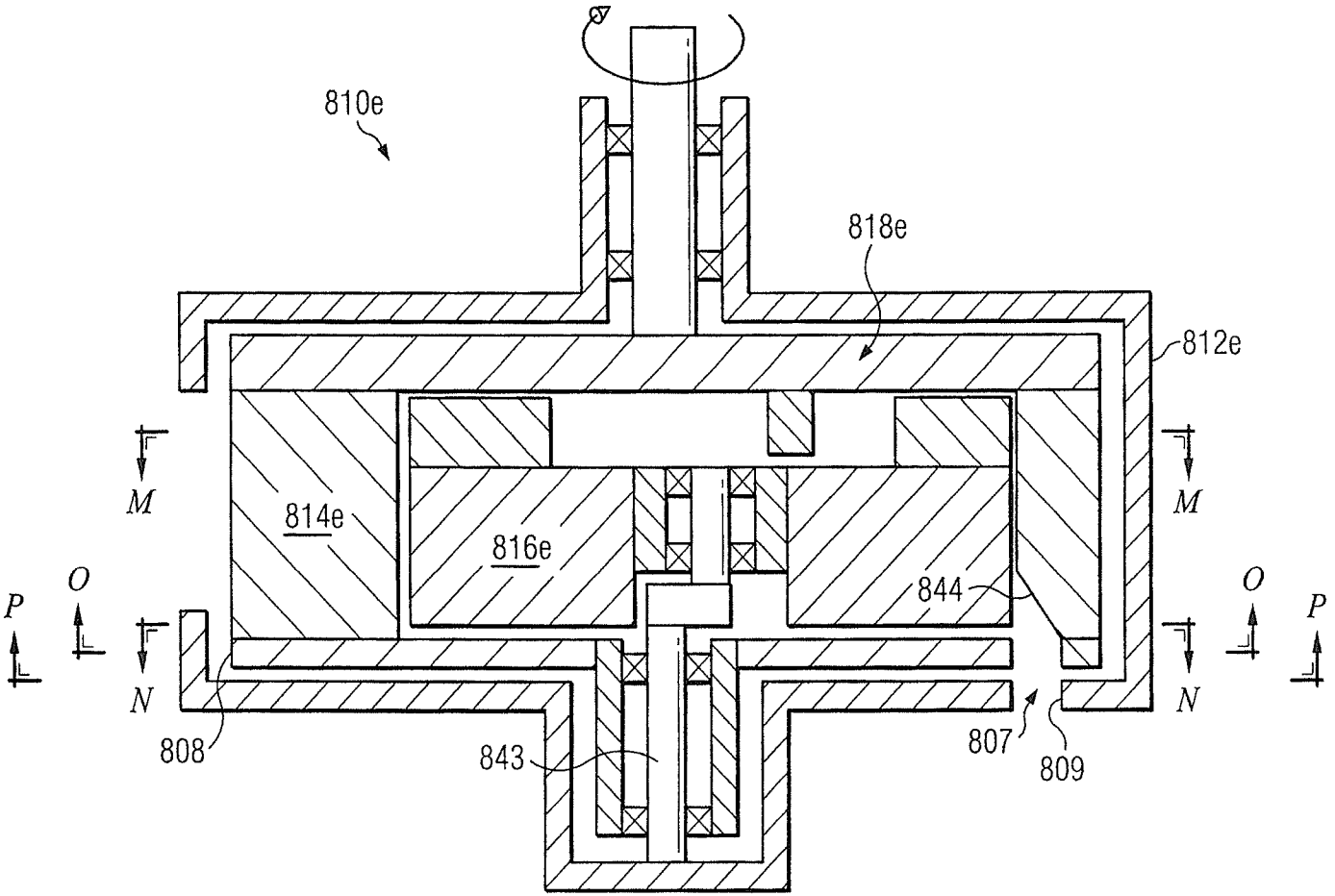
FIG. 56 illustrates a gerotor apparatus according to another embodiment of the invention.
Figure 57:
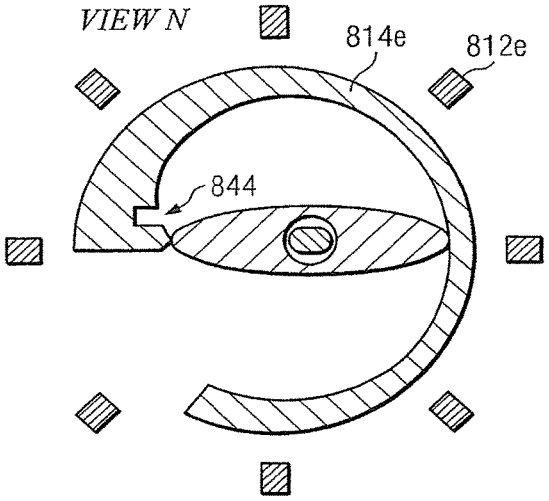
FIG. 57 illustrates a gerotor apparatus according to another embodiment of the invention.
Figure 58:
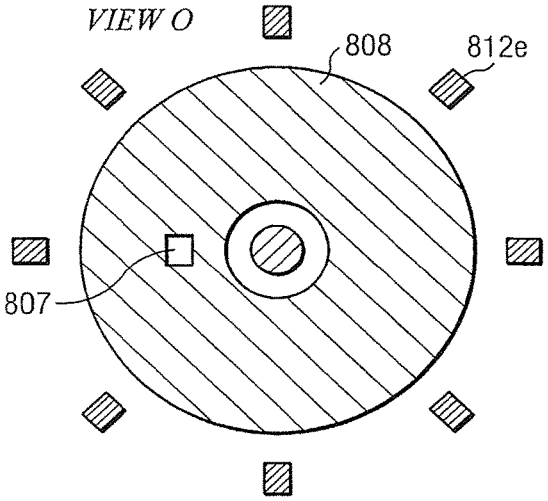
FIG. 58 illustrates a gerotor apparatus according to another embodiment of the invention.
Figure 59:
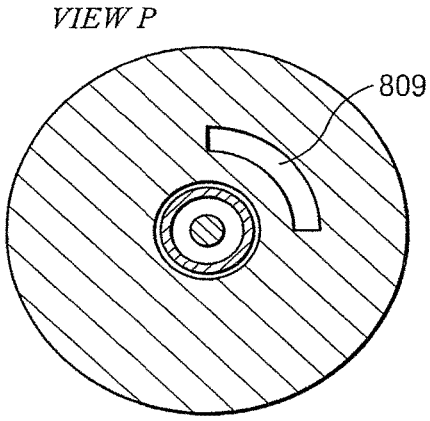
FIG. 59 illustrates a gerotor apparatus according to another embodiment of the invention.

FIGS. 53-55 illustrate a gerotor apparatus 810*d* according to another embodiment of the invention. Gerotor apparatus 810*d* is substantially similar to gerotor apparatus 810*b*; however, for its synchronizing system 818*d*, gerotor apparatus 810*d* employs a peg 828*d* rigidly attached to outer gerotor 814*d*. View M as shown in FIG. 54 illustrates that peg 828*d* rides in a linear track 826*d* located within inner gerotor 816*d*. Both peg 828*d* and linear track 826*d* may be constructed from any suitable metal. Alternatively, peg 828*d* and linear track 826*d* may be constructed of low-friction materials, such as those described above. In one embodiment, if water is used as a lubricant, a suitable low-friction material is VESCONITE. Synchronizing system 818*d* may also be used in conjunction with any suitable lubricant, such as oil or grease. As yet another alternative, peg 828*d* may be constructed of a roller bearing that rolls within linear track 826*d*. FIG. 55 illustrates synchronization system 818*d* in operation of one embodiment of the invention. The small black dots illustrated are simply reference points to illustrate the orientation of outer gerotor 814*d* an inner gerotor 816*d* during rotation.

FIGS. 56-59 illustrate a gerotor apparatus 810*e* according to another embodiment of the invention. Gerotor apparatus 810*e* may function both as a compressor or expander; here, it is assumed to be a compressor. Gerotor apparatus 810*e* has a synchronization system 818*e* similar to that of gerotor apparatus 810*d*; however, the motion of the inner and outer gerotors may be synchronized in other suitable manners. In this embodiment, gerotor apparatus 810*e* accounts for the discharge of gas through an outlet port 807 formed in a faceplate 808 of the outer gerotor 814*e* rather than through an exit pipe in the center. View N (FIG. 57) shows a small notch 844 in outer gerotor 814*e* through which gas travels through outlet port 807 for exiting through an exhaust port 809 formed in housing 812*e*. Notch 844, outlet port 807 and exhaust port 809 may have any suitable size and shape. View 0 (FIG. 58) shows outlet port 807 in sectional view and View P (FIG. 59) shows exhaust port 809 in sectional view. The position and length of exhaust port 809 determines the compression ratio for gerotor apparatus 810*e*. Generally, a longer exhaust port 809 means a lower compression device whereas a shorter exhaust port 809 means a higher compression device. In this embodiment, both inner gerotor 816*e* and outer gerotor 814*e* may be rotatably coupled to housing 812*e* via a shaft 843 that is rigidly coupled to housing 812*e*.

Figure 60:
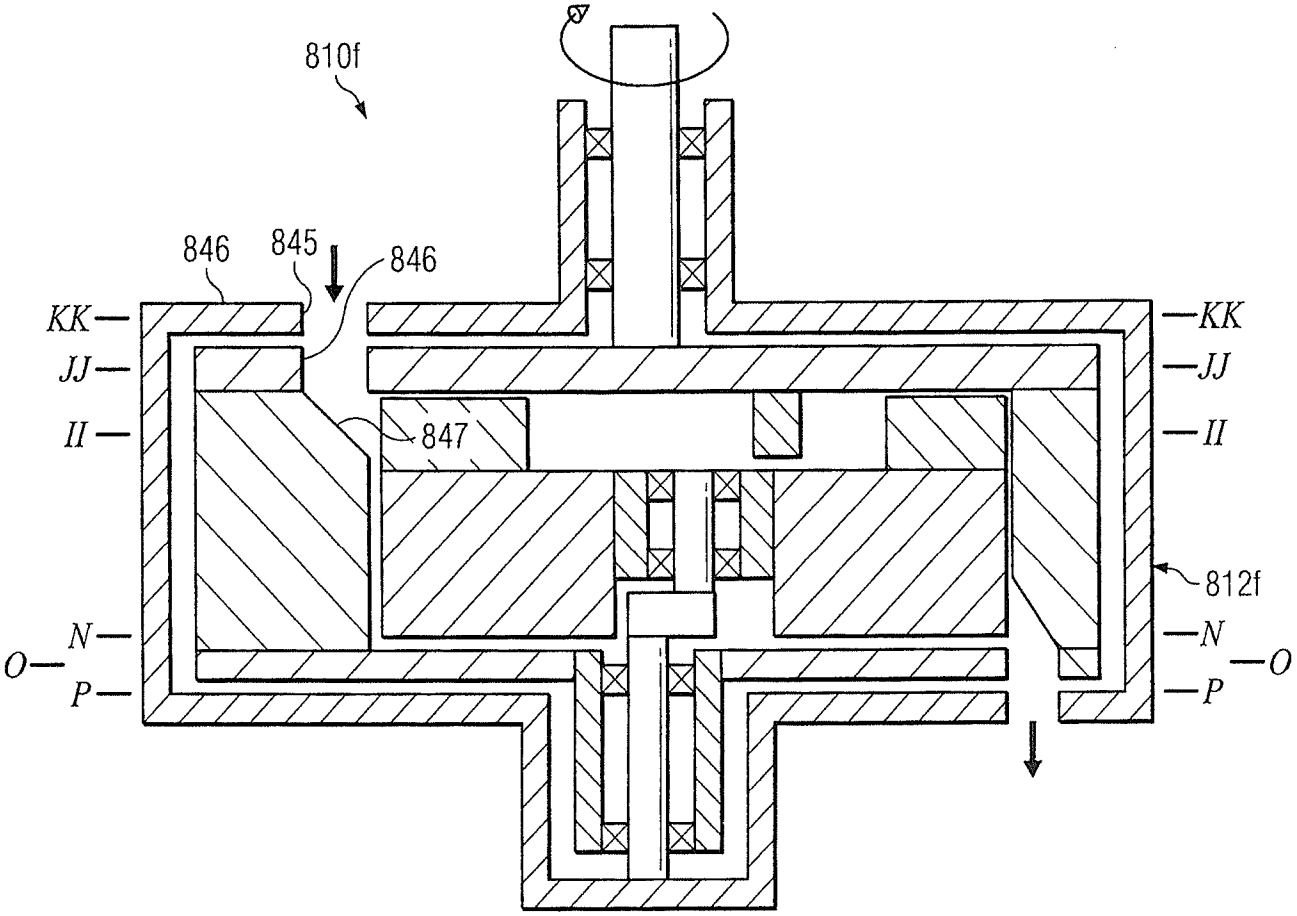
FIG. 60 illustrates a gerotor apparatus according to another embodiment of the invention.
Figure 61:
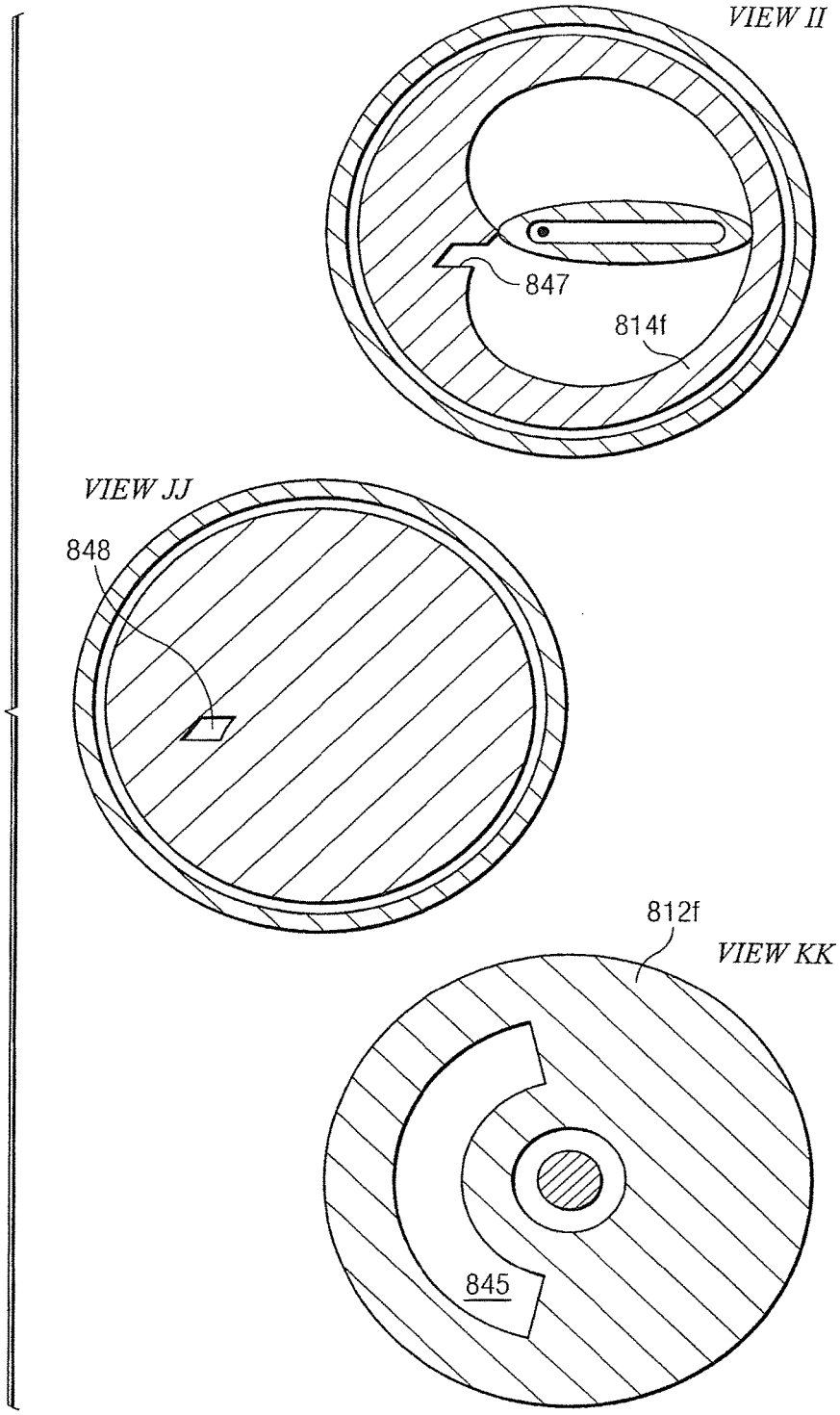
FIG. 61 illustrates a gerotor apparatus according to another embodiment of the invention.

FIGS. 60-61 illustrate a gerotor apparatus 810*f* according to another embodiment of the invention. Gerotor apparatus 810*f* is substantially similar to gerotor apparatus 810*e*; however, inlet air enters from an inlet port 845 formed in an endwall 846 of housing 812*f* rather than from a sidewall. In other embodiments, air could enter from both endwall 846 and the sidewall of housing 812*f*. View II (FIG. 61) shows a notch 847 that allows air to enter outer gerotor 814*f* via an inlet port 848. View JJ shows inlet port 848 through which the air flows. View KK shows the inlet port 845 in housing 812*f*. Notch 847, inlet port 848 and inlet port 845 may have any suitable size and shape.

Figure 62:
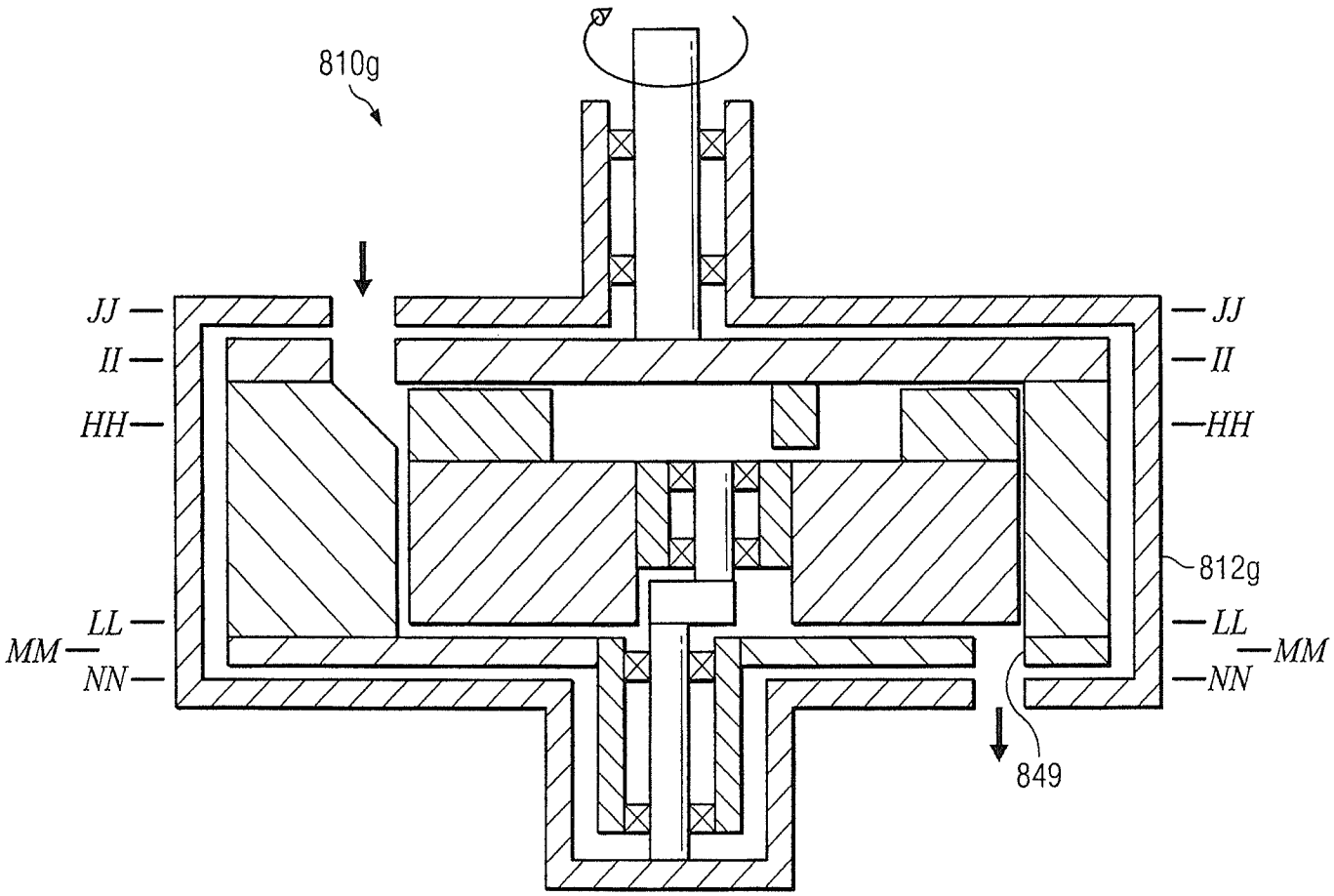
FIG. 62 illustrates a gerotor apparatus according to another embodiment of the invention.
Figure 63:
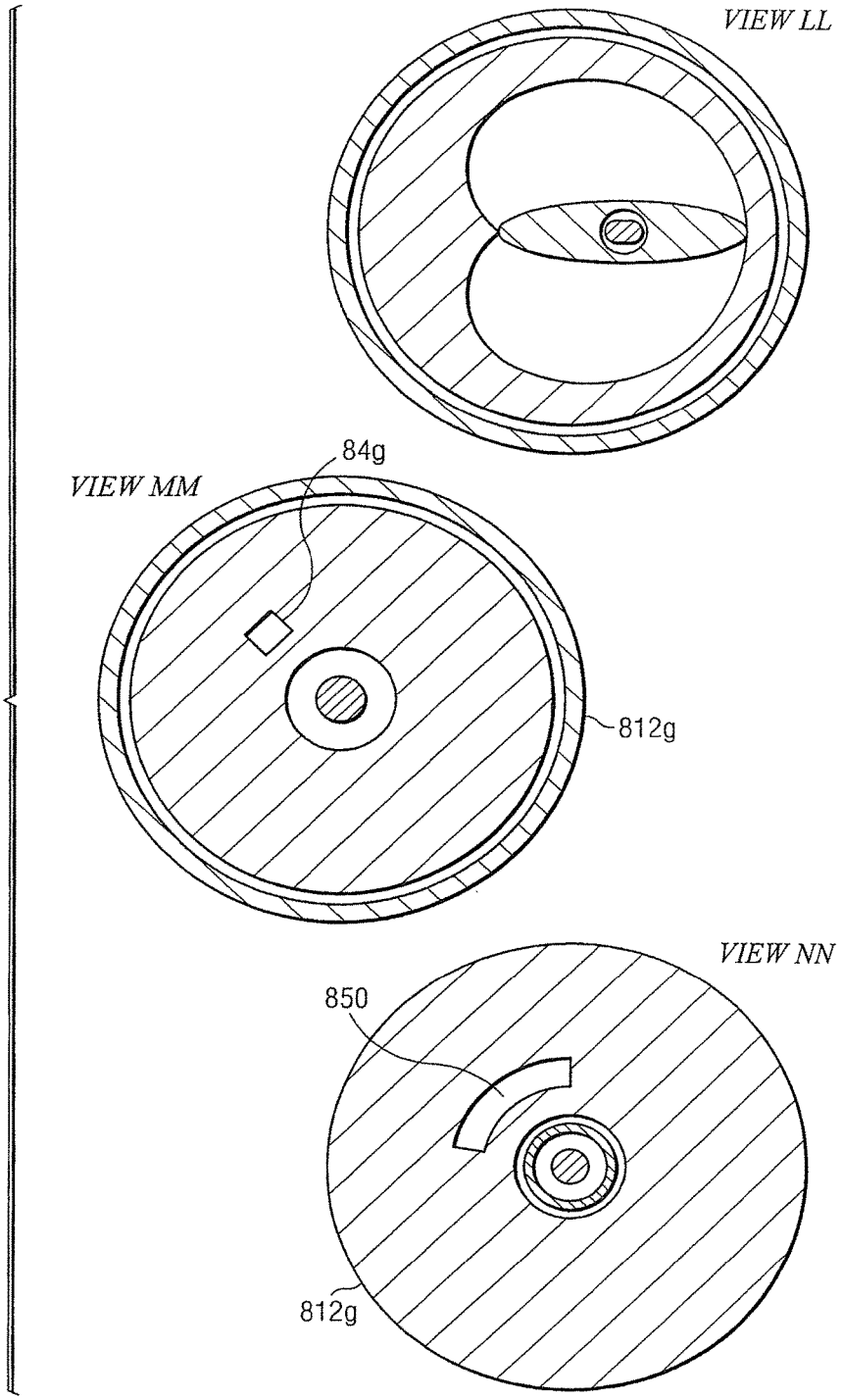
FIG. 63 illustrates a gerotor apparatus according to another embodiment of the invention.
Figure 64:
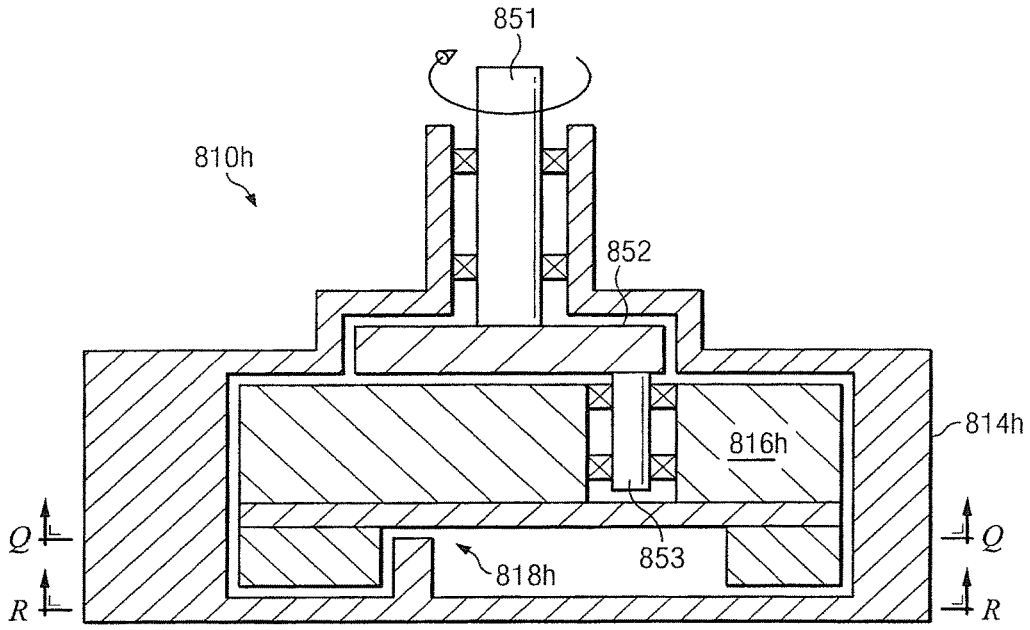
FIG. 64 illustrates a gerotor apparatus according to another embodiment of the invention.

FIGS. 62-63 illustrate a gerotor apparatus 810*g* according to another embodiment of the invention. Gerotor apparatus 810*g* is substantially similar to gerotor apparatus 810*f*; however, the discharge is through a hole 849, rather than a notch. In some embodiments, it is possible that the discharge methods of FIGS. 56 and 62 could be combined, allowing gas to discharge from both the hole and notch. View LL (FIG. 63) shows that there is no notch and View MM shows hole 849 through which the gas exits. View NN shows an exhaust port 850 in housing 812*g*, which functions similarly to exhaust port 809 of FIG. 59.

Figure 65:
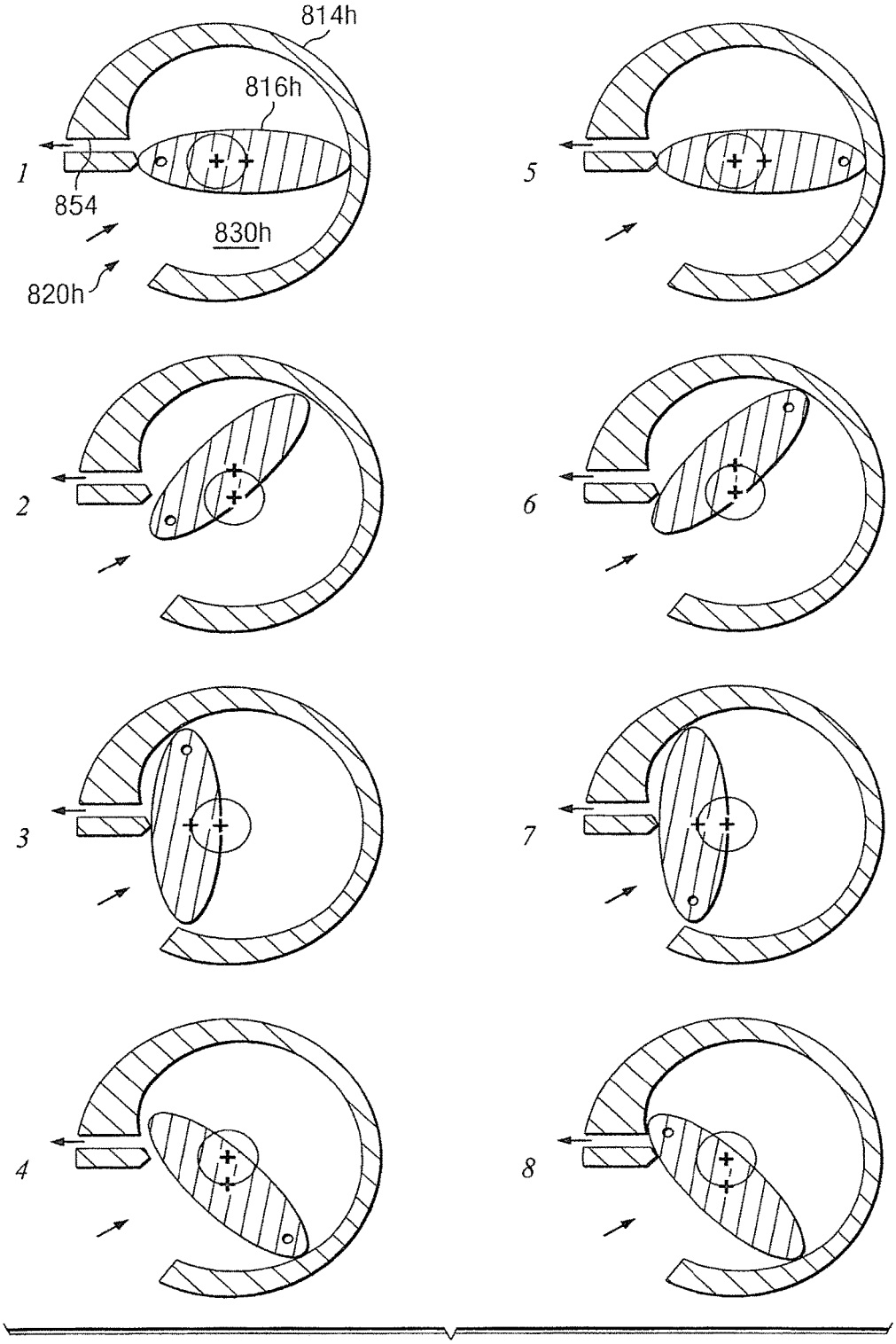
FIG. 65 illustrates a gerotor apparatus according to another embodiment of the invention.

FIGS. 64-68 illustrate a gerotor apparatus 810*h* according to another embodiment of the invention. In this embodiment, an outer gerotor 814*h* is stationary; there is no separate housing. Outer gerotor 814*h* includes at least one inlet port 820*h* that leads to an inner chamber 830*h* defined by the inside surface of outer gerotor 814*h*. A first shaft 851 is rotatably coupled to outer gerotor 814*h* and a disk 852 is coupled to first shaft 851. A second shaft 853 is coupled to disk 852 and is offset from the axis of rotation of first shaft 851. This arrangement facilitates the rotation and orbiting of an inner gerotor 816*h* within inner chamber 830*h* because inner gerotor is rotatably coupled to second shaft 853. As shown best in FIG. 65, the white dot on inner gerotor 816*h* is simply a reference point illustrating the orientation of inner gerotor 816*h* during rotation. Also shown in FIG. 65 are the centers of rotation of inner gerotor 816*h*.

Figure 68:
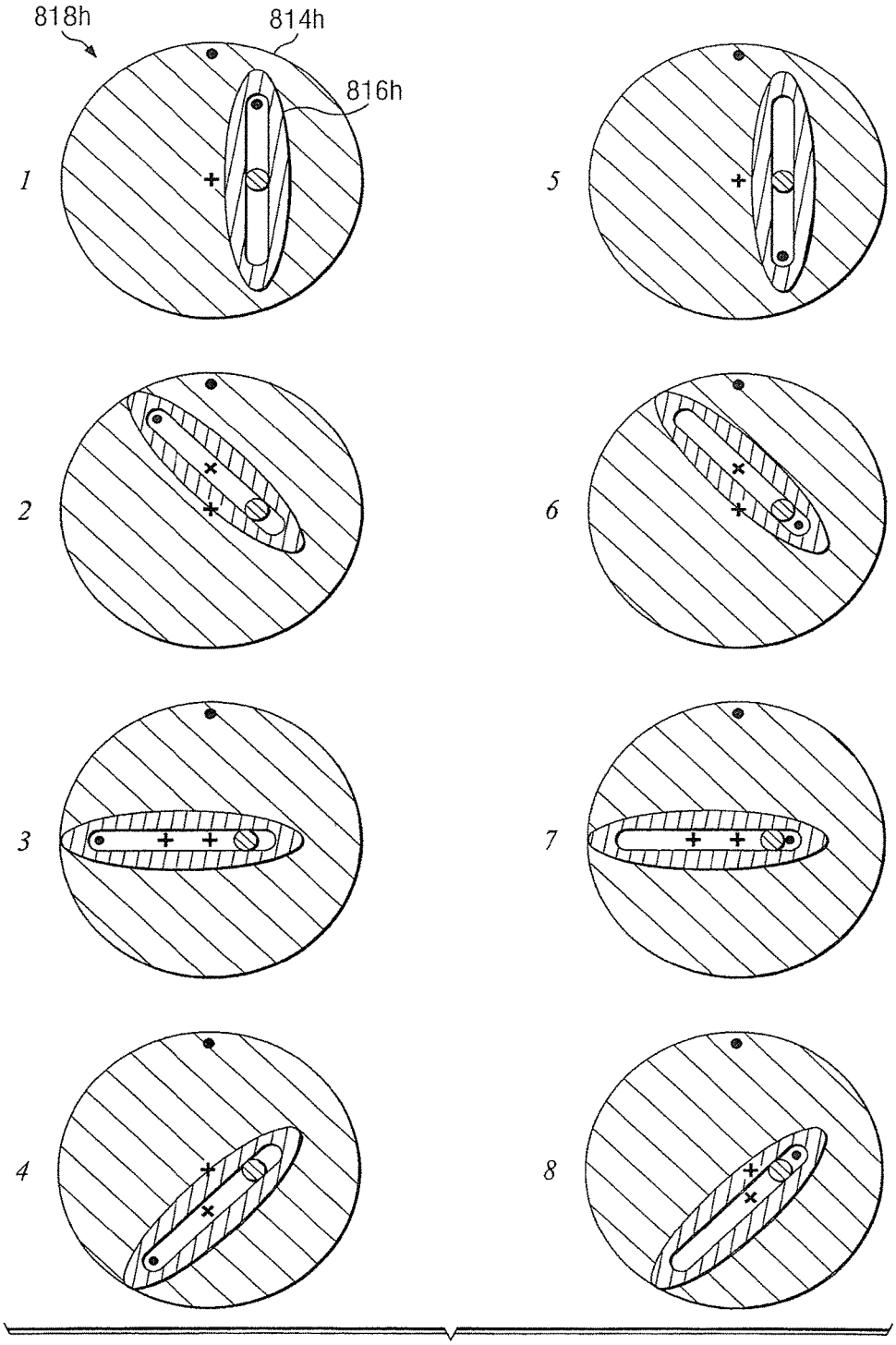
FIG. 68 illustrates a gerotor apparatus according to another embodiment of the invention.

In operation of this embodiment, gas enters through side port 820*h* on outer gerotor 814*h* and exits through an outlet port 854 formed in outer gerotor 814*h*. Although outlet port 854 may be formed in any suitable location, in the illustrated embodiment, outlet port 854 is located on the opposite side of the tip separates inlet port 820*h* from outlet port 854. The motion of inner gerotor 816*h* and outer gerotor 814*h* may be synchronized in any suitable manner, such as with a synchronization system 818*h* as illustrated in FIG. 68.

Figure 66:
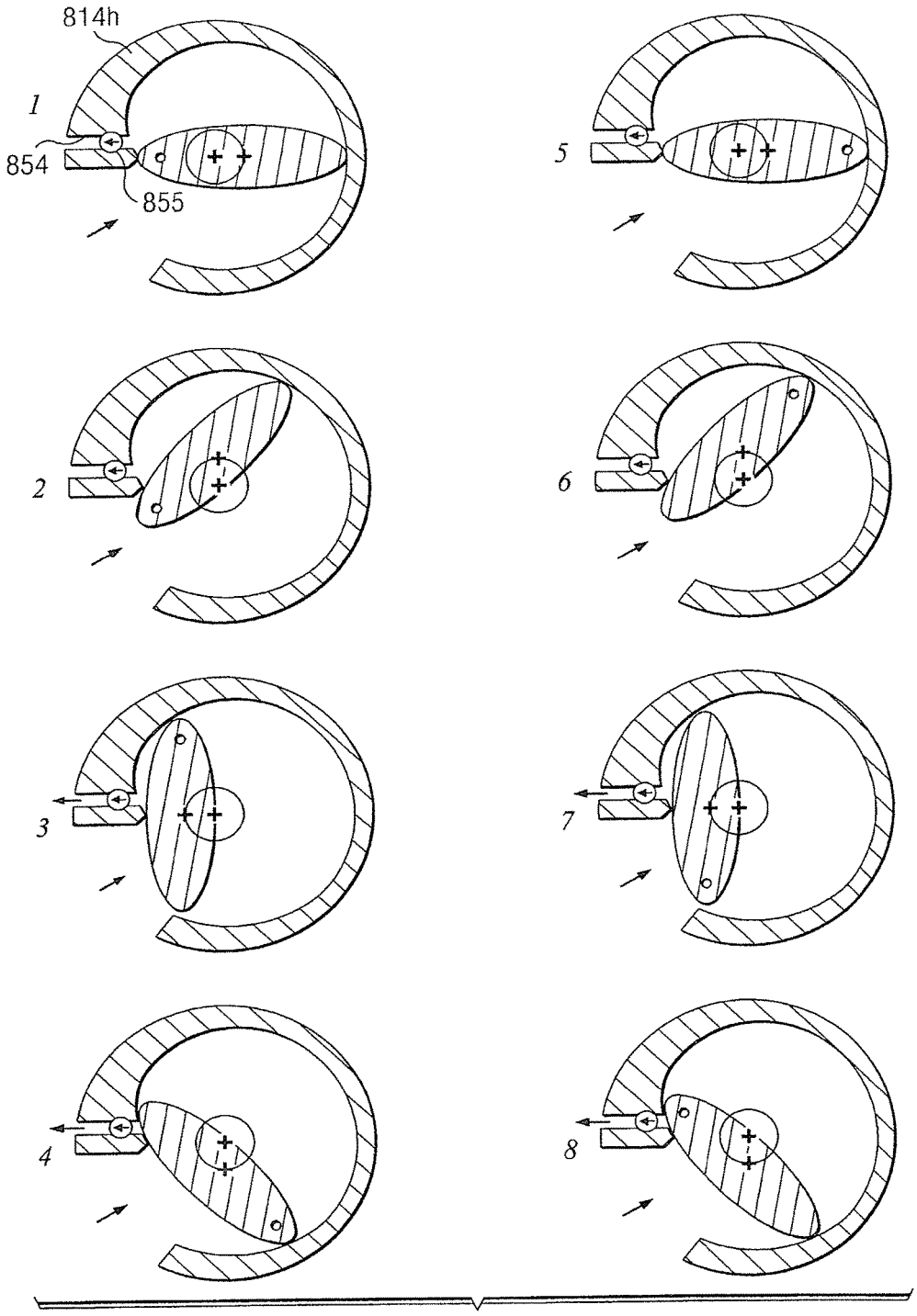
FIG. 66 illustrates a gerotor apparatus according to another embodiment of the invention.
Figure 67:
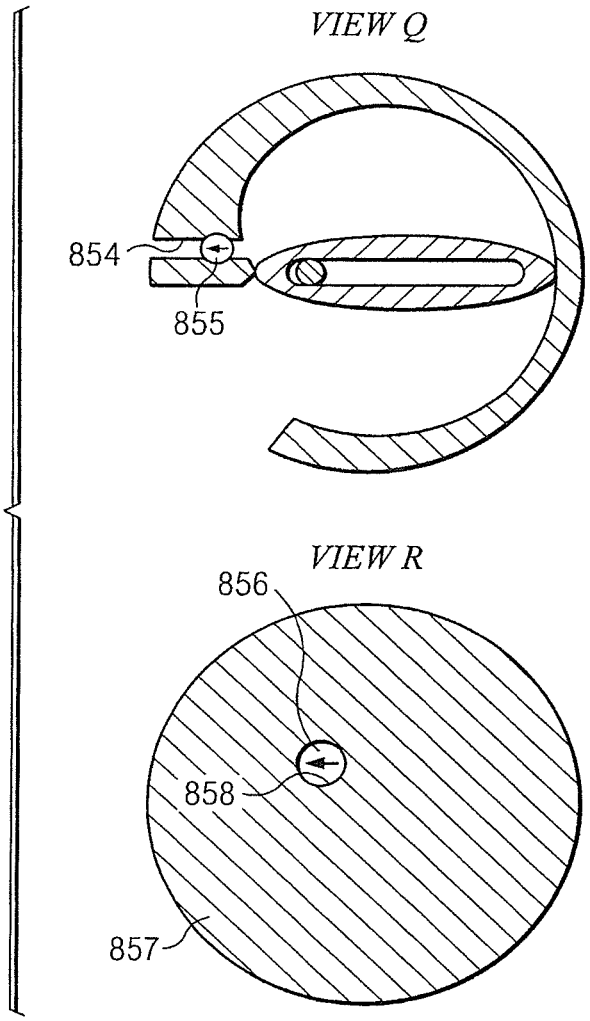
FIG. 67 illustrates a gerotor apparatus according to another embodiment of the invention.

FIGS. 66 and 67 illustrate that gerotor apparatus 810*h*, in accordance with another embodiment of the invention, may include a check valve 855 associated with outlet port 854 to regulate the discharge of gas through outlet port 854 of outer gerotor 814*h*. In addition, View R of FIG. 67 illustrates that an endwall 857 of outer gerotor 814*h* may have an aperture 858 formed therein for an additional gas outlet. Aperture 858 may have an associated check valve 856 to regulate the discharge of gas therethrough. Check valves 855 and 856 may be any suitable check valves and may couple to outlet port 854 and aperture 858 in any suitable manner.

Figure 69:
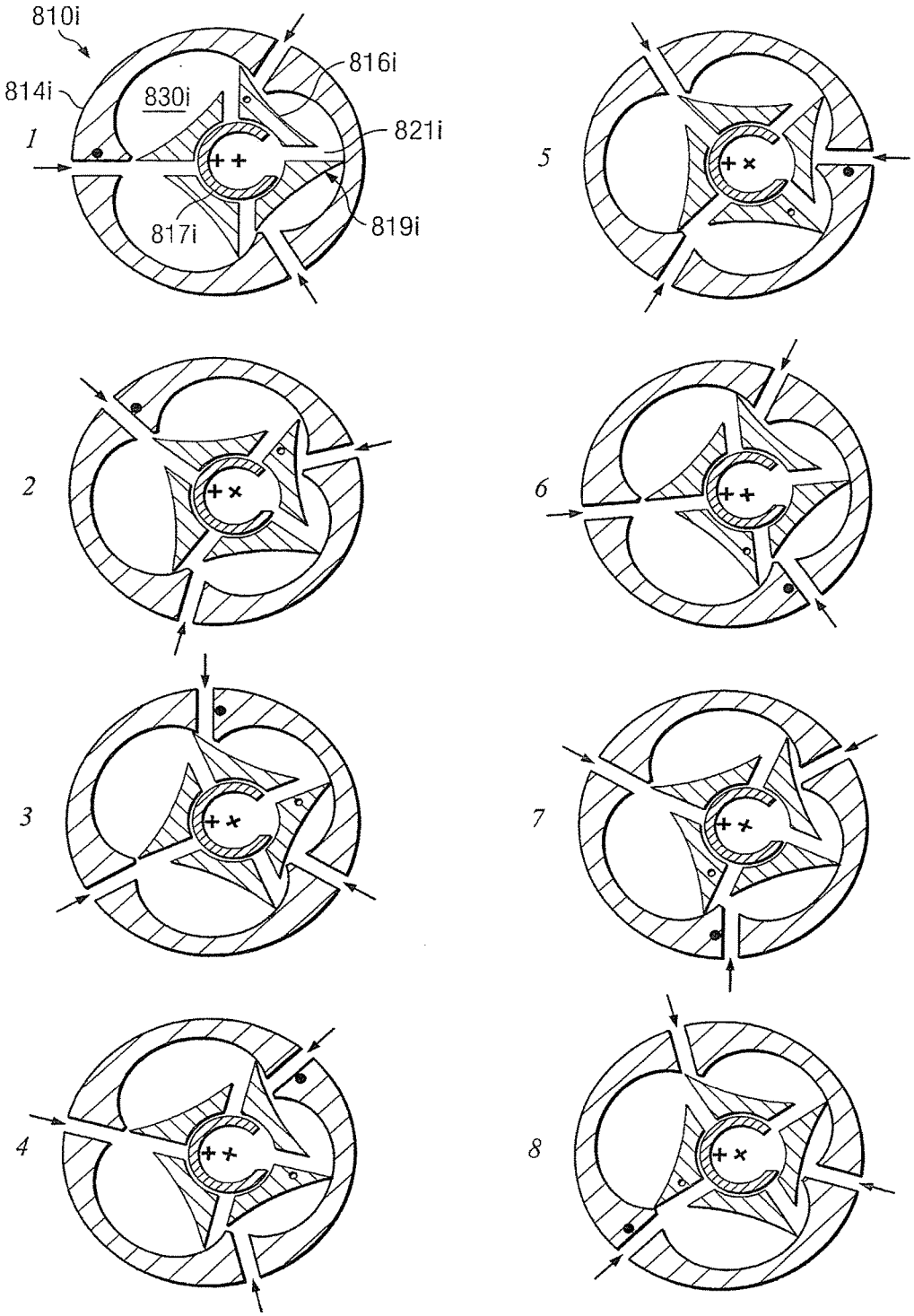
FIG. 69 illustrates a gerotor apparatus according to another embodiment of the invention.

FIG. 69 illustrates a gerotor apparatus 810*i* according to another embodiment of the invention. Gerotor apparatus 810*i* is substantially similar to gerotor apparatus 810*a* (see FIGS. 46-47 above); however, an inner gerotor 816*i* of gerotor apparatus 810*i* has four tips 819*i* and an outer gerotor 814*i* has three tips. Inner gerotor 816*i* is disposed within inner chamber 830*i* and is rotatably coupled to an exit pipe 817*i*. In the illustrated embodiment, the outside surface of inner gerotor 816*i* is defined by a hypocycloid. Inner gerotor 816*i* includes a plurality of passageways 821*i* that are each in fluid communication with exit pipe 817*i* at various times during the rotation of inner gerotor 816*i*. Passageways 821*i* may have any suitable size and shape. Exit pipe 817*i* includes a projecting portion 823*i* that projects upward into inner gerotor 816*i*, thereby blocking three of the four passageways 821*i* at certain times during the rotation of inner gerotor 816*i*. The projecting portion in this embodiment is penannular; however, other configurations are contemplated by the present invention.

Figure 70:
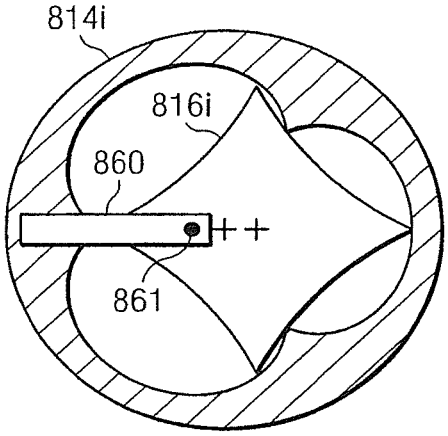
FIG. 70 shows a method by which a track may be scribed onto an inner gerotor, such as inner gerotor, according to an embodiment of the invention.
Figure 71:
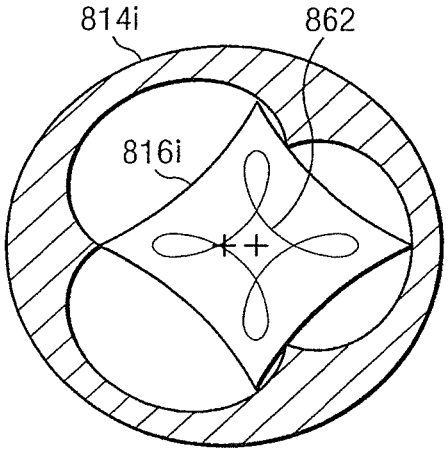
FIG. 71 illustrates a gerotor apparatus according to another embodiment of the invention.
Figure 72:
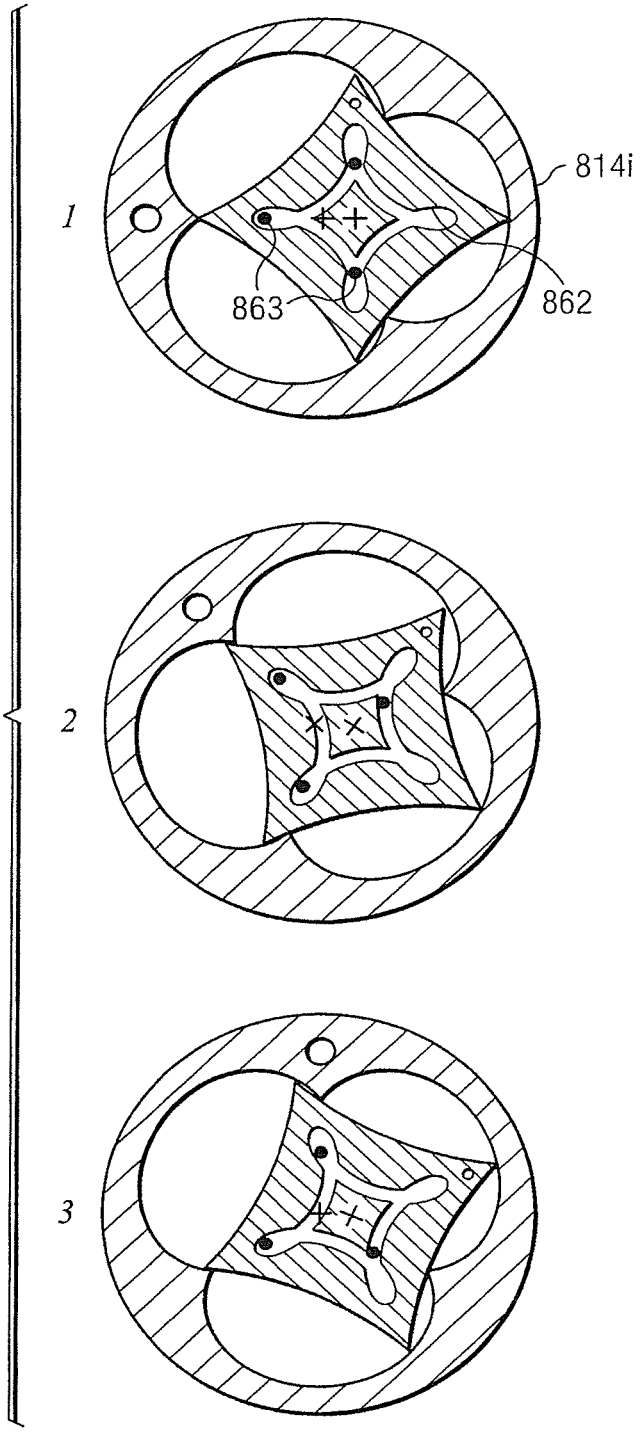
FIG. 72 shows pegs located on outer gerotor sliding along track, according to an embodiment of the invention.

FIG. 70 shows a method by which a track may be scribed onto an inner gerotor, such as inner gerotor 816*i*. A bar 860 is rigidly attached to an outer gerotor, in this case, outer gerotor 814*i*. As the inner and outer gerotors rotate with respect to each other, a point 861 on bar 860 scribes an outline of a track 862 (FIG. 71) onto inner gerotor 816*i*. FIG. 72 shows pegs 863 located on outer gerotor 814*i* sliding along track 862. The side view shown in FIG. 53 illustrates a placement of the pegs 863 and track 862, as an example. Other suitable synchronization systems are contemplated by the present invention.

Figure 73:
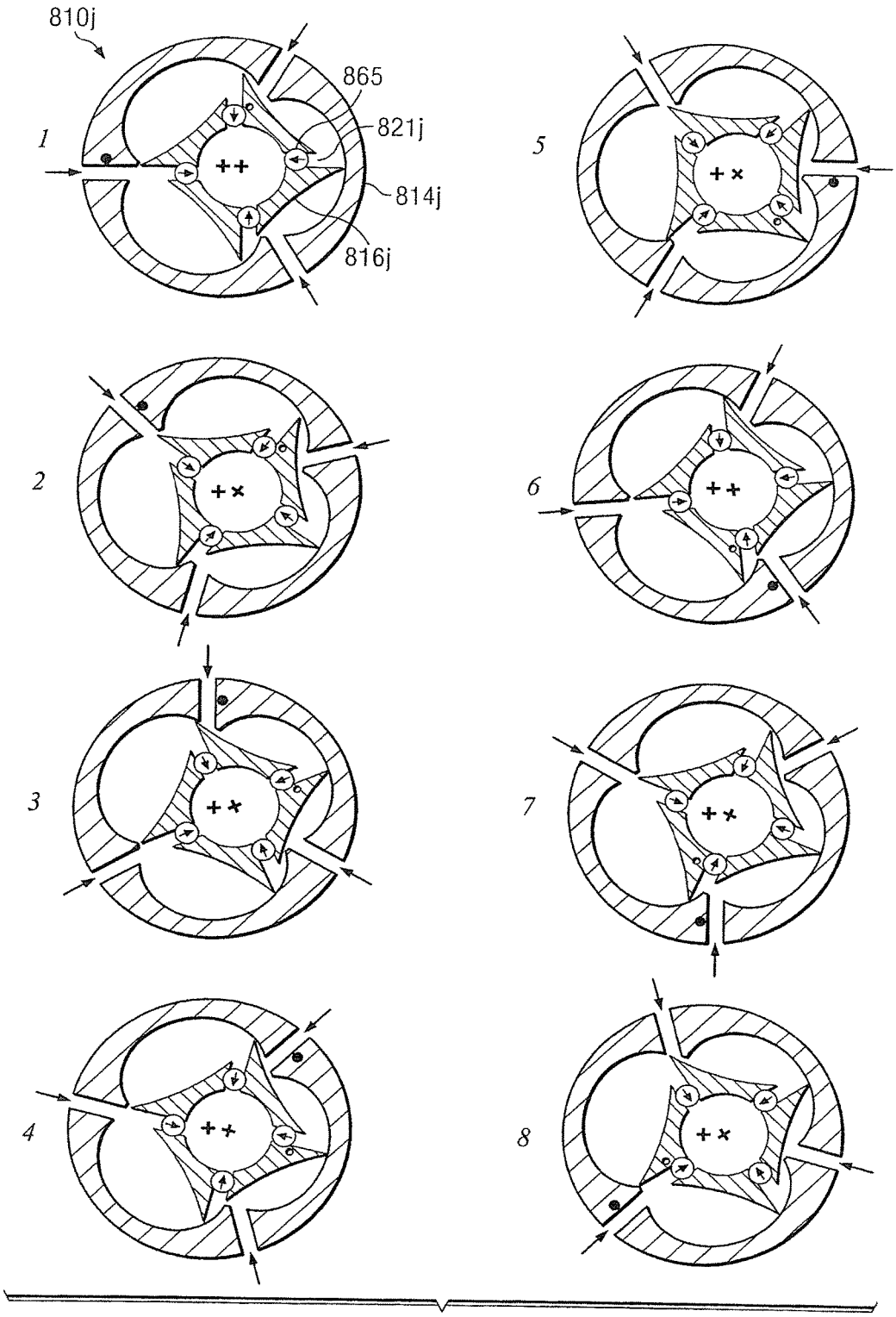
FIG. 73 illustrates a gerotor apparatus according to another embodiment of the invention.

FIG. 73 illustrates a gerotor apparatus 810*j* according to another embodiment of the invention. Gerotor apparatus 810*j* is substantially similar to gerotor apparatus 810*i*; however, gerotor apparatus 810*j* includes an inner gerotor 816*j* having a plurality of check valves 865 associated with respective ones of passageways 821*j* to regulate the discharge of gas through passageways 821*j* of inner gerotor 816*j*. Check valves 865 may be any suitable check valves and may coupled to passageways 821*j* in any suitable manner. Because of the existence of check valves 865, the exit pipe (not explicitly shown) does not include a projecting portion.

Figure 74:
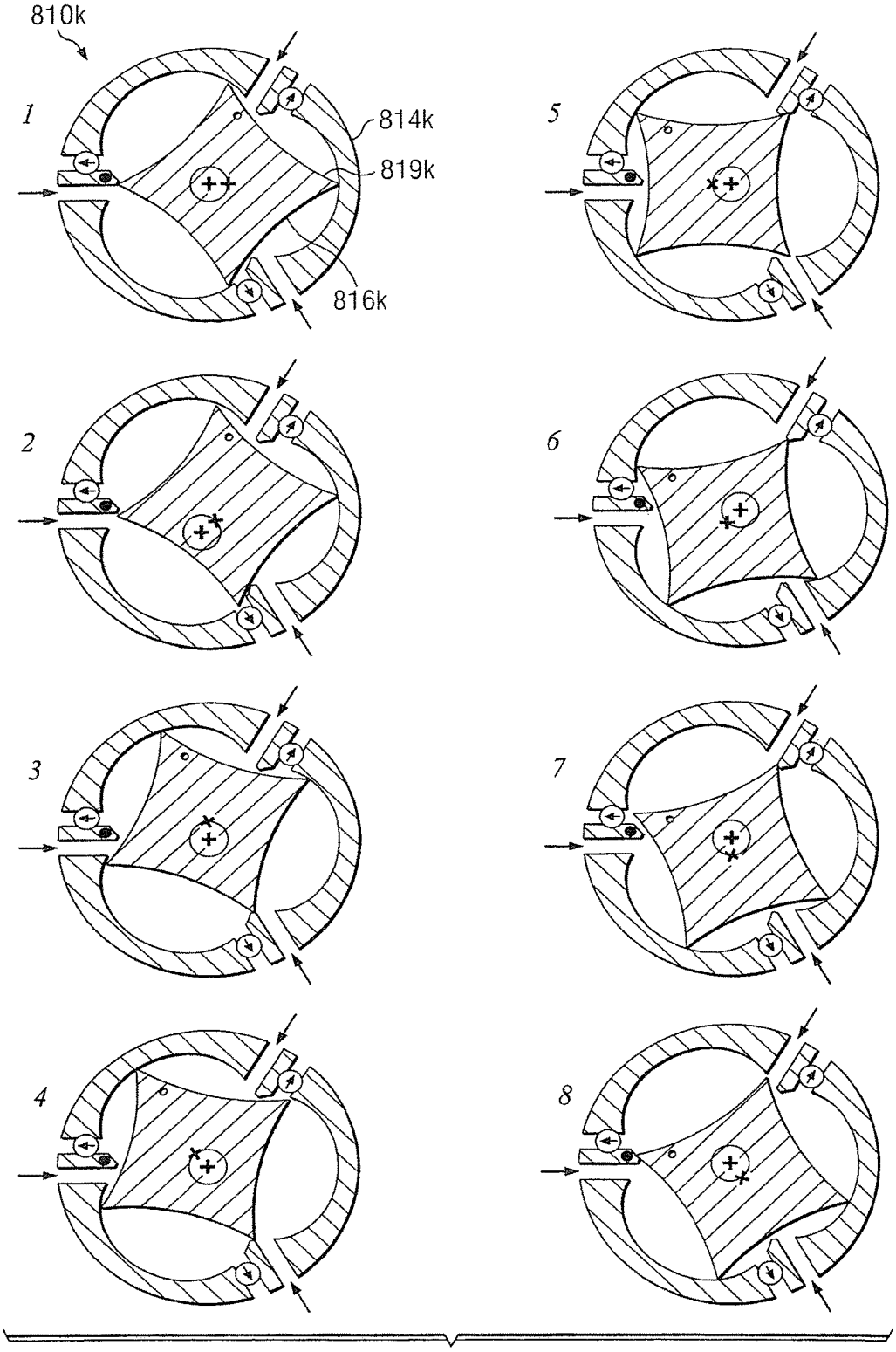
FIG. 74 illustrates a gerotor apparatus according to another embodiment of the invention.
Figure 75:
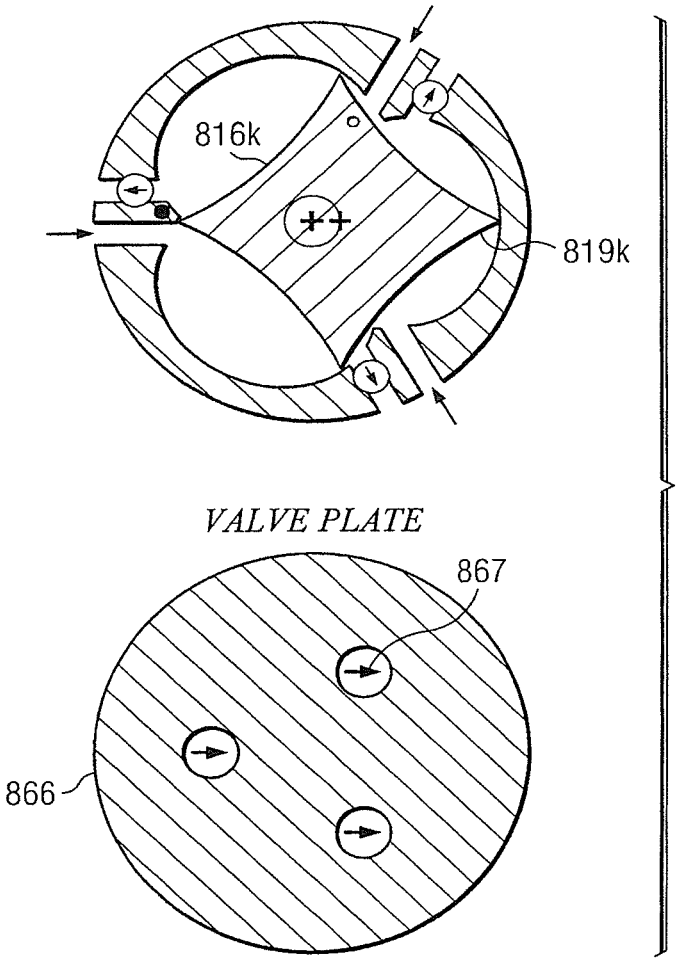
FIG. 75 illustrates a gerotor apparatus according to another embodiment of the invention.

FIGS. 74 and 75 illustrate a gerotor apparatus 810*k* according to another embodiment of the invention. Gerotor apparatus 810*k* is substantially similar to gerotor apparatus 810*h* (see FIGS. 64 and 65); however, an inner gerotor 816*k* has four tips 819*k* and an outer gerotor 814*k* has three. FIG. 75 shows a possible valve plate 866 that has any suitable number of check valves 867 that provide an additional means for gas to exit gerotor apparatus 810*k*.

Figure 76:
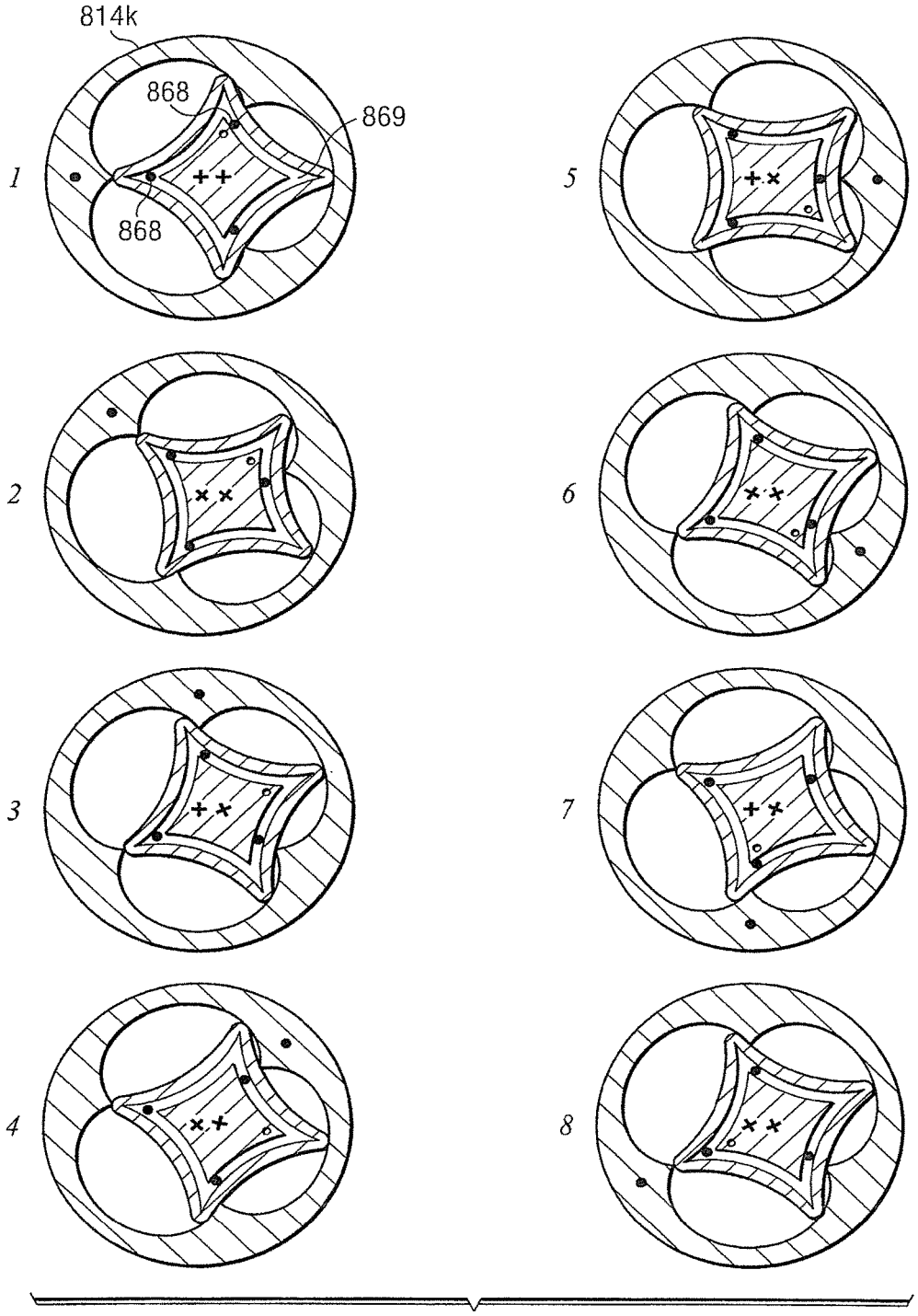
FIG. 76 shows a plurality of pegs and a track for gerotor apparatus, according to an embodiment of the invention.

FIG. 76 shows a plurality of pegs 868 and a track 869 for gerotor apparatus 810*k*. For simplicity purposes, the inlet and outlet ports of outer gerotor 814*k* are not explicitly shown. In the illustrated embodiment, the shape of track 869 is a hypocycloid. The outer shape of inner gerotor 816*k* may be generated by adding an offset to the hypocycloid.

FIGS. 77-80 illustrate a face-breathing engine system 900*a* in accordance with one embodiment of the invention. Engine system 900*a* is similar to engine system 300*o* shown in FIG. 20 in that power is transmitted from outer gerotors 914*a* and 914*a*' to an external rotatable shaft 901 via a suitable gear set 902 (see View DD in FIG. 79). However, engine system 900*a* is different because it employs thermal management systems and components, as described below in conjunction with FIGS. 79 and 80.

Figure 78:
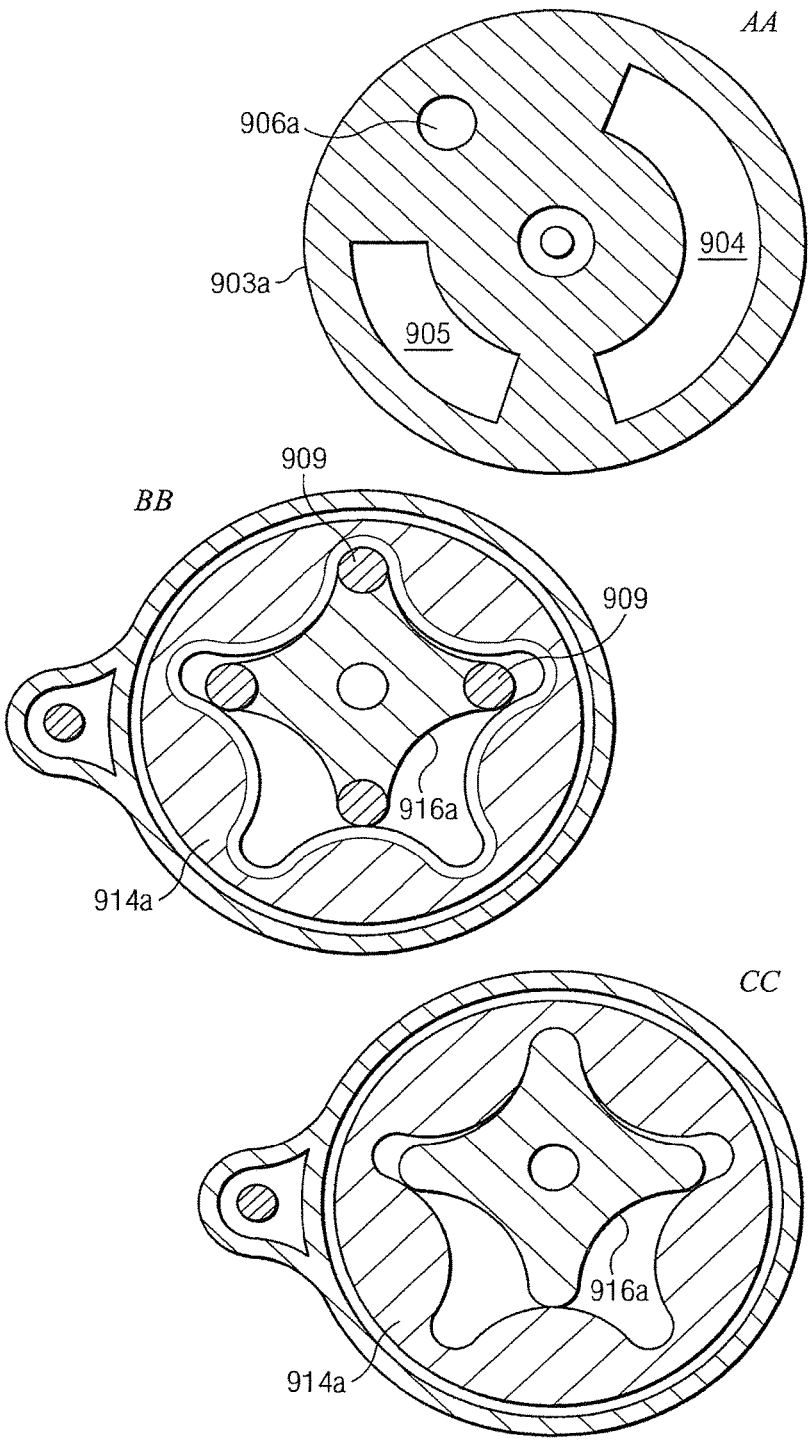

Referring to FIG. 78, View AA shows a compressor valve plate 903. An inlet port 904 is on the right and a smaller outlet port 905 is on the lower left. A small hole 906 between inlet port 904 and outlet port 905 allows a small portion of partially compressed air to be bled off for cooling purposes for expander section 907*a*, as indicated by reference numeral 908. View BB shows low-friction inserts 909 on the tips of inner compressor gerotor 916*a* and along the inner edge of the outer compressor gerotor 914*a*. The inserts 909 allow direct contact between inner compressor gerotor 916*a* and outer compressor gerotor 914*a*, thus synchronizing their rotation. View CC shows lower portions of inner compressor gerotor 916*a* and outer compressor gerotor 914*a*, where there is no substantial physical contact. Other suitable synchronizing systems may be utilized, such as gears or pegs/cams. Please refer to FIGS. 16-22 above for additional details on compressor section 911*a*.

Figure 79:
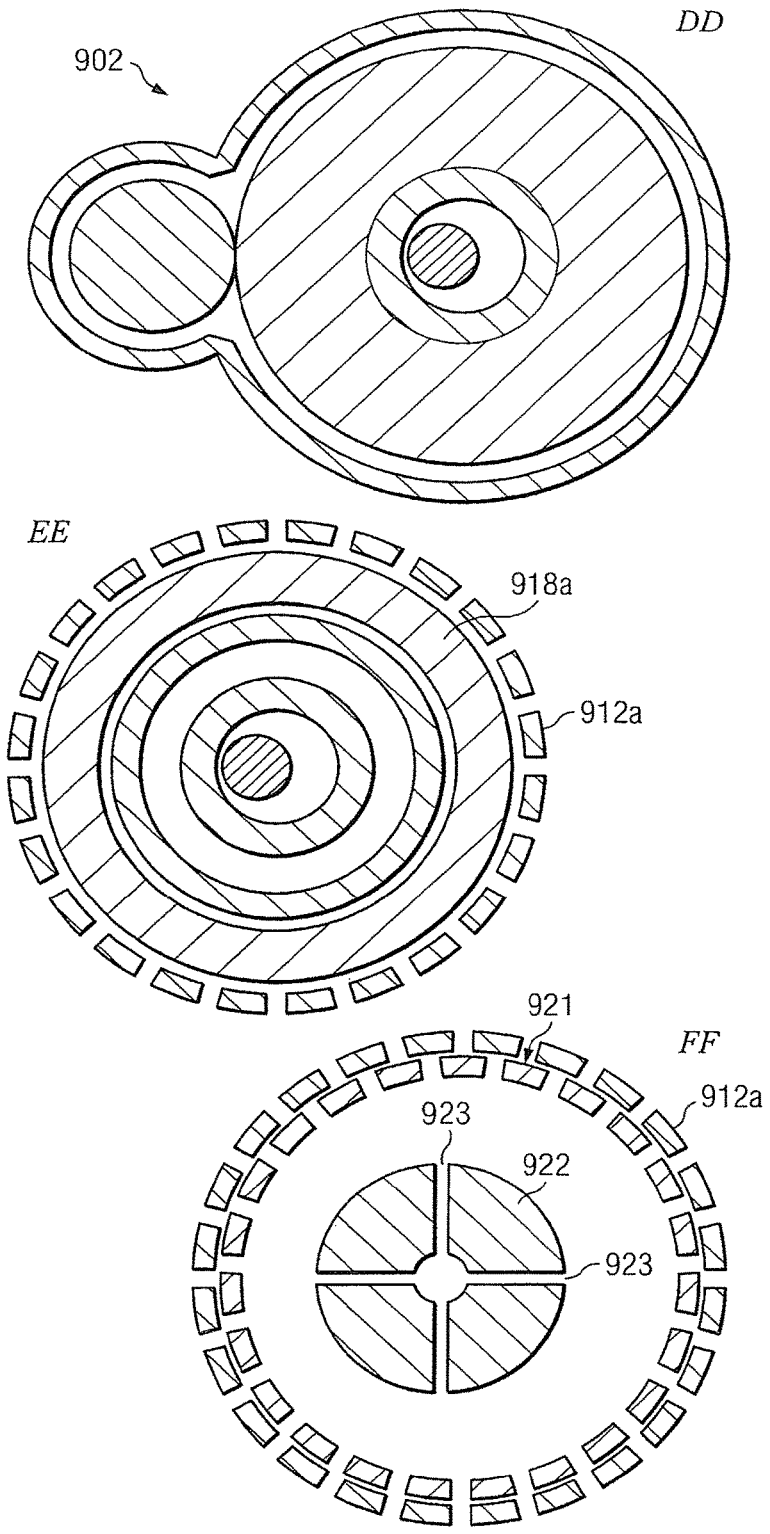
Figure 80:
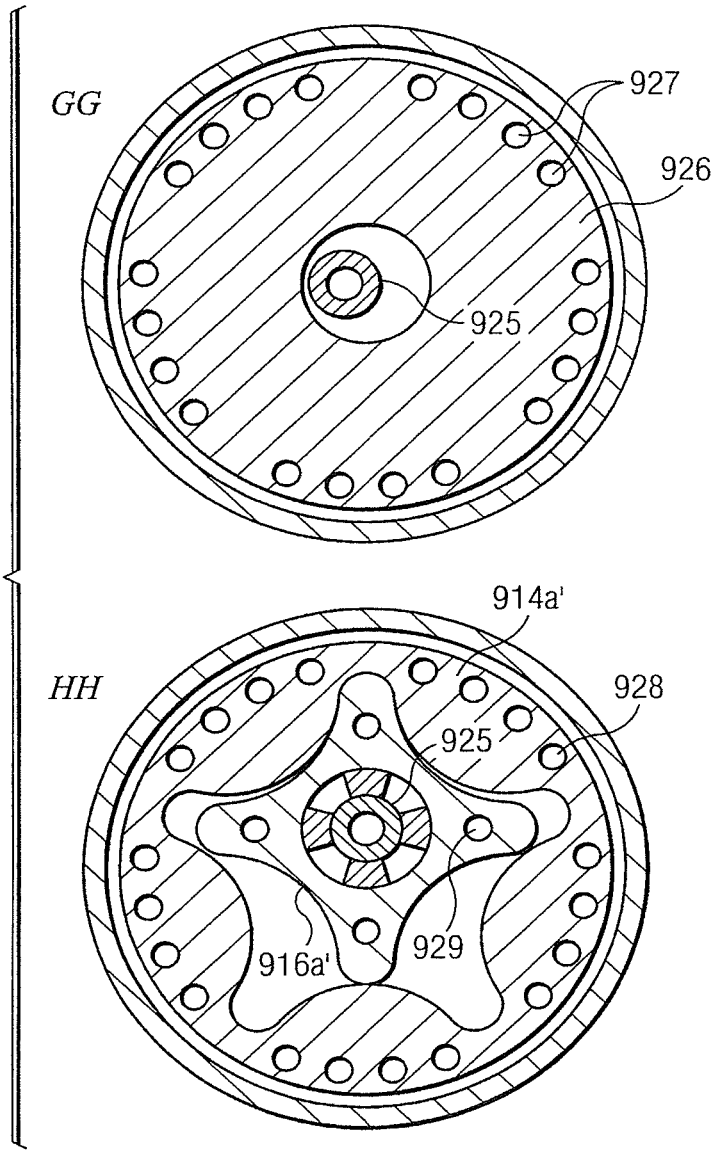
Figure 81:
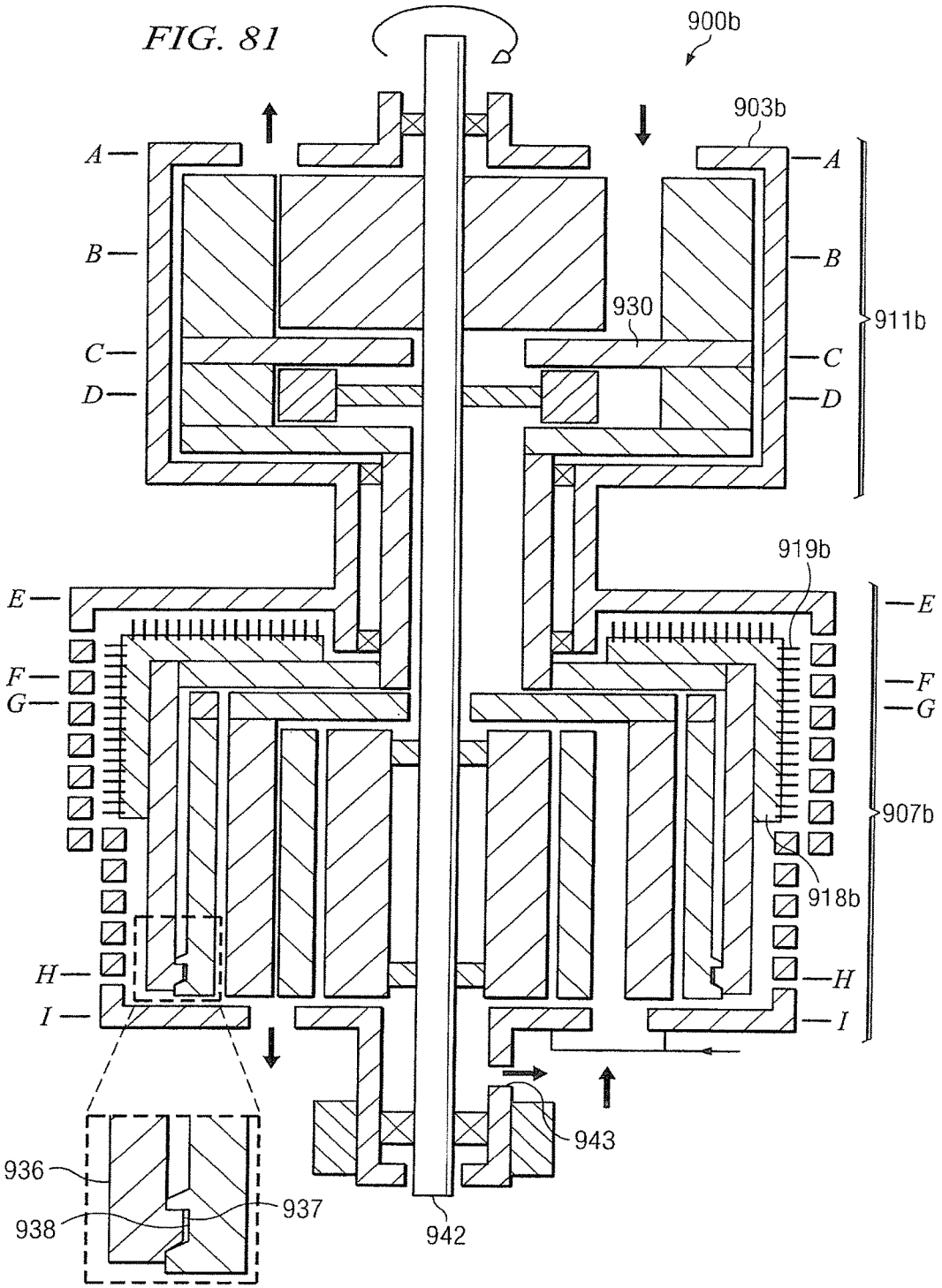
FIGS. 81-86 illustrate a face-breathing engine system in accordance with another embodiment of the invention.
Figure 82:
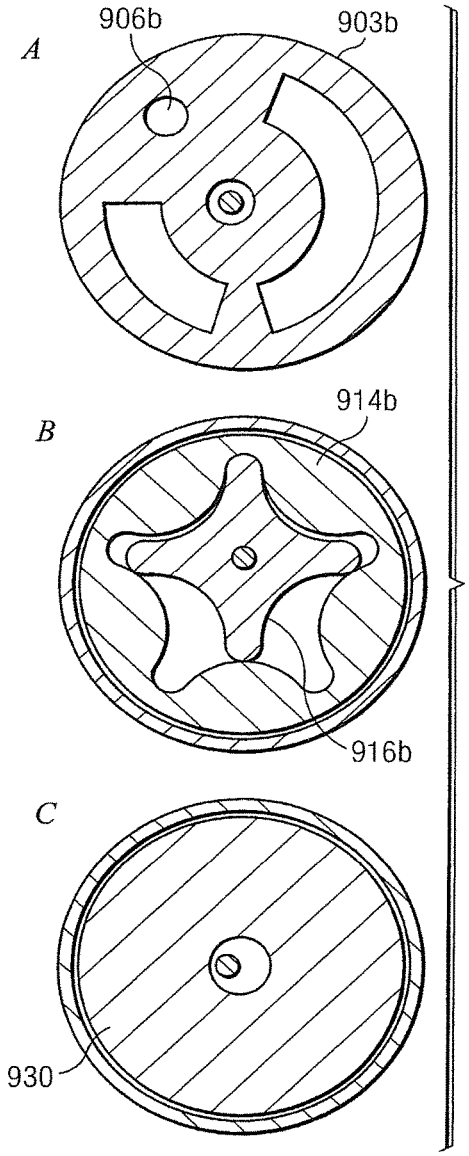
Figure 83:
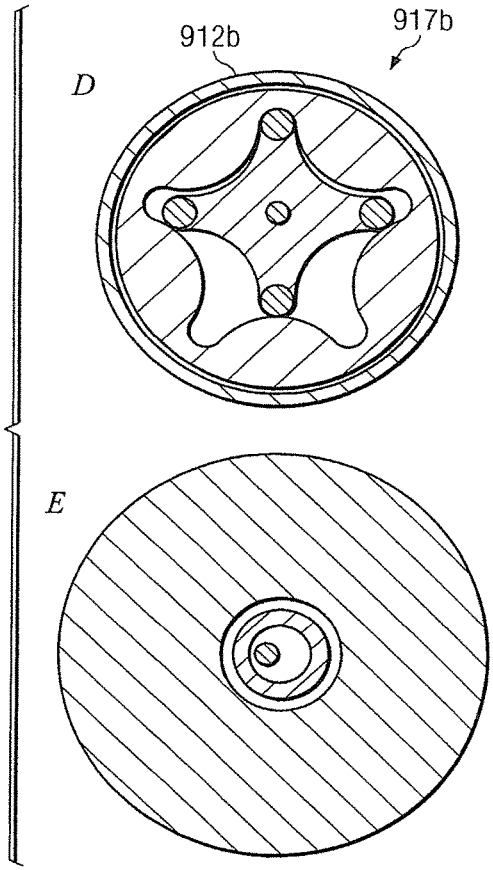

Referring to FIG. 79, View EE shows a cross-section through a heat sink 918*a*, that is coupled between outer compressor gerotor 914*a* and outer expander gerotor 914*a*'. In some embodiments, heat sink 918*a* may include a plurality of fins 919 on the exterior to help dissipate heat. Heat sink 918*a* may be constructed of any suitable material, such as a solid metal with a thick cross-section to help transfer heat to fins 919. Alternatively, heat sink 918*a* may be a suitable heat pipe, which is able to transfer heat to fins 919 with great capacity. Also shown in View EE is a perforated housing 912*a*' of expander section 907*a*.

View FF shows an upper portion 921 of outer expander gerotor 914*a*' that couples to heat sink 918*a*. Rather than a continuous connection, upper portion 921 is segmented in order to intermittently couple to heat sink 918*a* to minimize the cross-sectional area for heat transfer between the hot outer expander gerotor 914*a*' and heat sink 918*a*. At the center of View FF is a spinning disk 922 having a plurality of secondary passageways 923 formed therein that suck cool air in via a primary passageway 924 of a center shaft 925 in the expander section 907*a* via centrifugal force. The spinning disk 922 directs the air toward outer expander gerotor 914*a*' during operation of engine system 900*a*. View GG (FIG. 80) shows an expander seal plate 926 containing small holes 927 that line up with small holes 928 in outer expander gerotor 914*a'*.

Figure 77:
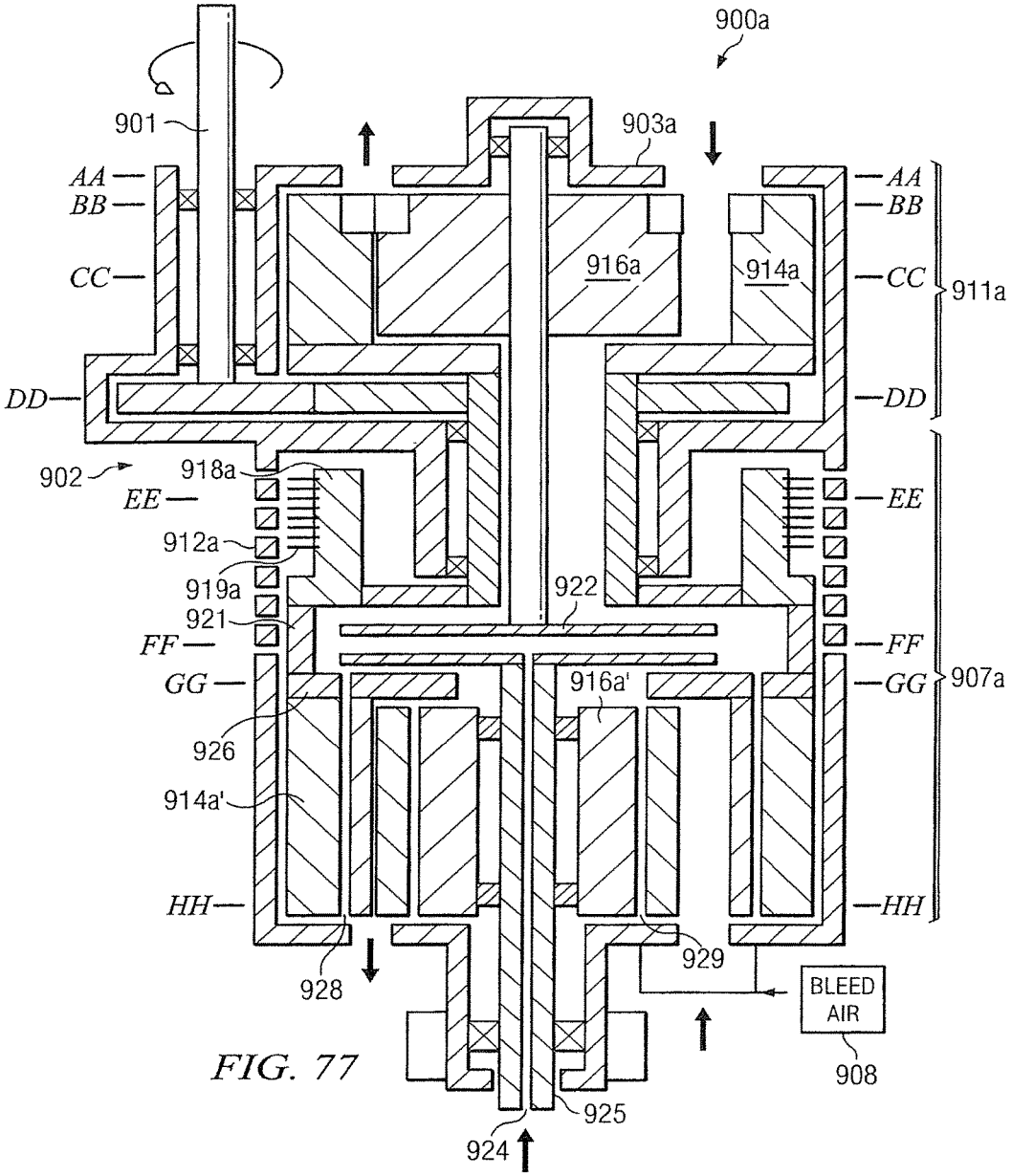
FIGS. 77-80 illustrate a face-breathing engine system in accordance with one embodiment of the invention.

View HH shows outer expander gerotor 914*a*' and inner expander gerotor 916*a*'. In the illustrated embodiment, both outer expander gerotor 914*a*' and inner expander gerotor 916*a*' are formed from a ceramic; however, other suitable materials are also contemplated by the present invention. Inner expander gerotor 916*a*' couples to center shaft 925 in a discontinuous manner, such as with splines, thereby minimizing heat transfer from inner expander gerotor 916*a*' to center shaft 925. In addition to small holes 928 of outer expander gerotor 914*a*', inner expander gerotor 916*a*' also includes small holes 929 through which cool air flows, allowing temperature regulation of inner expander gerotor 916*a*' and outer expander gerotor 914*a*'. As described above, the cool air is bled from compressor section 911*a* via hole 906. After the cool air flows through the gerotors and heat sink 918*a*, it becomes warm. It may be discharged into the ambient air or, if warm enough, it may be used to preheat the compressed air prior to the combustor. Referring to FIG. 77, the cool air flowing through the hollow center shaft 925 keeps it cool. Also, fins or a heat pipe may keep the lower bearing cool.

The shut-down procedure for engine system 900*a* involves reducing the temperature of the combustor while simultaneously flowing cool air through the inner and outer gerotors of expander section 907*a*. As the temperature is reduced, the engine efficiency is reduced, so it may be necessary to remove or reduce the load on the engine. Once the inner and outer gerotors of expander section 907*a* are sufficiently cool, then the engine stops.

FIGS. 81-86 illustrate a face-breathing engine system 900*b* in accordance with another embodiment of the invention. Engine system 900*b* includes a compressor section 911*b* at the top and an expander section 907*b* at the bottom. View A (FIG. 82) shows a valve plate 903*b* that allows for bleed off of a small amount of air at a pressure intermediate between the inlet and outlet air pressures via a hole 906*b*. This bleed air may be used to cool components of expander section 907*b*, as discussed in more detail below. View B shows the interaction between an inner compressor gerotor 916*b* and outer compressor gerotor 914*b*. View C shows a seal plate 930 of compressor section 911*b*.

View D (FIG. 83) shows a synchronization system 917*b* for engine system 900*b*; however, other suitable synchronization systems are contemplated by the present invention. View D also shows a housing 912*b* for compressor section 911*b*.

Figure 84:
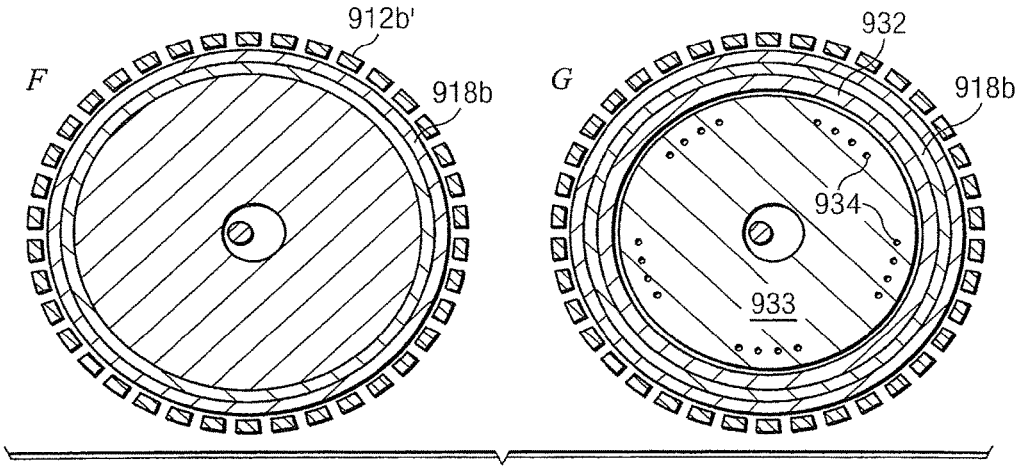

Referring to FIG. 84, View F shows that an outer housing 912*b*' of expander section 907*b* is suitably perforated allowing for ambient air to enter housing 912*b*', thereby cooling any metal components of expander section 907*b*'. One of these metal components is a heat sink 918*b* having optional fins 919*b* to facilitate cooling. In another embodiment, the heat sink 918*b* may be hollow and contain a suitable phase-change material, such as wax or metal, that is solid while engine system 900*b* is operating. When engine system 900*b* is shut off, the phase-change material melts and absorbs thermal energy that would transfer from the expander section 907*b* to other components, which may be temperature sensitive (e.g., bearings). Alternatively, the hollow section may contain chemicals that participate in a reversible chemical reaction that releases heat at low temperatures and absorbs heat at high temperatures. The need for this hollow section may be eliminated by running engine system 900*b* in a cool-down mode prior to shut off. The ceramic components would not be hot enough to damage the sensitive components. Also, liquid water may be sprayed on those components that are temperature sensitive just prior to shut down. View G shows a spring cup 932 formed from suitable metal coupled to an inside of heat sink 918*b*. A ceramic end plate 933 of outer expander gerotor 914*b*' is disposed within spring cup 932 and includes a plurality of cooling holes 934 formed therein.

Figure 85:
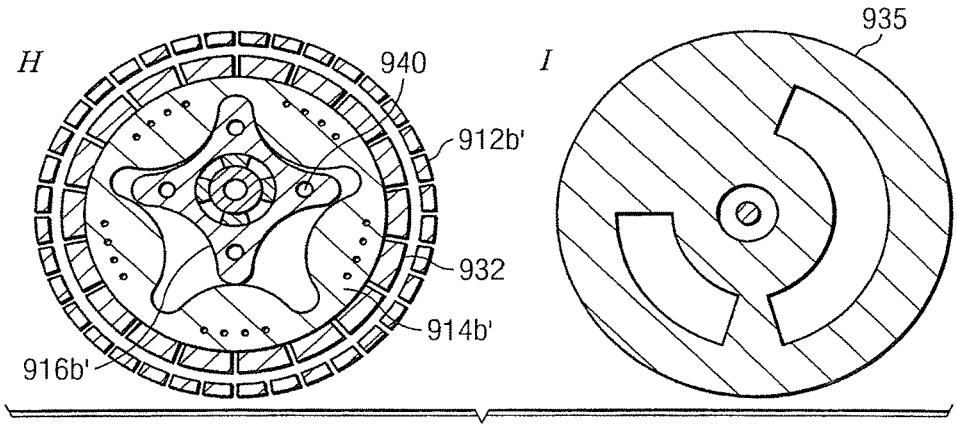

Referring now to FIG. 85, View H shows inner expander gerotor 916*b*' and outer expander gerotor 914*b*', both of which are made of a ceramic. The outer segmented metal ring shown is a lower portion of spring cup 932. It is segmented to accommodate thermal expansion of outer expander gerotor 914*b*'. View I shows a valve plate 935 for the expander section 907*b*

Figure 86:
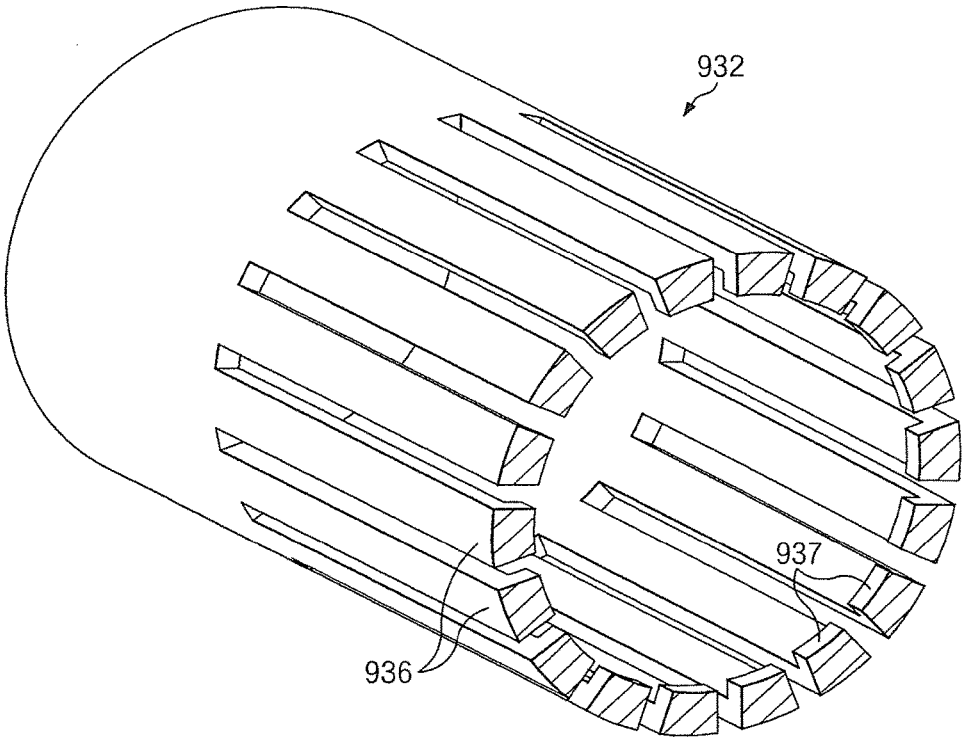

FIG. 86 shows a perspective view of spring cup 932. The tips of longitudinal fingers 936 of spring cup 932 include radial protrusions 937, which allows spring cup 932 to lock into a groove 938 of outer expander gerotor 914*b*'. (See blown-up detail in FIG. 81.) This arrangement allows for precise positioning of outer expander gerotor 914*b*' without a direct metal/ceramic bond. Further, it accommodates different thermal expansion rates of ceramics and metal.

To allow the ceramic to operate at high temperatures, but prevent damage to the metal components, medium pressure gas may be tapped from compressor section 911*b* and blown through holes 940 and 941 in inner expander gerotor 916*b*' and outer expander gerotor 914*b*', respectively (see FIG. 85). Also, to prevent the center shaft 942 from getting too hot, compressor gas that leaks from seal plate 930 (View C of FIG. 82) will flow down the center of the engine cooling the interior of the inner expander gerotor 816*b*' and exiting through a port 943 near the bottom. If necessary, the bearings at the bottom mount into a section of the housing that may have fins or some other heat sink mechanism, to maintain a cool temperature.

Figure 87:
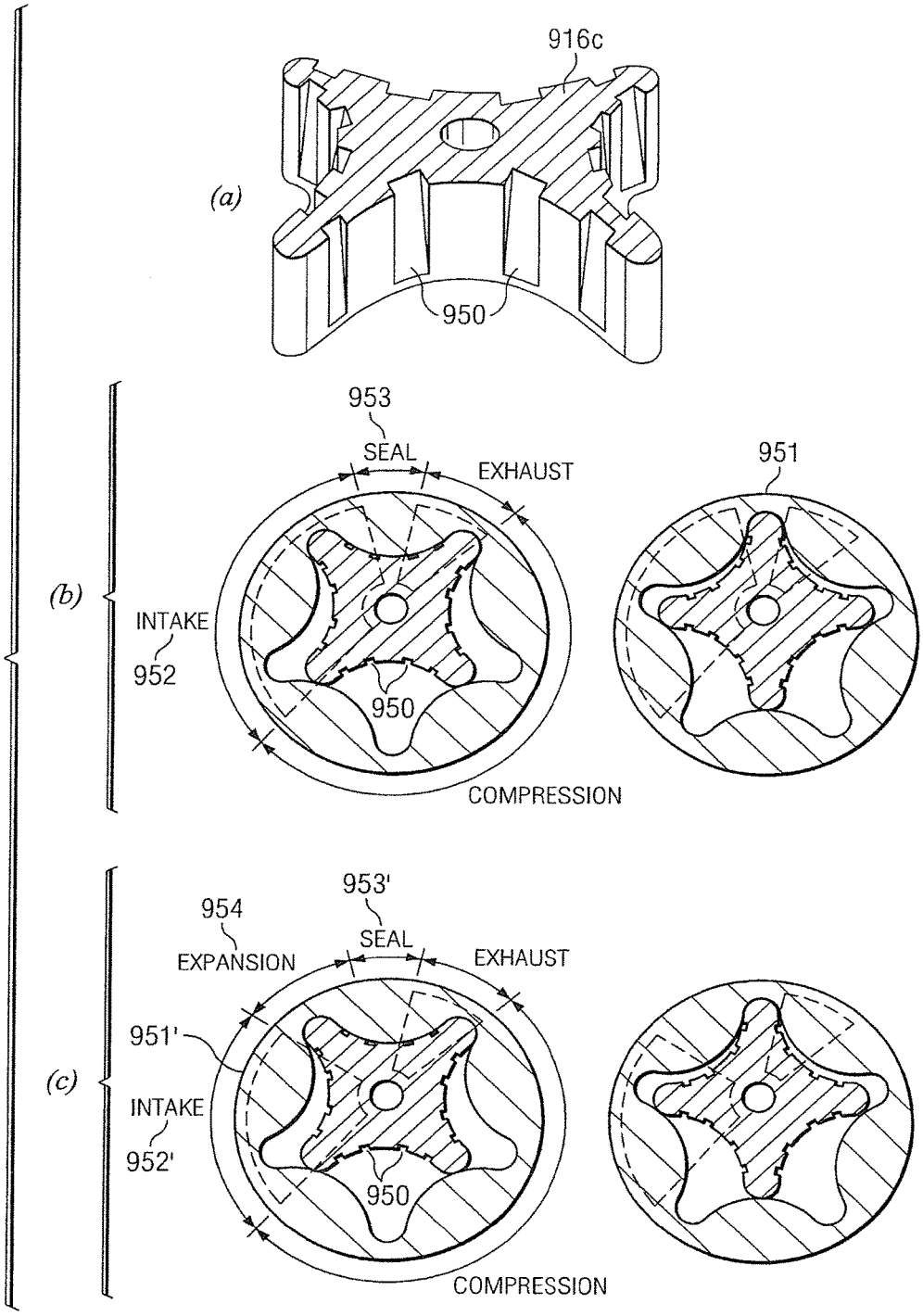
FIG. 87 shows an inner gerotor having a plurality of notches that provide extra area for gases to leave through the exhaust port allowing for more efficient breathing, according to an embodiment of the invention.

FIG. 87(*a*) shows an inner gerotor 916*c* having a plurality of notches 950 that provide extra area for gases to leave through the exhaust port, allowing for more efficient breathing. FIG. 87 shows the notches on a hypocycloid; however, they may be used on the other suitable geometries, such as epicycloids, hypotrochoids, epitrochoids, and conjugates as well. Similar notches may be used on an outer gerotor. In an embodiment for a gerotor set composed of two epicycloids, the notches 950 would appear on the outer gerotor to accomplish the same benefit. Notches 950 add dead volume, which may adversely affect efficiency; any high-pressure gas trapped in a notch is transported to the intake port and non-productively exhausted. The energy it took to compress that gas is wasted. To overcome this efficiency problem, the shape of the intake port may be adjusted. In one embodiment, notches 950 are wedge-shaped and are shallow at the base and deeper at the top.

FIG. 87(*b*) shows a conventional valve plate 951. The intake section 952 of valve plate 951 is adjacent to the seal section 953. Any high-pressure gas contained within notches 950 is lost to the intake section 952. FIG. 87(*c*) shows a modified valve plate 951' that has a smaller intake port 952'. There is an expansion section 954 between the seal section 953' and intake section 952'. Any high-pressure gas trapped in notches 950 expands in expansion section 954, which applies torque to the gerotors and recovers much of the energy invested in this high-pressure trapped gas.

Figure 88:
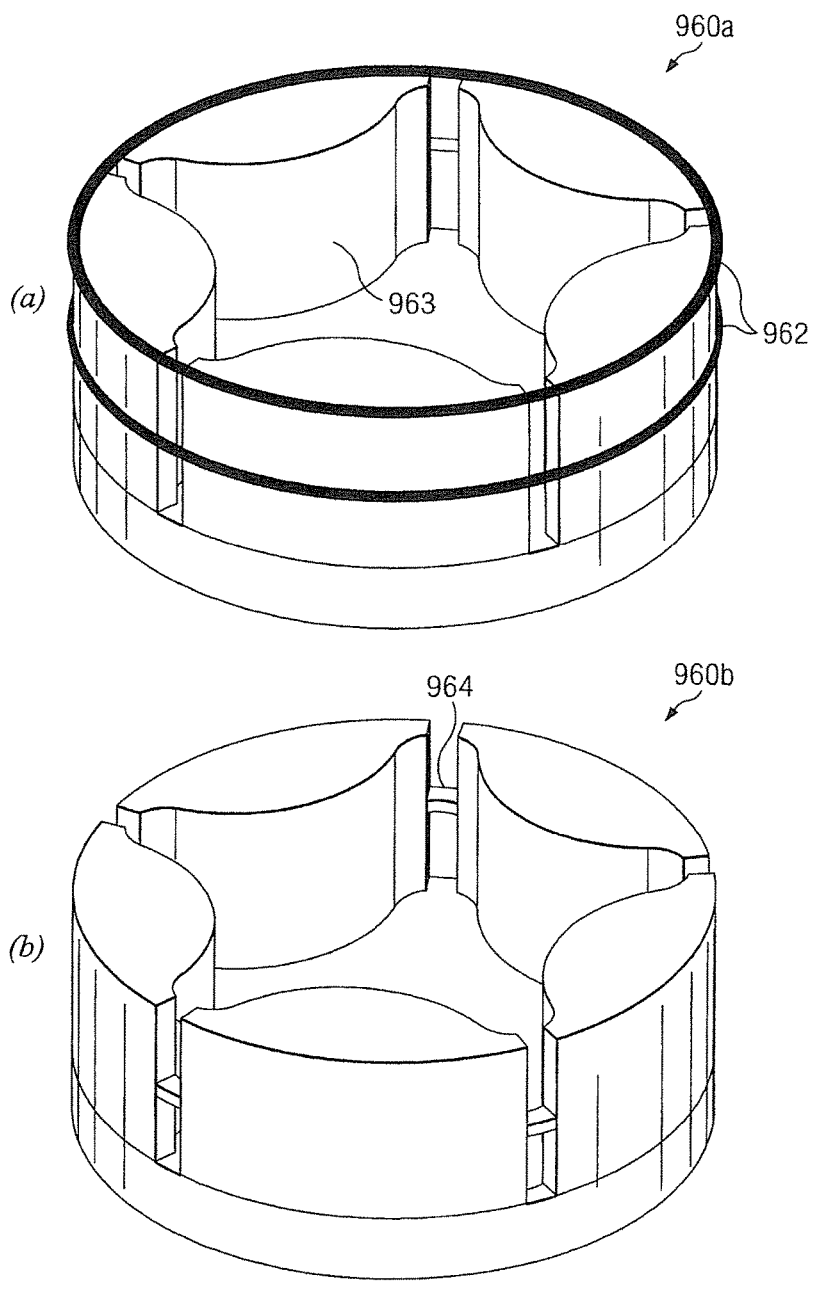
FIG. 88 shows support rings or strengthening bands that wrap around an outer gerotor that provide support to the wall of outer gerotor, according to an embodiment of the invention.
Figure 89:
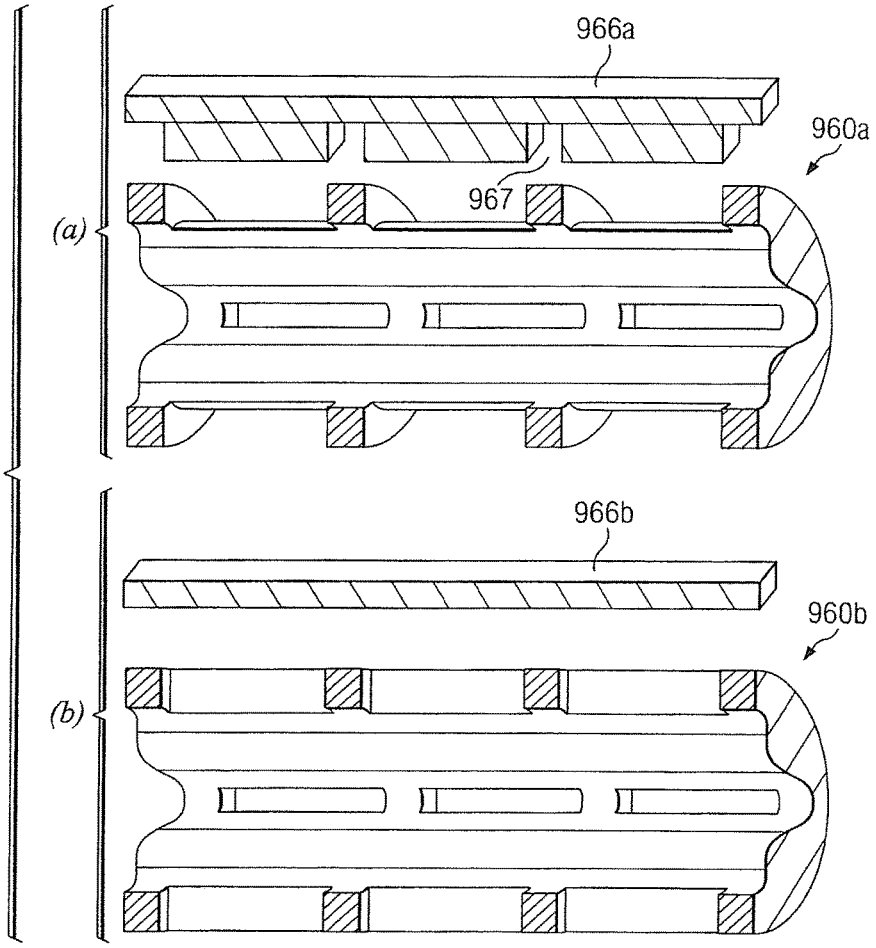
FIG. 89 shows that seals require notches to accommodate strengthening bands, according to an embodiment of the invention.
Figure 90:
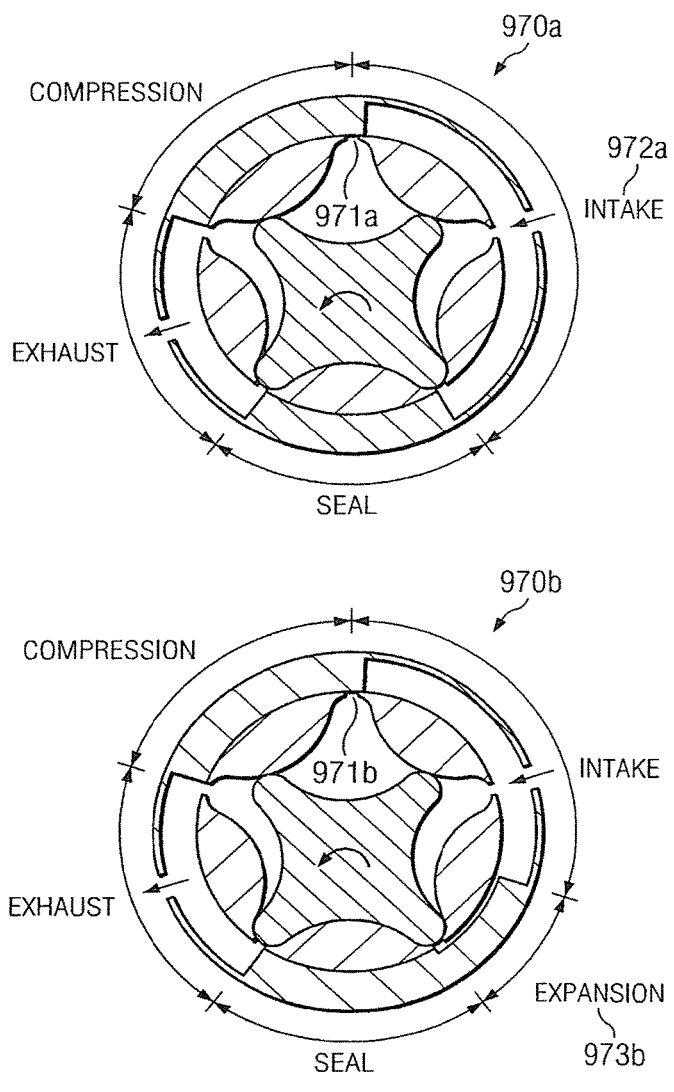
FIG. 90 shows a conventional sealing system for a tip-breathing gerotor, according to an embodiment of the invention.
Figure 91:
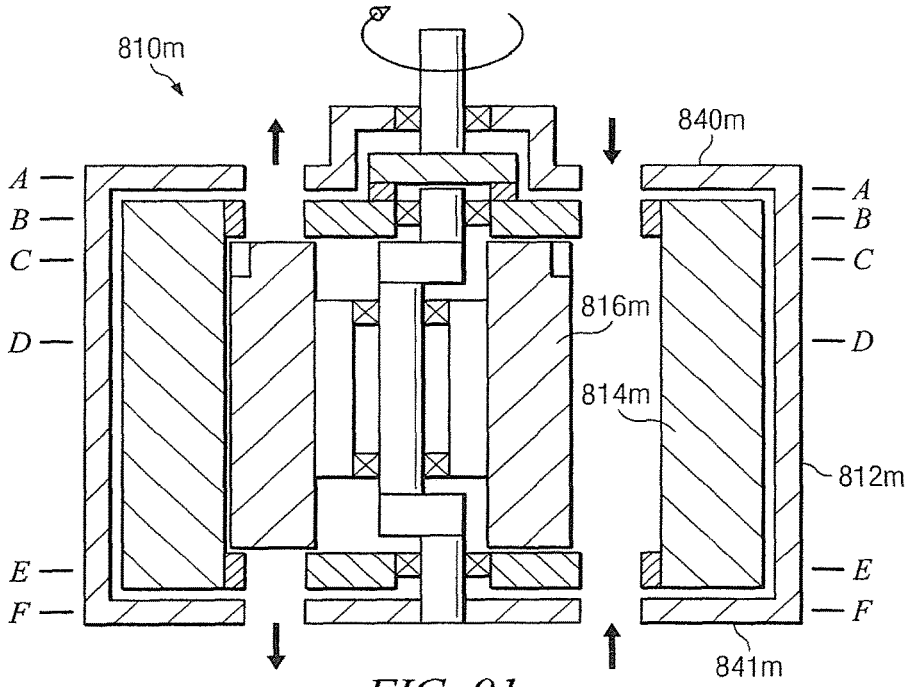
FIG. 91 illustrates a face-breathing gerotor apparatus according to one embodiment of the invention that allows for an upper valve plate and a lower valve plate at opposite ends thereof.

FIGS. 88-90 illustrate tip-breathing gerotors 960*a*, 960*b* according to various embodiments of the invention. FIG. 88(*a*) shows support rings or strengthening bands 962 that wrap around an outer gerotor 963 that provide support to the wall of outer gerotor 963. Strengthening bands 962 may be composed of graphite fibers, other high-strength, high-stiffness materials, or other suitable materials. FIG. 88(*b*) shows strengthening ligaments 964 that couple between tips of outer gerotor 965. The outer gerotors 963 and 965 are each divided into multiple portions as shown in FIGS. 88(*a*) and 88(*b*). FIG. 89(*a*) shows that seals 966*a* require notches 967 to accommodate strengthening bands 962. In contrast, FIG. 89(*b*) shows the seals 966*b* for ligaments 964 do not require notches. The un-notched seal 966*b* is preferred because there is no interference due to axial thermal expansion. However, there is more dead volume with the embodiment shown in FIG. 89(*b*).

FIG. 90(*a*) shows a conventional sealing system for a tip-breathing gerotor 970*a*. Any high-pressure gas trapped in the tips 971*a* is transferred to the intake region 972*a* without recapturing the energy invested in this high-pressure gas. FIG. 90(*b*) shows an improved sealing system for a tip-breathing gerotor 970*b* that has an added expansion section 973*b* where the high-pressure gas trapped in the dead volume of the tips 971*b* has an opportunity to re-expand and impart torque to the gerotors, thereby recovering much of the energy invested in the trapped high-pressure gas.

FIGS. 91-94 illustrate a face-breathing gerotor apparatus 810*m* according to one embodiment of the invention that allows for an upper valve plate 840*m* and a lower valve plate 841*m* at opposite ends thereof. The extra breathing area allows for a longer compressor (or an expander if high-pressure gas enters through the smaller port.)

Figure 92:
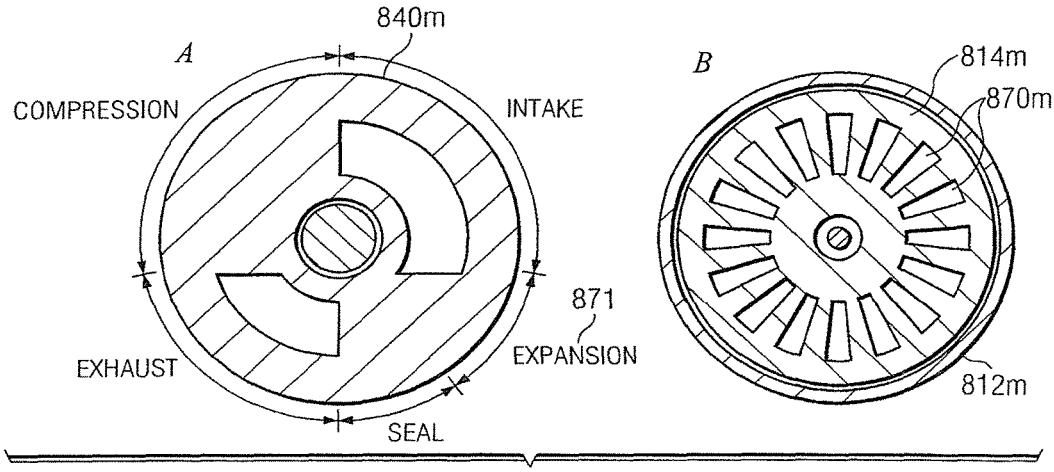
FIG. 92 illustrates a face-breathing gerotor apparatus according to one embodiment of the invention that allows for an upper valve plate and a lower valve plate at opposite ends thereof.

Referring to FIG. 92, View A shows upper valve plate 840*m*. View B shows an outer gerotor 814*m* disposed within a housing 812*m*. Outer gerotor 814*m* includes a plurality of slots 870*m* that allow gases to pass between upper valve plate 840*m* and the voids between inner gerotor 816*m* and outer gerotor 814*m*. Because these slots 870*m* add dead volume, upper valve plate 840*m* includes an expansion section 871 to extract work from any high-pressure gases trapped in the dead volume.

Figure 93:
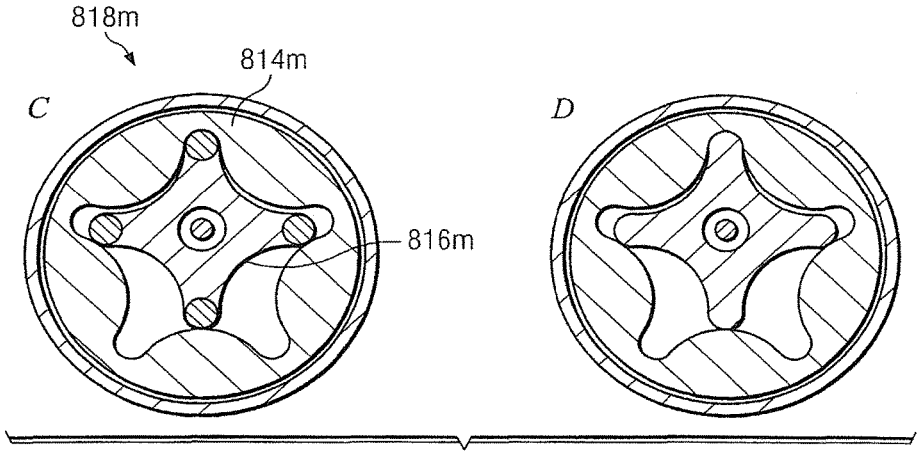
FIG. 93 illustrates a face-breathing gerotor apparatus according to one embodiment of the invention that allows for an upper valve plate and a lower valve plate at opposite ends thereof.

Referring to FIG. 93, View C shows a synchronization system 818*m* that allows for direct contact between inner gerotor 816*m* and outer gerotor 814*m* through a low-friction, low-wear material, such as VESCONITE discussed above. Other suitable synchronization systems may be employed. View D shows the interaction of inner gerotor 816*m* and outer gerotor 814*m*; there is a small gap so these components do not touch.

Figure 94:
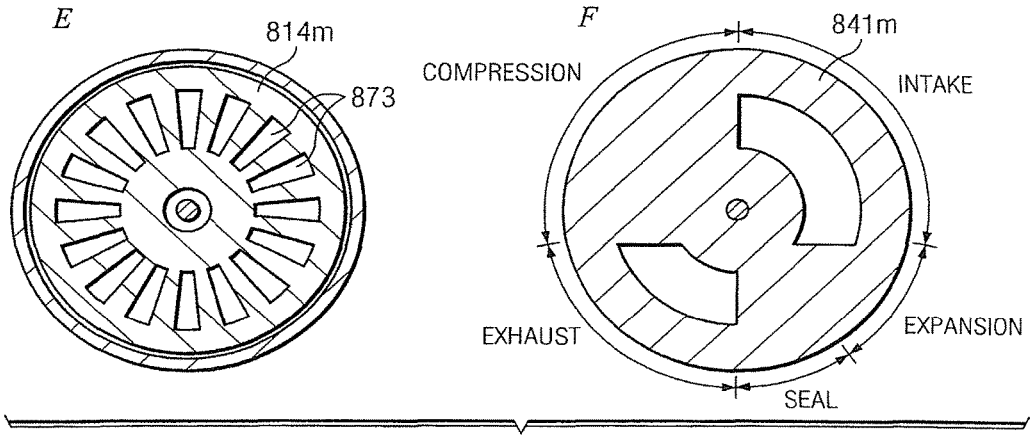
FIG. 94 illustrates a face-breathing gerotor apparatus according to one embodiment of the invention that allows for an upper valve plate and a lower valve plate at opposite ends thereof.

Referring to FIG. 94, View E shows slots 873 in the outer gerotor 814*m* that allow gases to pass between lower valve plate 841*m* and the voids between the inner gerotor 816*m* and outer gerotor 814*m*. View F shows lower valve plate 841*m*.

Figure 95:
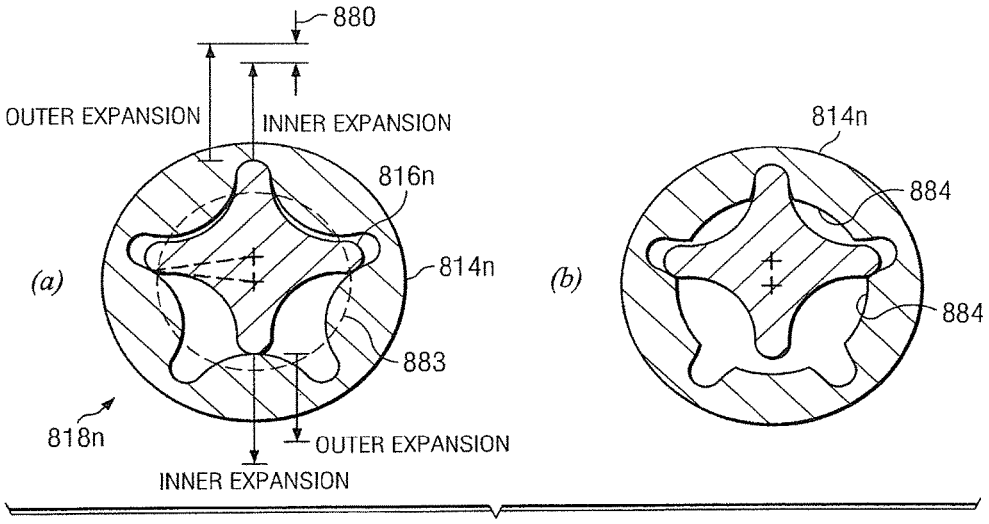
FIG. 95 shows that a gap opens up at the top tip of inner gerotor, according to an embodiment of the invention.

FIG. 95 shows a synchronization system 818*n* composed of an inner gerotor 816*n* and an outer gerotor 814*n*. Synchronization system 818*n* is designed to accommodate thermal expansion of inner gerotor 816*n* and outer gerotor 814*n* from their respective centers. FIG. 95(*a*) shows that a gap 880 opens up at the top tip of inner gerotor 816*n*. In addition, there is interference at the bottom tip of inner gerotor 816*n*. However, at the left tip of inner gerotor 816*n*, the expansion of the inner gerotor 816*n* and outer gerotor 814*n* is nearly the same from their respective centers. The left tip is the preferred contacting tip for the most precise synchronization. Cutting away material from outer gerotor 814*n*, as shown by the dotted line 883 in FIG. 95(*a*), prevents interference of the bottom tip. FIG. 95(*b*) shows the final shape of outer gerotor 814*n* in which a portion 884 of each tip is removed to allow for thermal expansion.

Figure 96:
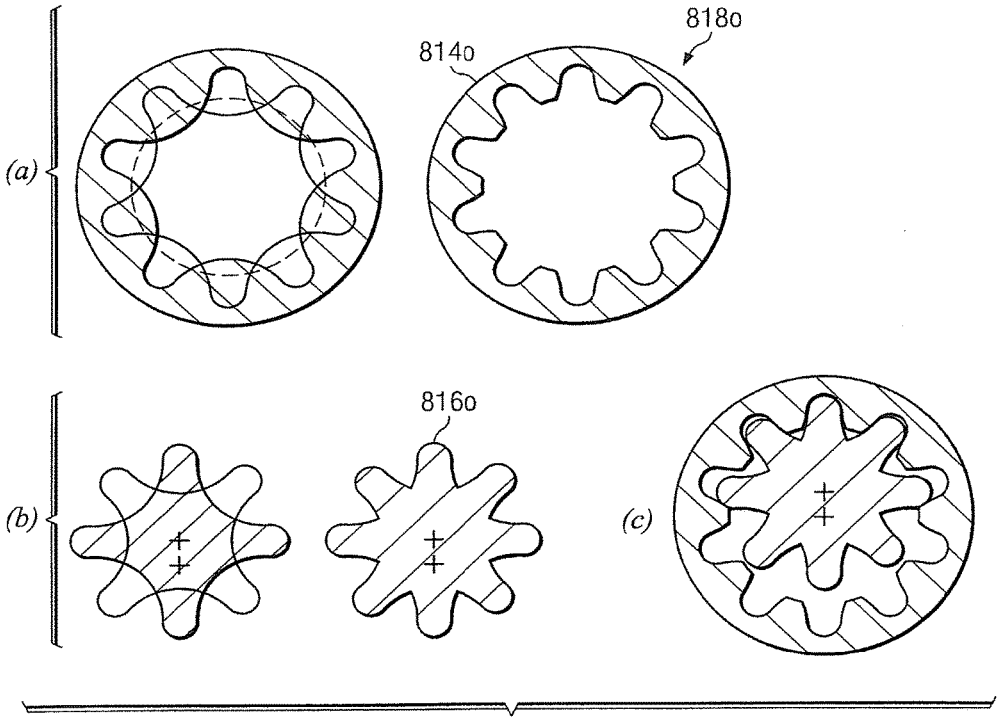
FIG. 96 shows that a phase-shifted set of tips may be added to an outer gerotor of a synchronization system thereby giving additional contacting surfaces which spread the load over a wider surface area, according to an embodiment of the invention.
Figure 100:
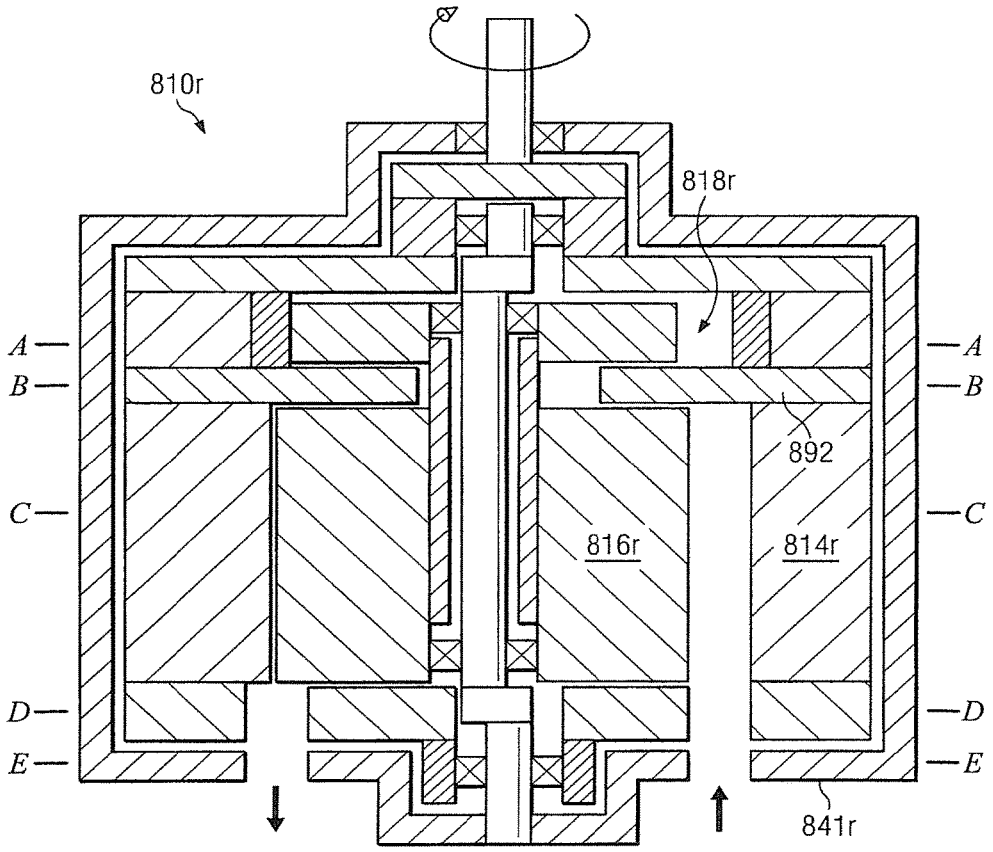
FIG. 100 illustrates a face-breathing gerotor apparatus according to another embodiment of the invention.
Figure 101:
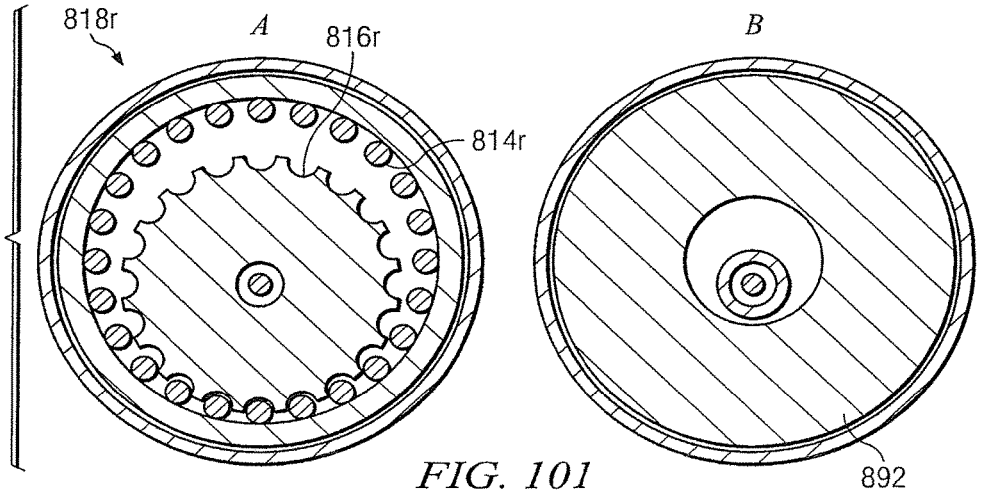
FIG. 101 illustrates a face-breathing gerotor apparatus according to another embodiment of the invention.

FIG. 96(*a*) shows that a phase-shifted set of tips may be added to an outer gerotor 814*o* of a synchronization system 818*o*, thereby giving additional contacting surfaces which spread the load over a wider surface area. In the illustrated embodiment, the number of tips are doubled; however, the number of tips may be multiplied by any suitable positive integer greater than one. FIG. 96(*b*) shows that a phase-shifted set of tips may be added to an inner gerotor 816*o*. FIG. 96(*c*) shows the mated inner gerotor 816*o* and outer gerotor 814*o*.

FIG. 97(*a*) shows that a plurality of tips 885 of an inner synchronization gerotor 816*p* may be comprised of full cylinders. Only a portion of the cylinder actually contacts the outer gerotor 814*p*. To reduce windage losses, the cylinder may be cut, as in FIG. 97(*b*) to produce a half cylinder 886 or some other portion of a cylinder. The cylinder may be mounted to the outer edge of inner gerotor 816*p* as shown in FIG. 97(*c*) or to a perimeter of inner gerotor 816*p* as shown in FIG. 97(*d*).

FIG. 98(*a*) shows even more phase-shifted sets of tips 887, 888 may be added to both the outer gerotor and inner gerotor, respectively. FIG. 98(*b*) shows that when the number of phase-shifted sets of tips increases to a very high number, the hypocycloid portions of the outer gerotor become irrelevant; synchronization may occur strictly through male and female semicircular tips. FIG. 98(*b*) shows the male tips 889 on the inner gerotor and the female tips 890 on the outer gerotor. FIG. 99 shows that this may be reversed; the male tips may be on the outer gerotor and the female tips on the inner gerotor.

FIGS. 100-103 illustrate a face-breathing gerotor apparatus 810*r* according to another embodiment of the invention. Gerotor apparatus 810*r* is substantially similar to gerotor apparatus 810*m*; however, gerotor apparatus 810*r* includes a synchronization system 818*r* at the top, so it may breath only from the bottom face. Although illustrated as a compressor, gerotor apparatus 810*r* may also serve as an expander. View A (FIG. 101) shows that synchronization system 818*r* is similar to that illustrated in FIG. 99; however, other suitable synchronization systems are contemplated by the present invention. View B shows a seal plate 892.

Referring to FIG. 102, View C shows the interaction of inner gerotor 816*r* and outer gerotor 814*r*. View D in FIG. 103 shows the slots 894 in outer gerotor 814*r* that allows gas passage between a lower valve plate 841*r* and the voids between inner gerotor 816*r* and outer gerotor 814*r*. View E shows lower valve plate 841*r*, which is similar to lower valve plate 841*m* in FIG. 94.

FIG. 104 shows a method for obtaining a power boost in a Brayton cycle engine according to one embodiment of the invention. FIG. 104(*a*) shows that liquid water 990*a* may be added to a combustor 991*a* when a power boost is desired. In combustor 991*a*, extra fuel may be added to cause the liquid water to vaporize, thereby making steam. The extra volume of high-pressure gas is then sent to an expander

992*a*, which generates additional power. If a compressor 993*a* and expander 992*a* are not rigidly coupled through a common shaft 994*a*, the extra power comes in the form of faster rotation of expander 992*a*. Alternatively, if the two are rigidly coupled through common shaft 994*a*, then the inlet port of expander 992*a* may be opened to accommodate the additional volume. In this case, the gas is not fully expanded when it exits expander 992*a*, thereby reducing efficiency.

FIG. 104(*b*) shows an alternative embodiment for obtaining the power boost. In the embodiment shown in FIG. 104(*b*), the liquid water 990*b* is added to a secondary heat exchanger 995*b* that has a high thermal capacity. When liquid water is added to heat exchanger 995*b*, the thermal capacity of heat exchanger 995*b* provides energy to vaporize the liquid water; therefore, steam enters combustor 991*b* not liquid water. Eventually, the thermal capacity of heat exchanger 995*b* will be exhausted, but by then, the fuel rate may be increased to combustor 991*b* to accommodate the extra load.

Below are control schemes that may be implemented for the Brayton cycle engine:

1. Maintain a constant compression ratio, vary combustor temperature. However, this may not be very efficient. At partial load, heat is not being delivered at the maximum temperature allowed by the materials. For a heat engine to be efficient, it may be necessary for the temperature at which heat is added to be as high as possible.

2. Maintain constant compression ratio and maximum combustor temperature. This engine operates at constant torque. Power output may be varied by adjusting engine speed. Increasing the torque requirement of the load slows the engine and decreasing the torque requirement of the load speeds the engine.

3. Vary compression ratio and combustor temperature. At each compression ratio, there is an optimal combustor temperature that prevents over-expansion or under-expansion of the gas exiting the expander.

4. Maintain constant compression ratio and combustor temperature, and throttle the inlet air to the compressor. Adding a restrictor to the inlet of the compressor restricts air flow, as is done in Otto cycle engines. This may be used to regulate power output; however, it is not very efficient because of irreversibilities associated with the pressure drop across the throttle.

For those control schemes above that vary compression ratio, the discharge port of the compressor and inlet port to the expander may need a mechanism that varies the area. Some such mechanisms were described above or in U.S. patent application Ser. No. 10/359,487. If the device has dead volume, and the compression ratio is varied, both inlet and outlet ports of both the compressor and expander should be varied for optimal performance.

Although embodiments of the invention and their advantages are described in detail, a person skilled in the art could make various alterations, additions, and omissions without departing from the spirit and scope of the present invention.

The invention claimed is:

1. A gerotor apparatus comprising:

a rotatable outer gerotor separated into multiple portions;

a rotatable inner gerotor disposed at least partially within the outer gerotor;

multiple strengthening members located along an outer periphery of the outer gerotor, each strengthening member contacting at least two of the portions of the outer gerotor, wherein the strengthening members comprise rings or bands that wrap around the outer gerotor;

a housing; and at least one seal located between the housing and the outer gerotor, each seal comprising a notched surface that contacts the outer gerotor, the notched surface having notches configured to accommodate the rings or bands.

2. The gerotor apparatus of claim 1, wherein each of the rings or bands contacts all of the multiple portions of the outer gerotor.

3. The gerotor apparatus of claim 1, wherein the rings or bands comprise graphite fibers.

4. The gerotor apparatus of claim 1, wherein:

the multiple portions of the outer gerotor comprise tips that are separated from one another; and the gerotor apparatus further comprises an expansion section in which high-pressure gas trapped in a dead volume of the tips is able to re-expand.

5. A gerotor apparatus comprising:

a rotatable outer gerotor separated into multiple portions;

a rotatable inner gerotor disposed at least partially within the outer gerotor; and multiple strengthening members located along an outer periphery of the outer gerotor, each strengthening member contacting at least two of the portions of the outer gerotor;

wherein the multiple portions of the outer gerotor comprise tips that are separated from one another; and wherein the strengthening members comprise strengthening ligaments, each strengthening ligament connecting the tips of two adjacent portions of the outer gerotor.

6. The gerotor apparatus of claim 5, further comprising:

a housing; and at least one seal located between the housing and the outer gerotor, each seal comprising a surface that contacts the outer gerotor.

7. The gerotor apparatus of claim 5, further comprising:

an expansion section in which high-pressure gas trapped in a dead volume of the tips is able to re-expand.

8. A system comprising:

a quasi-isothermal Brayton cycle engine;

wherein the quasi-isothermal Brayton cycle engine comprises a gerotor apparatus; and wherein the gerotor apparatus comprises:

a rotatable outer gerotor separated into multiple portions;

a rotatable inner gerotor disposed at least partially within the outer gerotor;

multiple strengthening members located along an outer periphery of the outer gerotor, each strengthening member contacting at least two of the portions of the outer gerotor, wherein the strengthening members comprise rings or bands that wrap around the outer gerotor a housing; and at least one seal located between the housing and the outer gerotor, each seal comprising a notched surface that contacts the outer gerotor, the notched surface having notches configured to accommodate the rings or bands.

9. The system of claim 8, wherein each of the rings or bands contacts all of the multiple portions of the outer gerotor.

10. The system of claim 8, wherein the rings or bands comprise graphite fibers.

11. The system of claim 8, wherein the quasi-isothermal Brayton cycle engine comprises a gerotor compressor or a gerotor expander.

12. The system of claim 8, wherein:

the multiple portions of the outer gerotor comprise tips that are separated from one another; and the gerotor apparatus further comprises an expansion section in which high-pressure gas trapped in a dead volume of the tips is able to re-expand.

13. A system comprising:

a quasi-isothermal Brayton cycle engine;

wherein the quasi-isothermal Brayton cycle engine comprises a gerotor apparatus;

wherein the gerotor apparatus comprises:

a rotatable outer gerotor separated into multiple portions;

a rotatable inner gerotor disposed at least partially within the outer gerotor; and multiple strengthening members located along an outer periphery of the outer gerotor, each strengthening member contacting at least two of the portions of the outer gerotor;

wherein the multiple portions of the outer gerotor comprise tips that are separated from one another; and wherein the strengthening members comprise strengthening ligaments, each strengthening ligament connecting the tips of two adjacent portions of the outer gerotor.

14. The system of claim 13, wherein the gerotor apparatus further comprises:

a housing; and at least one seal located between the housing and the outer gerotor, each seal comprising a surface that contacts the outer gerotor.

15. The system of claim 13, wherein the gerotor apparatus further comprises an expansion section in which high-pressure gas trapped in a dead volume of the tips is able to re-expand.

16. A method comprising:

rotating an outer gerotor, the outer gerotor separated into multiple portions; and rotating an inner gerotor disposed at least partially within the outer gerotor;

wherein multiple strengthening members are located along an outer periphery of the outer gerotor, each strengthening member contacting at least two of the portions of the outer gerotor, wherein the strengthening members comprise rings or bands that wrap around the outer gerotor; and wherein at least one seal is located between a housing and the outer gerotor, each seal comprising a notched surface that contacts the outer gerotor, the notched surface having notches configured to accommodate the rings or bands.

17. The method of claim 16, wherein:

the multiple portions of the outer gerotor comprise tips that are separated from one another; and the method further comprises allowing high-pressure gas trapped in a dead volume of the tips to re-expand.

18. A method comprising:

rotating an outer gerotor, the outer gerotor separated into multiple portions; and rotating an inner gerotor disposed at least partially within the outer gerotor;

wherein multiple strengthening members are located along an outer periphery of the outer gerotor, each strengthening member contacting at least two of the portions of the outer gerotor;

wherein the multiple portions of the outer gerotor comprise tips that are separated from one another; and wherein the strengthening members comprise strengthening ligaments, each strengthening ligament connecting the tips of two adjacent portions of the outer gerotor.

19. The method of claim 18, wherein at least one seal is located between a housing and the outer gerotor, each seal comprising a surface that contacts the outer gerotor.

20. The method of claim 18, wherein the method further comprises allowing high-pressure gas trapped in a dead volume of the tips to re-expand.

* * * * *